US009922600B2

(12) United States Patent
Kimura

(10) Patent No.: US 9,922,600 B2
(45) Date of Patent: Mar. 20, 2018

(54) DISPLAY DEVICE

(75) Inventor: Hajime Kimura, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 1375 days.

(21) Appl. No.: 11/605,537

(22) Filed: Nov. 29, 2006

(65) Prior Publication Data

US 2007/0222737 A1 Sep. 27, 2007

(30) Foreign Application Priority Data

Dec. 2, 2005 (JP) ..... 2005-348835

(51) Int. Cl.

| | |
|---|---|
| ***G09G 3/3266*** | (2016.01) |
| ***G09G 3/3291*** | (2016.01) |
| *G09G 3/20* | (2006.01) |
| *G09G 3/325* | (2016.01) |
| *G09G 3/3258* | (2016.01) |

(52) U.S. Cl.

CPC ..... *G09G 3/3266* (2013.01); *G09G 3/3291* (2013.01); *G09G 3/2022* (2013.01); *G09G 3/325* (2013.01); *G09G 3/3258* (2013.01); *G09G 2300/0842* (2013.01); *G09G 2300/0861* (2013.01); *G09G 2310/027* (2013.01);

(Continued)

(58) Field of Classification Search

CPC .. G09G 3/3266; G09G 3/3291; G09G 3/2022; G09G 3/3258; G09G 3/325; G09G 2330/021; G09G 2310/027; G09G 2310/0251; G09G 2300/0861; G09G 2300/0842

USPC ..... 345/55, 76, 82, 100, 103, 204

See application file for complete search history.

(56) References Cited

U.S. PATENT DOCUMENTS 5,534,884 A * 7/1996 Mase ..... G09G 3/3651 345/87
5,708,455 A * 1/1998 Maekawa ..... 345/100

(Continued)

FOREIGN PATENT DOCUMENTS

| | | |
|---|---|---|
| JP | 2-137886 | 5/1990 |
| JP | 5-35221 | 2/1993 |

(Continued)

OTHER PUBLICATIONS

Office Action re Chinese application No. CN 200610064155.7, dated Jan. 29, 2010 (with English translation).

*Primary Examiner* — Jonathan Horner
(74) *Attorney, Agent, or Firm* — Husch Blackwell LLP

(57) ABSTRACT

An object of the present invention is to provide a display device which consumes less electric power by reducing the number of times to output sampling pulses in a pulse output circuit or write video signals to pixels. A display device includes a pixel portion in which a plurality of pixels are provided in a matrix form in accordance with a row direction and a column direction; a signal line driving circuit for inputting to a signal line a video signal for controlling lighting or non-lighting of a pixel; and a scan line driving circuit for selecting a pixel row to which the video signal is to be written. The signal line driving circuit is provided with a shift register and has a means of not transferring a signal in the shift register when a video signal written in the pixel row selected by the scan line driving circuit is identical with a video signal to be written in a pixel in one row after the selected row.

18 Claims, 78 Drawing Sheets

(52) U.S. Cl.
CPC ..... *G09G 2310/0251* (2013.01); *G09G 2330/021* (2013.01)

(56) References Cited

U.S. PATENT DOCUMENTS

| | | | | |
|---|---|---|---|---|
| 5,828,429 | A | 10/1998 | Takemura | |
| 5,978,052 | A * | 11/1999 | Ilcisin et al. | 345/87 |
| 6,023,308 | A | 2/2000 | Takemura | |
| 6,064,713 | A | 5/2000 | Lebrun et al. | |
| 6,225,969 | B1 | 5/2001 | Ishii | |
| 6,480,181 | B2 | 11/2002 | Ishii | |
| 6,683,596 | B2 | 1/2004 | Ozawa | |
| 6,693,301 | B2 | 2/2004 | Takemura | |
| 6,759,680 | B1 | 7/2004 | Takemura | |
| 6,803,898 | B2 | 10/2004 | Ishii | |
| 6,961,034 | B2 | 11/2005 | Kusanagi | |
| 7,071,910 | B1 | 7/2006 | Takemura | |
| 7,088,322 | B2 * | 8/2006 | Koyama | G09G 3/30 257/E27.111 |
| 7,116,302 | B2 | 10/2006 | Takemura | |
| 7,190,338 | B2 | 3/2007 | Kubota et al. | |
| 7,333,096 | B2 | 2/2008 | Washio et al. | |
| 7,339,570 | B2 | 3/2008 | Kubota et al. | |
| 7,538,753 | B2 * | 5/2009 | Tanada | G09G 3/20 345/100 |
| 7,859,508 | B2 | 12/2010 | Yamashita | |
| 2002/0024489 | A1 | 2/2002 | Koyama et al. | |
| 2002/0039018 | A1 * | 4/2002 | Sanzo | H02M 3/156 323/282 |
| 2002/0126108 | A1 * | 9/2002 | Koyama | G09G 3/30 345/204 |
| 2003/0030614 | A1 * | 2/2003 | Tajima | G09G 5/006 345/89 |
| 2004/0130542 | A1 * | 7/2004 | Tanada | 345/204 |
| 2005/0012732 | A1 | 1/2005 | Koyama et al. | |
| 2005/0185477 | A1 | 8/2005 | Aoki et al. | |
| 2005/0225526 | A1 | 10/2005 | Chiu et al. | |
| 2005/0286775 | A1 * | 12/2005 | Jeffrey | G06T 1/60 382/232 |
| 2006/0071897 | A1 | 4/2006 | Moon | |
| 2006/0267889 | A1 * | 11/2006 | Kimura | G09G 3/2022 345/84 |
| 2007/0146354 | A1 | 6/2007 | Kubota et al. | |
| 2007/0222737 | A1 * | 9/2007 | Kimura | G09G 3/3266 345/100 |
| 2008/0036753 | A1 | 2/2008 | Washio et al. | |

FOREIGN PATENT DOCUMENTS

| | | |
|---|---|---|
| JP | 05-107561 | 4/1993 |
| JP | 10-83165 | 3/1998 |
| JP | 2784615 | 8/1998 |
| JP | 11-502355 | 2/1999 |
| JP | 2000-181414 A | 6/2000 |
| JP | 2000-194305 | 7/2000 |
| JP | 2001-209355 | 8/2001 |
| JP | 2001-242841 | 9/2001 |
| JP | 2001-306014 | 11/2001 |
| JP | 2002-32048 | 1/2002 |
| JP | 2003-150132 | 5/2003 |
| JP | 2003-248468 | 9/2003 |
| JP | 2004-205725 | 7/2004 |
| JP | 2005-275382 | 10/2005 |
| JP | 2006-350304 | 12/2006 |
| JP | 2007-78717 | 3/2007 |
| JP | 4693757 B2 | 6/2011 |
| JP | 5448263 b2 | 3/2014 |
| WO | WO 03/094362 A2 | 11/2003 |

* cited by examiner

SIGNAL WRITING PERIOD
STILL IMAGE DISPLAYING PERIOD
PIXEL ELECTRODE (WHITE DISPLAY)
Digital Video Data (High)
PIXEL ELECTRODE (BLACK DISPLAY)
Digital Video Data (Low)
OPPOSITE ELECTRODE
PIXEL SELECTION SWITCH
1st SWITCH
2nd SWITCH
3rd SWITCH
on
on
off
off→on
off off off

DISPLAY DEVICE

BACKGROUND OF THE INVENTION

1. Field of the Invention

The present invention relates to a semiconductor device having a function to control, by a transistor, current to be supplied to a load. The present invention particularly relates to a display device including: a scan line driving circuit; a signal line driving circuit; and at least one of a pixel formed by a current-driving type display element of which luminance is changed by a signal, a pixel formed by a voltage-driving type display element of which luminance is changed by voltage, and a pixel formed by a display element of which transmittance is changed by voltage, such as a liquid crystal.

2. Description of the Related Art

In recent years, a so-called self-light-emitting display device in which a pixel is formed using a display element such as a light-emitting diode (LED) has attracted attention. As a display element used for such a self-light-emitting display device, for example, an organic light-emitting diode (also referred to as an OLED, an organic EL element, or an electroluminescent element) has attracted attention, and has been used for an EL display and the like. Since a display element such as an OLED is of self-light-emitting type, such a display device has advantages over a liquid crystal display in point of high visibility, no backlight required, and high response speed. It is to be noted that the luminance of a display element is controlled by the value of a current flowing through the display element.

A pixel matrix circuit of a general display device and its operation will be hereinafter described.

A pixel matrix circuit has a signal line driving circuit 7001, a scan line driving circuit 7002, and a pixel portion 7003. The pixel portion 7003 is provided with a plurality of pixels 7004 (FIG. 61). The plurality of pixels 7004 are arranged in a matrix form in accordance with scan lines (G1 to Gm) arranged in a row direction and signal lines (S1 to Sn) arranged in a column direction. The signal line driving circuit 7001 outputs video signals to the signal lines S1 to Sn, and the scan line driving circuit 7002 outputs to the scan lines G1 to Gm signals for selecting the pixels 7004 arranged in the row direction. Then, each of the video signals from the signal line driving circuit 7001 is written in the pixel corresponding to each column of the selected row. Each pixel stores the written signal.

In a similar manner, the signals are written in the pixels of every column in the rows selected sequentially. When signal writing is completed to all the pixels of the pixel portion 7003, a writing period to the pixels 7004 is completed. While the pixels are operated to emit light, the pixels 7004 store the written signals for a certain period. Therefore, each of the pixels 7004 maintains a state in accordance with the signal written therein. Then, by repeating the writing operation and light-emitting operation, a moving image is displayed.

The output of the video signal to the pixel is controlled by the signal line driving circuit 7001. The signal line driving circuit 7001 has, for example, a pulse output circuit 7011, a first latch circuit portion 7012, and a second latch circuit portion 7013. The pulse output circuit 7011 sequentially outputs sampling pulses to the first latch circuit portion 7012 in accordance with the timing of an inputted start pulse signal (S_SP) or the like. A video signal (video Data) is inputted to the first latch circuit portion 7012. The timing thereof is controlled in accordance with the sampling pulse outputted from the pulse output circuit 7011. Then, the video signal is held in each stage of the first latch circuit portion 7012. That is to say, a latch circuit of each stage of the first latch circuit portion 7012 operates based on the sampling pulse outputted from the pulse output circuit 7011.

After that, when the video signal input is completed to the last stage in the first latch circuit portion 7012, latch pulses (Latch Pulses) are inputted to the second latch circuit portion 7013, and the video signals held in the first latch circuit portion 7012 are simultaneously transferred to the second latch circuit portion 7013 and held in the second latch circuit portion 7013. Then, the video signals (for one row) are outputted simultaneously from the second latch circuit portion 7013 to the signal lines S1 to Sn. Then, while the signals are outputted from the second latch circuit portion 7013 to the signal lines, video signal data for the next row is inputted to the first latch circuit portion 7012. Then, after the input to the last stage, signals are transferred from the first latch circuit portion 7012 to the second latch circuit portion by latch pulses. By repeating this operation, the signals are inputted to all the pixels to display a moving image.

As a method for driving such a display device to express a gray scale, there are an analog gray scale method and a digital gray scale method. The analog gray scale method includes a method of controlling the light emission intensity of a display element in an analog manner and a method of controlling the light emission time of a display element in an analog manner. As the analog gray scale method, the method of controlling the light emission intensity of a display element in an analog manner is often used. However, the method of controlling the light emission intensity in an analog manner is easily affected by variation in characteristics of a thin film transistor (hereinafter also referred to as a TFT) between pixels, which causes variation also in luminance between pixels. On the other hand, in the digital gray scale method, a display element is turned on/off by controlling in a digital manner to express a gray scale. In the case of the digital gray scale method, the uniformity of luminance of each pixel is excellent. However, there are only two states, that is, a light emitting state and a non-light emitting state; therefore, only two gray scale levels can be expressed. Therefore, multiple-level gray scale display is attempted by using another method in combination. As a technique for multiple-level gray scale display, for example, there are an area gray scale method in which light emission area of a pixel is weighted (one pixel is divided into a plurality of regions and whether light emission or non light emission is controlled for every region) and selected to perform gray scale display and a time gray scale method in which light emission time is weighted (one frame is divided into a plurality of subframes and whether light emission or non light emission is controlled for every subframe) and selected to perform gray scale display. In the case of the digital gray scale method, the time gray scale method, which is also suitable to obtain higher definition, is often used (see, for example, Reference 1: Japanese Patent No. 2784615).

Here, improvement in definition can be achieved by using the time gray scale method in the digital gray scale method. However, as improvement in definition proceeds, the number of pixels is increased. Therefore, the number of pixels to which signal writing is conducted is also increased. Moreover, for higher-level gray scale display, the number of subframes needs to be increased. Accordingly, the number of times to write signals in pixels increases.

Moreover, in the aforementioned display device, since the pulse output circuit inputs sampling pulses for one row to the first latch circuit portion in all the rows, the pulse output circuit operates to transfer the signals for one row from the first to last columns. Thus, the increase in power consumption becomes a problem with the increase in the number of pixels.

SUMMARY OF THE INVENTION

In view of the aforementioned problem, it is an object of the present invention to provide a display device in which reduction of power consumption can be achieved by reducing the number of times to output sampling pulses from a pulse output circuit and the number of times to write video signals in pixels.

A display device of the present invention has a pixel portion in which a plurality of pixels are provided in a matrix form in accordance with a row direction and a column direction, a signal line driving circuit for inputting a video signal to a signal line, and a scan line driving circuit for selecting a pixel row to which the video signal is to be written. The signal line driving circuit is provided with a shift register and has a means of not transferring a signal in the shift register when a video signal written in a pixel in a row selected by the scan line driving circuit is identical with a video signal to be written in a pixel in one row after the selected row.

A display device of the present invention has a pixel portion in which a plurality of pixels are provided in a matrix form in accordance with a row direction and a column direction, a signal line driving circuit for inputting a video signal to a signal line, and a scan line driving circuit for selecting a pixel row to which the video signal is to be written. The signal line driving circuit is provided with a shift register and has a means of not transferring a signal in the shift register in consecutive plural columns when video signals written in pixels in a row selected by the scan line driving circuit are identical with video signals to be written in pixels in one row after the selected row in the consecutive plural columns.

A display device of the present invention has a pixel portion in which a plurality of pixels are provided in a matrix form in accordance with a row direction and a column direction, a signal line driving circuit for inputting a video signal to a signal line, and a scan line driving circuit for selecting a pixel row to which the video signal is to be written. The signal line driving circuit is provided with a shift register and a latch circuit. The latch circuit has a means of holding the video signal based on a sampling pulse supplied from the shift register. The signal line driving circuit has a means of not supplying a sampling pulse to the latch circuit when a video signal held in the latch circuit is identical with a video signal to be written in the latch circuit.

A display device of the present invention has a pixel portion in which a plurality of pixels are provided in a matrix form in accordance with a row direction and a column direction, a signal line driving circuit for inputting a video signal to a signal line, and a scan line driving circuit for selecting a pixel row to which the video signal is to be written. The signal line driving circuit is provided with a shift register and a latch circuit. The latch circuit has a means of holding the video signal based on a sampling pulse supplied from the shift register. The signal line driving circuit has a means of, when a video signal written in a pixel of a row selected by the scan line driving circuit is identical with a video signal to be written in a pixel in one row after the selected row in the same column, not supplying a sampling pulse to the latch circuit in the same column.

A display device of the present invention has a pixel portion in which a plurality of pixels are provided in a matrix form in accordance with a row direction and a column direction, a signal line driving circuit for inputting a video signal to a signal line, and a scan line driving circuit for selecting a pixel row to which the video signal is to be written. The signal line driving circuit is provided with a shift register and a latch circuit. The latch circuit has a means of holding the video signal based on a sampling pulse supplied from the shift register. The signal line driving circuit has a means of not transferring a signal in the shift register in consecutive plural columns when video signals written in pixels of a row selected by the scan line driving circuit are identical with video signals to be written in pixels in one row after the selected row in the consecutive plural columns.

A display device of the present invention has a pixel portion in which a plurality of pixels are provided in a matrix form in accordance with a row direction and a column direction, a signal line driving circuit for inputting a video signal to a signal line, and a scan line driving circuit for selecting a pixel row to which the video signal is to be written. The signal line driving circuit is provided with a shift register, a first latch circuit, and a second latch circuit. The first latch circuit has a means of holding the video signal based on a sampling pulse supplied from the shift register. The second latch circuit has a means of holding the video signal supplied from the first latch circuit. The signal line driving circuit has a means of not supplying a sampling pulse to the first latch circuit when the video signal held in the second latch circuit is identical with the video signal to be written in the first latch circuit.

A display device of the present invention has a pixel portion in which a plurality of pixels are provided in a matrix form in accordance with a row direction and a column direction, a signal line driving circuit for inputting a video signal to a signal line, and a scan line driving circuit for selecting a pixel row to which the video signal is to be written. The signal line driving circuit is provided with a shift register, a first latch circuit, and a second latch circuit. The first latch circuit has a means of holding the video signal based on a sampling pulse supplied from the shift register. The second latch circuit has a means of holding the video signal supplied from the first latch circuit. The signal line driving circuit has a means of, when a video signal written in a pixel of a row selected by the scan line driving circuit is identical with a video signal to be written in a pixel in one row after the selected row in the same column, not supplying a sampling pulse to the first latch circuit in the same column.

A display device of the present invention has a pixel portion in which a plurality of pixels are provided in a matrix form in accordance with a row direction and a column direction, a signal line driving circuit for inputting a video signal to a signal line, and a scan line driving circuit for selecting a pixel row to which the video signal is to be written. The signal line driving circuit is provided with a shift register, a first latch circuit, and a second latch circuit. The first latch circuit has a means of holding the video signal based on a sampling pulse supplied from the shift register. The second latch circuit has a means of holding the video signal supplied from the first latch circuit. The signal line driving circuit has a means of not transferring a signal in the shift register in consecutive plural columns when video signals written in pixels of a row selected by the scan line driving circuit are identical with video signals to be written in pixels in one row after the selected row in the consecutive plural columns.

A display device of the present invention has a pixel portion in which a plurality of pixels are provided in a matrix form in accordance with a row direction and a column direction, a signal line driving circuit for inputting a video signal to a signal line, and a scan line driving circuit for selecting a pixel row to which the video signal is to be written. The scan line driving circuit has a means of not writing a video signal in a selected pixel row when a video signal to be written in the selected pixel row is identical with a video signal stored in the selected pixel row. The signal line driving circuit is provided with a shift register and has a means of not transferring a signal in the shift register when a video signal written in a pixel of a row selected by the scan line driving circuit is identical with a video signal to be written in a pixel in one row after the selected row.

A display device of the present invention has a pixel portion in which a plurality of pixels are provided in a matrix form in accordance with a row direction and a column direction, a signal line driving circuit for inputting a video signal to a signal line, and a scan line driving circuit for selecting a pixel row to which the video signal is to be written. The scan line driving circuit has a means of, when a video signal to be written in a pixel of a selected row is identical with a video signal stored in the pixel in the selected row, not selecting the pixel in the selected row. The signal line driving circuit is provided with a shift register and has a means of not transferring a signal in the shift register when a video signal written in a pixel of a row selected by the scan line driving circuit is identical with a video signal to be written in a pixel in one row after the selected row.

A switch shown in this specification may be either an electric switch or a mechanical switch. Whatever can control current flow may be used as the switch. The switch may be a transistor, a diode, or a logic circuit using a transistor and a diode in combination. Thus, in a case of using a transistor as the switch, since the transistor operates simply as a switch, the polarity (conductivity type) of the transistor is not particularly limited. However, if off-current is desirably low, a transistor with a polarity of less off-current is desirable. As the transistor with less off-current, a transistor provided with an LDD region, a transistor having a multi-gate-structure, or the like is given. If a transistor as a switch operates in a state that the potential of a source terminal of the transistor is close to a low potential side power source (such as Vss, GND, or 0 V), the transistor is preferably an n-channel transistor. On the other hand, if the transistor operates in a state that the potential of the source terminal thereof is close to a high potential side power source (such as Vdd), the transistor is preferably a p-channel TFT. This is because the transistor easily operates as a switch due to the increase in an absolute value of a gate-source voltage. Moreover, a CMOS switch using both an n-channel TFT and a p-channel TFT may be employed.

It is to be noted that connection is synonymous with electric connection in this specification. Therefore, the provision of another element, a switch, or the like in between is acceptable.

Moreover, the display element is not limited. Any display element such as the following may be used: an EL element (such as an organic EL element, an inorganic EL element, or an EL element containing an organic substance and an inorganic substance), an element used in a field-emission display (FED), a liquid crystal display (LCD), a plasma display (PDP), an electronic paper display, a digital micro-mirror device (DMD), a piezoceramic display, a ferroelectric LCD, an antiferroelectric LCD, a surface-conduction electron-emitter display (SED), or the like. Moreover, the following display element is preferable: a display element using a time gray scale method, a display device having a pixel with a memory property (particularly an element having an SRAM, a DRAM, or the like in a pixel, or a memory element (an element which can store a signal)), or the like.

In the present invention, the kind of applicable transistor is not limited. A thin film transistor (TFT) using a non-single-crystal semiconductor film typified by amorphous silicon or polycrystalline silicon; a MOS type transistor, a junction transistor, or a bipolar transistor which is formed using a semiconductor substrate or an SOI substrate; a transistor using an organic semiconductor or a carbon nanotube; or another transistor can be used. The kind of substrate where the transistor is provided is not limited, and a single-crystal substrate, an SOI substrate, a glass substrate, a plastic substrate, or the like can be used.

As described above, the transistor in the present invention may be of any type and may be formed over any kind of substrate. Thus, all of circuits may be formed over a glass substrate, a plastic substrate, a single-crystal substrate, an SOI substrate, or any other substrate. Alternatively, some circuits may be formed over a certain substrate and some other circuits may be formed over another substrate. In other words, all of the circuits are not necessarily formed over one substrate. For example, some circuits may be formed over a glass substrate by using TFTs and some other circuits may be formed using a single-crystal substrate. Then, an IC chip that includes the circuits using the single-crystal substrate may be connected by COG (Chip On Glass) so as to be provided over the glass substrate. Alternatively, the IC chip may be connected to the glass substrate by using TAB (Tape Automated Bonding) or a printed board.

In this specification, one pixel shows a color element. Thus, in a case of a full color display device including color elements of R (red), G (green), and B (blue), one pixel refers to any of color elements of R, G, and B.

Moreover, in this specification, matrix-form arrangement of pixels includes a case in which pixels are arranged in a so-called grid form with a combination of vertical stripes and horizontal stripes, and moreover includes a case in which pixels of three color elements expressing a minimum element of one image are arranged in a so-called delta form when performing full-color display by three-color elements (for example, RGB).

In this specification, the semiconductor device refers to a device having a circuit including a semiconductor element (such as a transistor or a diode). A liquid crystal display device refers to a display device including a liquid crystal element.

The signal transfer in the shift register of the signal line driving circuit can be made less frequent, which can reduce the power consumption. Moreover, a display device can be provided in which the power consumption can be reduced by reducing the number of times to write signals in the pixels.

DETAILED DESCRIPTION OF THE INVENTION

Figure 1:
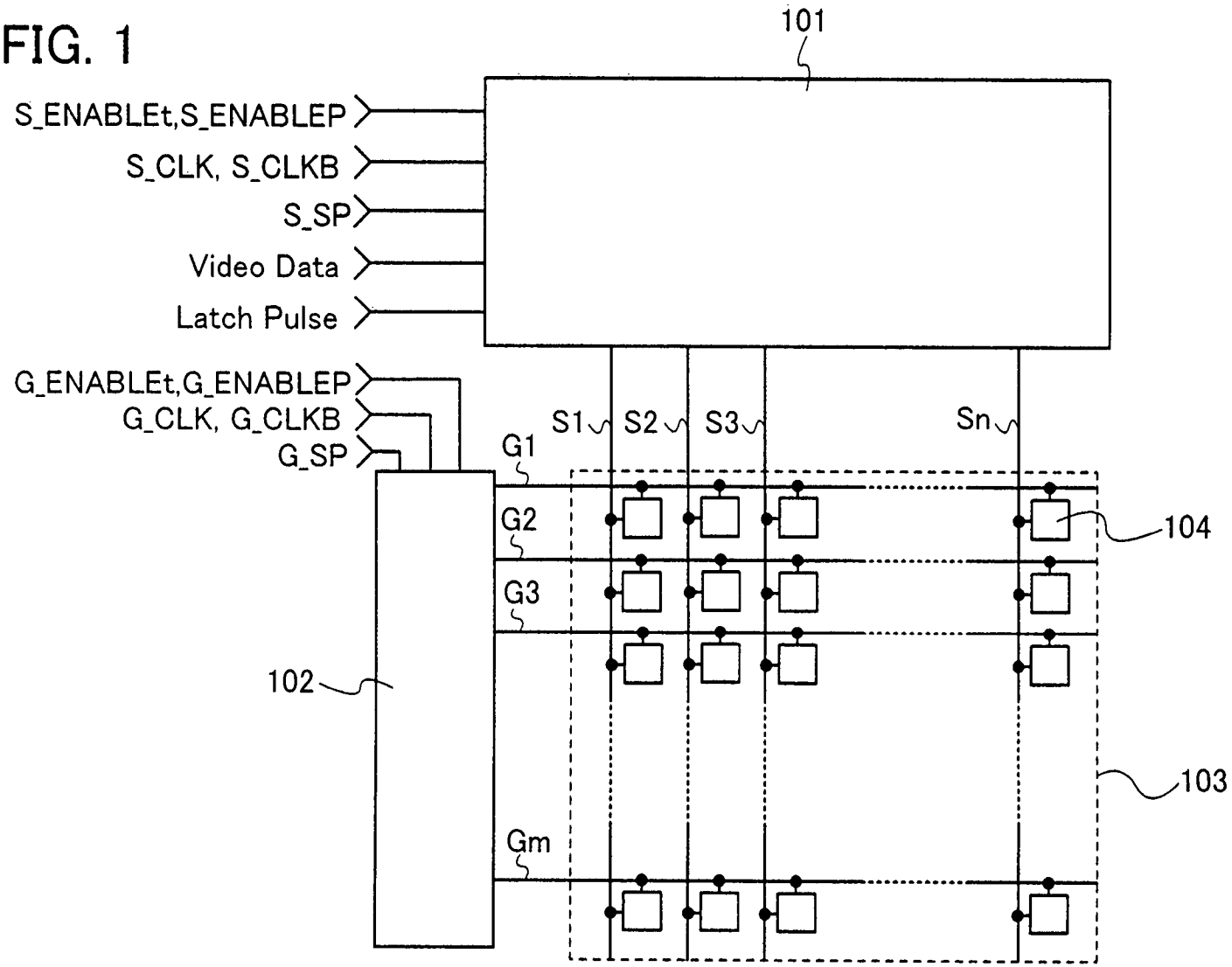
FIG. 1 shows a structure example of a display device of the present invention.

Embodiment modes of the present invention will be hereinafter described with reference to drawings. However, the present invention is not limited to the following description, and it is easily understood by those skilled in the art that the mode and detail can be variously changed without departing from the scope and spirit of the present invention. Therefore, the present invention is not construed as being limited to the description of embodiment modes hereinafter shown. It is to be noted that, in the hereinafter-described structures of the present invention, a reference numeral denoting the same portion may be used in common throughout the different drawings.

In a display device of the present invention, in a case of writing a video signal in a certain row, whether to output a sampling pulse or write a video signal in a pixel is controlled based on a result of comparing video signals to be newly written in the certain row and video signals already written in one row before the certain row or comparing video signals to be newly written in the certain row and video signals already written in pixels of the certain row. Therefore, a display device of the present invention employs any of structures which can be roughly classified into a first structure and a second structure as follows.

In the first structure, when video signals are written in pixels of every column in a selected row (for example, i-th row), video signals already written in one row before the selected row (for example, (i−1)-th row) are compared with video signals to be newly written in the next row (i-th row). Then, if the video signal in the i-th row is identical with the video signal in the (i−1)-th row, a sampling pulse is not generated in a signal line driving circuit 101. It is to be noted here that the comparison made between the video signals to be newly written in the row (i-th row) and the video signals already written in one row before ((i−1)-th row) means comparison made for each of columns connected to the same signal line between the video signals to be newly written in pixels corresponding to the columns in the row (i-th row) and the video signals already written in pixels corresponding to the columns in one row before ((i−1)-th row).

In the second structure, when video signals are written in pixels of every column in a certain row, video signals already written and held in the pixels of every column in the certain row are compared with video signals to be newly written in the certain row. Then, if the video signals are identical, video signal writing is not conducted in the pixels of the certain row. It is to be noted here that the comparison made between the video signals already written and held in the pixels of every column in the certain row and the video signals to be newly written therein means comparison made for each of columns connected to the same signal line between the video signals already written in the certain row and the video signals to be newly written in the certain row.

Differently from the first structure, the second structure is applied to a case where all the video signals written and held in the certain row are identical with the video signals to be newly written in the certain row as a result of comparing the video signals in the pixels of every column in the certain row. On the other hand, the first structure can be applied without limitation to a case where all the video signals to be newly written in pixels of every column in a row (i-th row) are identical with the video signals already written in pixels of every column in one row before ((i−1)-th row).

A display device of the present invention consumes less electric power by using the first structure or the second structure. The first structure and the second structure may be applied alone or in combination.

A structure example of a display device of the present invention is shown in FIG. 1.

A display device of the present invention has a signal line driving circuit 101, a scan line driving circuit 102, and a pixel portion 103 (FIG. 1). The pixel portion 103 is provided with pixels 104 arranged in a matrix form in accordance with scan lines G1 to Gm and signal lines S1 to Sn. Each pixel 104 has a means of storing a written signal.

Signals such as a clock signal (G_CLK), an inverted clock signal (G_CLKB), and a start pulse signal (G_SP) are inputted to the scan line driving circuit 102. However, the signals are not limited to these.

The clock signal (G_CLK) is a signal alternating between H (High) and L (Low) levels at regular intervals, and the inverted clock signal (G_CLKB) is a signal having an inverted polarity of the clock signal (G_CLK). In accordance with these signals, the scan line driving circuit 102 is synchronized and the timing of process execution is controlled. Thus, when the start pulse signal (G_SP) is inputted to the scan line driving circuit 102, a scan signal (gate selection pulse) of the timing for selecting a pixel row is generated in each of the scan lines G1 to Gm in accordance with the clock signal and the inverted clock signal. This scan signal is a signal of the timing at which each of a plurality of pixel rows provided in the pixel portion 103 is selected in order through each of the scan lines connected to the scan line driving circuit 102.

Thus, the scan line driving circuit 102 selects a pixel row in which a video signal is written, by inputting a scan signal to a scan line Gi among the scan lines G1 to Gm. In other words, a pixel row connected to the scan line Gi to which a scan signal for selecting the pixel is inputted is selected. When the pixel is selected, the video signal is inputted thereto through the signal line. In the present invention, a transfer controlling signal (G_ENABLEt) or a sampling controlling signal (G_ENABLEp) is inputted to the scan line driving circuit 102, thereby controlling the generation of a sampling pulse. Specifically, video signals already written and held in the pixel row are compared with video signals to be newly written in the pixel row. Then, if the video signals are identical, the scan line corresponding to the row is not selected so that the video signal is not written in the row.

To the signal line driving circuit 101 are inputted signals such as a clock signal (S_CLK), an inverted clock signal (S_CLK), a start pulse signal (S_SP), and a video signal (Video Data). However, the signals are not limited to these.

The clock signal (S_CLK) is a signal alternating between H (High) and L (Low) levels at regular intervals, and the inverted clock signal (S_CLKB) is a signal having an inverted polarity of the clock signal (S_CLK). In accordance with these signals, the signal line driving circuit 101 is synchronized and the timing of process execution is controlled. Thus, when the start pulse signal (S_SP) is inputted to the signal line driving circuit 101, a sampling pulse corresponding to a pixel column is generated in accordance with the clock signal and the inverted clock signal. The sampling pulse is a signal controlling the timing to convert a video signal (Video Data) to be written in a certain pixel into data in a column of that pixel when the video signal is inputted to the signal line driving circuit 101. Therefore, in accordance with this sampling pulse, serial video signal data inputted to the signal line driving circuit 101 can be converted into parallel video signal data. Note that in a case of a line sequential display device, this parallel video signal data is held in the signal line driving circuit 101 and the data for one column is inputted simultaneously to each of the signal lines S1 to Sn. Meanwhile, in a case of a dot sequential display device, the serial video signal data is converted to parallel video signal data and inputted sequentially to each of the signal lines S1 to Sn in accordance with the timing of the sampling pulse. In this manner, the signal line driving circuit 101 inputs the video signal corresponding to the pixel of each column to each of the signal lines S1 to Sn.

Accordingly, the pixel row in which the signal is to be written is selected at the timing of the scan signal generated by the scan line driving circuit 102. Then, the video signals inputted to the signal lines S1 to Sn from the signal line driving circuit 101 are written in the pixels 104 of every column in the selected row. Each pixel 104 stores the video signal data written therein for a certain period. In the present invention, a transfer controlling signal (S_ENABLEt) or a sampling controlling signal (S_ENABLEp) is inputted to the signal line driving circuit 101 to control the generation of the sampling pulse. In specific, video signals already written in one row before ((i−1)-th row) and video signals to be newly written in the next row (i-th row) are compared for each column, and if there is a column in which the video signals are identical, the sampling pulse is not generated or the generation of the sampling pulse is stopped halfway in the signal line driving circuit 101.

Pixel rows are sequentially selected in the pixel portion 103, and video signal writing in the pixels is completed when the video signals corresponding to the pixels are written to all the pixels 104. Note that each pixel 104 can maintain a lighting or non-lighting state by holding the video signal data written therein for a certain period. By controlling lighting and non-lighting of each pixel 104, a gray scale in the display device can be expressed. For example, a gray scale can be expressed by controlling the length of the light emission time of the pixel 104.

In this manner, a moving image can be displayed by repeating the writing operation and the light-emitting operation. Also in the case of displaying a still image, the writing operation and the light emitting operation are performed every time the image is rewritten.

Hereinafter, a specific structure of a display device of the present invention will be described with reference to drawings.

Embodiment Mode 1

This embodiment mode will describe an example of a display device of the present invention with reference to drawings. In specific, this embodiment mode will show a structure in which, when a certain row is selected and video signals are written in the selected row, video signals to be newly written in the certain row are compared with video signals already written in one row before the certain row.

Figure 2A:
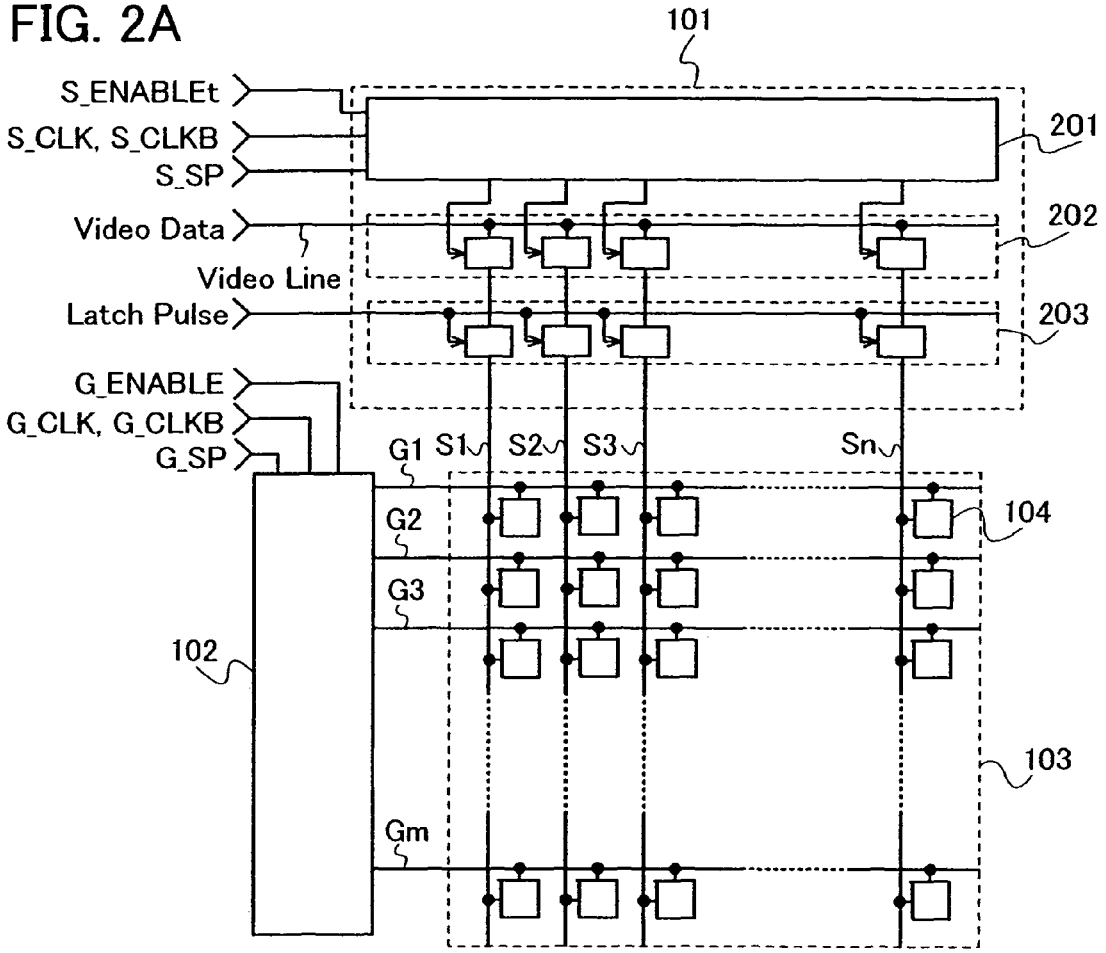
FIGS. 2A and 2B show a structure example of a display device of the present invention.
Figure 2B:
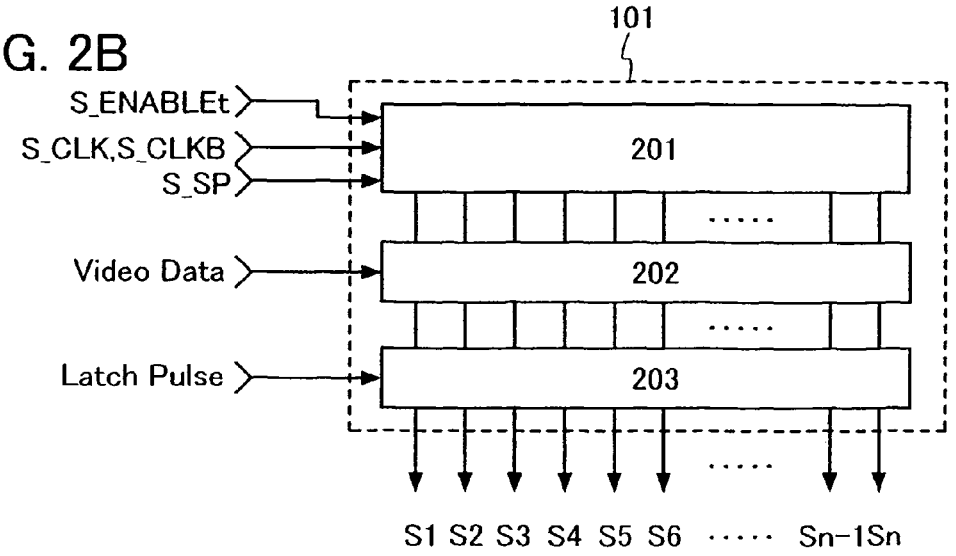

FIGS. 2A and 2B are schematic views of a display device shown in this embodiment mode.

The display device shown in FIGS. 2A and 2B has the signal line driving circuit 101, the scan line driving circuit 102, and the pixel portion 103. The pixel portion 103 is provided with the pixels 104 arranged in a matrix form in accordance with the scan lines G1 to Gm and the signal lines S1 to Sn. The pixel 104 has a means of storing a written signal. Moreover, the signal line driving circuit 101 has a pulse output circuit 201, a first latch circuit portion 202, and a second latch circuit portion 203.

The pulse output circuit 201 sequentially outputs sampling pulses to the first latch circuit portion 202 in accordance with the timing of the input of a start pulse signal (S_SP), a clock signal (S_CLK), and an inverted clock signal (S_CLKB). A video signal (Video Data) is inputted to the first latch circuit portion 202, and the video signal is inputted and held in each stage in accordance with the timing of the input of a sampling pulse outputted from the pulse output circuit 201. In other words, a latch circuit of each stage of the first latch circuit portion 202 operates based on the sampling pulse outputted from the pulse output circuit 201.

When the video signal holding is completed to the last stage in the first latch circuit portion 202, latch pulses (Latch Pulse) are inputted to the second latch circuit portion 203 in a horizontal flyback period, and the video signals held in the first latch circuit portion 202 are simultaneously transferred to the second latch circuit portion 203. After that, the video signals held in the second latch circuit portion 203 for one row are simultaneously outputted to the signal lines S1 to Sn.

Moreover, in this embodiment mode, a transfer controlling signal (S_ENABLEt) is inputted to the pulse output circuit 201. The output of the sampling pulse from the pulse output circuit 201 to the first latch circuit portion 202 is controlled based on the level of the transfer controlling signal. That is to say, whether to input the video signal to the first latch circuit portion 202 can be controlled by the transfer controlling signal. Whether to input the video signal to the first latch circuit portion 202 is controlled in the following manner: (1) video signals in a row (i-th row) to which writing is newly carried out and video signals already written in one row before ((i−1)-th row) are compared for every column in each row of the pixel portion 103, (2) a sampling pulse is outputted to the first latch circuit portion 202 only if the video signal in the row is different from the video signal written in the pixel of one row before, thereby writing a new video signal in the first latch circuit portion 202.

In this manner, the generation of the sampling pulse is selectively controlled instead of writing the video signals to the first latch circuit portion 202 by outputting sampling pulses in all the rows from the pulse output circuit 201 to the first latch circuit portion 202, thereby allowing reduction of the power consumption.

Figure 3:
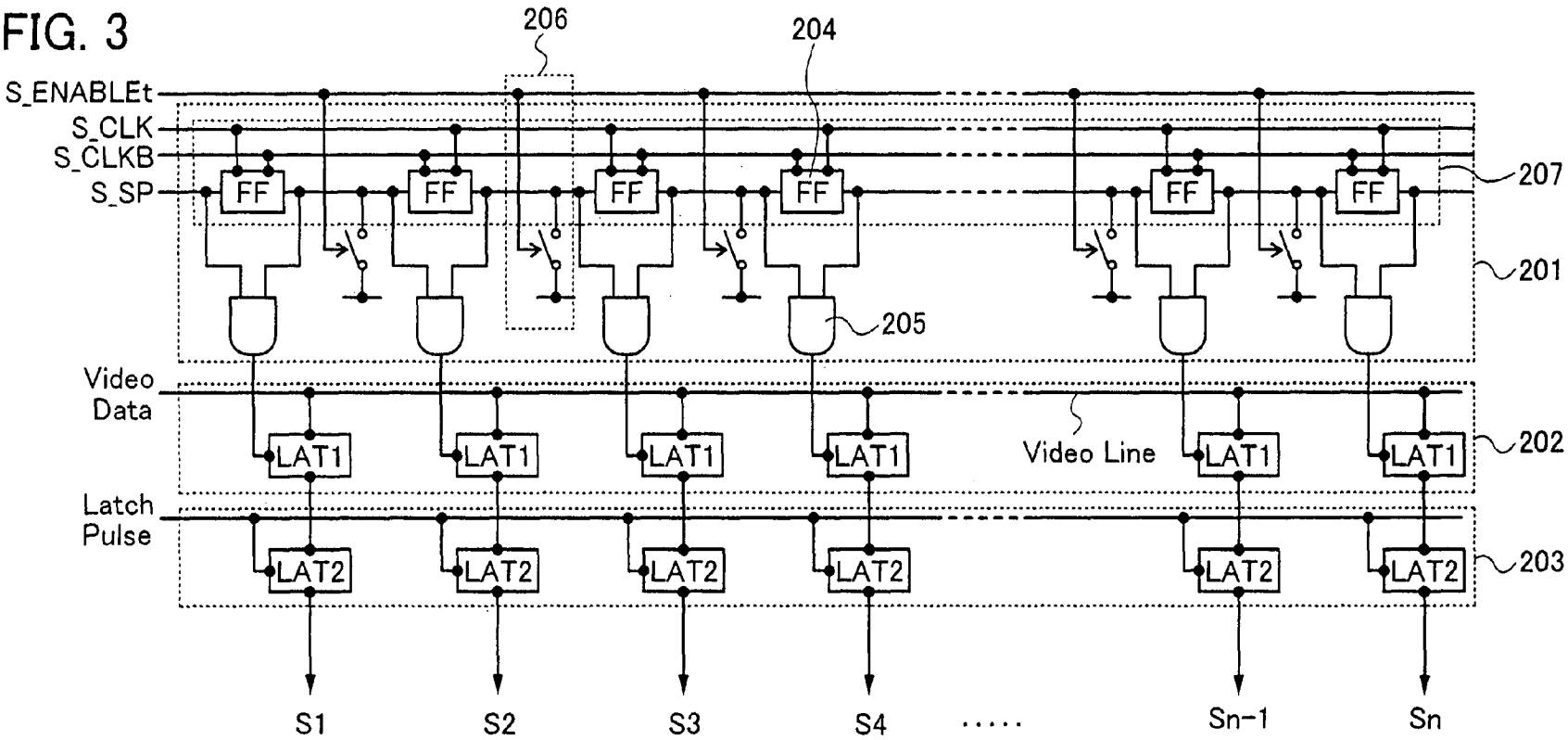
FIG. 3 shows a structure example of a signal line driving circuit of a display device of the present invention.

Subsequently, examples of a specific structure of the signal line driving circuit 101 shown in FIGS. 2A and 2B and its operation are described in more detail with reference to FIG. 3. FIG. 3 shows a case in which signal transfer in the pulse output circuit 201 is stopped when video signals to be newly written in pixels in and after a certain column in a selected row are identical with video signals already written in the pixels in and after the certain column in one row before the selected row.

The pulse output circuit 201 shown in this embodiment mode has a shift register 207 formed by using plural stages of flip-flop circuits (FF) 204 and the like, and AND gates 205. A clock signal (S_CLK), an inverted clock signal (S_CLKB), and a start pulse signal (S_SP) are inputted to each of the flip-flop circuits 204. Then, sampling pulses are sequentially outputted in accordance with the timing of these signals. Moreover, two input terminals of the AND gate 205 are connected to an input terminal and an output terminal of the flip-flop circuit 204. Although an example using the AND gate 205 is shown here, there is no limitation to this. Any structure may be employed as long as the circuit can function similarly. For example, an OR gate, a NAND gate, a NOR gate, an XOR gate, a NOT gate, or the like may be used alone or in combination.

Figure 74:
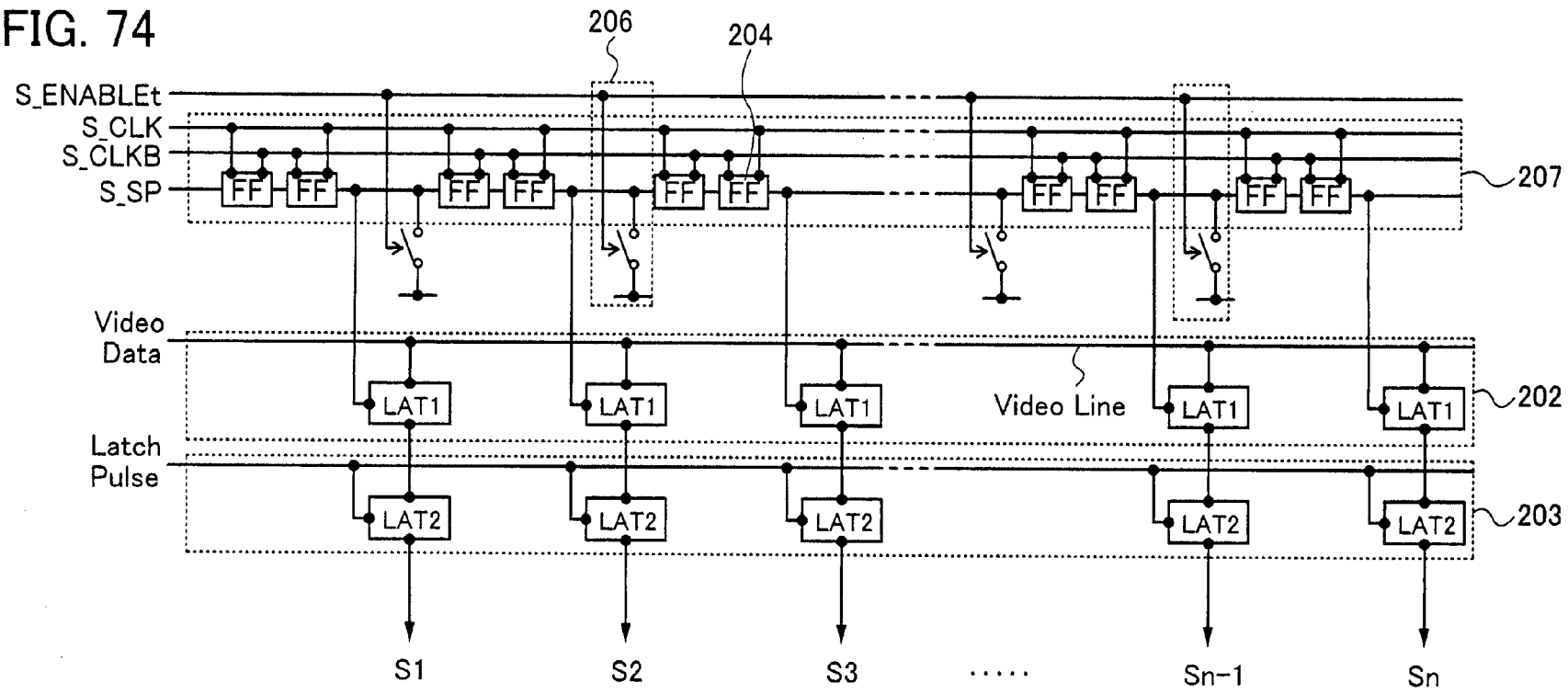
FIG. 74 explains a structure example of a signal line driving circuit of a display device of the present invention.

In the structure shown in FIG. 3, using the AND gates 205 can prevent the sampling pulses in the columns from overlapping with each other. If such overlapping does not have to be avoided, the AND gates are not necessarily provided. For example, as shown in FIG. 74, the sampling pulse outputted to one signal line may be generated by a plurality of flip-flop circuits 204 (here two flip-flop circuits). In this case, overlapping of the sampling pulses in the columns can be prevented without providing the AND gates.

The sampling pulses are outputted from the pulse output circuit 201 to the first latch circuit portion 202 through the AND gates 205, and in accordance with that timing, the video signals are held in the first latch circuit portion 202. When the video signal holding is completed to the last stage in the first latch circuit portion 202, latch pulses are inputted to the second latch circuit portion 203 in a horizontal flyback period, and the video signals held in the first latch circuit portion 202 are simultaneously transferred to the second latch circuit portion 203.

In addition, an input portion of each flip-flop circuit 204 is provided with a switch 206 for initializing a signal in FIG. 3. The turning on/off of the switch 206 is controlled by the transfer controlling signal (S_ENABLEt). When the switch is turned on, an L-level signal is written forcibly in a case of a positive logic (an H-level signal in a case of a negative logic). Specifically, when an L-level signal is written forcibly by turning on the switch 206 using the transfer controlling signal in the case where the video signals to be newly written in and after a certain column in a row to which writing is carried out are identical with the video signals already written in the pixels of one row before, the signals transferred sequentially from the start pulse signal are initialized to stop the signal transfer in the shift register 207 in and after the certain column. Accordingly, the output of the sampling pulse to the first latch circuit portion 202 is stopped in and after the certain column so as not to write the video signals to the first latch circuit portion 202 in and after the certain column. Therefore, by stopping the transfer in the shift register 207 in and after the certain column, charging and discharging at the flip-flop circuits 204 are no longer carried out, thereby allowing reduction of the power consumption. Furthermore, when the video signal input to the video signal line is stopped, charging and discharging of the video signal to the first latch circuit portion 202 are no longer necessary, thereby allowing reduction of the power consumption. Although the input portion of each flip-flop circuit in the first column is not provided with the switch 206, the input portion thereof may be provided with the switch.

The switch 206 may be either an electric switch or a mechanical switch. Moreover, whatever can control current flow may be used as the switch 206. The switch 206 may be a transistor, a diode, or a logic circuit using a transistor and a diode in combination. A case of using a transistor as a switch will be shown in FIG. 73A. A first terminal (source or drain terminal) of the transistor is connected to an input portion of the flip-flop circuit 204, and a second terminal (source or drain terminal) of the transistor is connected to an electrode set to have a low power source potential. For example, the lower power source potential may be GND, 0 V, or the like. Moreover, since the transistor operates as a switch simply, the polarity (conductivity type) of the transistor is not limited in particular. However, if off-current is desirably low, a transistor with a polarity of less off-current is desirable. As the transistor with less off-current, a transistor provided with an LDD region, a transistor having a multigate-structure, or the like is given. If a transistor operates as a switch in a state that the potential of the source terminal of the transistor is closer to a low potential side power source (such as Vss, GND, or 0 V), the transistor is desirably an n-channel transistor. On the other hand, if the transistor operates in a state that the potential of the source terminal is closer to a high potential side power source (such as Vdd), the transistor is desirably a p-channel TFT. This is because the absolute value of a gate-source voltage can be increased so that the transistor operates easily as a switch. Moreover, a CMOS switch using both an n-channel TFT and a p-channel TFT may be employed. A diode may be used as a switch, and a case of using a diode as a switch is shown in FIG. 73B. If a diode is provided as a switch as shown in FIG. 73B, the transfer controlling signal is normally maintained at an H level. Then, in a case of stopping the transfer, the transfer controlling signal can be changed to an L level so that the diode is turned on to initialize the signal. In addition, a diode-connected transistor, a PN junction or PIN junction diode, a schottky diode, a diode formed by a carbon nanotube, or the like may be used.

Figure 4A:
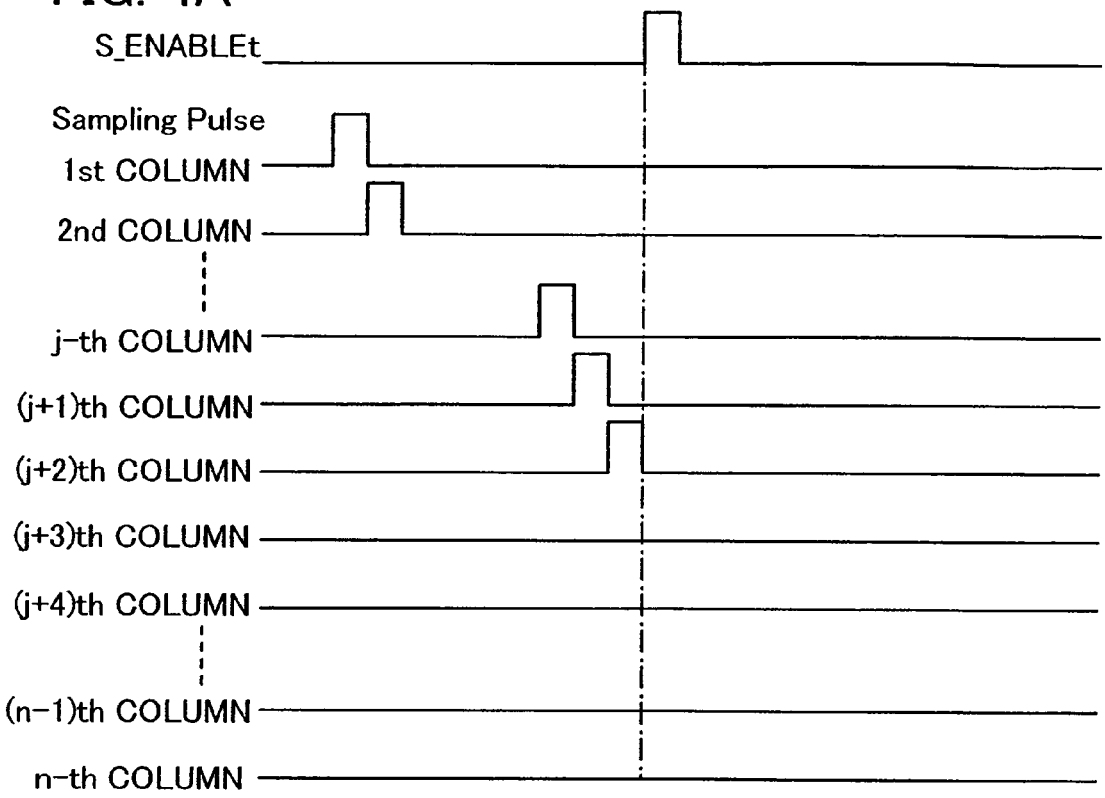
FIGS. 4A and 4B each explain an operation of a signal line driving circuit of a display device of the present invention.
Figure 4B:
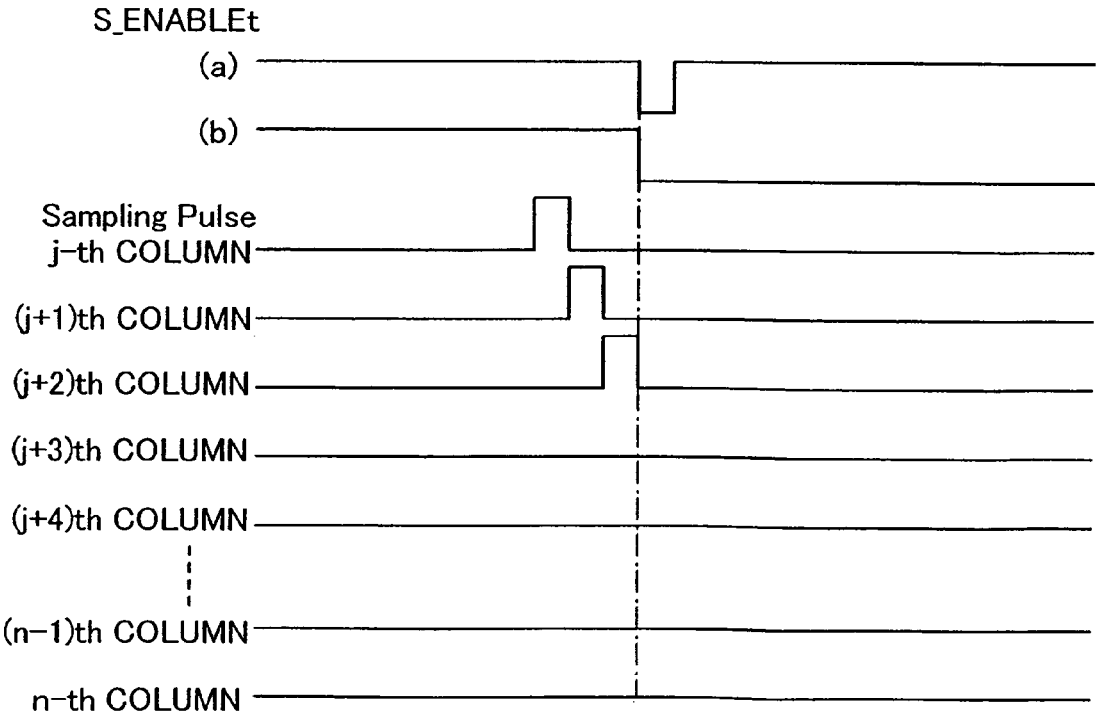

FIGS. 4A and 4B are timing charts when the transfer is stopped by initializing the signal. It is to be noted that FIGS. 4A and 4B show an example of not writing video signals to the first latch circuit portion 202 in and after the (j+3)-th column in a case where one row includes signal lines of n columns (the first to n-th columns) in the pixel portion 103.

Figure 73A:
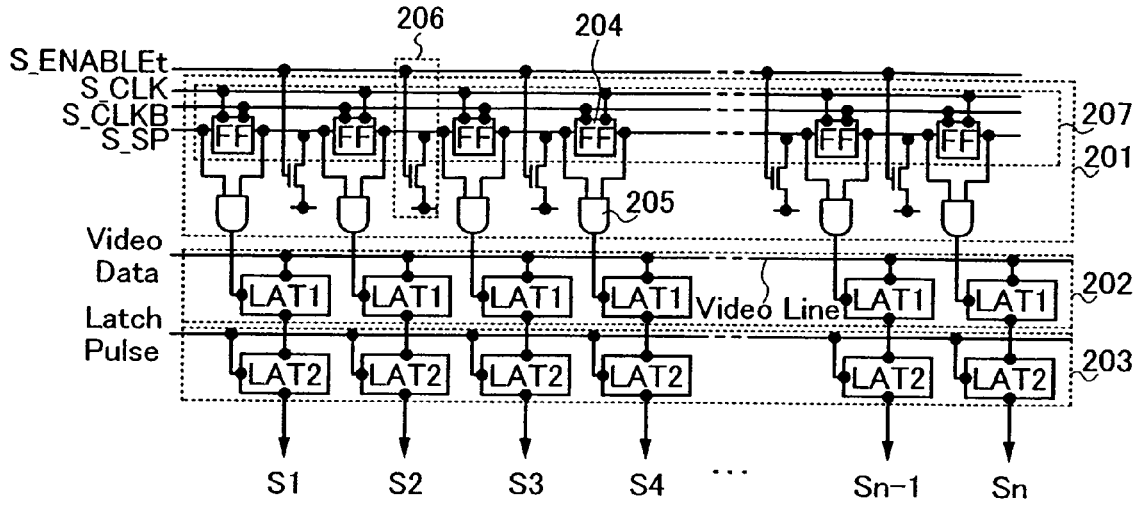
FIGS. 73A and 73B each explain a structure example of a signal line driving circuit of a display device of the present invention.
Figure 73B:
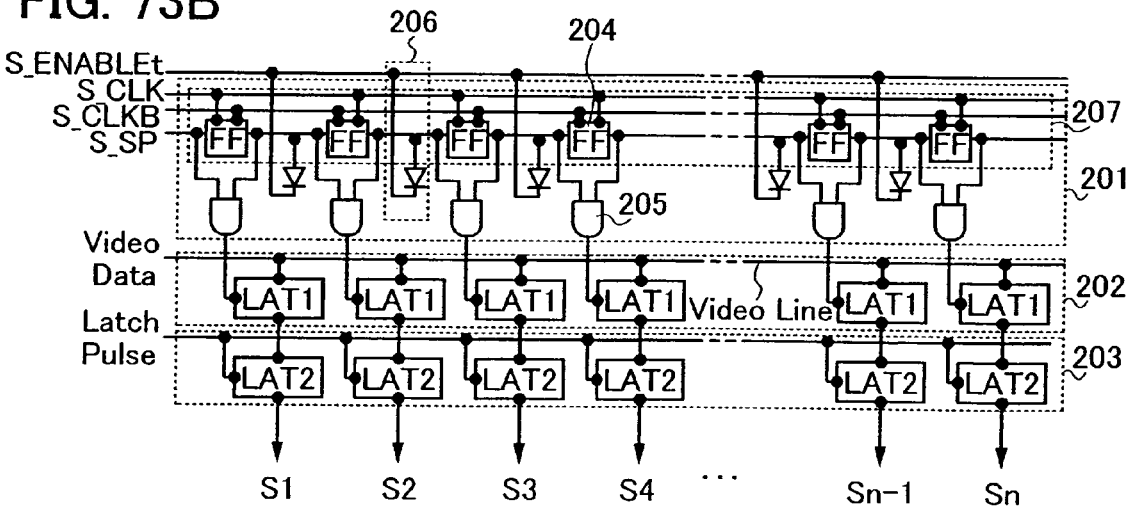

FIG. 4A shows a case of using the transistor shown in FIG. 73A as the switch 206 and FIG. 4B shows a case of using the diode shown in FIG. 73B as the switch 206.

In FIGS. 4A and 4B, since the video signals in and after the (j+3)-th column in a certain row are identical with those in one row before the certain row, the signal transfer in the shift register 207 is stopped in and after the (j+3)-th column by turning on the switch 206 using the transfer controlling signal. In other words, in and after the (j+3)-th column, the sampling pulses are not outputted to the first latch circuit portion 202 and the video signals are not written in the first latch circuit portion 202. In FIG. 4A, specifically, the transfer controlling signal is maintained at an L level until the (j+2)-th column and the transfer controlling signal is set at an H level in the (j+3)-th column to turn on the transistor functioning as the switch 206, whereby an L-level signal is forcibly written. Thus, the signals sequentially transferred from the start pulse are initialized and the signal transfer in the shift register 207 is stopped in and after the (j+3)-th column. Moreover, in FIG. 4B, the transfer controlling signal is maintained at an H level until the (j+2)-th column and the transfer controlling signal is set at an L level in the (j+3)-th column (in a case of (a)) to turn on the diode functioning as the switch 206, whereby an L-level signal is forcibly written. Thus, the signals sequentially transferred from the start pulse are initialized to stop the signal transfer in the shift register 207 in and after the (j+3)-th column. Moreover, the transfer controlling signal is set at an L level in and after the (j+3)-th column (in a case of (b)) to turn on the diode functioning as the switch 206, whereby an L-level signal is forcibly written. Thus, the signals sequentially transferred from the start pulse can be initialized to stop the signal transfer in the shift register 207 in and after the (j+3)-th column.

Since there is at least one column among the first to (j+2)-th columns, in which a video signal is different from that in one row before (in this case, at least a video signal in the (j+2)-th column is different from that in one row before (j+2)-th column)), the transfer controlling signal is set in an off state to output sampling pulses from the flip-flop circuits 204 to the first latch circuit portion 202 through the AND gates 205, thereby writing new video signals in the first latch circuit portion 202. On the other hand, in and after the (j+3)-th column, since all the video signals are identical with those in one row before, the signal transfer in the shift register 207 is stopped in and after the (j+3)-th column by turning on the switch 206 using the transfer controlling signal in the (j+3)-th column, so that the sampling pulses are not outputted to the first latch circuit portion 202. Thus, new video signals are not written in the first latch circuit portion 202. Not writing new signals does not cause a problem because the video signals are identical with those stored in the first latch circuit portion 202.

Therefore, the video signals to be newly written in the first latch circuit portion 202 are held in the first to (j+2)-th columns. In and after the (j+3)-th column, the video signals identical with those in one row before are held in the first latch circuit portion 202. Then, latch pulses are inputted to the second latch circuit portion 203 in a horizontal flyback period, and the video signals held in the first latch circuit portion 202 are transferred to the second latch circuit portion 203. Then, the video signals held in the second latch circuit portion 203 for one row are simultaneously outputted to the signal lines S1 to Sn.

In this manner, instead of writing all the video signals for one row in the first latch circuit portion 202, the signal transfer in the shift register 207 is stopped in and after a certain column and sampling pulses are not outputted to the first latch circuit portion 202, if the video signals in and after the certain column are identical with those in one row before. Thus, the power consumption can be reduced.

In the structure shown in FIG. 3, if the switch 206 is turned on by using the transfer controlling signal in a certain column, the signal transfer in the shift register 207 is stopped in and after the certain column; therefore, the sampling pulses are not outputted any more to the first latch circuit portion 202. Therefore, in the structure shown in FIG. 3, a switch for changing a scanning direction may be provided so that a scanning direction can be selected. In other words, the output of the sampling pulse to the first latch circuit portion 202 can be reduced by selecting one of flip-flop circuits located at opposite ends among serially connected flip-flop circuits 204 and inputting a start pulse signal to the selected flip-flop circuit.

Figure 75A:
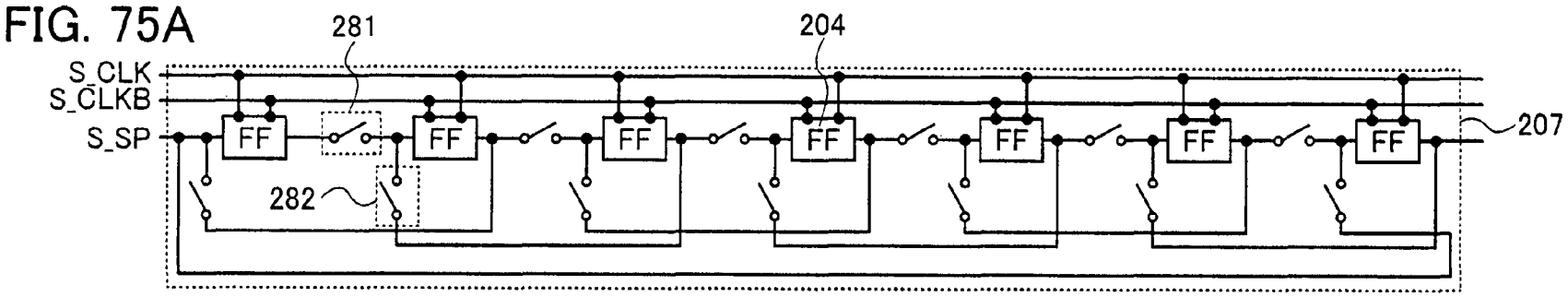
FIGS. 75A to 75C each explain a structure example of a signal line driving circuit of a display device of the present invention.

FIG. 75A shows a structure in which the aforementioned shift register 207 is provided with a switch for changing a scanning direction. Here, an input portion of each flip-flop circuit 204 is provided with switches 281 and 282 for changing a scanning direction, which control the signal transfer. Specifically, in the adjacent flip-flop circuits (such as flip-flop circuits corresponding to the j-th column and the (j+1)-th column), the switch 281 for changing a scanning direction is provided between an output portion of the flip-flop circuit in the j-th column and an input portion of the flip-flop circuit in the (j+1)-th column. Then, the switch 282 for changing a scanning direction is provided between an input portion of the flip-flop circuit in the j-th column and an output portion of the flip-flop circuit in the (j+1)-th column.

Figure 5A:
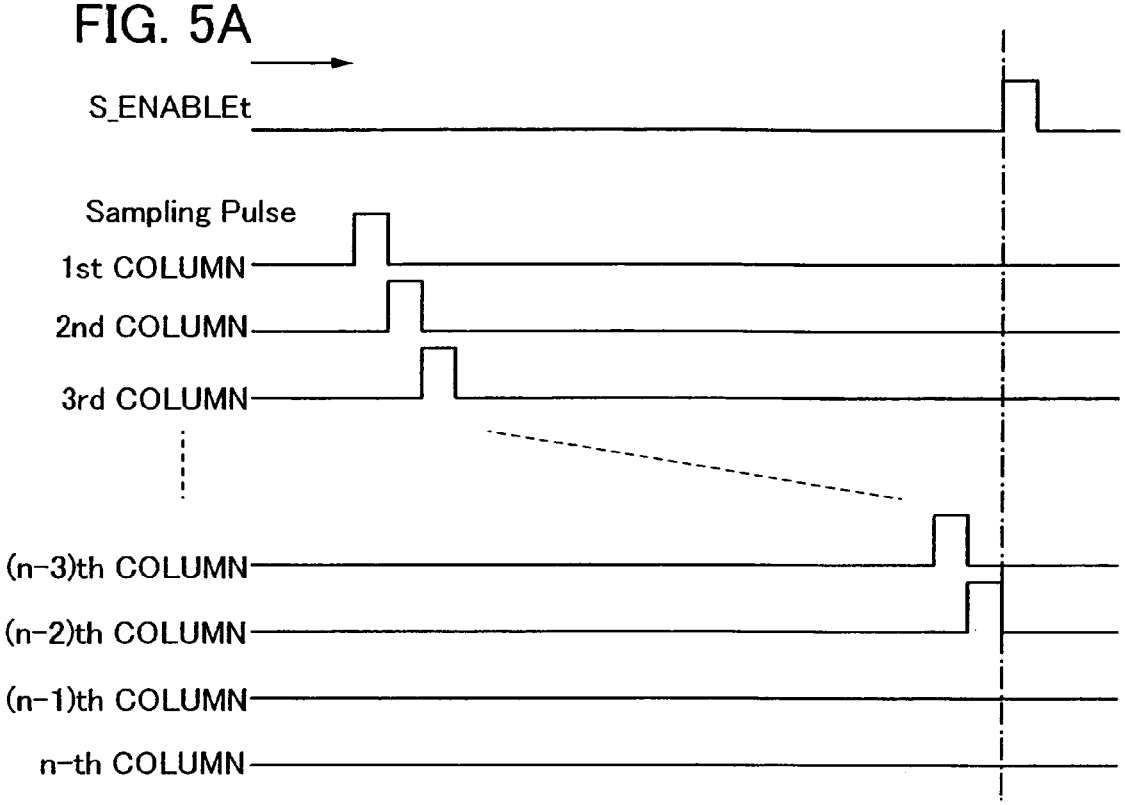
FIGS. 5A and 5B each explain an operation of a signal line driving circuit of a display device of the present invention.
Figure 5B:
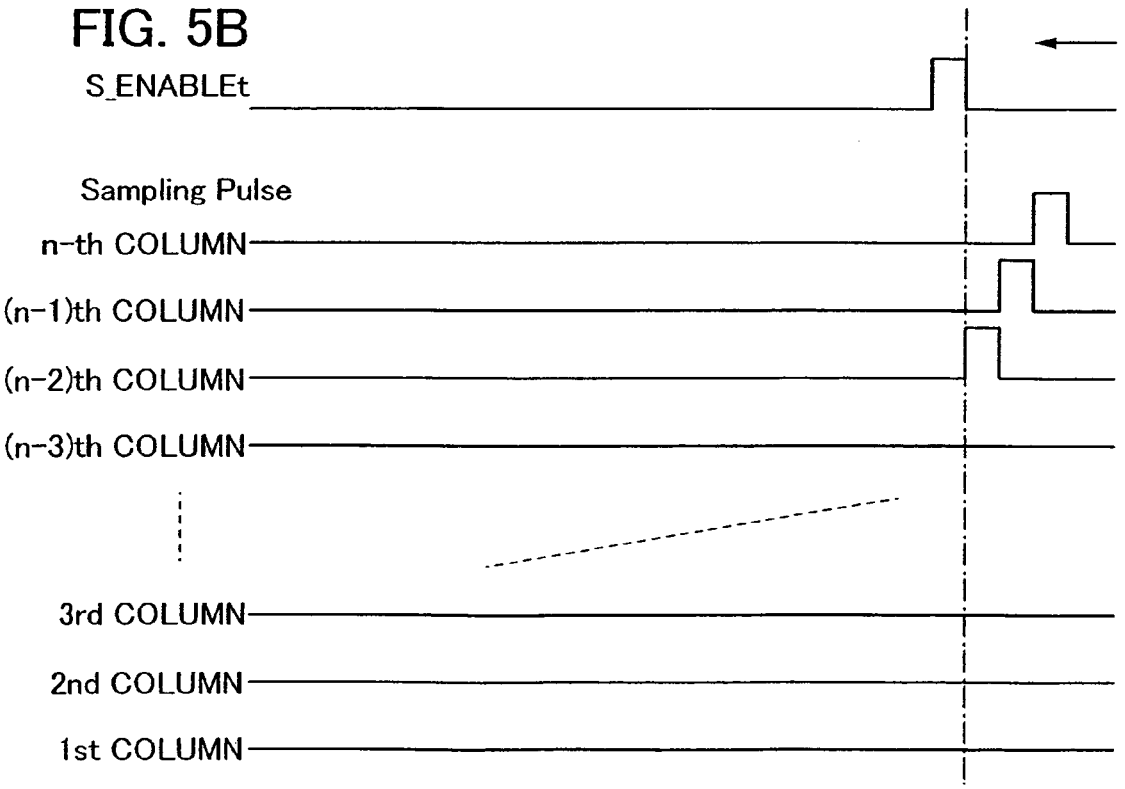

For example, FIGS. 5A and 5B show a case of writing video signals in pixels of a display device in which one row includes signal lines of n columns (the first to n-th columns) and only a video signal in the (n−2)-th column is different from that written in a pixel in one row before. Specifically, FIGS. 5A and 5B show timing charts in a case where a start pulse signal is inputted to the first column and a case where a start pulse signal is inputted to the n-th column, to conduct signal transfer in the shift register 207.

Figure 75B:
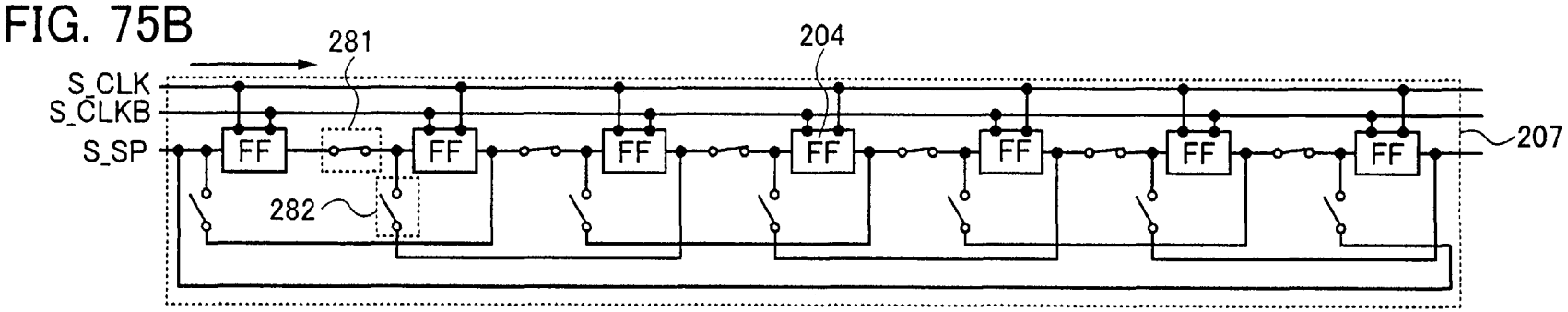

FIG. 5A shows a case where a start pulse signal is inputted to the flip-flop circuit 204 electrically connected to the signal line in the first column. A circuit diagram thereof corresponds to that shown in FIG. 75B, in which the switch 281 for changing a scanning direction is in an on state while the switch 282 for changing a scanning direction is in an off state. In this case, signal transfer is conducted in the first to (n−2)-th columns and is not conducted in and after the (n−1)-th column in the shift register 207. In other words, sampling pulses are outputted from the flip-flop circuits 204 in the first to (n−2)-th columns to the first latch circuit portion 202 through the AND gates 205, thereby newly writing video signals to the first latch circuit portion 202.

Figure 75C:
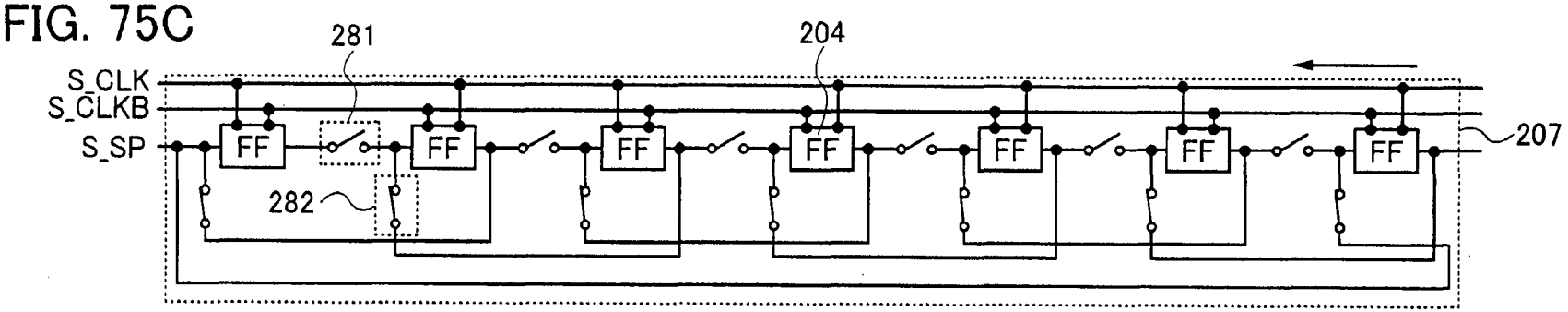

On the other hand, FIG. 5B shows a case where a start pulse signal is inputted to the flip-flop circuit 204 electrically connected to the signal line in the n-th column. A circuit diagram thereof corresponds to that shown in FIG. 75C, in which the switch 281 for changing a scanning direction is in an off state while the switch 282 for changing a scanning direction is in an on state. In this case, signal transfer is conducted in the n-th to (n−2)-th columns and is not conducted in the (n−3)-th to first columns in the shift register 207. That is to say, sampling pulses are outputted from the flip-flop circuits 204 in the n-th to (n−2)-th columns to the first latch circuit portion 202 through the AND gates 205, thereby newly writing new video signals in the first latch circuit portion 202. However, signal transfer in the shift register 207 stops in the first to (n−3)-th columns, whereby sampling pulses are not outputted to the first latch circuit portion 202.

In this manner, the signal transfer in the shift register 207 is carried out for (n−2) columns of the first to (n−2)-th columns to output sampling pulses to the first latch circuit portion 202, thereby writing video signals in the first latch circuit portion 202 in FIG. 5A. Meanwhile, in FIG. 5B, the signal transfer in the shift register 207 is carried out for two columns of the n-th to (n−1)-th columns to output sampling pulses to the first latch circuit portion 202, thereby writing video signals in the first latch circuit portion 202. Therefore, allowing the selection of the scanning direction by providing the switch for changing a scanning direction makes it possible to stop the signal transfer in the shift register 207 at an early stage to stop the sampling pulse outputted from the flip-flop circuit 204 through the AND gate 205, thereby reducing the video signal writing in the first latch circuit portion 202. Accordingly, charging and discharging of video signals and charging and discharging in the shift register 207 are no longer necessary; therefore, the power consumption can be reduced. This advantage is more remarkable as the number n (number of pixels) increases.

Figure 77A:
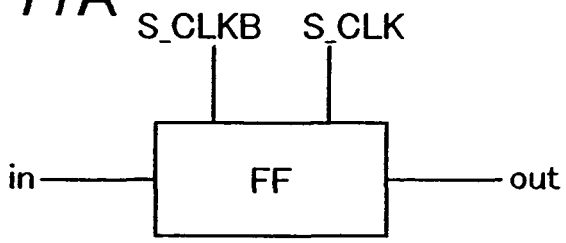
FIGS. 77A and 77B each explain a structure example of a flip-flop circuit of a display device of the present invention.
Figure 77B:
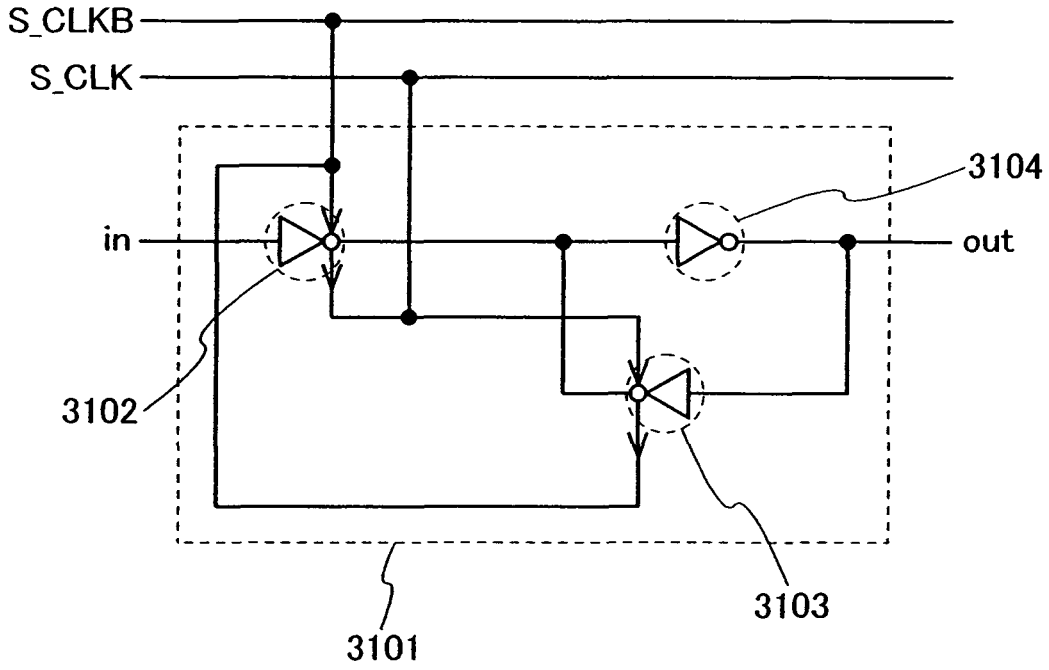

An example of the flip-flop circuit having the aforementioned structure is shown in FIGS. 77A and 77B. It is acceptable as long as the flip-flop circuit basically has a structure that outputs an inputted signal with delay. A flip-flop circuit 3101 shown in FIGS. 77A and 77B has a clocked inverter 3102, a clocked inverter 3103, and an inverter 3104 and is generally called a delay flip-flop circuit (DFF). The clocked inverters 3102 and 3103 that form the DFF operate in synchronization with clock signals and inverted clock signals inputted thereto. Therefore, when one stage of DFF is provided as a delay circuit, a signal is delayed by one pulse of a clock signal supplied to the DFF (delayed by a half of a period of the clock signal). Although FIGS. 77A and 77B show a structure in a case of using the DFF, the present invention is not limited to this. Any structure may be employed as long as the circuit can be used in the shift register.

Figure 78A:
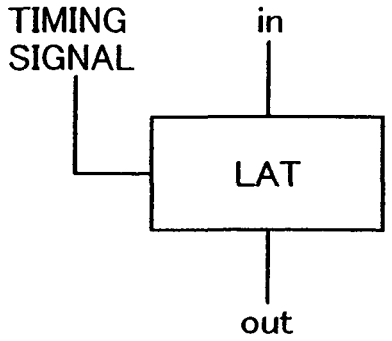
FIGS. 78A and 78B each explain a structure example of a latch circuit of a display device of the present invention.
Figure 78B:
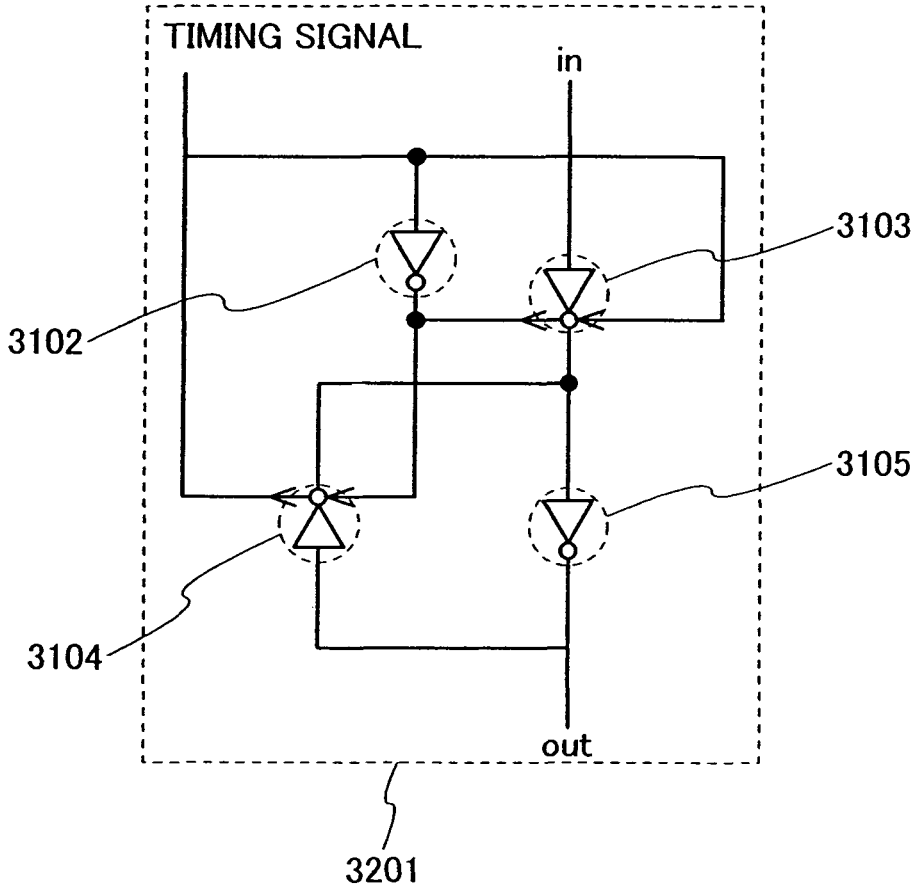

An example of a latch circuit in the latch circuit portion having the aforementioned structure is shown in FIGS. 78A and 78B. It is acceptable as long as the latch circuit portion basically has a structure in which an inputted signal is held and outputted. A latch circuit 3201 shown in FIGS. 78A and 78B has an inverter 3202, a clocked inverter 3203, a clocked inverter 3204, and an inverter 3205. The clocked inverters 3203 and 3204 that form the latch circuit operate in synchronization with a timing signal directly inputted thereto or a timing signal inputted thereto through the inverter 3202. In other words, a signal inputted thereto is held and outputted in synchronization with a timing signal. The latch circuit which can be applied to the present invention may have not only the structure shown in FIGS. 78A and 78B but also any structure as long as the circuit can hold and output an inputted signal.

The structure shown in this embodiment mode can employ a structure in which a plurality of latch circuits are provided to one signal line. This case is explained with reference to FIG. 76.

Figure 76:
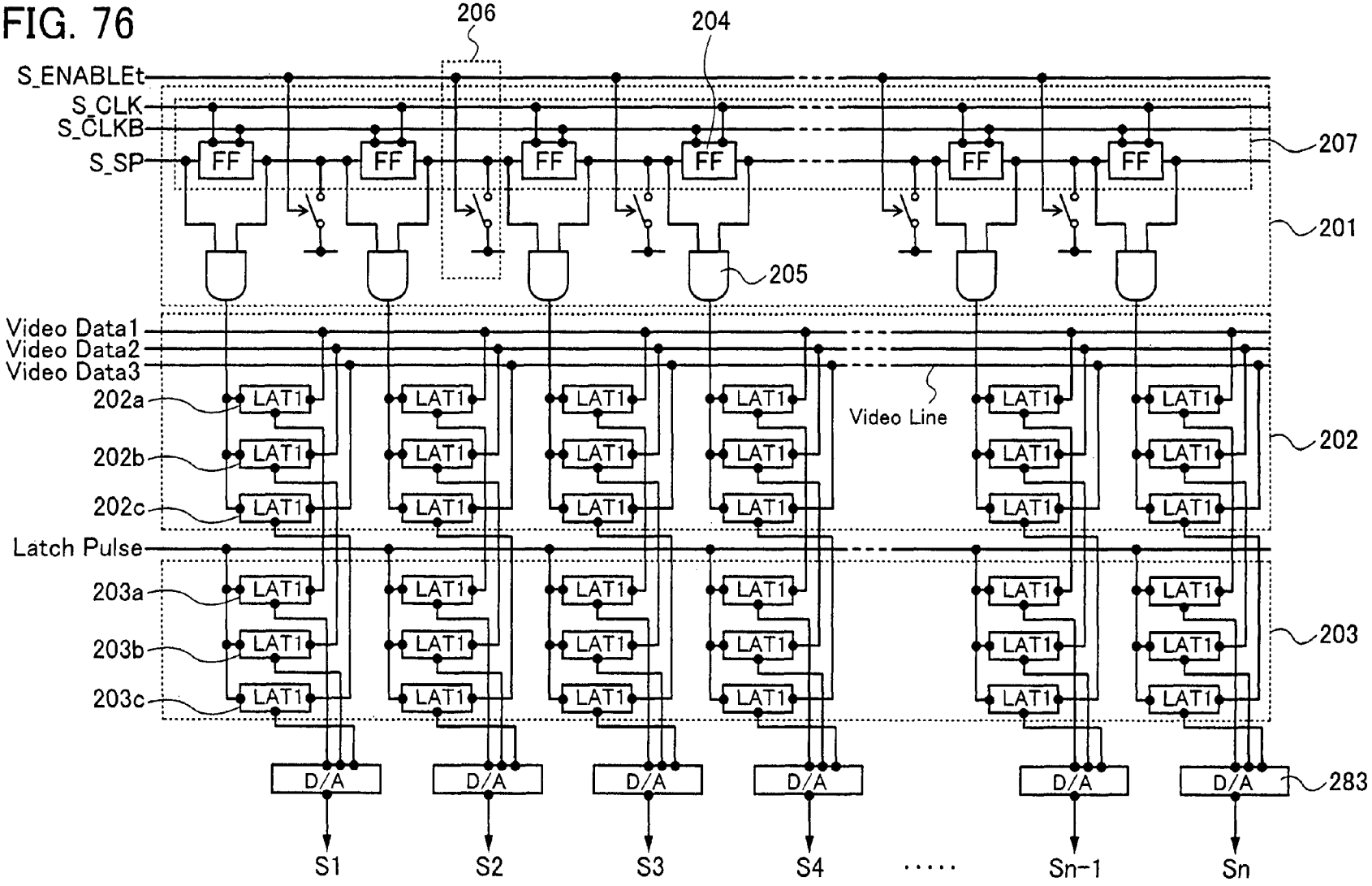
FIG. 76 explains a structure example of a signal line driving circuit of a display device of the present invention.

In FIG. 76, a plurality of latch circuits (here, three) are provided to one signal line in each of the first latch circuit portion 202 and the second latch circuit portion 203 and a plurality of video lines (here, three) are provided in accordance with the number of latch circuits in the first latch circuit portion 202. Then, video signals are outputted from the second latch circuit portion 203 to the signal lines through D/A conversion circuits 283. Although three latch circuits (for three bits) are provided to one signal line in the first latch circuit portion in this example, the number thereof is not limited to three. That is, the number of latch circuits may be selected in consideration of the necessary number of display bits (for example, in a case of six bits, six latch circuits are provided to one signal line in each of the first latch circuit portion 202 and the second latch circuit portion 203).

Sampling pulses are outputted from the pulse output circuit 201 to first latch circuits 202*a* to 202*c*, and in accordance with the timing of the signals, video signals are held in the first latch circuits. Here, the number of video lines is equal to that of the latch circuits in the first latch circuit portion 202, and video signals 1 to 3 are held in the first latch circuits 202*a* to 202*c*, respectively. In other words, video signals for three bits are simultaneously taken into the first latch circuits 202*a* to 202*c* which are arranged in parallel. When the video signal holding is completed to the last stage in the first latch circuit portion 202, latch pulses are inputted to the second latch circuit portion 203 in a horizontal flyback period, and the video signals held in the first latch circuit portion 202 are simultaneously transferred to the second latch circuit portion 203.

It is to be noted that the number of latch circuits in the second latch circuit portion 203 is also equal to that in the first latch circuit portion 202, and the video signals outputted from the first latch circuits 202*a* to 202*c* are held in second latch circuits 203*a* to 203*c*, respectively. Then, the video signals held in the second latch circuit portion 203 are outputted to pixels through the D/A conversion circuits 283.

Moreover, in FIG. 76, the switch 206 for initializing signals is provided to an input portion of the flip-flop circuit 204 and the turning on/off of the switch 206 is controlled by a transfer controlling signal (S_ENABLEt) similarly to the aforementioned FIG. 3. When the switch is turned on, an L-level signal is forcibly written in a case of positive logic (an H-level signal in a case of a negative logic). In specific, when an L-level signal is written forcibly by turning on the switch 206 using the transfer controlling signal in the case where the video signals written in and after a certain column in a row to which writing is carried out are identical with the video signals already written in the pixels of one row before, the signals transferred sequentially from the start pulse signal are initialized to stop the signal transfer in the shift register 207 in and after the certain column. Accordingly, the outputs of the sampling pulses to the first latch circuit portion 202 are no longer carried out so as not to write the video signals in the first latch circuit portion 202 in and after the certain column. Therefore, by stopping the transfer in the shift register 207 in and after the certain column, charging and discharging at the flip-flop circuit 204 are no longer carried out, thereby allowing reduction of the power consumption. Furthermore, stopping of the video signal input to the video signal line leads to omission of charging and discharging of the video signal to the first latch circuit portion 202, thereby allowing reduction of the power consumption.

It is to be noted in FIG. 76 that the case where the video signals written in and after a certain column in a row to which writing is carried out are identical with the video signals already written in the pixels of one row before means a case where video signals for plural bits per column are all identical as a result of comparing the video signals written in the pixels in a certain row and the video signals already written in the pixels in one row before for each column (here, a case where the video signals 1 to 3 written in the certain row are identical with the video signals 1 to 3 already written in the pixels of one row before, respectively).

Needless to say, the aforementioned switch for changing a scanning direction may be provided in the structure shown in FIG. 76 or the structures shown in FIGS. 73A to 74 and the like may be used in combination. The signal line driving circuit shown in FIG. 76 is preferably applied to a display device expressing a gray scale of a pixel by an analog signal with the input of a digital signal, and more preferably applied to a liquid crystal display device.

Embodiment Mode 2

This embodiment mode will describe an example of a display device having a different signal line driving circuit from that shown in Embodiment Mode 1, with reference to drawings.

Figure 6:
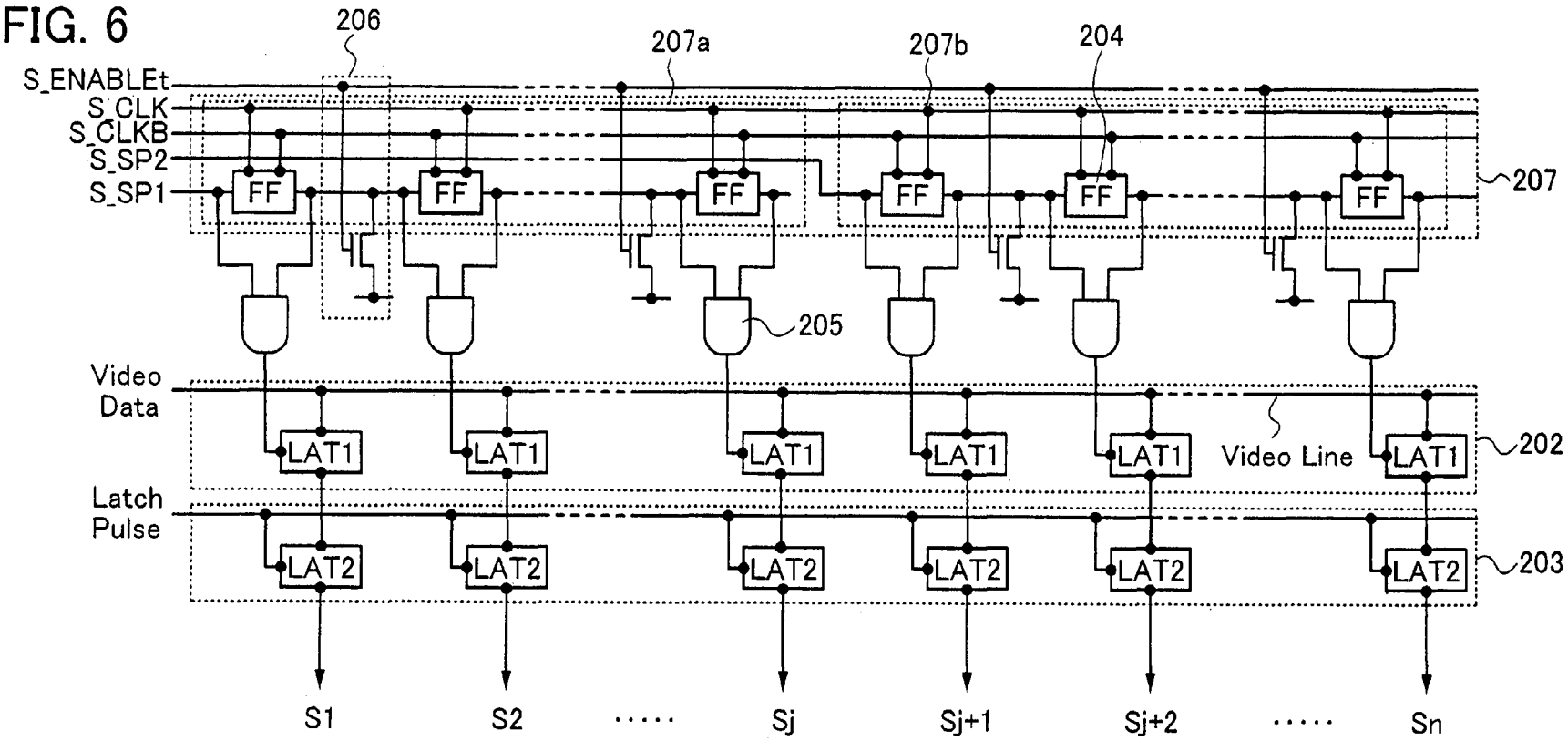
FIG. 6 shows a structure example of a signal line driving circuit of a display device of the present invention.

FIG. 6 is a schematic view of a pulse output circuit in a signal line driving circuit of a display device shown in this embodiment mode.

The pulse output circuit shown in this embodiment mode has the shift register 207 formed by using plural stages of the flip-flop circuits 204 and the like, and the AND gates 205. Two input terminals of the AND gate 205 are connected to an input terminal and an output terminal of the flip-flop circuit 204. In the pulse output circuit 201 shown in FIG. 3, the shift register 207 formed by using plural flip-flop circuits 204 are divided into plural regions and start pulse signals are prepared so that each start pulse signal is inputted to each of the plural regions of the shift register. Here, although the AND gate 205 is used in this example, the present invention is not limited to this. Any structure may be employed as long as the circuit can function similarly. For example, an OR gate, a NAND gate, a NOR gate, an XOR gate, a NOT gate, or the like may be used alone or in combination. In addition, in the structure shown in FIG. 6, using the AND gates 205 can prevent sampling pulses in the columns from overlapping with each other. If such overlapping does not have to be avoided, the AND gates are not necessarily provided.

The flip-flop circuits 204 sequentially output sampling pulses to the first latch circuit portion 202 in accordance with the timing of the input of plural start pulse signals (S_SP), clock signals (S_CLK), and inverted clock signals (S_CLKB). Video signals are inputted to the first latch circuit portion 202, and each of the video signals is inputted and held in each stage in accordance with the timing at which plural sampling pulses outputted from the pulse output circuit 201 are inputted. In other words, the latch circuit of each stage of the first latch circuit portion 202 operates based on the sampling pulse outputted from the pulse output circuit 201.

When the video signal holding is completed to the last stage in the first latch circuit portion 202, latch pulses (Latch Pulses) are inputted to the second latch circuit portion 203 in a horizontal flyback period, and the video signals held in the first latch circuit portion 202 are simultaneously transferred to the second latch circuit portion 203. After that, the video signals held in the second latch circuit portion 203 for one row are simultaneously outputted to the signal lines S1 to Sn.

In addition, an input portion of each flip-flop circuit 204 is provided with the switch 206 for initializing a signal in this embodiment mode. The turning on/off of the switch 206 is controlled by the transfer controlling signal (S_ENABLEt). Specifically, in the case where video signals to be newly written in and after a certain column in a row to which writing is carried out are identical with video signals already written in pixels of one row before, the switch 206 is turned on using the transfer controlling signal to stop the signal transfer in the shift register 207 in and after the certain column and the sampling pulses are not outputted to the first latch circuit portion 202. In addition, in this embodiment mode, the shift register 207 formed by the flip-flop circuits 204 is divided into plural regions and a start pulse signal is inputted to each of the regions. Therefore, even if signal transfer in the shift register 207 is stopped once by turning on the switch 206 using a transfer controlling signal, the input of a start pulse signal separately to a new region can restart the signal transfer in the shift register 207. Although FIG. 6 shows an example of providing the switch 206 by a transistor, the present invention is not limited to this and any of the switches shown in the aforementioned embodiment modes can be used.

Next, a specific operation of the signal line driving circuit shown in this embodiment mode is explained in detail with reference to FIGS. 6 and 7.

FIG. 6 shows an example in which, in a case where one row includes signal lines of n columns (the first to n-th columns), the shift register 207 is provided separately into a region 207*a* including flip-flop circuits in the first to j-th columns and a region 207*b* including flip-flop circuits in the (j+1)-th to n-th columns. In this case, in the shift register 207, signal transfer is started by inputting a first start pulse signal in the region 207*a* and signal transfer is started by inputting a second start pulse signal in the region 207*b*. In other words, in the region 207*a* of the shift register 207, sampling pulses are sequentially outputted to the first latch circuit portion 202 in accordance with the timing of the inputted first start pulse signal, clock signal, and inverted clock signal. On the other hand, in the region 207*b*, sampling pulses are sequentially outputted to the first latch circuit portion 202 in accordance with the timing of the inputted second start pulse signal, clock signal, and inverted clock signal. The second start pulse signal is desirably inputted so that the output of the sampling pulse starts in the region 207*b* immediately after the output of the sampling pulse in the region 207*a* is completed.

In the shift register 207, signal transfer is controlled separately in the region 207*a* and the region 207*b* using transfer controlling signals. Here, for example, a case is considered in which, when video signals are compared in a row and in one row before, the video signals are different only in the second column and the (j+2)-th column in FIG. 6.

First, by inputting a first start pulse signal to the flip-flop circuit 204 provided in the region 207*a*, a sampling pulse is outputted to each of latch circuits in the first latch circuit portion 202, which are electrically connected to the signal lines S1 and S2 in the first and second columns, thereby writing video signals to the first latch circuit portion 202. Then, by turning on the switch 206 using transfer controlling signals, signal transfer in the shift register 207 in and after the third column (here, the third to j-th columns) is stopped, whereby the sampling pulses are not outputted to the latch circuits in the first latch circuit portion 202 which are electrically connected to the signal lines $S_3$ to $S_j$ in the third to j-th columns. Thus, the video signals are not outputted to the video signal lines and the video signals are not written.

Next, by inputting the second start pulse signal to the flip-flop circuits 204 provided in the region 207*b*, a sampling pulse is outputted to each of latch circuits in the first latch circuit portion 202, which are electrically connected to the signal lines $S_{j+1}$ and $S_{j+2}$ in the (j+1)-th column and the (j+2)-th column, thereby writing video signals to the first latch circuit portion 202. Then, by turning on the switch 206 using transfer controlling signals, signal transfer in the shift register 207 in and after the (j+3)-th column (here, the (j+3)-th to n-th columns) is stopped, whereby the sampling pulses are not outputted to the latch circuits in the first latch circuit portion 202, which are electrically connected to the signal lines S(j+3) to Sn in the (j+3)-th to n-th columns. Thus, the video signals are not written.

Figure 7:
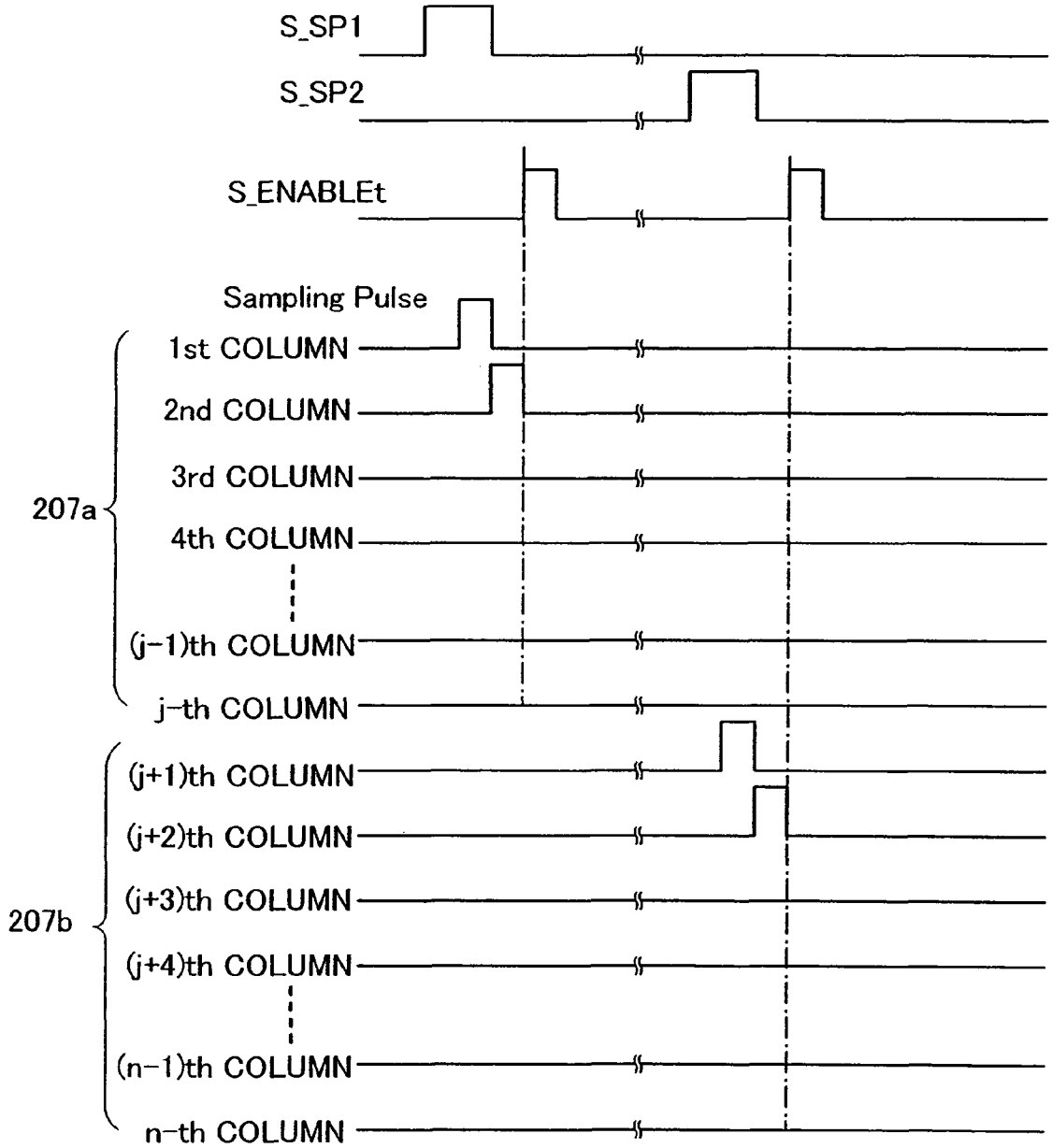
FIG. 7 explains an operation of a signal line driving circuit of a display device of the present invention.

FIG. 7 shows a timing chart at this time.

In the region 207*a* where signal transfer in the shift register 207 is controlled by the input of the first start pulse signal, since video signals in and after the third column are identical with those in one row before, the switch 206 is turned on using a transfer controlling signal to stop the signal transfer in the shift register 207 in and after third column (the third to j-th columns). Thus, the sampling pulses are not outputted to the first latch circuit portion 202. Meanwhile, in the region 207*b* where signal transfer in the shift register 207 is controlled by the input of the second start pulse signal, since video signals in and after the (j+3)-th column are identical with those in one row before, the switch 206 is turned on using a transfer controlling signal to stop the signal transfer in the shift register 207 in and after the (j+3)-th column (the (j+3)-th to n-th columns). Thus, sampling pulses are not outputted to the first latch circuit portion 202.

As a result, video signals to be newly written in the first latch circuit portion 202 in the first, second, (j+1)-th, and (j+2)-th columns are outputted to the signal lines through the second latch circuit portion 203. Then, in the third to j-th columns and the (j+3)-th to n-th columns, the video signals which have been held in the first latch circuit portion 202 in one row before are outputted to the signal lines through the second latch circuit portion 203 with the input of the latch pulse.

In this manner, by using the structure shown in FIG. 6, signal transfer in the shift register 207 is stopped in the third to j-th columns and the (j+3)-th to n-th columns so that the sampling pulses are not outputted to the first latch circuit portion 202, thereby not writing video signals to the first latch circuit portion 202. Thus, charging and discharging of video signals and charging and discharging in the shift register 207 can be omitted; therefore, the power consumption can be reduced.

In the structure shown in FIG. 3, when the switch 206 is turned on by using a transfer controlling signal, signal transfer is stopped in the shift register 207 in and after a certain column in the row, so that the sampling pulses are not outputted to the first latch circuit portion 202. Therefore, all the video signals in that row in and after the certain column need to be identical with those in one row before. Accordingly, in the case shown in the aforementioned embodiment mode, signals need to be transferred in the shift register 207 in the first to (j+2)-th columns to output sampling pulses to the first latch circuit portion 202. However, in the structure shown in this embodiment mode, since the switch 206 can be turned on or off by controlling a transfer controlling signal for each of the divided regions, whether or not signals are transferred in the shift register 207 can be controlled more specifically and whether or not sampling pulses are outputted to the first latch circuit portion can be controlled more specifically. As a result, the power consumption can be reduced more effectively.

Although this embodiment mode shows the structure in which the shift register 207 is divided into two regions and the start pulse signal is inputted to each of the two regions, the present invention is not limited to this structure. The shift register 207 may be divided into three or more regions and the output and the like of the sampling pulses from the regions can be controlled by inputting plural start pulse signals to the regions.

Further, in this embodiment mode, the switch for changing a scanning direction shown in the aforementioned embodiment mode can also be provided. That is, in the structure where the shift register 207 is divided into plural regions, each region (regions 207*a* and 207*b* in FIG. 6) can be provided with the switch for changing a scanning direction so that a scanning direction can be selected for each region. In other words, the structure is that one of the flip-flop circuits located at opposite ends of each region is selected from among serially-connected plural flip-flop circuits and the first start pulse signal and the second start pulse signal are inputted to the selected flip-flop circuit.

For example, in FIG. 6, one of the flip-flop circuits corresponding to the first and j-th columns is selected and the first start pulse signal is inputted to the selected flip-flop circuit in the region 207*a*; on the other hand, one of the flip-flop circuits corresponding to the (j+1)-th and n-th columns is selected and the second start pulse signal is inputted to the selected flip-flop circuit in the region 207*b*.

Figure 8:
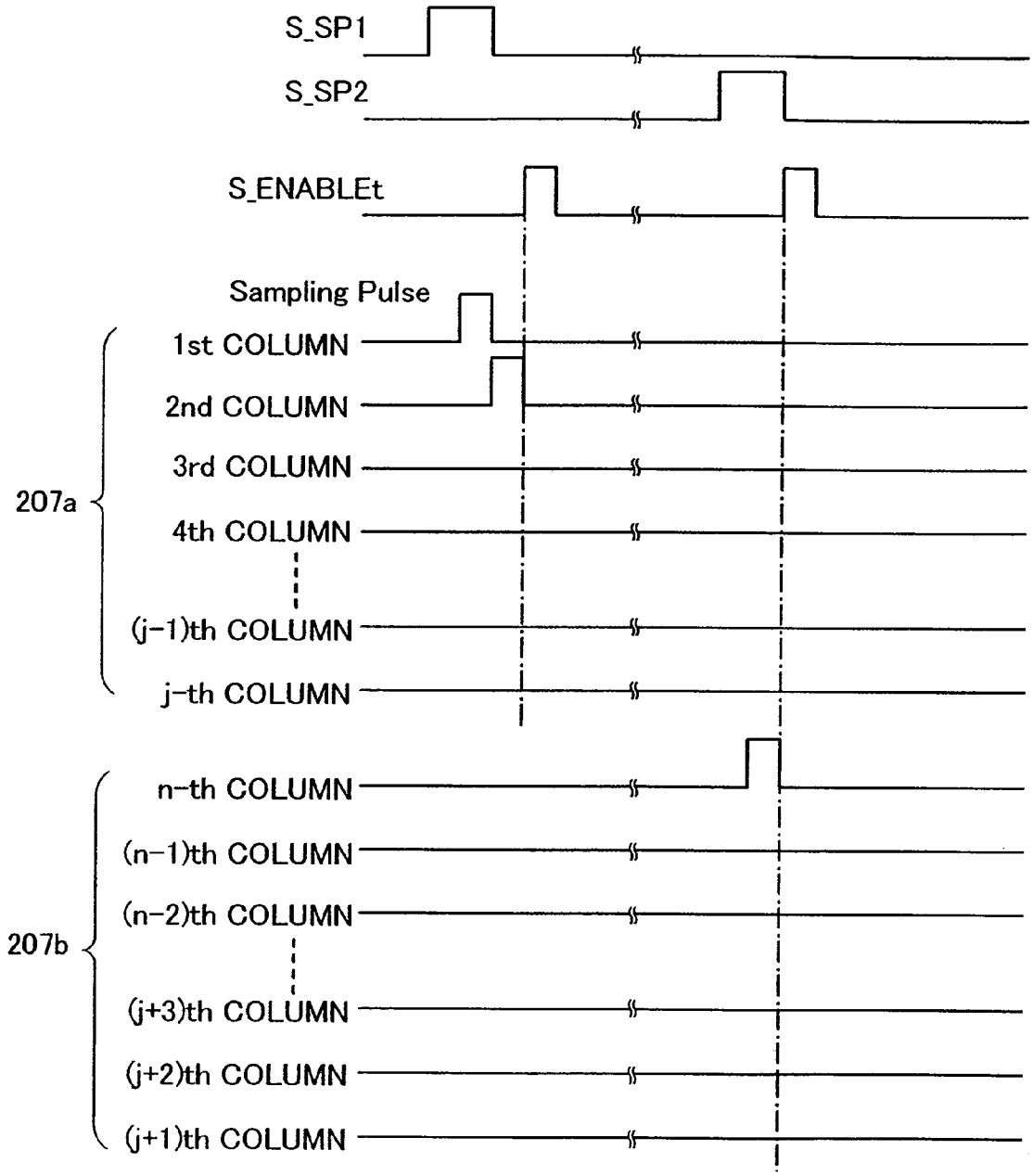
FIG. 8 explains an operation of a signal line driving circuit of a display device of the present invention.

For example, in FIG. 6, a case is considered in which, as a result of comparison with video signals in one row before, video signals are different only in the second column and the n-th column. FIG. 8 shows a timing chart in this case.

In this case, in the region 207*a*, the first start pulse signal is inputted to the flip-flop circuit corresponding to the first column and sampling pulses are outputted from the flip-flop circuits 204 in the first column and the second column, thereby writing video signals in the first latch circuit portion 202. Then, by turning on the switch 206 using a transfer controlling signal, signal transfer in the shift register 207 in and after the third column (here, the third to j-th columns) is stopped, whereby sampling pulses are not outputted to the first latch circuit portion 202. Thus, the video signals are not written in the first latch circuit portion 202.

On the other hand, in the region 207*b*, the second start pulse signal is inputted to the flip-flop circuit corresponding to the n-th column and a sampling pulse is outputted from the flip-flop circuit in the n-th column, thereby writing video signals in the first latch circuit portion 202. Then, by inputting a transfer controlling signal, signal transfer in the shift register 207 in and after the (n−1)-th column (here, the (n−1)-th to (j+1)-th columns) is stopped, whereby the sampling pulses are not outputted to the first latch circuit portion 202. Thus, the video signals are not written in the first latch circuit portion 202.

In this manner, by controlling the scanning direction in the shift register 207 for each region, signal transfer in the shift register 207 in the third to (n−1)-th columns is stopped so as not to output sampling pulses to the first latch circuit portion 202. Thus, video signals are not written in the first latch circuit portion 202. In other words, even if video signals are different from those in one row before only in columns located at opposite ends of a pixel row, signal transfer is stopped in the shift register 207 at an early stage by dividing the shift register 207 into plural regions and controlling a scanning direction for each region. Thus, since the output of the sampling pulse to the first latch circuit portion 202 can be more effectively reduced, the power consumption can be reduced effectively.

This embodiment mode can be combined with the above embodiment mode. For example, this embodiment mode can be combined with the structure shown in FIG. 76 in which plural latch circuits are provided to one signal line. In other words, the present invention can employ all the structures in which the structure shown in this embodiment mode is combined with the structure shown in the above embodiment mode.

Embodiment Mode 3

Embodiment Mode 3 will describe an example of a display device having a different signal line driving circuit from that shown in the above embodiment mode, with reference to drawings. Specifically, a display device having a different pulse output circuit from that shown in the above embodiment mode is explained in detail.

Figure 9:
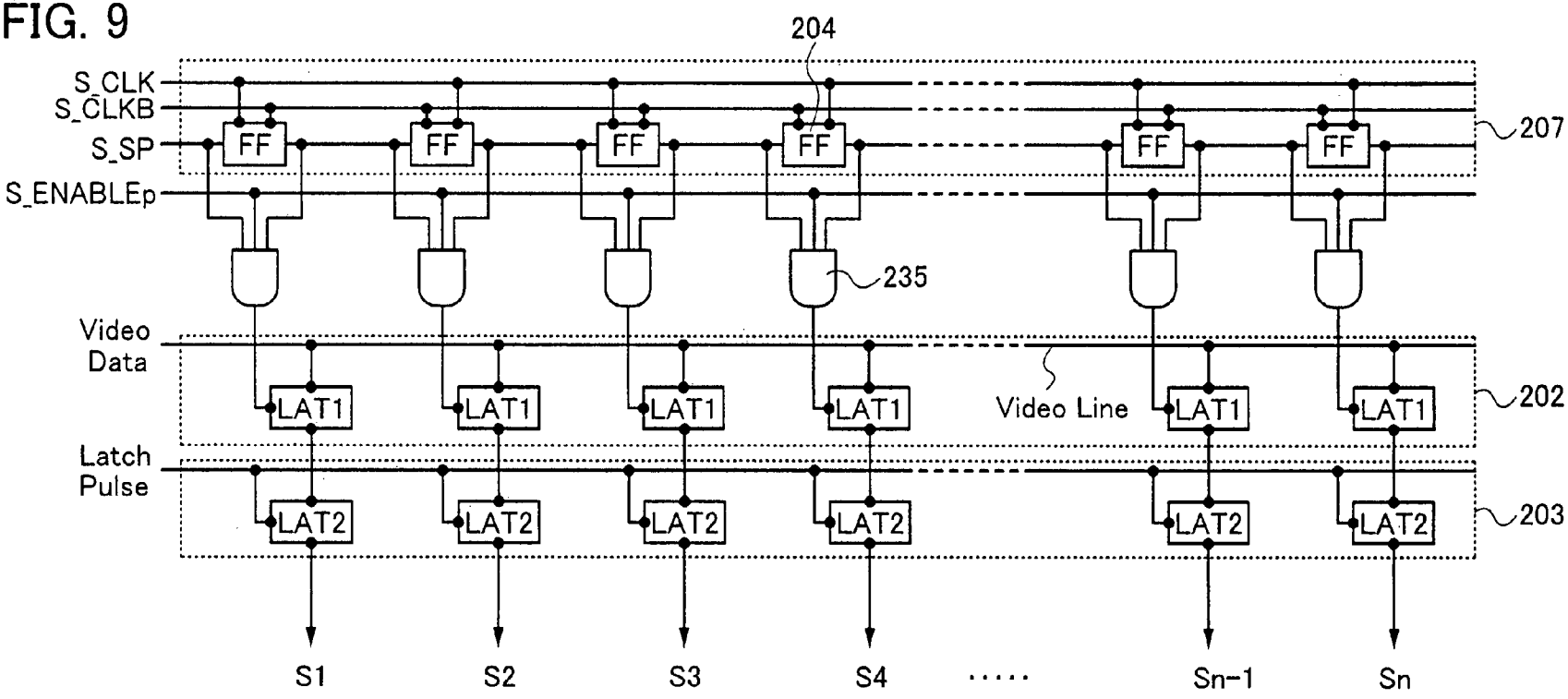
FIG. 9 shows a structure example of a signal line driving circuit of a display device of the present invention.

FIG. 9 is a schematic view of the signal line driving circuit of the display device shown in this embodiment mode.

The pulse output circuit shown in this embodiment mode has the shift register 207 formed by using plural stages of flip-flop circuits 204 and the like, and AND gates 235 each having three input terminals. The input terminals of the AND gate 235 are connected to an input terminal and an output terminal of the flip-flop circuit 204 and a wire through which a sampling controlling signal is inputted to the AND gate 235. Although the AND gates 235 are used here in this example, the present invention is not limited to this. Any structure may be employed as long as the circuit can function similarly. For example, an OR gate, a NAND gate, a NOR gate, an XOR gate, a NOT gate, or the like may be used alone or in combination.

The flip-flop circuits 204 sequentially output sampling pulses to the first latch circuit portion 202 in accordance with the timing of the input of plural start pulse signals (S_SP), clock signals (S_CLK), and inverted clock signals (S_CLKB). A video signal is inputted to the first latch circuit portion 202, and the video signal is inputted and held in each stage in accordance with the timing of the input of each of the sampling pulses outputted from the pulse output circuit 201. In other words, the latch circuit of each stage of the first latch circuit portion 202 operates based on each of the sampling pulses outputted from the pulse output circuit 201. When the video signal holding is completed to the last stage in the first latch circuit portion 202, a latch pulse (Latch Pulse) is inputted to the second latch circuit portion 203 in a horizontal flyback period, and the video signals held in the first latch circuit portion 202 are simultaneously transferred to the second latch circuit portion 203. After that, the video signals held in the second latch circuit portion 203 for one row are outputted to the signal lines S1 to Sn.

In this embodiment mode, a sampling controlling signal (S_ENABLEp) is inputted to the AND gate 235, and the output of the sampling pulse from the AND gate 235 to the first latch circuit portion 202 is controlled based on the level of the sampling controlling signal. In other words, signal transfer is conducted in all the columns in the shift register 207 and the signals are inputted to the AND gates 235 by controlling the level of the sampling controlling signals, whereby the outputs of the sampling pulses to the first latch circuit portion 202 are controlled.

Figure 20:
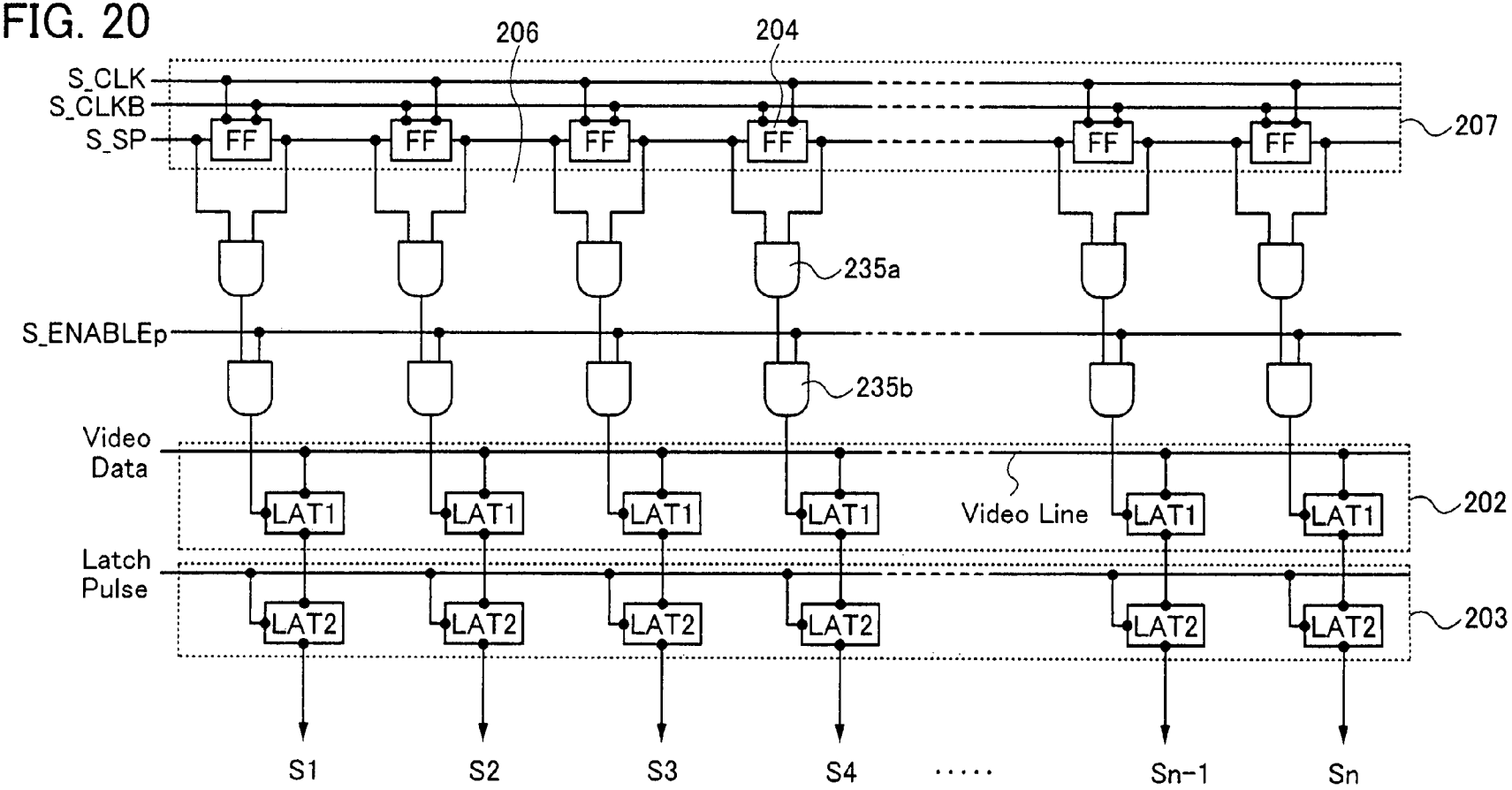
FIG. 20 explains a structure example of a signal line driving circuit of a display device of the present invention.

The circuit structure shown in this embodiment mode is not limited to that shown in FIG. 9 and a structure shown in FIG. 20 may be used. In FIG. 20, two AND gates 235*a* and 235*b* each having two input terminals are provided instead of the AND gate 235 having three input terminals shown in FIG. 9. The input terminals of the AND gate 235*a* are connected to an input terminal and an output terminal of the flip-flop circuit 204, while the input terminals of the AND gate 235*b* are connected to an output terminal of the AND gate 235*a* and a wire through which a sampling controlling signal is inputted to the AND gate 235*a*. Although the AND gate is used in this example, the present invention is not limited to this. Any structure may be employed as long as the circuit can function similarly. For example, an OR gate, a NAND gate, a NOR gate, an XOR gate, a NOT gate, or the like may be used alone or in combination.

Figure 21:
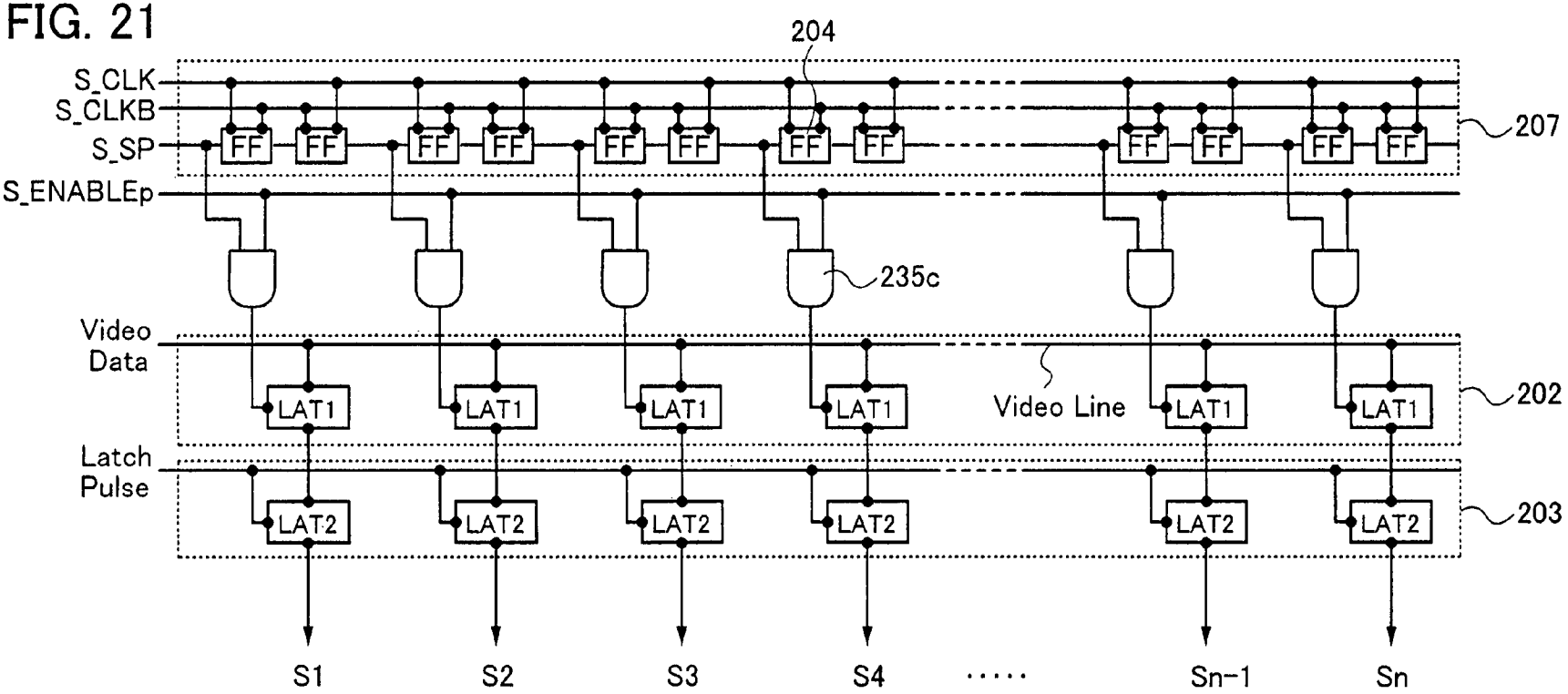
FIG. 21 explains a structure example of a signal line driving circuit of a display device of the present invention.

Moreover, in the structure shown in FIG. 9, using the AND gates 235 each having three input terminals can prevent sampling pulses in the columns from overlapping with each other. If such overlapping does not have to be avoided, the AND gate 235 is not necessarily provided to have three input terminals. For example, as shown in FIG. 21, the sampling pulse to be outputted to one signal line may be generated from plural flip-flop circuits 204 (here, two). In this case, an AND gate 235*c* is not necessarily provided with three input terminals and the input terminals of the AND gate 235*c* are connected to an output portion of the flip-flop circuit and a wire through which a sampling controlling signal is inputted to the AND gate 235*c*.

Figure 10:
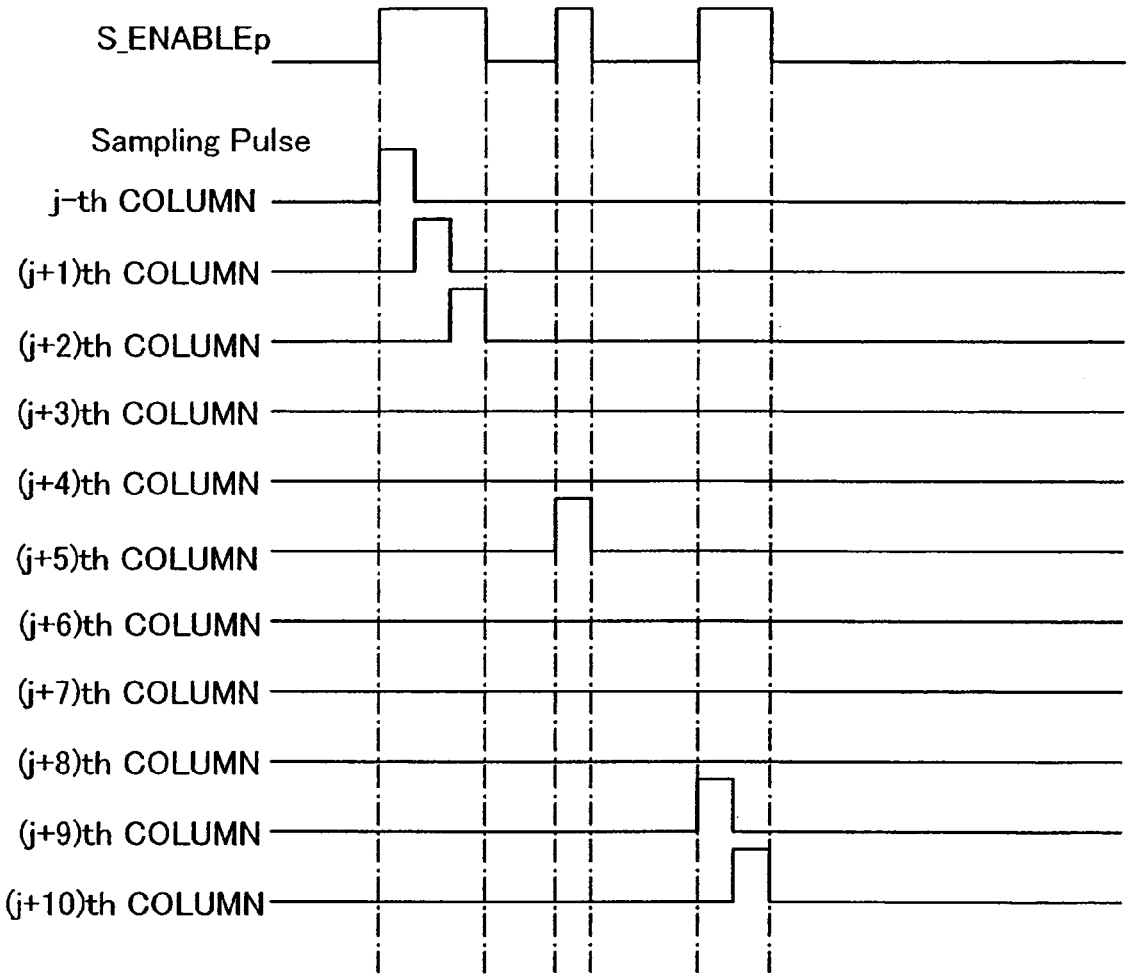
FIG. 10 explains an operation of a signal line driving circuit of a display device of the present invention.

An example of a timing chart of the signal line driving circuit shown in FIG. 9 is shown in FIG. 10.

FIG. 10 shows a case where video signals to be newly written in the (j+3)-th column, the (j+4)-th column, and the (j+6)-th to (j+8)-th columns among the j-th to (j+10)-th columns in a certain row are identical with those already written in pixels in one row before.

In FIG. 10, since the video signals to be newly written in the (j+3)-th column, the (j+4)-th column, and the (j+6)-th to (j+8)-th columns are identical with those in one row before, the sampling controlling signals are turned off so that sampling pulses are not outputted from the AND gates 235 to the first latch circuit portion 202. At this time, the video signals are not inputted to video signal lines. On the other hand, since video signals to be newly written in the j-th to (j+2)-th columns, the (j+5)-th column, the (j+9)-th column, and the (j+10)-th column are different from those in one row before, the sampling controlling signals are turned on so that sampling pulses are outputted from the AND gates 235 to the first latch circuit portion 202. Thus, the video signals are written in the first latch circuit portion 202. It is to be noted that, in the structure shown in FIG. 9, since signal transfer is conducted in all the columns, the outputs of the sampling pulses to the first latch circuit portion 202 are controlled by inputting sampling controlling signals to the AND gates 205.

Then, video signals to be newly written in the first latch circuit portion 202 are outputted through the second latch circuit portion 203 in the j-th to (j+2)-th columns, the (j+5)-th column, the (j+9)-th column, and the (j+10)-th column, and the video signals which have been held by the first latch circuit portion 202 in one row before in the (j+3)-th column, the (j+4)-th column, and the (j+6)-th to (j+8)-th columns are outputted to the signal lines through the second latch circuit portion 203.

In this manner, the output of the sampling pulse to the first latch circuit portion 202 can be stopped just in the necessary column by controlling the turning on/off of the sampling controlling signal. That is to say, the power consumption can be reduced by selectively writing the video signal only in the necessary column (here, the column in which the video signal is different from that in one row before). Moreover, when the video signal is identical with that in one row before, reduction in power consumption can be achieved by not inputting the video signal to the video signal line.

In addition, the structure of the present invention can be combined with the structure shown in any of the above embodiment modes.

Figure 11:
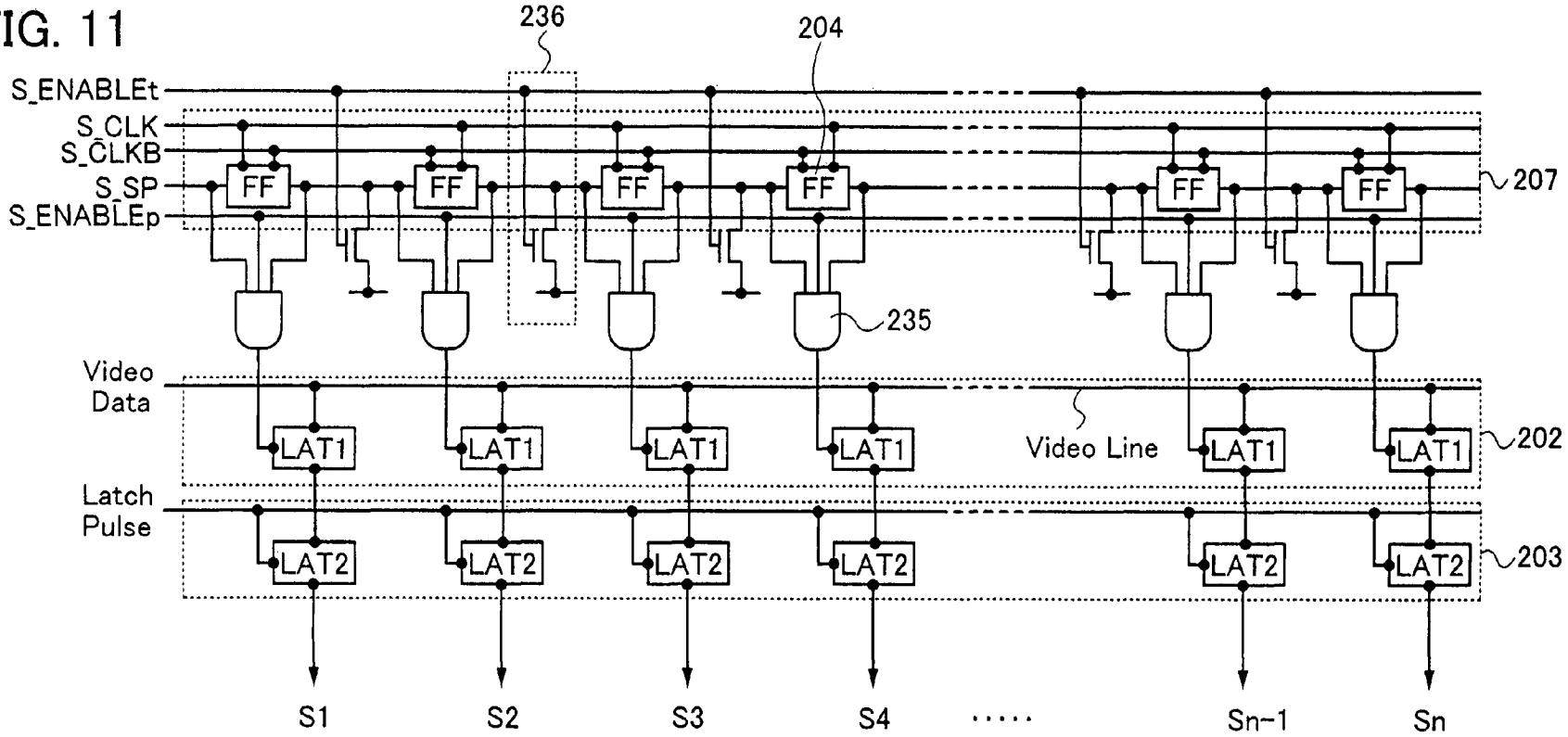
FIG. 11 shows a structure example of a signal line driving circuit of a display device of the present invention.

For example, as shown in FIG. 11, an input portion of the flip-flop circuit 204 may be provided with a switch 236 for initializing a signal and the switch 236 may be controlled by using a transfer controlling signal (S_ENABLEt). In this case, the output of the sampling pulse to the first latch circuit portion 202 can be controlled by using the transfer controlling signal and the sampling controlling signal. In addition, each of the structures shown in FIGS. 20 and 21 may be provided with a transfer controlling signal. Although FIG. 11 shows the example in which the switch 236 is a transistor, the present invention is not limited to this, and any of the switches shown in the above embodiment modes can be used.

Figure 12:
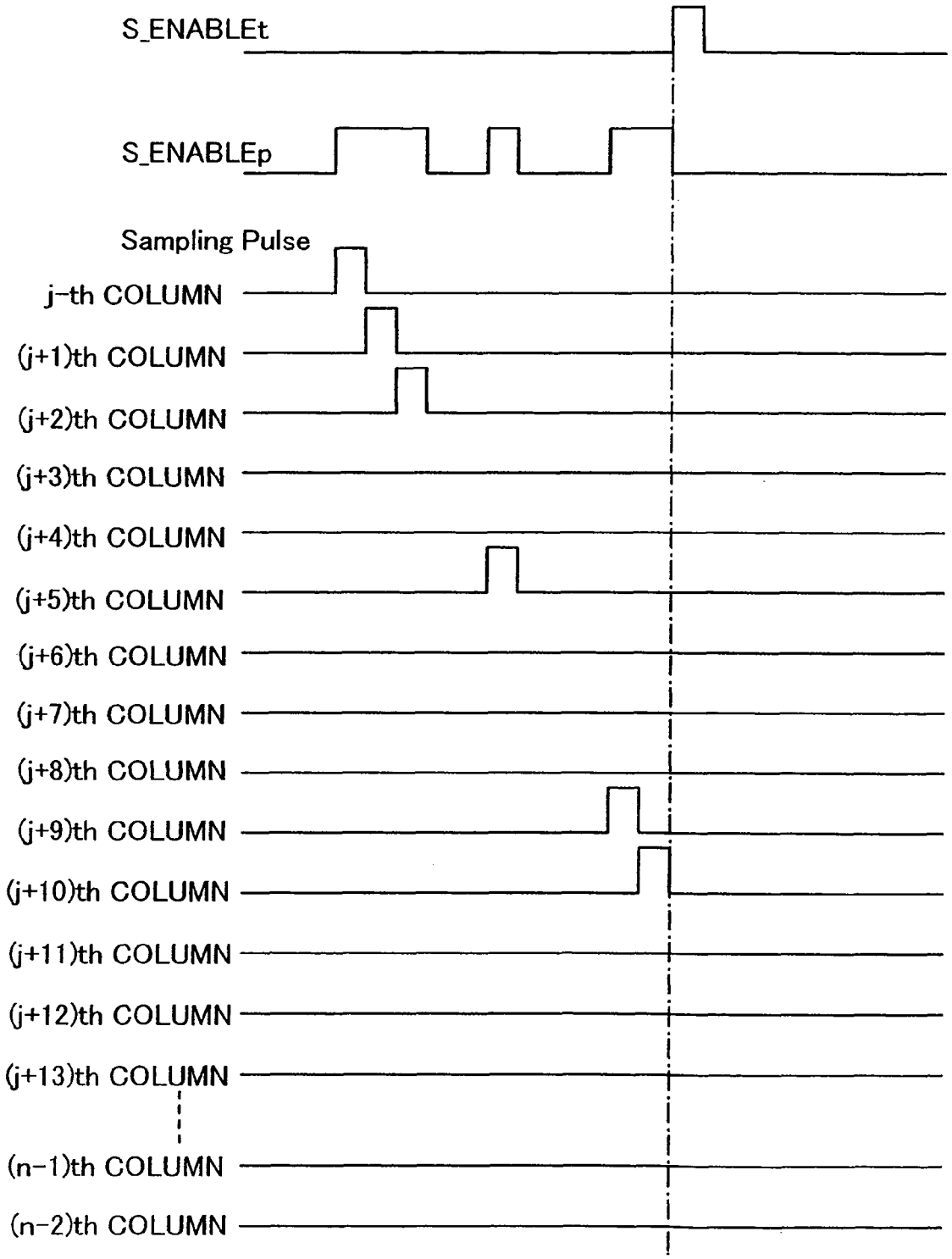
FIG. 12 explains an operation of a signal line driving circuit of a display device of the present invention.

FIG. 12 shows a timing chart at this time.

FIG. 12 shows a case where video signals to be newly written in the (j+3)-th column, the (j+4)-th column, the (j+6)-th to (j+8)-th columns, and the (j+11)-th to n-th columns among the j-th to n-th columns are identical with those in one row before.

In FIG. 12, since video signals to be newly written in the (j+3)-th column, the (j+4)-th column, the (j+6)-th to (j+8)-th columns, and the (j+11)-th to n-th columns are identical with those in one row before, the sampling controlling signals are turned off so as not to output the sampling pulses from the AND gates 235 to the first latch circuit portion 202. On the other hand, since video signals to be written in the j-th to (j+2)-th columns, the (j+5)-th column, the (j+9)-th column, and the (j+10)-th column are different from those in one row before, the sampling controlling signals are turned on to output the sampling pulses from the AND gates 235 to the first latch circuit portion 202. Thus, the video signals are written in the first latch circuit portion 202. Here, since all the video signals to be newly written in and after the (j+11)-th column are identical with those in one row before, the switch 236 is turned on by using the transfer controlling, signal so as to stop the signal transfer in the shift register 207 in and after the (j+11)-th column.

In this way, when the transfer controlling signal and the sampling controlling signal are used, signal transfer in the shift register and the output of the sampling pulse to the first latch circuit portion are controlled to allow a video signal to be selectively written only in the necessary column; thus, the power consumption can be reduced.

In other words, if the output of the sampling pulse is controlled by using the transfer controlling signal, the video signals to be newly written in and after a certain column need to be identical with the video signals already written in pixels in one row before. If the output of the sampling pulse is controlled by using the sampling controlling signal, the output of the sampling pulse can be controlled for each column but the signal transfer needs to be conducted in the shift register with respect to all the columns. Therefore, various images can be displayed flexibly by using both the transfer controlling signal and the sampling controlling signal to control the output of the sampling pulse; thus, the power consumption can be reduced more effectively.

Moreover, as shown in the above embodiment mode, the structure shown in FIG. 11 may be provided with a switch for changing a scanning direction or the shift register may be divided into plural regions to which plural start pulse signals may be inputted respectively. Further, the shift register 207 may be divided into plural regions and a scanning direction may be controlled for each of the regions.

This embodiment mode can be freely combined with the above embodiment mode. That is to say, the present invention can employ all the structures formed by combining the structure shown in this embodiment mode and the structure shown in any of the above embodiment modes.

Embodiment Mode 4

Embodiment Mode 4 will describe an example of a different display device from that in the above embodiment mode, with reference to drawings. Specifically, this embodiment mode will explain an operation method in plural rows for a certain period, and particularly explain an operation method in cases including a case where video signals to be newly written in a row and video signals already written in one row before are identical in all the columns.

Figure 13:
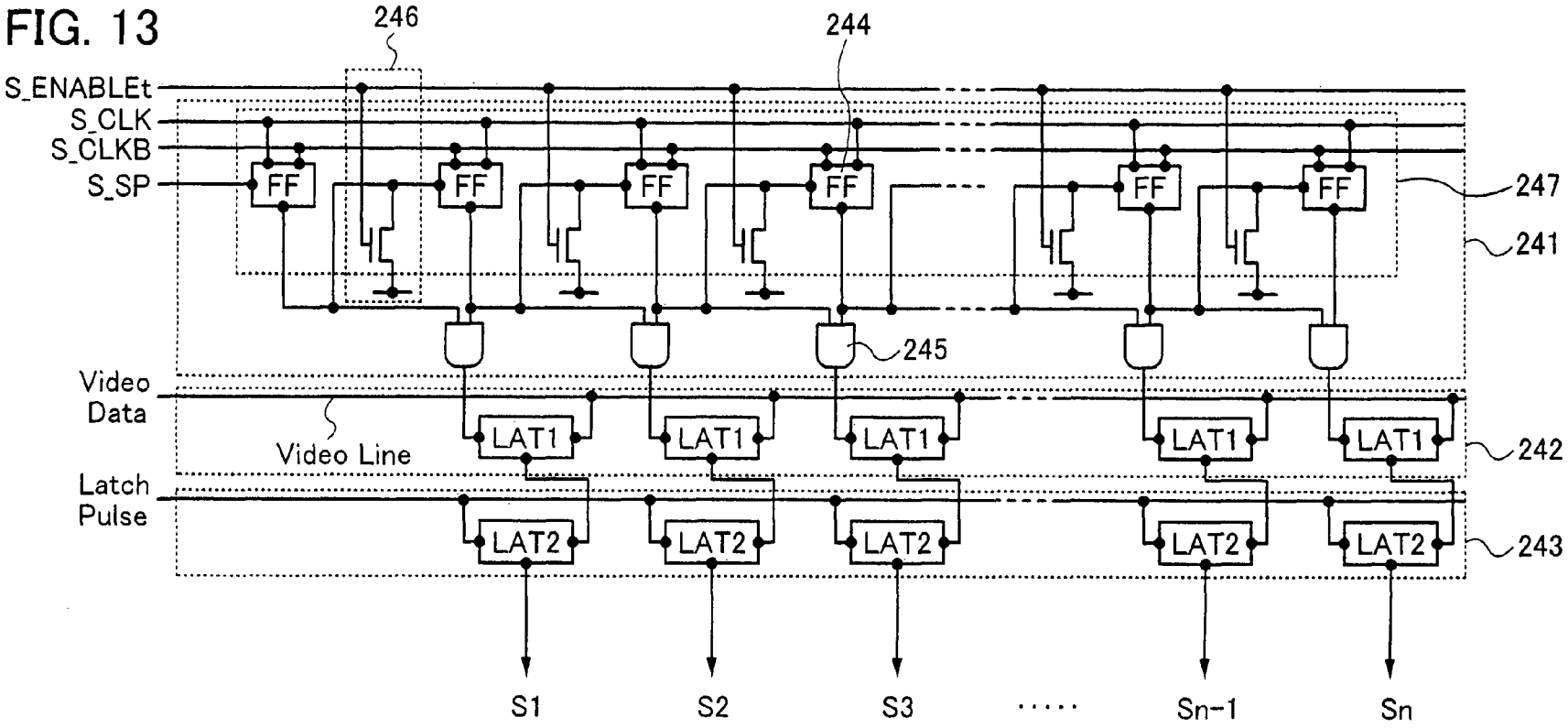
FIG. 13 shows a structure example of a signal line driving circuit of a display device of the present invention.

FIG. 13 shows an example of a signal line driving circuit of a display device shown in this embodiment mode.

The signal line driving circuit shown in FIG. 13 has a pulse output circuit 241, a first latch circuit portion 242, and a second latch circuit portion 243. The pulse output circuit 241 has a shift register 247 formed by using plural stages of flip-flop circuits 244, and AND gates 245. Two input terminals of the AND gate 245 are connected to output terminals of the adjacent flip-flop circuits 244. In other words, one redundant flip-flop circuit 244 is provided with respect to the AND gates 245 and the outputs of the adjacent flip-flop circuits 244 are inputted to the AND gates 245 in each stage provided corresponding to the signal lines S1 to Sn.

Moreover, in the pulse output circuit 241, an input portion of the flip-flop circuit 244 is provided with a switch 246 for initializing a signal and the switch 246 is controlled by a transfer controlling signal (S_ENABLEt). Then, even if a start pulse signal is inputted and signals are sequentially transferred from the flip-flop circuits 244 to the first latch circuit portion 242, in a case where signals in and after a certain column are identical with those in one row before, the transfer controlling signal is turned on to stop the signal transfer in the shift register 247 so that the sampling pulses are not outputted to the first latch circuit portion in and after the certain column. Although the switch 246 is a transistor in FIG. 13, the present invention is not limited to this and any of the switches shown in the above embodiment modes can be used.

Here, an operation of the signal line driving circuit shown in FIG. 13 is explained with reference to FIG. 14.

Figure 14:
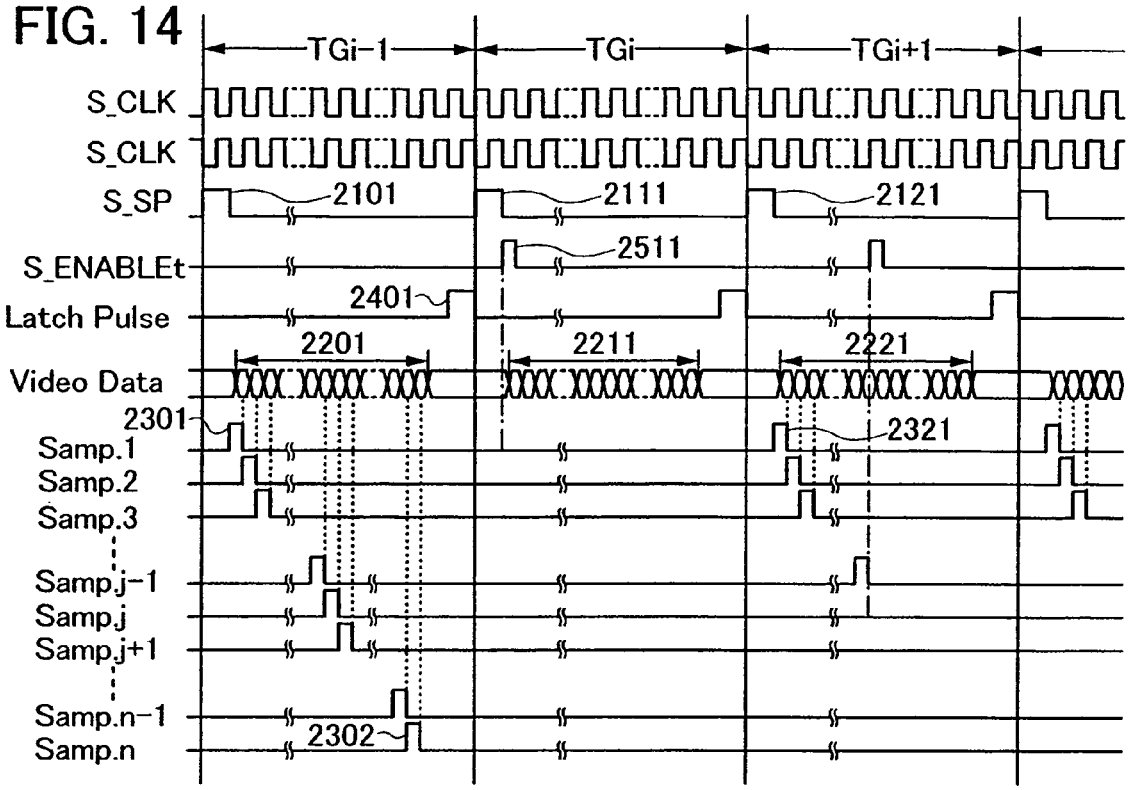
FIG. 14 explains an operation of a signal line driving circuit of a display device of the present invention.

FIG. 14 shows periods (here, $T_{Gi-1}$, $T_{Gi}$, and $T_{Gi+1}$) in which the first latch circuit portion 242 of the signal line driving circuit hold video signals that are inputted to the pixels in the (i−1)-th row, the i-th row, and the (i+1)-th row. In other words, each of $T_{Gi-1}$, $T_{Gi}$, and $T_{Gi+1}$ corresponds to one gate selection period.

First, an operation during $T_{Gi-1}$ is explained.

A clock signal (S_CLK) and an inverted clock signal (S_CLKB) are inputted to the flip-flop circuit 244 of the shift register 247, and a start pulse signal (S_SP) is inputted to the first stage of the flip-flop circuit 244. In FIG. 14, a pulse 2101 corresponds to a start pulse of $T_{Gi-1}$.

This pulse 2101 is delayed by one pulse of a clock signal when inputted to the flip-flop circuit 244 in the next stage. Therefore, the output of the AND gate 245 in the first column to which the outputs of the redundant flip-flop circuit 244 in the first stage and the flip-flop circuit 244 in the next stage are inputted corresponds to a pulse of the clock signal as shown by a pulse 2301 in FIG. 14. The pulse 2301 is inputted as a sampling pulse Samp. 1 to a latch circuit in the first latch circuit portion 242 that corresponds to a pixel in the first column. In a similar manner, the output of the AND gate 245 in the n-th column is inputted to a latch circuit in the first latch circuit portion 242 that corresponds to a pixel in the n-th column as a sampling pulse Samp. n as shown by a pulse 2302 in FIG. 14.

In the $T_{Gi-1}$, video signal data 2201 is inputted to the first latch circuit portion 242 and a video signal is held in each stage of the first latch circuit portion corresponding to each pixel column in accordance with the timing of the input of the sampling pulse. It is to be noted in FIG. 14 that the timing at which the sampling pulse is inputted means the timing at which the sampling pulse falls from an H level to an L level. At this time, the video signal inputted to the first latch circuit portion 242 is held in each stage of the first latch circuit portion 242.

When the video signal holding is completed to the last stage in the first latch circuit portion 242, a latch pulse (Latch Pulse) 2401 is inputted to the second latch circuit portion 243 in a horizontal flyback period, and the video signals held in the first latch circuit portion 242 are simultaneously transferred to the second latch circuit portion 243. Thereafter, the video signals held in the second latch circuit portion 243 for one row are simultaneously outputted to the signal lines.

It is to be noted that an input portion of the flip-flop circuit 244 is provided with the switch 246 for initializing a signal. The switch 246 is controlled by a transfer controlling signal. Therefore, signal transfer in the shift register 247 is controlled based on the level of the transfer controlling signal, and a sampling pulse outputted to the first latch circuit portion 242 is controlled.

In a case where video signals in and after a certain column are identical with those in one row before, the transfer controlling signal is set at an H level in those columns and at an L level in other cases. That is to say, when the transfer controlling signal is at an L level, the switch 246 for initializing the signal, which is provided to the input portion of the flip-flop circuit 244, is turned off. Therefore, the signal is transferred in the shift register 247 so that a sampling pulse is outputted to the first latch circuit portion 242 to write a video signal. When the transfer controlling signal is at an H level, the switch 246 for initializing the signal, which is provided to the input portion of the flip-flop circuit 244, is turned on. Therefore, the signal transfer is stopped in the shift register 247 so that a sampling pulse is not outputted to the first latch circuit portion 242. Thus, a video signal is not written in the first latch circuit portion 242. Since the video signal is not written, it is not necessary to input the video signal to a video signal line (Video Line). Therefore, the supply of the video signal may be stopped. As a result, the power consumption can be reduced further.

In this example, during $T_{Gi-1}$, the video signals are different from those in one row before ((i−2)-th row) in all the columns, or the video signals are different in at least the first column and the n-th column. Therefore, new video signals are written in the first latch circuit portion 242 in such a way that signal transfer is conducted in the shift register 247 in all the columns to output sampling pulses to the first latch circuit portion 242; accordingly, the transfer controlling signal is at an L level.

Next, an operation during $T_{Gi}$ is explained. A case is shown in which, during $T_{Gi}$, video signals are identical with those already written in pixels in one row before ((i−1)-th row) in all the columns of a pixel row to which writing is newly conducted.

First, a clock signal (S_CLK) and an inverted clock signal (S_CLKB) are inputted to the flip-flop circuit 244 of the shift register 247, and a start pulse signal (S_SP) is inputted to the flip-flop circuit 244 in the first stage. In FIG. 14, a pulse 2111 corresponds to a start pulse of $T_{Gi}$.

At the same time as the output of the pulse from the redundant flip-flop circuit 244 in the first stage, the transfer controlling signal is set at an H level and the switch for initializing the signal, which is provided to the input portion of the flip-flop circuit 244, is turned on; therefore, the signal is not transferred to the flip-flop circuit in the next stage. Accordingly, since the signal transfer is stopped in the shift register 247, sampling pulses are not outputted to the first latch circuit portion 242 in all the columns so that video signals are not written. Since the video signal is not written, it is not necessary to input the video signal to the video signal line (Video Line). Thus, the supply of the video signal may be stopped. As a result, the power consumption can be reduced further.

Thus, the video signals held in the first latch circuit portion 242 in one row before ((i−1)-th row) are transferred simultaneously to the second latch circuit portion 243 and the video signals for one row held in the second latch circuit portion 243 are simultaneously outputted to the signal lines. In other words, the video signals that are identical with those in one row before are outputted.

Next, an operation during $T_{Gi+1}$ is explained. It is to be noted that a case is shown in which, during $T_{Gi+1}$, the video signals are identical with those in one row before (the i-th row) in and after the j-th column.

First, a clock signal (S_CLK) and an inverted clock signal (S_CLKB) are inputted to the flip-flop circuit 244 in the shift register 247 and a start pulse signal (S_SP) is inputted to the flip-flop circuit 244 in the first stage. In FIG. 14, a pulse 2121 corresponds to a start pulse of $T_{Gi+1}$.

Then, the AND gate 245 in the first column to which the outputs of the redundant flip-flop circuit 244 in the first stage and the flip-flop circuit 244 in the next stage are inputted outputs a clock signal corresponding to one pulse as shown by a pulse 2321 in FIG. 14. The pulse 2321 is inputted as a sampling pulse Samp. 1 to a latch circuit in the first latch circuit portion 242 that corresponds to a pixel in the first column. In accordance with the timing of the input of the sampling pulse Samp. 1, a video signal is written in the latch circuit of the first latch circuit portion 242 that corresponds to the pixel in the first column.

In a similar manner, signals are transferred by the shift register 247 up to the (j−1)-th column to input sampling pulses to the first latch circuit portion 242 corresponding to the respective pixels, thereby writing video signals.

Then, at the same time as the output of the sampling pulse from the (j−1)-th column, the transfer controlling signal is set at an H level and the switch for initializing the signal, which is provided to the input portion of the flip-flop circuit 244, is turned on; therefore, the signal is not transferred to the flip-flop circuit in the next stage. Accordingly, signal transfer in the shift register 247 is stopped in and after the (j−1)-th column; thus, the sampling pulses are not outputted to the first latch circuit portion 242 in and after the j-th column, thereby not writing the video signals. Moreover, since the video signals are not written in and after the j-th column, it is not necessary to write the video signal in the video signal line (Video Line). Therefore, the supply of the video signals may be stopped in and after the j-th column. As a result, the power consumption can be reduced further.

Accordingly, the video signals held in the first latch circuit portion 242 in one row before (the i-th row) in and after the j-th column are simultaneously transferred to the second latch circuit portion 243 at the same time as the input of the latch pulse, and the video signals held in the second latch circuit portion 243 for one row are simultaneously outputted to the signal lines. In other words, the video signals that are identical with those in one row before are outputted.

As shown in $T_{Gi}$ in FIG. 14, if the video signals are identical with those in one row before in all the columns of the pixel row to which writing is conducted, the transfer controlling signal is set at an H level at the same time as the output of the pulse from the flip-flop circuit 244 in the first stage to stop the signal transfer in the shift register 247. Thus, the sampling pulses are not outputted to the first latch circuit portion so as not to write the video signals in the first latch circuit portion. Therefore, if the video signals are identical with those written in pixels in one row before in all the columns of the pixel row to which writing is conducted, a start pulse signal is not necessarily inputted.

Figure 15A:
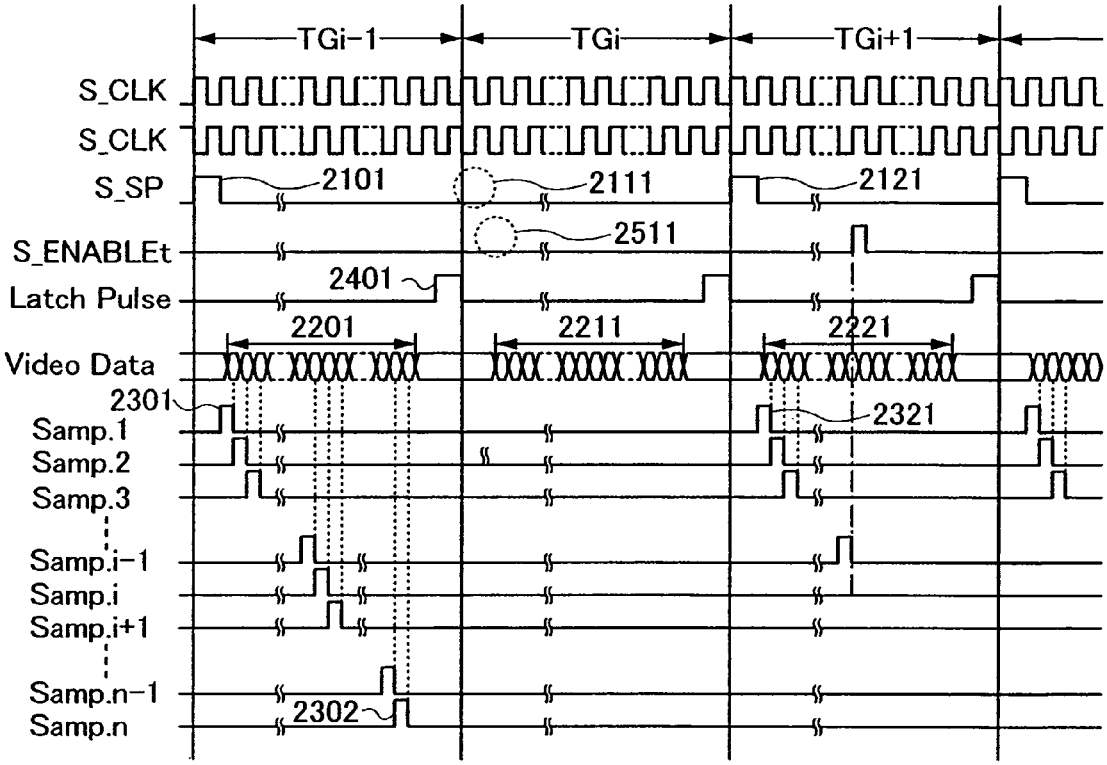
FIGS. 15A and 15B each explain an operation of a signal line driving circuit of a display device of the present invention.

In other words, as shown in FIG. 15A, the start pulse signal is not inputted to the signal line driving circuit during $T_{Gi}$. This is because the shift register does not transfer signals during $T_{Gi}$ so as not to output the sampling pulses to the first latch circuit portion; therefore, the start pulse signal does not need to be inputted originally. In addition, if the pulse 2111 of the start pulse signal is not inputted, the sampling pulse is not outputted to the first latch circuit portion 242; therefore, a video signal 2211 is not written in the first latch circuit portion. Therefore, the power consumption can be reduced by omitting charging and discharging of the first latch circuit portion 242. In this case, a pulse 2511 of the transfer controlling signal may or may not be outputted. If the video signal is not written, it is not necessary to input the video signal to the video signal line (Video Line). Thus, the supply of the video signal may be stopped. Accordingly, the power consumption can be reduced further.

Moreover, if the video signals are identical with those written in pixels in one row before in all the columns of the pixel row to which writing is conducted, the video signal is not necessarily inputted to the signal line driving circuit.

Figure 15B:
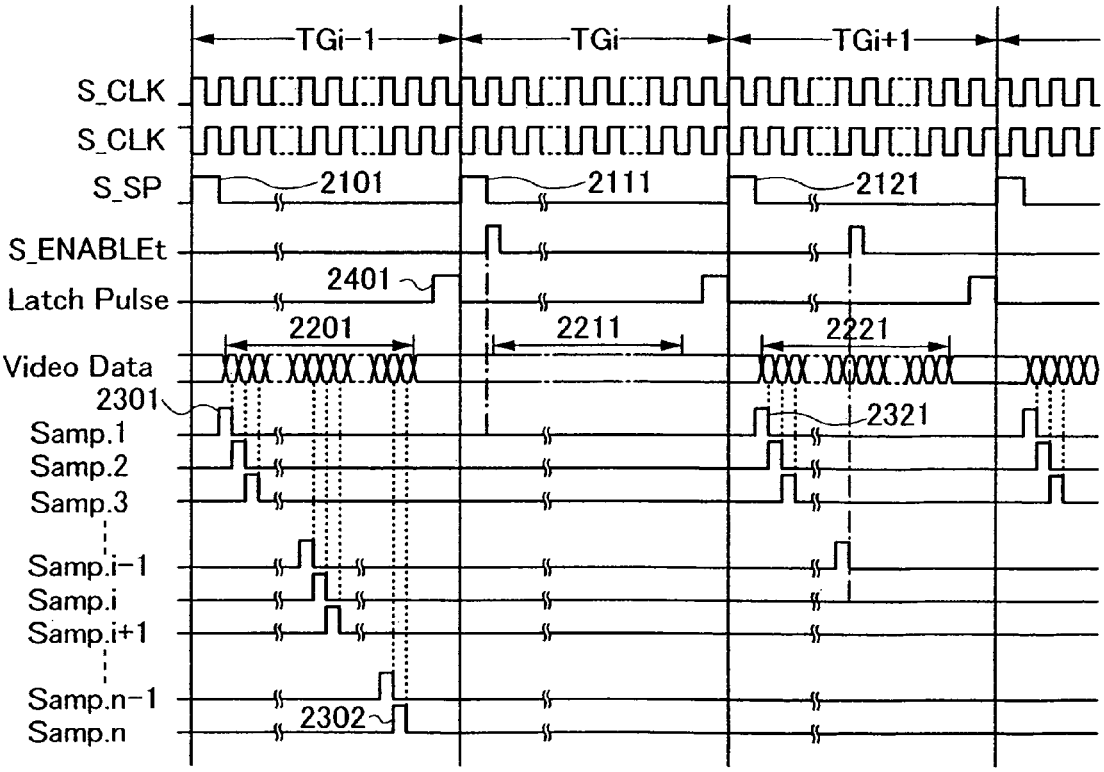

In other words, as shown in FIG. 15B, the video signal 2211 is not inputted to the signal line driving circuit during $T_{Gi}$. This is because the video signal inputted during $T_{Gi}$ is not written in the first latch circuit portion 242; therefore, the video signal does not need to be inputted originally. When the video signal input is stopped, charging and discharging of the video line can be omitted; therefore, the power consumption can be reduced. Thus, during $T_{Gi}$, the potential at which the power consumption to the video line is low (for example, only an L-level signal) is inputted or the first latch circuit portion is put in a floating state. This is particularly effective in a case where a connection terminal to which signals are inputted from the outside and a signal line driving circuit are provided with a pixel portion interposed therebetween. An example of a structure in this case is shown in FIG. 16.

Figure 16:
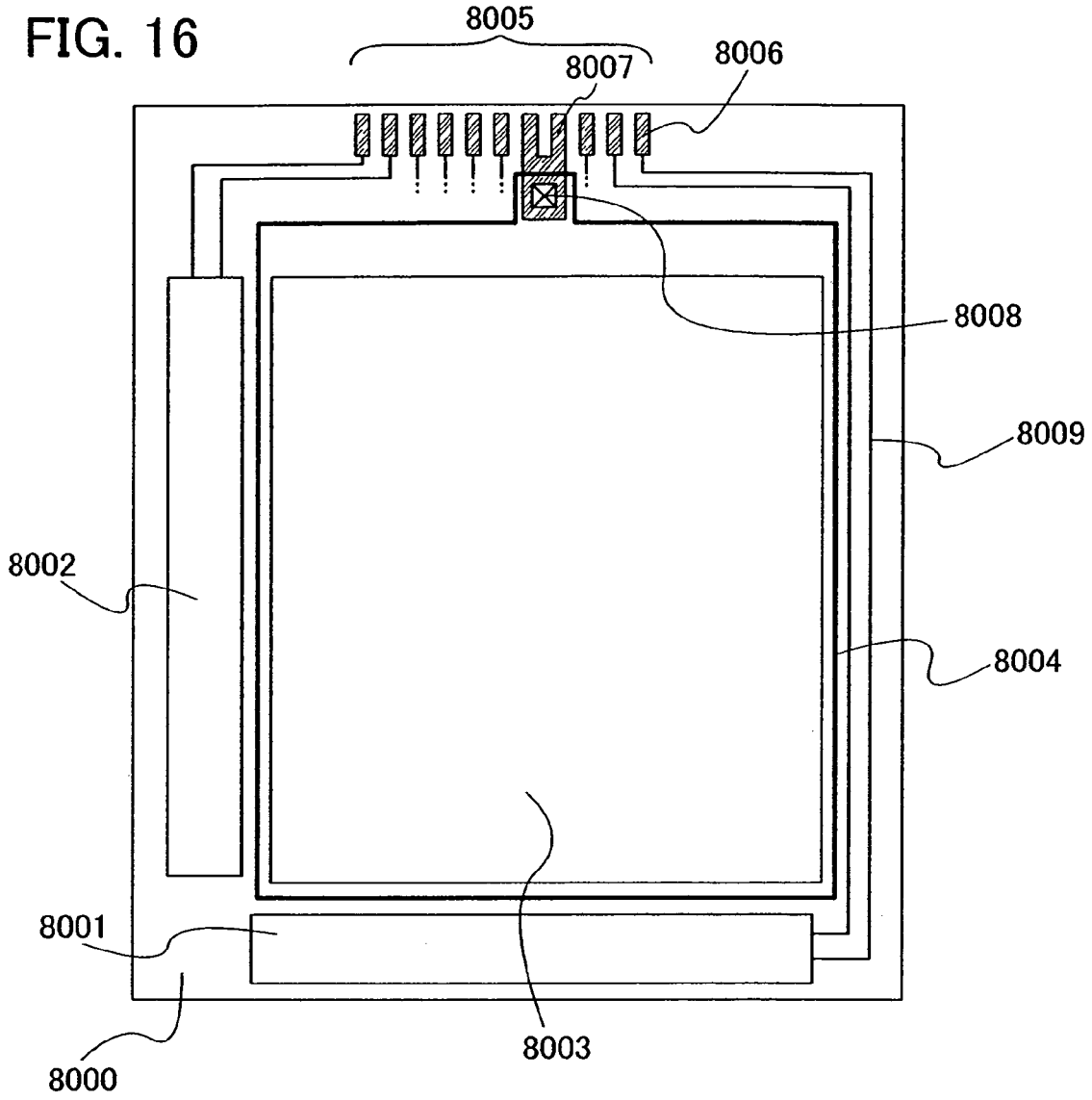
FIG. 16 shows a structure example of a display device of the present invention.

In FIG. 16, a signal line driving circuit 8001, a scan line driving circuit 8002, a pixel portion 8003, and a connection terminal portion 8005 are provided over a substrate 8000. Over the pixel portion 8003, an opposite electrode 8004 is formed so as to cover the pixel portion 8003. The opposite electrode 8004 is connected through a contact hole 8008 to a wire wider than a pad for a plurality of connection terminals 8007 extended from the connection terminals 8007 to which a low power source potential of the opposite electrode formed in the connection terminal portion is inputted. The connection terminal 8006 to which the video signal is inputted is connected to the signal line driving circuit 8001 by a video line 8009. In the case of using this structure, the resistance of the power supplying line to the opposite electrode 8004 (such as the contact resistance between the connection terminal 8007 and an FPC terminal or the wire resistance between the opposite electrode 8004 and the connection terminal 8007) or the capacitance thereof (such as the wire parallel capacitance or the wire cross capacitance) can be reduced. Thus, voltage drop in the power supplying line and distortion and fluctuation of a waveform can be reduced, and the potential of the opposite electrode can be set normal. Even if a leading wire becomes long like the video line 8009 to cause the parasitic resistance of the wire and the capacitance thereof to increase, charging and discharging of the video line 8009 can be reduced. Therefore, the power consumption can be reduced.

During $T_{Gi}$ shown in FIG. 15B, the pulse 2111 of the start pulse signal and the pulse 2511 of the transfer controlling signal 2511 are not necessarily inputted to the signal line driving circuit as shown in FIG. 15A.

Therefore, if the video signals are identical with those written in one row before in all the columns of a pixel row to which writing is conducted, a clock signal, an inverted clock signal, and the like are not necessarily inputted to the signal line driving circuit.

Figure 17A:
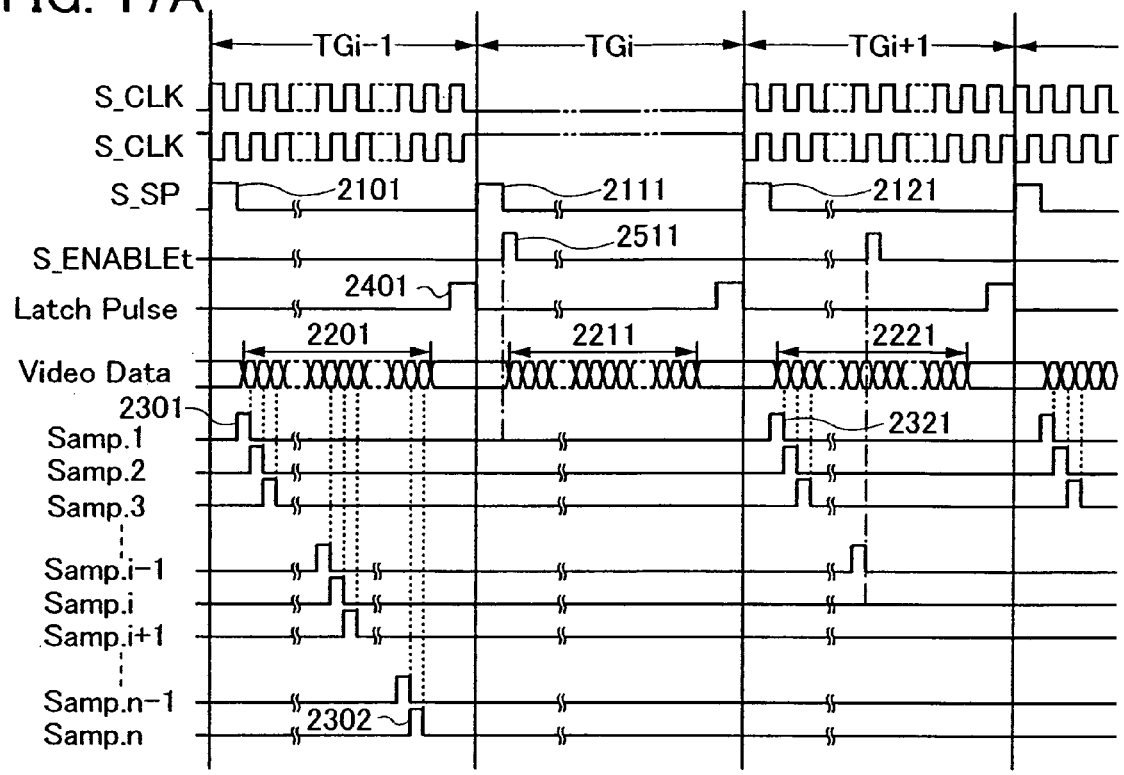
FIGS. 17A and 17B each explain an operation of a signal line driving circuit of a display device of the present invention.

In other words, as shown in FIG. 17A, a clock signal and an inverted clock signal are not inputted to the signal line driving circuit during $T_{Gi}$. For example, a fixed potential that is inverted between the clock signal and the inverted clock signal (one is at an H level and the other is at an L level) may be inputted. This is because signal transfer is not conducted in the shift register during $T_{Gi}$ so as not to output the sampling pulses to the first latch circuit portion; therefore, a clock signal and an inverted clock signal do not need to be inputted to the signal line driving circuit originally. Thus, when a clock signal and an inverted clock signal are set at a fixed potential, charging and discharging are not conducted, thereby allowing reduction of the power consumption. Further, during $T_{Gi}$ of FIG. 17A, the pulse 2111 of the start pulse signal and the pulse 2511 of the transfer controlling signal are not necessarily inputted to the signal line driving circuit as shown in FIG. 15A, and the video signal 2211 is not necessarily inputted to the signal line driving circuit as shown in FIG. 15B. Accordingly, the power consumption can be reduced drastically.

Moreover, if the video signals are identical with those written in one row before in all the columns of a pixel row to which writing is conducted, a latch pulse is not necessarily inputted to the signal line driving circuit.

Figure 17B:
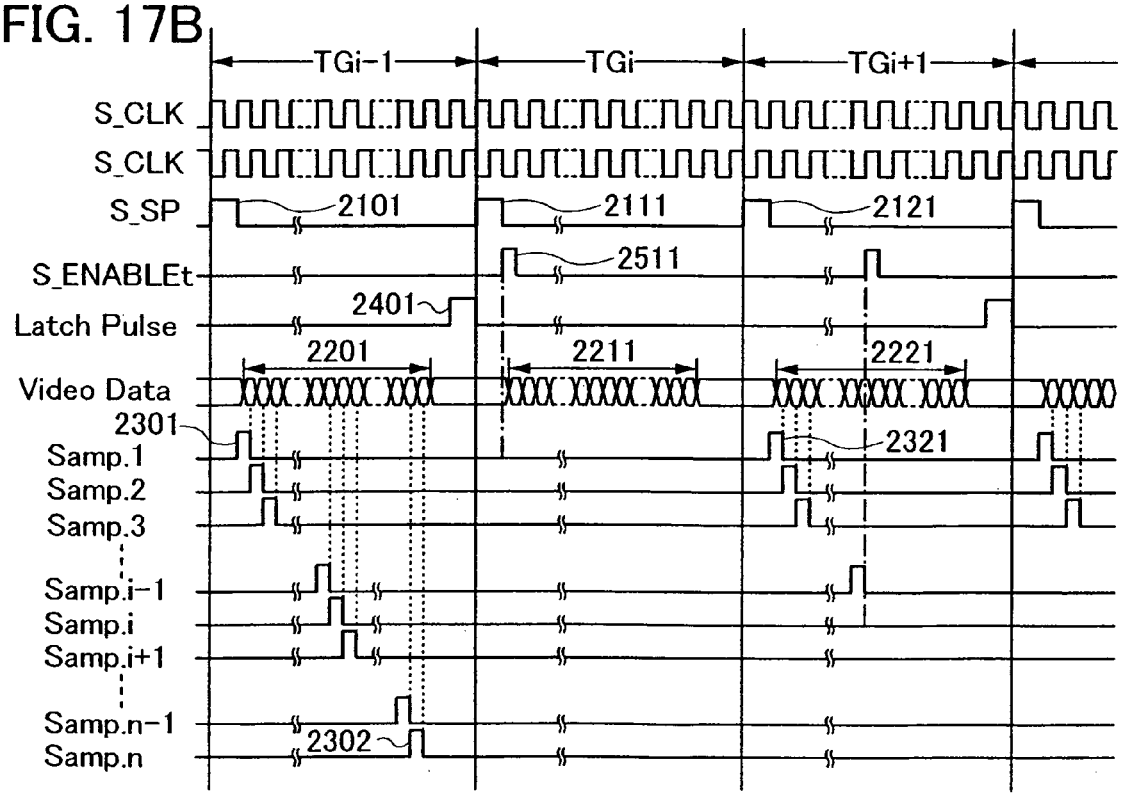

In other words, as shown in FIG. 17B, a latch pulse is not inputted to the signal line driving circuit during $T_{Gi}$. This is because signal transfer is not conducted in the shift register during $T_{Gi}$ so as not to output the sampling pulse to the first latch circuit portion; therefore, the latch pulse does not need to be inputted to the signal line driving circuit originally. Accordingly, when the latch pulse is not inputted to the signal line driving circuit, signal transfer is not conducted from the first latch circuit portion to the second latch circuit portion; therefore, charging and discharging can be omitted so as to reduce the power consumption. Further, during $T_{Gi}$ of FIG. 17B, the pulse 2111 of the start pulse signal and the pulse 2511 of the transfer controlling signal are not necessarily inputted to the signal line driving circuit as shown in FIG. 15A, the video signal 2211 is not necessarily inputted to the signal line driving circuit as shown in FIG. 15B, and a clock signal and an inverted clock signal are not necessarily inputted as shown in FIG. 17A. As a result, the power consumption can be reduced drastically.

Next, a structure of a signal line driving circuit, which is different from that shown in FIG. 13 is explained with reference to FIG. 18.

Figure 18:
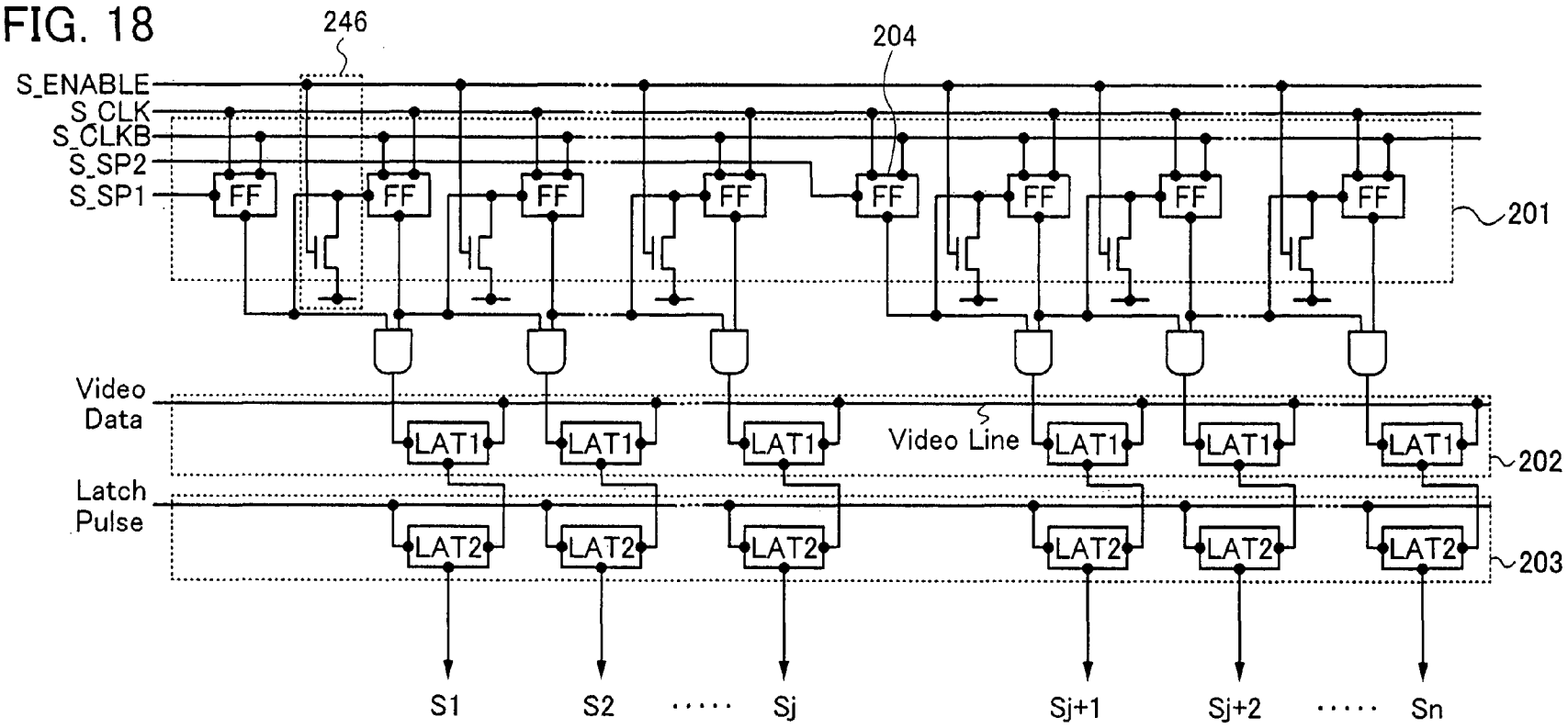
FIG. 18 explains a structure example of a signal line driving circuit of a display device of the present invention.

The signal line driving circuit shown in FIG. 18 has the pulse output circuit 241, the first latch circuit portion 242, and the second latch circuit portion 243. The pulse output circuit 241 has the shift register 247 formed by using plural stages of the flip-flop circuits 244, and the AND gates 245. Two input terminals of the AND gate 245 are connected to output terminals of the adjacent flip-flop circuits 244. In FIG. 18, in the pulse output circuit 201 shown in FIG. 13, the shift register 207 including plural flip-flop circuits 204 is divided into plural regions and a plurality of start pulse signals are prepared so that each start pulse signal is inputted to each of the regions of the shift register.

In the pulse output circuit 241, an input portion of the flip-flop circuit 244 is provided with the switch 246 for initializing a signal, and the switch 246 is controlled by a transfer controlling signal (S_ENABLEt). Even if the start pulse signal is inputted to sequentially transfer signals from the flip-flop circuits 244 to the first latch circuit portion 242, when the video signals in and after a certain column are identical with those in one row before, the transfer controlling signal is turned on to stop the signal transfer in the shift register 247 so as not to output the sampling pulses to the first latch circuit portion 242 in and after the certain column.

Here, an example is shown in which, in a case where one row includes signal lines of n columns (the first to n-th columns), the shift register 247 is divided into a first region 247*a* including flip-flop circuits from the first to j-th columns and a second region 247*b* including flip-flop circuits from the (j+1)-th to n-th columns. In this case, in this shift register 247, signal transfer is started by the input of a first start pulse signal in the first region 247*a* and signal transfer is started by the input of a second start pulse signal in the region 247*b*.

Figure 19A:
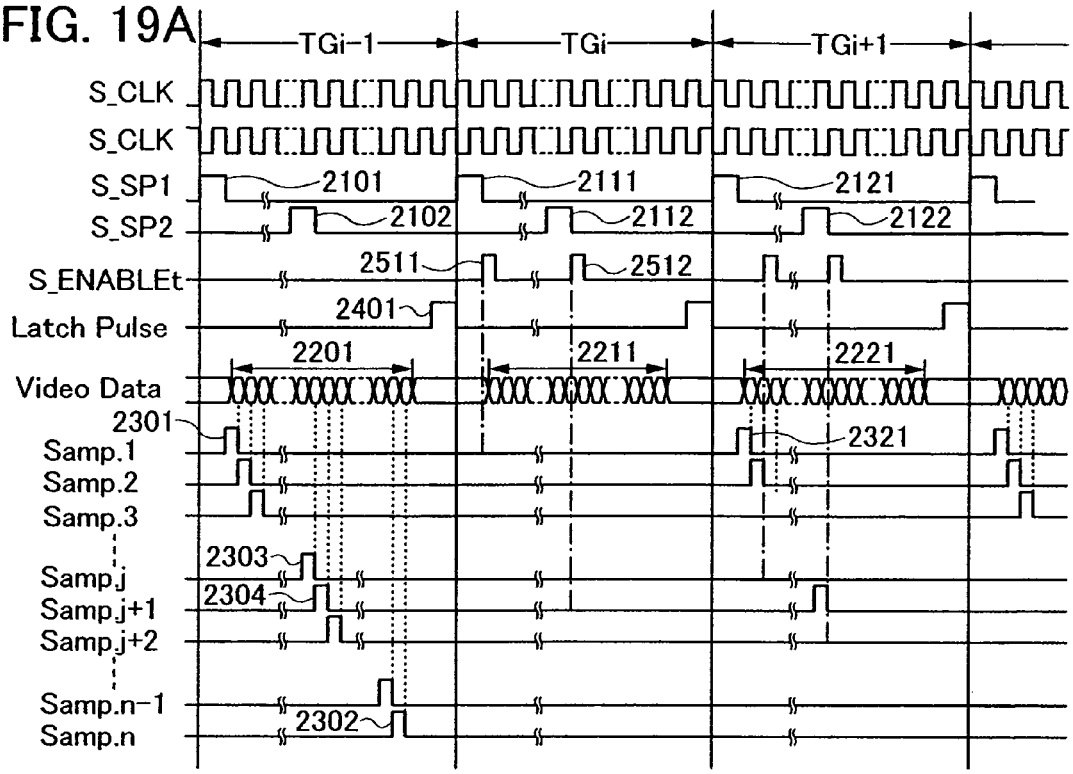
FIGS. 19A and 19B each explain an operation of a signal line driving circuit of a display device of the present invention.

Here, an operation of the signal line driving circuit shown in FIG. 18 is explained with reference to FIG. 19A. It is to be noted that the description on the same portion as that in FIG. 14 is omitted.

FIG. 19 shows periods (here, $T_{Gi-1}$, $T_{Gi}$, and $T_{Gi+1}$) for holding video signals to be inputted to pixels in the (i−1)-th row, the i-th row, and the (i+1)-th row in a certain period in the first latch circuit portion 242 of the signal line driving circuit. In other words, each of $T_{Gi-1}$, $T_{Gi}$, and $T_{Gi+1}$ corresponds to one gate selection period.

First, an operation during $T_{Gi-1}$ is explained.

A clock signal (S_CLK) and an inverted clock signal (S_CLKB) are inputted to the first region 247*a* of the shift register 247, and the first start pulse signal (S_SP1) is inputted to the flip-flop circuit 244 in the first stage of the first region 247*a*. In FIG. 19A, the pulse 2101 corresponds to the first start pulse signal of $T_{Gi-1}$.

The pulse 2101 is delayed by a pulse of the clock signal when inputted to the flip-flop circuit 244 in the next stage. Thus, the output of the AND gate 245 in the first column to which the outputs of the redundant flip-flop circuit 244 in the first stage and the flip-flop circuit 244 in the next stage are inputted corresponds to the pulse of the clock signal as shown by the pulse 2301 in FIG. 19A. This pulse 2301 is inputted as a sampling pulse Samp. 1 to a latch circuit in the first latch circuit portion 242 that corresponds to a pixel of the first column. Similarly, the output from the AND gate 245 in the j-th column is inputted as a sampling pulse Samp. j to a latch circuit in the first latch circuit portion 242 that corresponds to a pixel of the j-th column.

After the signals are transferred up to the j-th column in the shift register 247, a clock signal (S_CLK) and an inverted clock signal (S_CLKB) are inputted to the second region 247*b* of the shift register 247 and a second start pulse signal (S_SP2) is inputted to the flip-flop circuit 244 in the first stage in the second region 247*b*. In FIG. 19A, a pulse 2102 corresponds to the second start pulse signal during $T_{Gi-1}$.

This pulse 2102 is delayed by a pulse of the clock signal when inputted to the flip-flop circuit 244 in the next stage. Therefore, the output of the AND gate 245 in the (j+1)-th column to which the outputs of the redundant flip-flop circuit 244 in the first stage and the flip-flop circuit 244 in the next stage are inputted corresponds to the pulse of the clock signal as shown by a pulse 2304 in FIG. 19A. The pulse 2304 is inputted as a sampling pulse Samp. j+1 to a latch circuit in the first latch circuit portion 242 that corresponds to a pixel in the (j+1)-th column. In a similar manner, the output of the AND gate 245 in the n-th column is inputted to a latch circuit in the first latch circuit portion 242 that corresponds to a pixel in the n-th column as a sampling pulse Samp. n as shown by the pulse 2302 in FIG. 19A.

During $T_{Gi-1}$, the video signal data 2201 is inputted to the first latch circuit portion 242 and the video signal is held in each stage of the first latch circuit portion that corresponds to each pixel column in accordance with the timing of the input of the sampling pulse.

In the first latch circuit portion 242, when the video signal holding is completed to the last stage, the latch pulse (Latch Pulse) 2401 is inputted to the second latch circuit portion 243 in a horizontal flyback period to simultaneously transfer the video signals held in the first latch circuit portion 242 to the second latch circuit portion 243. After that, the video signals held in the second latch circuit portion 243 for one row are simultaneously outputted to the signal lines.

It is to be noted that an input portion of the flip-flop circuit 244 is provided with the switch 246 for initializing a signal and the switch 246 is controlled by a transfer controlling signal. Therefore, signal transfer in the first region 247*a* and the second region 247*b* of the shift register 247 is controlled based on the level of the transfer controlling signal, thereby controlling the sampling pulse outputted to the first latch circuit portion 242.

This example shows that, during $T_{Gi-1}$, the video signals are different from those in one row before ((i−2)-th row) in all the columns or the video signals are different from those in one row before in at least the first column and the n-th column. Therefore, signal transfer is conducted in the first region 247*a* and the second region 247*b* of the shift register 247 in all the columns to output sampling pulses to the first latch circuit portion 242, so that new video signals are written in the first latch circuit portion 242 in this example. Thus, the transfer controlling signal is at an L level.

Next, an operation during $T_{Gi}$ is explained. It is to be noted that a case is shown where, during $T_{Gi}$, video signals are identical with those written in pixels in one row before (the (i−1)-th row) in all the columns of the pixel row to which writing is newly conducted.

First, a clock signal (S_CLK) and an inverted clock signal (S_CLKB) are inputted to the first region 247*a* of the shift register 247 and the first start pulse signal (S_SP) is inputted to the flip-flop circuit 244 in the first stage of the first region 247*a*. In FIG. 19A, the pulse 2111 corresponds to the first start pulse during $T_{Gi}$.

Then, at the same time as the output of the pulse from the flip-flop circuit 244 in the first stage of the first region 247*a*, the transfer controlling signal is set at an H level to turn on the switch for initializing a signal, which is provided to the input portion of the flip-flop circuit 244. Thus, the signal is not transferred to the flip-flop circuit in the next stage. As a result, the signal transfer is stopped in the shift register 247 so as not to output the sampling pulses to the first latch circuit portion 242 in all the columns, thereby not writing the video signals.

Subsequently, a clock signal (S_CLK) and an inverted clock signal (S_CLKB) are inputted to the second region 247*b* of the shift register 247 and the second start pulse signal (S_SP) is inputted to the flip-flop circuit 244 in the first stage of the second region 247*b*. In FIG. 19A, a pulse 2112 corresponds to the second start pulse during $T_{Gi}$.

Then, in a similar manner to the first region 247*a*, the transfer controlling signal is at an H level (pulse 2512) at the same time as the output of the pulse from the flip-flop circuit 244 in the first stage of the second region 247*b* and the signal transfer is stopped also in the second region 247*b* of the shift register 247.

As a result, the video signals held in the first latch circuit portion 242 in one row before ((i−1)-th row) are simultaneously transferred to the second latch circuit portion 243 and the video signals held in the second latch circuit portion 243 for one row are simultaneously outputted to the signal lines. In other words, the video signals that are identical with those in one row before are outputted.

Figure 19B:
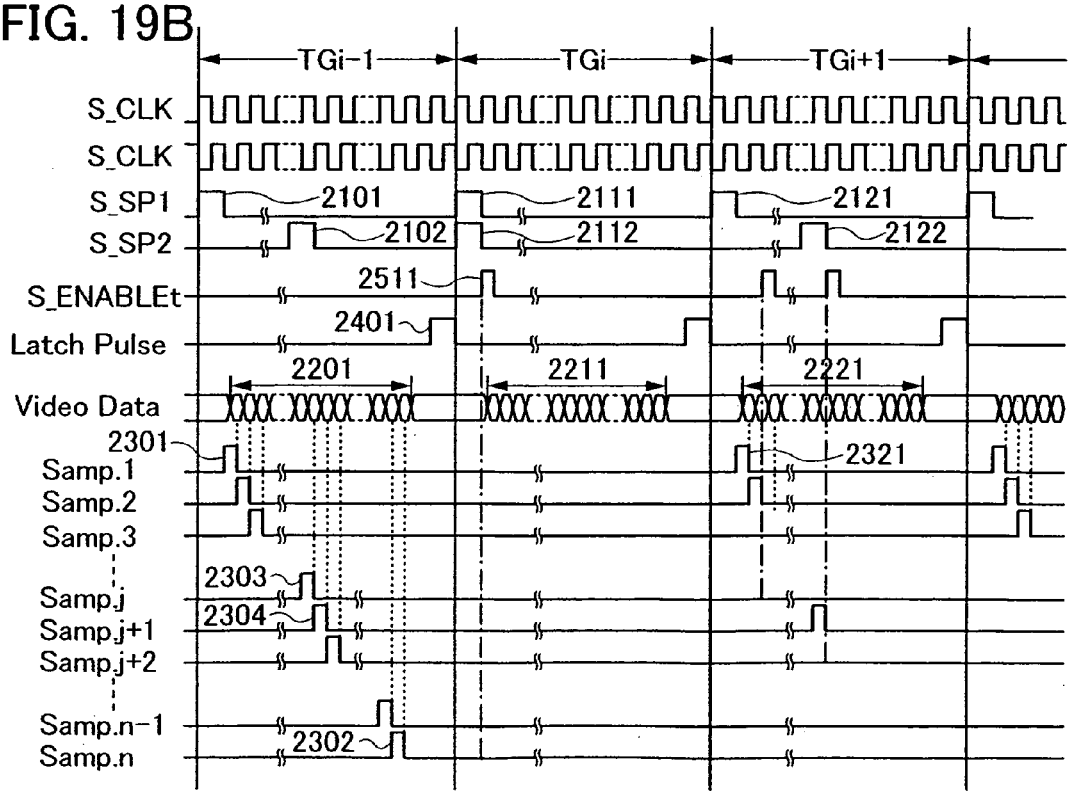

Moreover, if video signals to be newly written in a certain row are identical with those in one row before the certain row in all the columns, the first start pulse (pulse 2111) and the second start pulse (pulse 2112) can be simultaneously inputted to the first region 247*a* and the second region 247*b* of the shift register 247 as shown in FIG. 19B. This is because, during $T_{Gi}$, the video signals are not written in the first latch circuit portion 242 in all the columns. In this case, the switch for initializing a signal, which is provided to the input portion of the flip-flop circuit 244, may be turned on by setting the transfer controlling signal at an H level (pulse 2511) at the same time as the outputs of the pulses from the flip-flop circuits 244 in the first stages of the first region 247*a* and the second region 247*b*.

Next, an operation during $T_{Gi+1}$ is explained.

A case is shown in which, during $T_{Gi+1}$, the video signals to be newly written in the third to j-th columns are identical with those written in one row before and the video signals to be newly written in the (j+2)-th to n-th columns are identical with those written in one row before.

In this case, the method explained with reference to $T_{Gi+1}$ in FIG. 14 can be applied in the first region 247*a* and the second region 247*b* of the shift register 247.

Moreover, as shown with reference to $T_{Gi}$ of FIG. 19, if the video signals are identical with those in one row before in all the columns of a pixel row to which writing is conducted, the transfer controlling signal is set at an H level at the same time as the output of the pulse from the flip-flop circuit 244 in the first stage to stop the signal transfer in the shift register 247. Thus, the sampling pulse is not outputted to the first latch circuit portion so as not to write the video signal to the first latch circuit portion. Therefore, if the video signals are identical with those written in one row before in all the columns of a pixel row to which the writing is conducted, the start pulse signal, the video signal, the clock signal, the inverted clock signal, the latch pulse, and the like are not necessarily inputted as shown in FIGS. 15A and 15B and FIGS. 17A and 17B.

This embodiment mode can be freely combined with the above embodiment mode. That is to say, the present invention can employ all the structures formed by combining the structure shown in this embodiment mode and the structure shown in any of the above embodiment modes.

Embodiment Mode 5

This embodiment mode will explain a case where a video signal to be newly written in a pixel is identical with a video signal already written in the pixel (i.e., a video signal stored in the pixel), with reference to drawings. Specifically, description is made of a case where video signals already written in pixels in and after a certain row are identical with video signals to be newly written in those rows.

In a display device shown in this embodiment mode, when pixels are selected from row to row and video signals are written in the selected pixels, if video signals to be newly written are identical with video signals already written in the pixels, the video signal writing is not conducted to the row of the pixels. That is to say, at the operation of video signal writing in the pixels of that row (also referred to as a pixel row), a signal for not selecting the pixel row is kept inputted or a scan line of that pixel row is put in a floating state.

In this embodiment mode, only when video signals already written in the pixels connected to one scan line are all identical with video signals to be newly written in the pixels, the signal writing is not conducted to that pixel row. Thus, if even one of the video signals to be newly written in the pixels of every column in that row is different from that already written therein, the signals are written in all the pixels connected to the scan line. This is because the input of the signal for selecting the pixel to the scan line necessarily leads to the input of the potential of the signal line to the pixel, by which the pixel data is rewritten. Therefore, only if all the video signals in one row are identical, the scan line is not selected.

Hereinafter, description is made of a specific structure shown in this embodiment mode with reference to drawings.

Figure 22B:
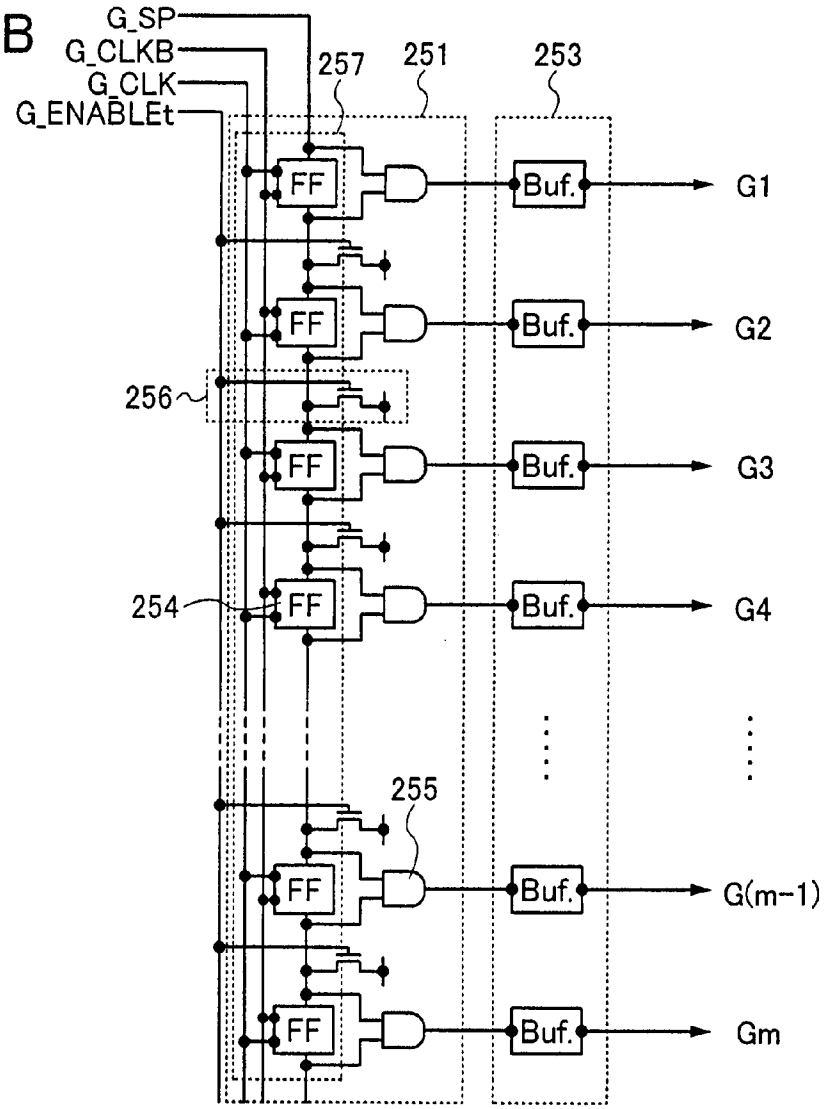
FIGS. 22A and 22B explain a structure example of a scan line driving circuit of a display device of the present invention.
Figure 22A:
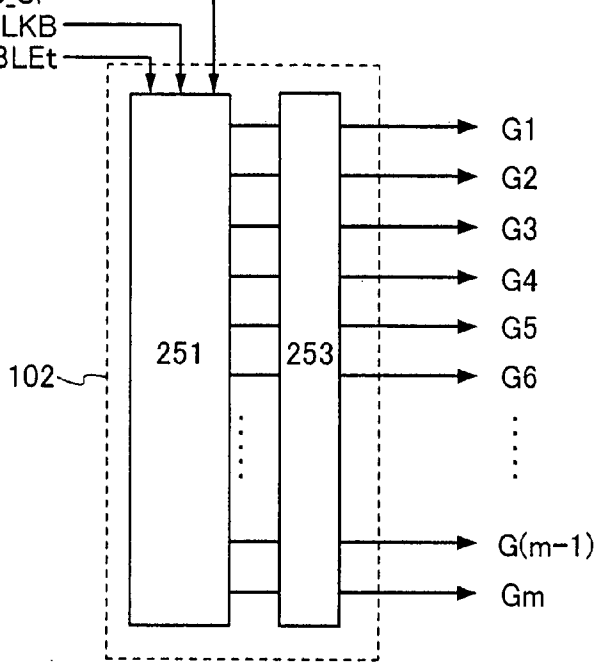

An example of the scan line driving circuit shown in this embodiment mode is shown in FIGS. 22A and 22B.

The scan line driving circuit 102 shown in FIG. 22A has a pulse output circuit 251 and a buffer 253. A clock signal (G_CLK), an inverted clock signal (G_CLKB), a start pulse signal (G_SP), and the like are inputted to the pulse output circuit 251. Then, in accordance with the timing of those signals, gate selection pulses are inputted to the buffer 253. Then, the gate selection pulses (SC. 1 to SC. m) outputted from the pulse output circuit 251 are converted by the buffer 253 into gate selection pulses (G.1 to G.m) having high current supply capability and outputted to the scan lines G1 to Gm. It is to be noted that a circuit for shifting a signal level (level shifter) may be provided between the pulse output circuit 251 and the buffer 253.

Here, the transfer controlling signal (G_ENABLEt) is inputted to the pulse output circuit 251. Then, the pixel row to which video signal writing is not conducted is selected by the transfer controlling signal so as not to output the gate selection pulse to the pixel row.

Next, a structure example which explains FIG. 22A in more detail is shown in FIG. 22B.

The pulse output circuit 251 has a shift register 257 formed by using plural stages of flip-flop circuits (FF) 254 and the like, and AND gates 255. A clock signal (S_CLK), an inverted clock signal (S_CLKB), and a start pulse signal (S_SP) are inputted to the flip-flop circuit 254. Then, the signals are transferred in the shift register 257, and the gate selection pulses are sequentially outputted to the buffer 253 in accordance with the timing of these signals. Two input terminals of the AND gate 255 are connected to an input terminal and an output terminal of the flip-flop circuit 254.

In FIG. 22B, an input portion of the flip-flop circuit 254 is provided with the switch 256 for initializing a signal and the turning on/off of the switch 256 is controlled by using a transfer controlling signal. For example, if video signals are not written in and after a certain row, the switch 256 is turned on by using a transfer controlling signal to stop the signal transfer in the shift register 257 in and after the certain row, thereby not outputting the gate selection pulse to the buffer 253. In this case, since the scan lines are not selected in and after the certain row, video signals are not newly written in the pixels in and after the certain row and the video signals which have been written are kept held. Although FIGS. 22A and 22B show the example of providing the switch 256 by a transistor, the present invention is not limited to this, and any of the switches shown in the above embodiment modes can be used.

When a signal for selecting a pixel is inputted to a scan line, usually, load capacitance typified by gate capacitance of a transistor connected to the scan line or a wire cross capacitance of the scan line is charged or discharged. Therefore, in and after a certain row, if video signals already written in pixels are identical with video signals to be newly written in the pixels, signal transfer in the shift register 257 is stopped in and after the certain row so as not to input to the scan line the gate selection pulse for selecting that pixel row. Thus, the number of times to charge and discharge can be reduced, allowing reduction of the power consumption.

Figure 23:
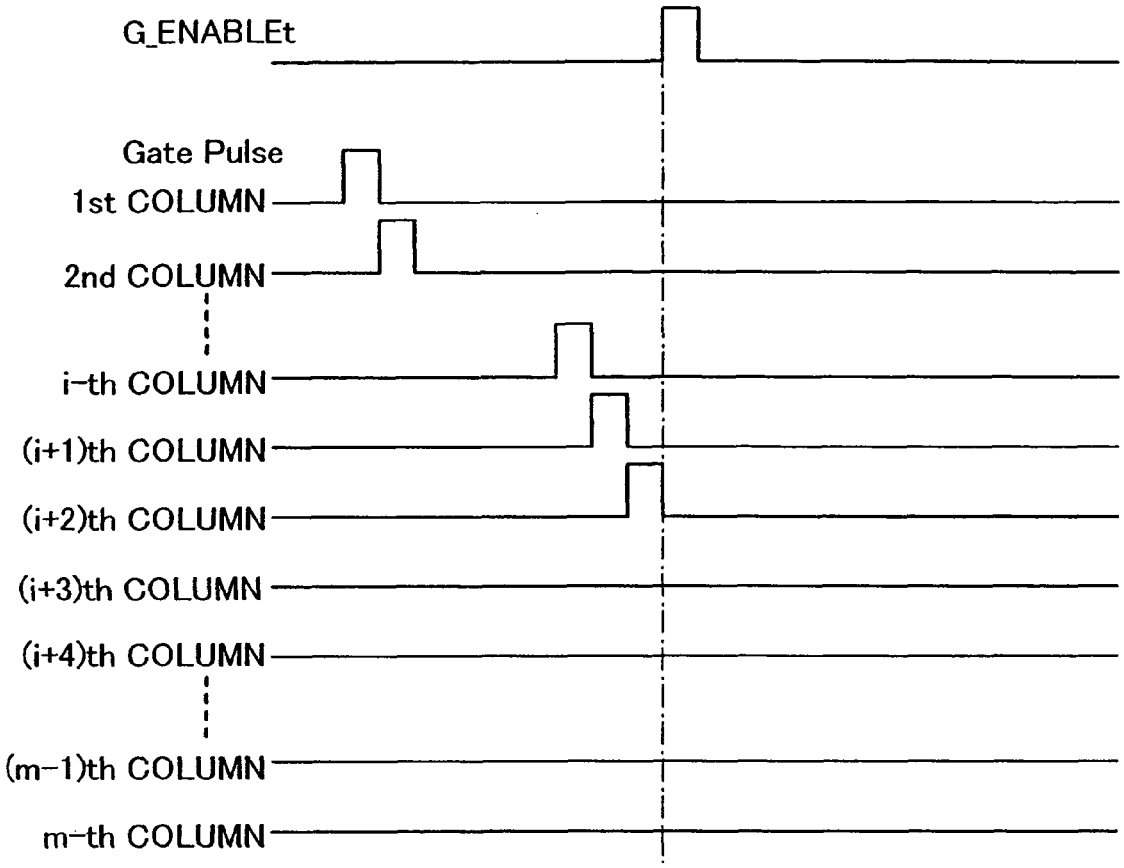
FIG. 23 explains an operation of a scan line driving circuit of a display device of the present invention.

FIG. 23 shows a timing chart at this time. FIG. 23 shows an example in which, in a case where a pixel portion includes m number of scan lines (the first to m-th rows), video signals are not written in pixels in and after the (i+3)-th row.

In FIG. 23, since the video signals to be newly written in the pixels of every column in and after the (i+3)-th row are identical with the video signals already written therein in and after the (i+3)-th row, turning on the switch 256 using a transfer controlling signal can stop the signal transfer in the shift register 257 in and after the (i+3)-th row. Thus, the gate selection pulses are not outputted in and after the (i+3)-th pixel row.

In the i-th row to the (i+2)-th row, the video signals already written in the pixel rows are compared with the video signals to be newly written in the pixel rows, and in that case, there is at least one row where the video signals are not identical (in this case, the video signals already written are different from the video signals to be newly written in at least the (i+2)-th row). Therefore, the switch 256 is turned off by using a transfer controlling signal to output the gate selection pulse to the scan line through the buffer 253. Thus, the video signals are written in the pixels. On the other hand, in and after the (i+3)-th row, since the video signals already written in the pixel rows are identical with the video signals to be newly written therein, the switch 256 is turned on by using a transfer controlling signal in the (i+3)-th row. Thus, the video signals are not written in the pixels in and after the (i+3)-th row and the video signals already written in the pixels are held.

When a gate selection pulse for selecting a pixel is inputted to a scan line, load capacitance typified by gate capacitance of a transistor connected to a scan line or a wire cross capacitance of the scan line is charged or discharged. Therefore, as shown in FIG. 23, in a case of writing a video signal, video signals already written in pixels are identical with video signals to be newly written in the pixels in all the columns in and after a certain row, signal transfer is stopped in the shift register 257 in and after the pixel row by using a transfer controlling signal, so that the gate selection pulse is not inputted to the scan line. Thus, the number of times to charge or discharge can be reduced, allowing reduction of the power consumption.

It is to be noted that, in the structure shown in FIGS. 22A and 22B, if the switch 256 is turned on in a certain row by using a transfer controlling signal, signal transfer in the shift register 257 is stopped in and after the certain row, so that the gate selection pulses are not outputted to the scan lines. Therefore, the structure shown in FIGS. 22A and 22B may be provided with the switch for changing a scanning direction so that the scanning direction can be selected. That is to say, by selecting one of flip-flop circuits 254 located at opposite ends among serially connected flip-flop circuits 254 and inputting a start pulse signal to the selected flip-flop circuit, the outputs of the gate selection pulses to the scan lines can be reduced in more rows.

The structure of the scan line driving circuit 102 applicable to this embodiment mode is not limited to that shown in FIGS. 22A and 22B. That is to say, the structure is not limited as long as the signal transfer is stopped in the shift register 257 by the transfer controlling signal when, in and after a certain row, video signals already written in the pixels are identical with video signals to be newly written in the pixels. In FIG. 23, the signal line driving circuit may be entirely stopped in and after the (i+3)-th row. As a result, the power consumption can be reduced drastically.

Figure 24:
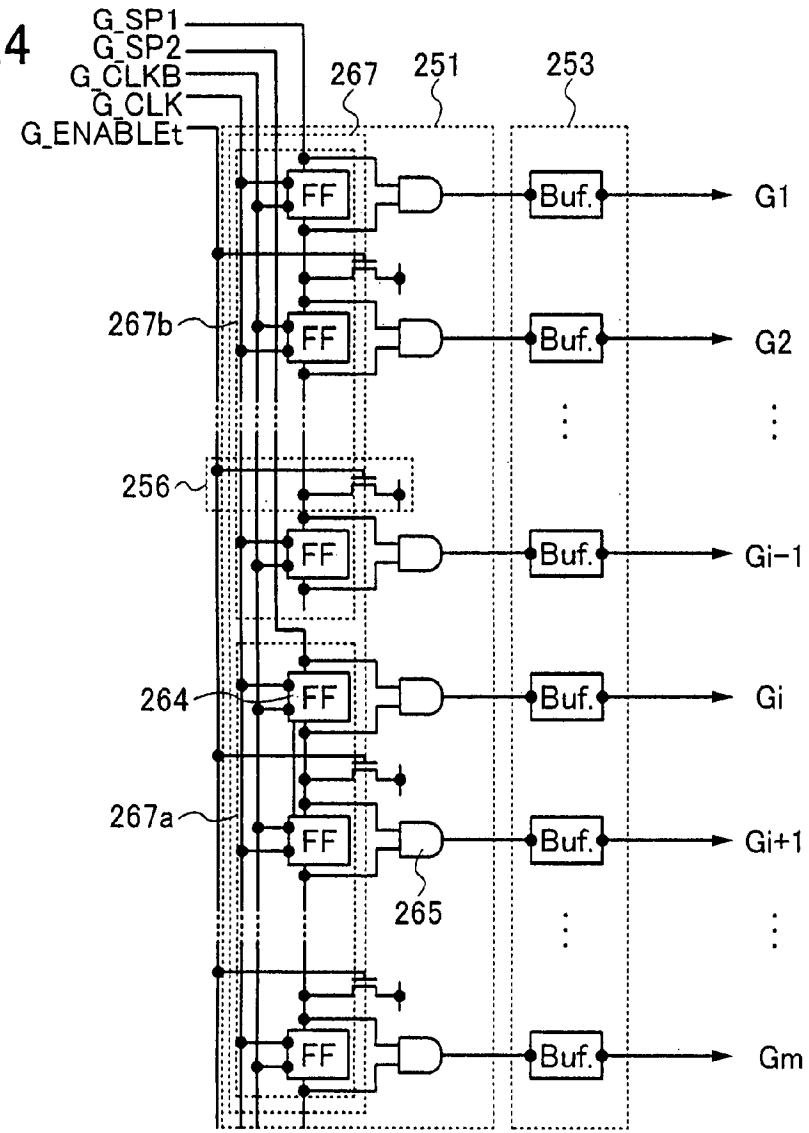
FIG. 24 explains a structure example of a scan line driving circuit of a display device of the present invention.

Next, a scan line driving circuit having a different structure from that in FIGS. 22A and 22B is shown in FIG. 24.

A scan line driving circuit shown in FIG. 24 has a shift register 267 formed by plural stages of flip-flop circuits 264 and the like, and AND gates 265. Two input terminals of the AND gate 265 are connected to an input terminal and an output terminal of the flip-flop circuit 264. Moreover, in the pulse output circuit 261, the shift register 267 is divided into plural regions and a plurality of start pulse signals are prepared, each of which is inputted to each region of the shift register.

Moreover, the input portion of the flip-flop circuit 264 is provided with a switch 266 for initializing a signal, and the turning on/off of the switch 266 is controlled by using a transfer controlling signal (G_ENABLEt). For example, if video signals are not written in all the pixels in and after a certain row, the switch 266 is turned on by using a transfer controlling signal so that signal transfer in the shift register 267 is stopped in and after the certain row; thus, the gate selection pulse is not outputted to the buffer 253. In this case, new video signals are not written in the pixels in and after the certain row and the video signals already written therein are kept held.

Moreover, FIG. 24 shows a structure in which the shift register 267 formed by the flip-flop circuits 264 is divided into a plurality of regions and the start pulse signal is inputted for each region. Therefore, by turning on the switch 266 using the transfer controlling signal, even after stopping the signal transfer in the shift register 267 in and after the certain row, the signal transfer can be restarted in the shift register 267 because a start pulse signal is inputted separately in another region.

Next, a specific example of the operation method is explained with reference to FIGS. 24 and 25.

In FIG. 24, the pixel portion includes m number of scan lines (the first to m-th rows), and in this case, the shift register 267 is divided into a region 267*a* including flip-flop circuits 264 from the first to i-th rows and a region 267*b* including flip-flop circuits from the (i+1)-th to m-th rows.

In this case, in the shift register 267, signal transfer is started by inputting a first start pulse signal in the region 267*a* and signal transfer is started by inputting a second start pulse signal in the region 267*b*. In other words, in the region 267*a* of the shift register 267, the gate selection pulses are sequentially outputted to the scan lines through the buffer 253 in accordance with the timing of the inputted first start pulse signal, clock signal, and inverted clock signal. On the other hand, in the region 267*b*, the gate selection pulses are sequentially outputted to the scan lines through the buffer 253 in accordance with the timing of the inputted second start pulse signal, clock signal, and inverted clock signal.

In the shift register 267, signal transfer is controlled separately in the region 267*a* and the region 267*b* using a transfer controlling signal (G_ENABLEt). Here, for example, a case is considered in which, when video signals already written in pixels and video signals to be newly written in the pixels are compared, the video signals already written in pixels are different from the video signals to be newly written in the pixels only in the second row and the (i+2)-th row in FIG. 24.

First, by inputting a first start pulse signal, gate selection pulses are outputted sequentially to scan lines of the first row and the second row, thereby writing video signals in the pixel rows. Subsequently, the switch 266 is turned on by using a transfer controlling signal to stop the signal transfer in the shift register 267 in and after the third row (here, the third to i-th rows), so that the gate selection pulses are not outputted from the flip-flop circuits 264 to the scan lines. Thus, video signals are not written in the pixels.

Next, data writing is carried out in the pixel row in such a way that gate selection pulses are outputted to the (i+1)-th row and the (i+2)-th row by inputting the second start pulse signal. Subsequently, by turning on the switch 266 using a transfer controlling signal, the signal transfer in the shift register 267 is stopped in and after the (i+3)-th row (here, the (i+3)-th to m-th rows) so as not to output the gate selection pulses from the flip-flop circuits 264 to the scan lines. Thus, data writing in the pixels is not conducted.

Figure 25:
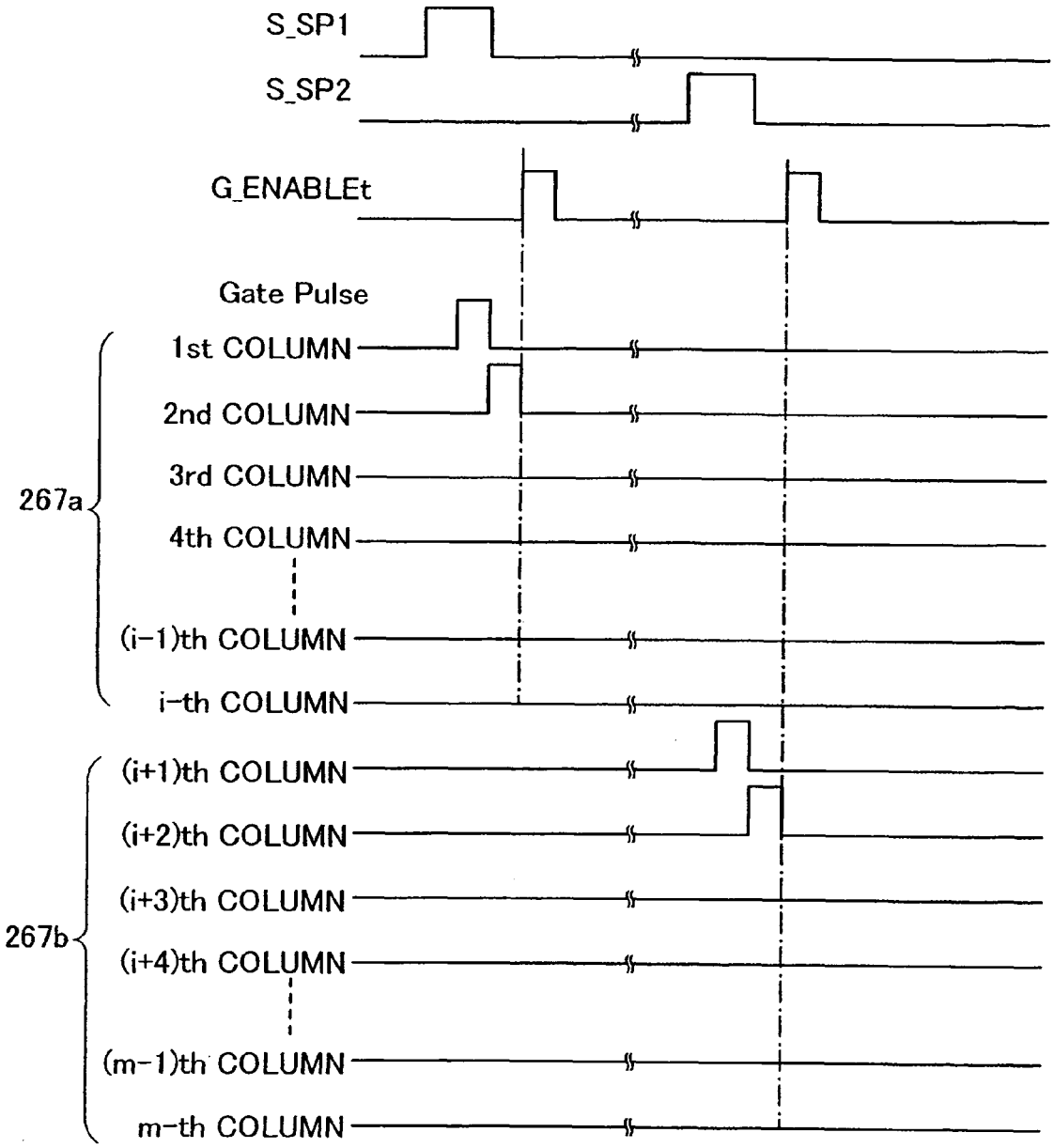
FIG. 25 explains an operation of a scan line driving circuit of a display device of the present invention.

FIG. 25 shows a timing chart at this time.

In the region 267*a* in which signal transfer is started in the shift register 267 by the input of the first start pulse signal, since video signals held in the pixels are identical with video signals to be newly written therein in and after the third row (here, the third to i-th rows), the gate selection pulses are not outputted to the scan lines of the third to i-th rows by turning on the switch 266 using a transfer controlling signal.

In the region 267*b* in which signal transfer is started in the shift register 267 by the input of the second start pulse signal, since video signals held in the pixels are identical with video signals to be newly written therein in and after the (i+3)-th row (here, the (i+3)-th to i-th rows), the gate selection pulses are not outputted to the scan lines in and after the (i+3)-th row by turning on the switch 266 using a transfer controlling signal.

Accordingly, new video signals are written in pixels of the first, second, (i+1)-th, and (i+2)-th rows, and video signals in pixels of the third to i-th and (i+3)-th to m-th rows are kept being held therein.

In this manner, by using the structure shown in FIG. 24, signal transfer in the shift register 267 is stopped in the third to i-th rows and the (i+3)-th to m-th rows so as not to input the gate selection pulses for selecting those pixel rows to the scan lines. Thus, the number of times to charge and discharge can be reduced, which allows reduction of the power consumption. If the gate selection pulse is not inputted to the scan line, the signal line driving circuit may be entirely stopped. As a result, drastic reduction of the power consumption can be achieved.

In the structure shown in FIGS. 22A and 22B, signal transfer in the shift register 257 is stopped in and after that row when the switch 256 is turned on by using a transfer controlling signal; then, the gate selection pulses are not outputted to all the scan lines in and after the row. Therefore, in and after the row, it is necessary that all the video signals already written in the pixels be identical with the video signals to be newly written therein. Accordingly, in the structure shown in FIGS. 22A and 22B, it is necessary that signal transfer be conducted in the shift register 257 in the first to (i+2)-th rows, and that the gate selection pulses be outputted to the scan lines. On the other hand, in the structure shown in FIG. 24, since the switch 266 can be turned on/off by using a transfer controlling signal in each of the divided regions, whether to output the gate selection pulse to the scan line or not can be controlled in detail by specifically controlling the signal transfer in the shift register 267. Thus, the power consumption can be reduced.

Although FIG. 24 shows the structure in which the shift register 267 is divided into two regions and the start pulse signal is inputted to each of the two regions, the present invention is not limited to this. The shift register may be divided into three or more regions and a plurality of start pulse signals may be each inputted in accordance with each of the regions. Thus, the output of the gate selection pulse can be controlled in each region.

In FIG. 24, a switch for changing a scanning direction can be provided. That is, in the structure where the shift register 267 is divided into plural regions, each of the regions (regions 267*a* and 267*b* in FIG. 24) is provided with a switch for changing a scanning direction so that the scanning direction can be selected for each of the regions. In other words, one of the flip-flop circuits located at opposite ends of each region can be selected from among serially-connected plural flip-flop circuits and the first start pulse signal or the second start pulse signal can be inputted to the selected flip-flop circuit.

For example, in FIG. 24, to which of the flip-flop circuits corresponding to the first and i-th columns the first start pulse signal is inputted can be selected in the region 267*a*; on the other hand, to which of the flip-flop circuits corresponding to the (i+1)-th and m-th columns the second start pulse signal is inputted can be selected in the region 267*b*.

As thus described, in and after a certain row, if the video signals already written in the pixels are identical with the video signals to be newly written therein, the signal transfer in the shift register 257 is stopped in and after the certain row so as not to input the gate selection pulses for selecting those pixel rows to the scan lines. Thus, the number of times to charge and discharge can be reduced, which allows reduction of the power consumption.

Moreover, in a case of writing video signals in pixels, if the video signals already written in the pixel row are identical with the video signals to be newly written therein, the signal lines of that pixel row are put in a floating state during the operation of writing signals in that pixel row, so that the power consumption can be reduced further. This is because charging and discharging of the wire cross capacitance of the signal lines with the same number of pixels connected to one scan line can be omitted. In addition, the signal which was inputted just before may be outputted without any change instead of putting the signal line in a floating state. This is because charging and discharging of the wire cross capacitance are completed in the signal line so that the power consumption is not that high. For example, the driving method in the case where the video signals to be newly written in a certain row are identical with the video signals already written in one row before the certain row in all the columns as aforementioned (for example, FIGS. 14, 15A and 15B, and 17A and 17B).

This embodiment mode can be freely combined with the above embodiment mode. Specifically, in a case of writing video signals in pixels, comparison is made between video signals to be newly written in a certain row and video signals already written in one row before the certain row and between video signals to be newly written in pixels and video signals already written therein. Based on the comparison result, the writing of the video signals in the pixels can be controlled.

For example, in a case of writing video signals in and after a certain row (the i-th row), first, video signals already written in pixels in and after the certain row are compared with video signals to be newly written therein. If the video signals are identical in all the pixels, the gate selection pulses are not outputted to the scan lines by using the structure shown in this embodiment mode so as not to select the scan lines. On the other hand, if there is a row in which the video signals already written in the pixels are different from the video signals to be newly written therein, the video signals to be newly written are compared with the video signals already written in pixels of one row before. Then, if there is a column where the video signals are different, the video signal is written only in the column where the video signals are different by using the structure shown in any of Embodiment Modes 1 to 4.

In this manner, video signals already written in pixels in and after a certain row are compared with video signals to be newly written therein, and the video signals to be newly written are compared with video signals already written in one row before. Then, by operating so that the power consumption is the minimum, the power consumption can be reduced more effectively.

It is to be noted that the present invention can employ all the structures formed by combining the structure shown in this embodiment mode and the structure shown in any of the above embodiment modes.

Embodiment Mode 6

This embodiment mode will explain a case where a video signal to be newly written in a pixel is identical with a video signal already written in the pixel (i.e., a video signal stored in the pixel), which is different from the structure in Embodiment Mode 5, with reference to drawings. Specifically, a structure is described in which if there are a plurality of rows in which video signals already written in the pixels are identical with video signals to be newly written therein, a gate selection pulse is not outputted selectively for each row.

Figure 26B:
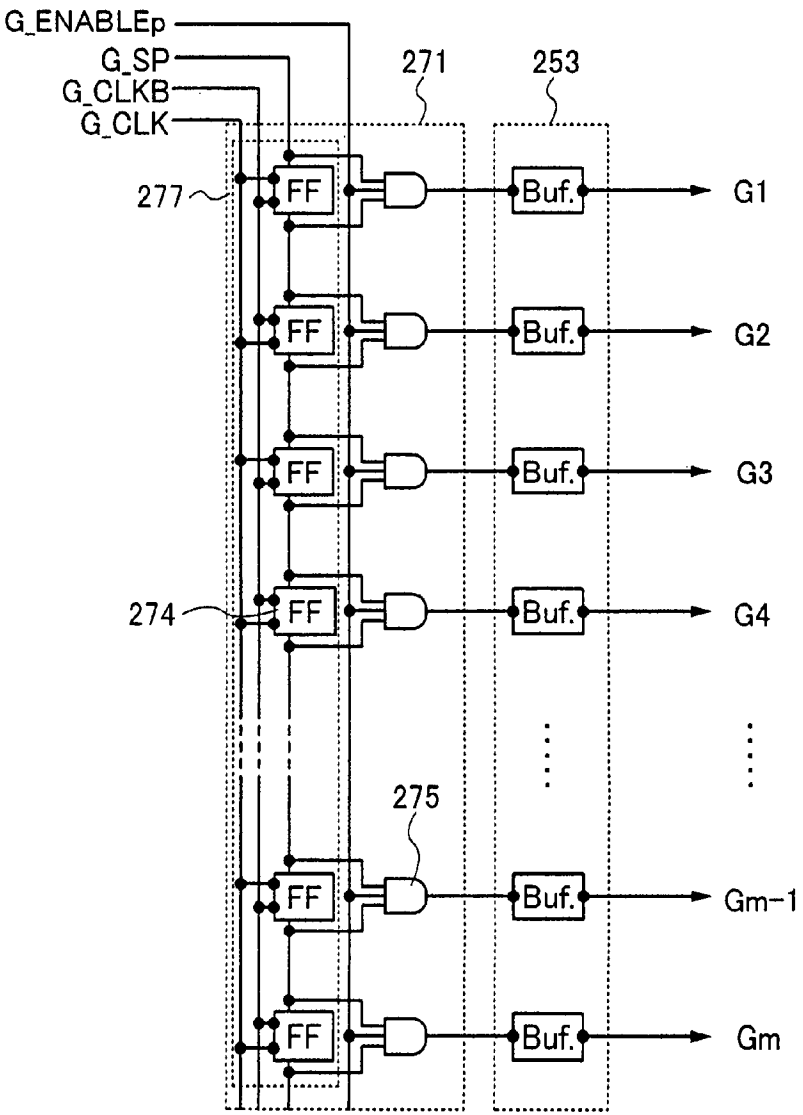
FIGS. 26A and 26B explains a structure example of a scan line driving circuit of a display device of the present invention.
Figure 26A:
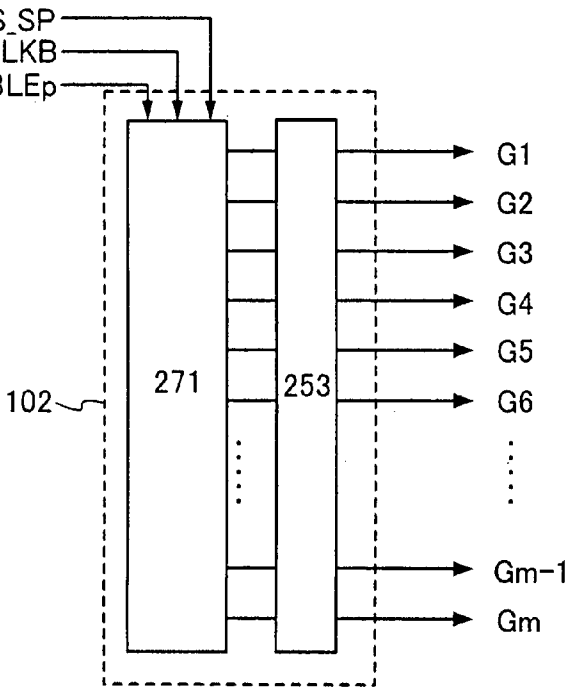

An example of a signal line driving circuit of a display device shown in this embodiment mode is shown in FIGS. 26A and 26B.

A pulse output circuit 271 shown in this embodiment mode has a shift register 277 formed by using plural stages of flip-flop circuits 274 and the like, and AND gates 275. Input terminals of the AND gate 275 are connected to an input terminal and an output terminal of the flip-flop circuit 274 and a wire through which a sampling controlling signal is inputted to the AND gate 275.

The flip-flop circuit 274 sequentially outputs gate selection pulses to a buffer circuit 253 in accordance with the timing of the input of a start pulse signal (S_SP), a clock signal (S_CLK), and an inverted clock signal (S_CLKB). Then, the gate selection pulse is converted into a pixel selection signal having high current supply capability by the buffer circuit 253, and then outputted to a scan line.

Moreover, in FIG. 26B, the sampling controlling signal (E_ENABLEp) is inputted to the AND gate 275, and the output of the gate selection pulse to the buffer circuit 253 is controlled based on the level of the sampling controlling signal. In other words, signal transfer is conducted in all the rows in the shift register 277 to input the sampling controlling signals to the AND gates 275, thereby controlling the output of the gate selection pulse to the buffer circuit 253.

Figure 27:
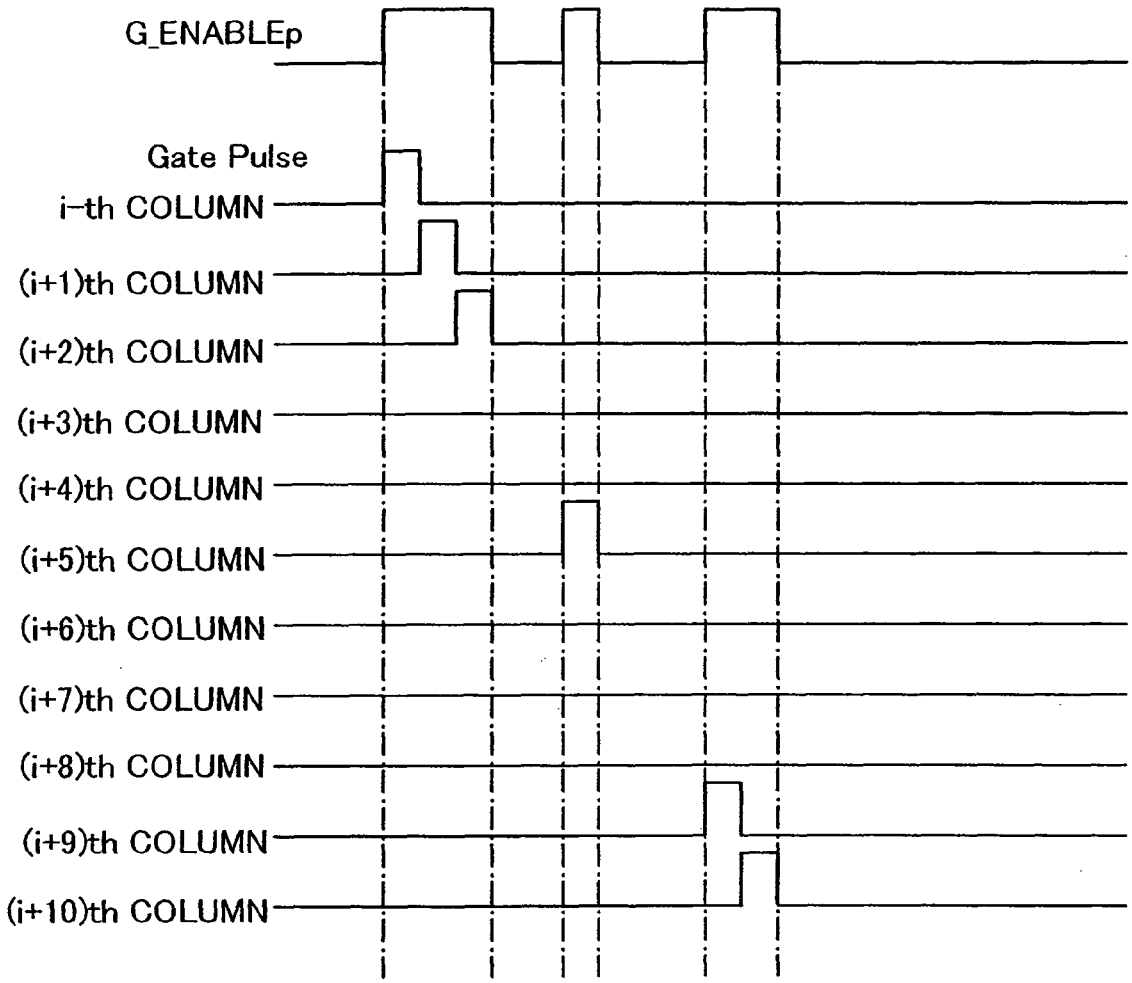
FIG. 27 explains an operation of a scan line driving circuit of a display device of the present invention.

FIG. 27 shows a timing chart at this time.

FIG. 27 shows a case where, in the i-th to (i+10)-th rows, video signals to be newly written in pixels in the (i+3)-th row, the (i+4)-th row, and the (i+6)-th to (i+8)-th rows are identical with video signals already written in the pixels in those rows.

In FIG. 27, since video signals to be newly written in pixels in the (i+3)-th row, the (i+4)-th row, and the (i+6)-th to (i+8)-th rows are identical with video signals already written in those pixel rows, the sampling controlling signals are turned off so as not to output the gate selection pulses from the AND gates 275 to the buffer circuit 253. On the other hand, since video signals to be newly written in pixels in the i-th to (i+2)-th rows, the (i+5)-th row, the (i+9)-th row, and the (i+10)-th row are different from video signals held in these pixel rows, the sampling controlling signals are turned on to output the gate selection pulses from the AND gates 275 to the buffer circuit 253. Thus, scan lines are selected to write video signals in pixels. Here, since signal transfer is conducted in all the rows in the shift register 277, the output of the gate selection pulse is controlled by inputting the sampling controlling signals in the AND gates 275.

Then, video signals are to be newly written in the pixels in the i-th to (i+2)-th rows, the (i+5)-th row, the (i+9)-th row, and the (i+10)-th row and the video signals are kept being held in the pixels in the (i+3)-th row, the (i+4)-th row, and the (i+6)-th to (i+8)-th rows.

In this manner, the output of the gate selection pulse can be stopped only in a necessary row by controlling the turning on/off of the sampling controlling signal. In other words, the scan line is selectively selected with respect to the necessary row (here, the row where the video signal already written in the pixel in that row is different from the video signal to be newly written therein) and the video signal is written in the pixel, thereby allowing reduction of the power consumption. If the gate selection pulse is not inputted to the scan line, the signal line driving circuit may be entirely stopped. This can reduce the power consumption drastically.

Moreover, the structure shown in FIG. 26 can be combined with the structure shown in FIGS. 22A and 22B.

Figure 28:
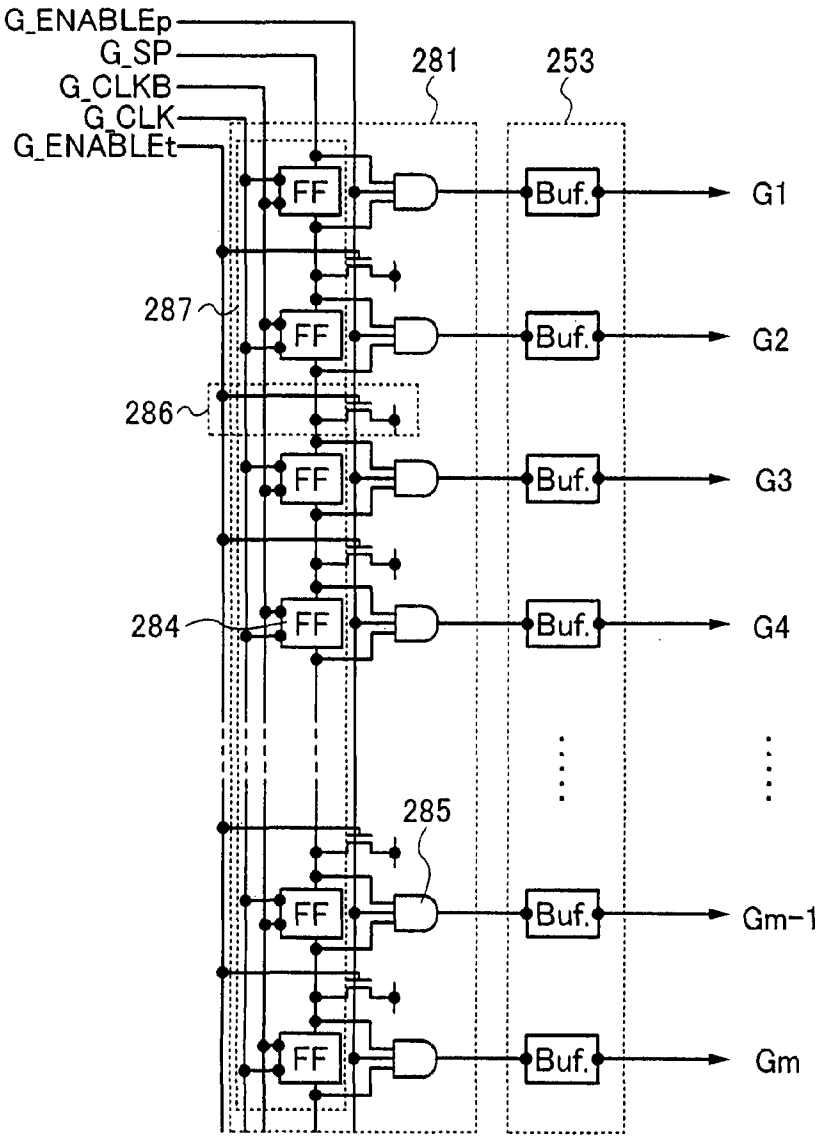
FIG. 28 explains a structure example of a scan line driving circuit of a display device of the present invention.

For example, as shown in FIG. 28, a switch 286 for initializing a signal may be provided to the input portion of the flip-flop circuit 284 in the structure shown in FIGS. 22A and 22B, and the switch may be controlled by using a transfer controlling signal. In this case, the output of the gate selection pulse can be controlled by using a transfer controlling signal and a sampling controlling signal. Although FIG. 28 shows the example of providing the switch 286 by a transistor, the present invention is not limited to this and any of the switches shown in the above embodiment modes can be used.

Figure 29:
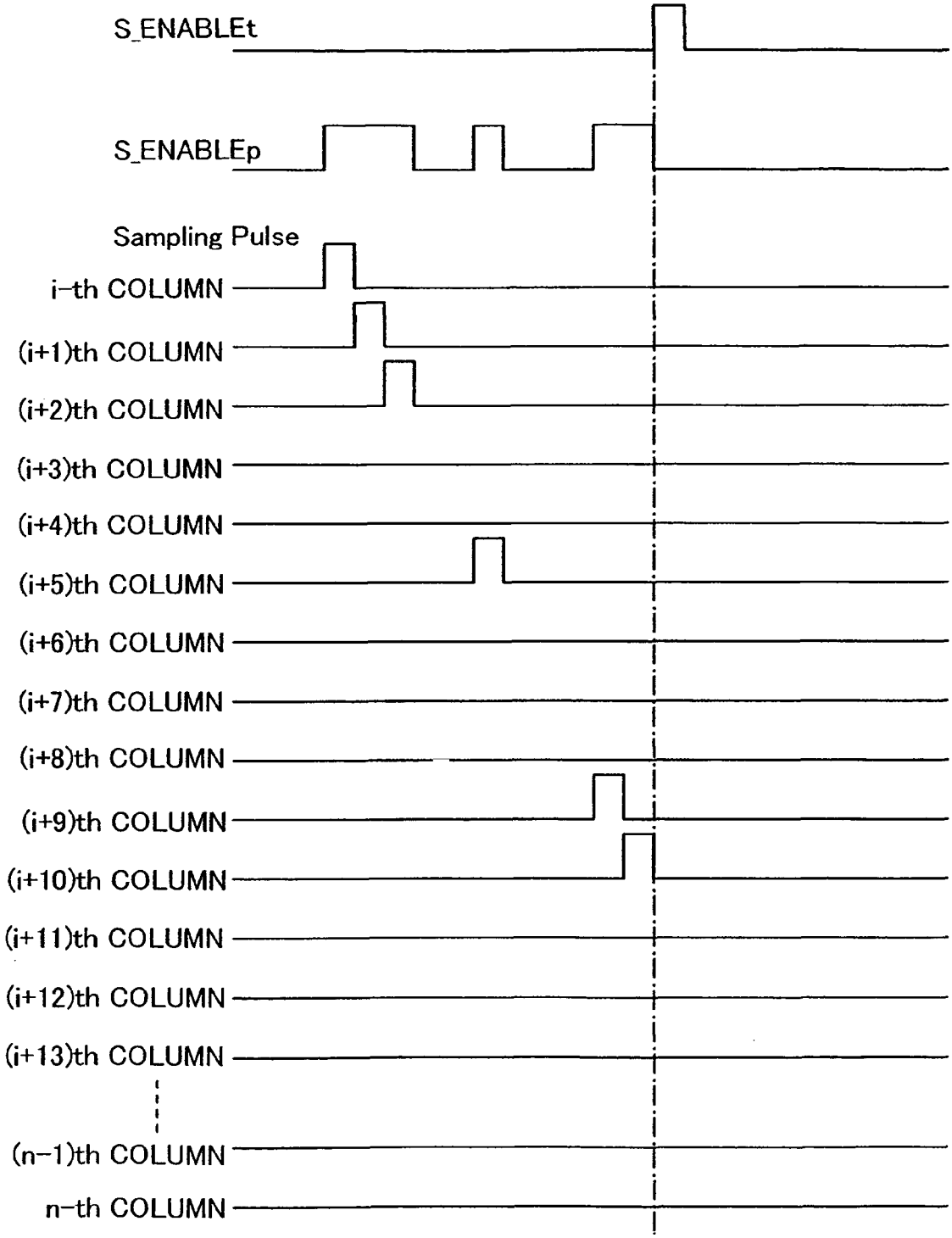
FIG. 29 explains an operation of a scan line driving circuit of a display device of the present invention.

FIG. 29 shows a timing chart at this time.

FIG. 29 shows a case in which video signals which are newly written in pixels of the (i+3)-th row, the (i+4)-th row, the (i+6)-th to (i+8)-th rows, and the (i+11)-th to m-th rows are identical with the data already written in these pixel rows.

In FIG. 29, since the video signals to be newly written in the pixels of the (i+3)-th row, the (i+4)-th row, the (i+6)-th to (i+8)-th rows, and the (i+11)-th to m-th rows are identical with the video signals already written in these pixel rows, the sampling controlling signals are turned off so as not to output the gate selection pulses from the AND gate 285 to the buffer circuit 253. On the other hand, since the video signals already written in the pixels of the i-th to (i+2)-th rows, the (i+5)-th row, the (i+9)-th row, and the (i+10)-th row are different from the video signals to be newly written in those pixels, the sampling controlling signal is turned on to output the gate selection pulses from the AND gates 285 to the buffer circuit 253. Thus, the video signals are written. Here, since the video signals already written in and after the (i+11)-th row are identical with the video signals to be newly written therein, the transfer controlling signal is turned on to stop the signal transfer in the shift register 287 in and after the (i+11)-th row.

In this manner, by using the transfer controlling signal and the sampling controlling signal, the signal transfer in the shift register and the output of the gate selection pulse can be controlled and the video signal can be selectively written only in the pixel in the necessary row. Therefore, the power consumption can be reduced.

That is to say, if the output of the gate selection pulse is controlled by using the transfer controlling signal, it is necessary that all the video signals to be newly written in and after a certain row be identical with the video signals already written in and after the certain row. If the output of the gate selection pulse is controlled by the sampling controlling signal, the output of the gate selection pulse can be controlled for each row, but it is necessary to transfer the signals in the shift register with respect to all the rows. Therefore, when the output of the gate selection pulse is controlled by using both the transfer controlling signal and the sampling controlling signal, various images can be displayed flexibly; therefore, the power consumption can be more effectively reduced. Furthermore, if the gate selection pulse is not inputted to the scan line, the signal line driving circuit may be entirely stopped. As a result, the power consumption can be reduced drastically.

Moreover, as shown in the above embodiment mode, the structure shown in FIG. 28 may be provided with the switch for changing a scanning direction or the structure may be that the shift register 287 is divided into a plurality of regions and a plurality of start pulse signals are prepared so that each start pulse signal is inputted to each region of the shift register. Furthermore, the shift register 287 may be divided into plural regions and the scanning direction may be controlled for each region.

If video signals already written in a pixel row are identical with video signals to be newly written therein, the signal lines of that pixel row are put in a floating state at the signal writing operation in that pixel row, which can achieve further reduction of the power consumption. This is because charging and discharging of the wire cross capacitance of the signal lines with the same number of pixels connected to one scan line can be omitted. Moreover, instead of putting the signal line in a floating state, the signal inputted in the signal line just before may be outputted without any change. This is because charging and discharging of the wire cross capacitance are completed in the signal line and the power consumption is therefore not so high. For example, the driving method in the case where the video signals in a row are identical with the video signals in one row before in all the columns as aforementioned (for example, FIGS. 14, 15A and 15B, and 17A and 17B) can be applied.

This embodiment mode can be freely combined with the above embodiment mode. Specifically, the writing of the video signal in the pixel can be controlled based on a result of comparing video signals to be newly written in a row and video signals already written in one row before and comparing a video signal already written in a pixel and a video signal to be newly written in the pixel.

For example, in a case of writing video signals in a certain row (the i-th row), first, video signals already written in pixels of the certain row (the i-th row) are compared with video signals to be newly written in the pixels of the row (the i-th row) and if the video signals are identical in all the pixels, the gate selection pulse is not outputted to the scan line by using the structure shown in this embodiment mode so as not to select the scan line. On the other hand, in the case where the video signal already written in the pixel is different from the video signal to be newly written therein, the video signals already written in the pixels in one row before (the (i−1)-th row) are compared with the video signals to be newly written in the next row (the i-th row). Then, if there is a column where the video signals are different, the video signal is written only in the column where the video signal is different from the video signal already written in one row before by using the structure shown in any of Embodiment Modes 1 to 4.

In this manner, video signals already written in pixels of a certain row are compared with video signals to be newly written in the pixels, and video signals to be newly written in a row are compared with video signals already written in one row before. Then, by operating the device so that the power consumption is the minimum, the power consumption can be reduced more effectively.

That is to say, the present invention can employ all the structures formed by combining the structure shown in this embodiment mode and the structure shown in any of the above embodiment modes.

Embodiment Mode 7

This embodiment mode will explain a structure example of a signal line driving circuit with reference to drawings, which is applied in a case where video signals to be newly written in pixels of a certain row are identical with video signals already written in the pixels of the row (i.e., video signals stored in the pixels). Specifically, description is made of a signal line driving circuit having a structure in which a video signal is not written to a pixel if a video signal to be newly written in a pixel of a certain row is identical with a video signal already written in the pixel of the certain row.

Figure 30A:
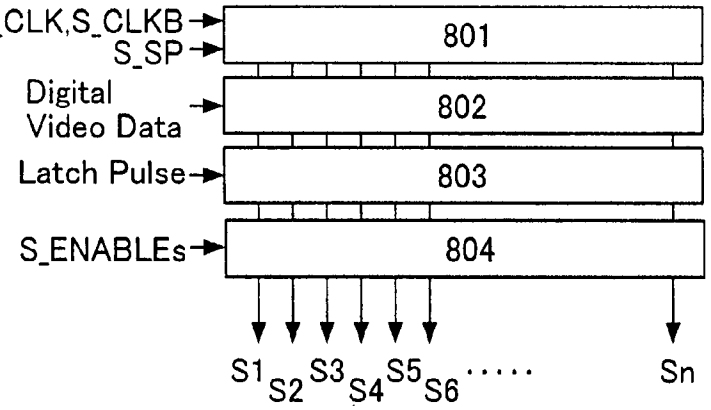
FIGS. 30A and 30B each explain a structure example of a signal line driving circuit of a display device of the present invention.
Figure 30B:
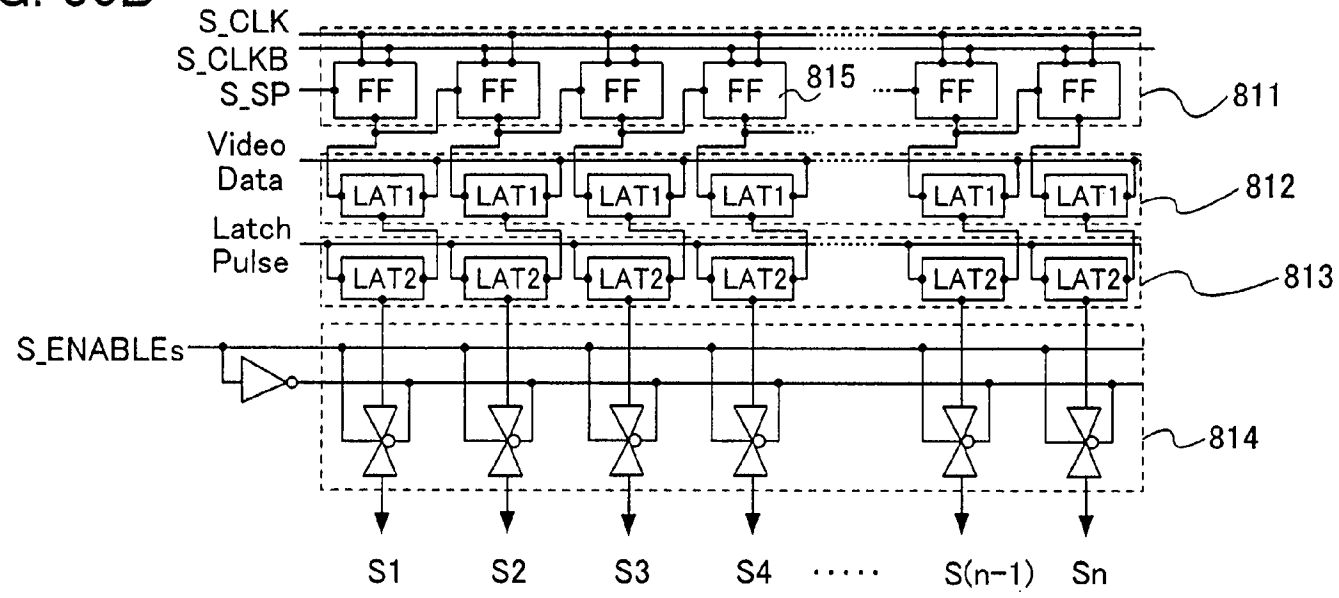

Here, FIGS. 30A and 30B show an example of a signal line driving circuit of a display device in this embodiment mode.

The signal line driving circuit shown in FIG. 30A includes a pulse output circuit 801, a first latch circuit portion 802, a second latch circuit portion 803, and an output controlling circuit 804. A clock signal (S_CLK), an inverted clock signal (S_CLKB), and a start pulse signal (S_SP) are inputted to the pulse output circuit 801. Sampling pulses are sequentially outputted in accordance with these signals.

The sampling pulse outputted from the pulse output circuit 801 is inputted to the first latch circuit portion 802, and a video signal (Video Data) is held in the first latch circuit portion 802 in accordance with the timing of the signal.

When the holding of the video signal is completed to the last stage in the first latch circuit portion 802, a latch pulse (Latch Pulse) is inputted to the second latch circuit portion 803 in a horizontal flyback period, and the video signals held in the first latch circuit portion 802 are simultaneously transferred to the second latch circuit portion 803.

The video signals transferred to the second latch circuit portion 803 are inputted to the output controlling circuit 804.

Furthermore, an output controlling signal (S_ENABLE) is inputted to the output controlling circuit 804, and this signal controls whether or not the video signals are outputted to signal lines S1 to Sn. Note that when the output controlling circuit 804 does not output the video signals, the signal lines S1 to Sn may be put in a floating state or a fixed potential may be set. As the fixed potential, such a potential as to reduce the power consumption may be set.

Note that the output controlling signal (S_ENABLEs) is at an L level when video signals for one pixel row in which signal writing is conducted to pixels in a subframe period in one frame period are identical with video signals for one row in the preceding subframe period, and the output controlling signal is at an H level when even one of video signals for one row is different. In other words, the video signal is not outputted from the output controlling circuit 804 when the output controlling signal is at an L level, and the video signal is outputted from the output controlling circuit 804 when the output controlling signal is at an H level.

FIG. 30B shows a more detailed structure of the signal line driving circuit. In addition, an operation of the signal line driving circuit is explained using the timing chart of FIG. 31.

A pulse output circuit 811 is formed using plural stages of flip-flop circuits 815 and the like, to which a clock signal (S_CLK), an inverted clock signal (S_CLKB), and a start pulse signal (S_SP) are inputted.

Figure 31:
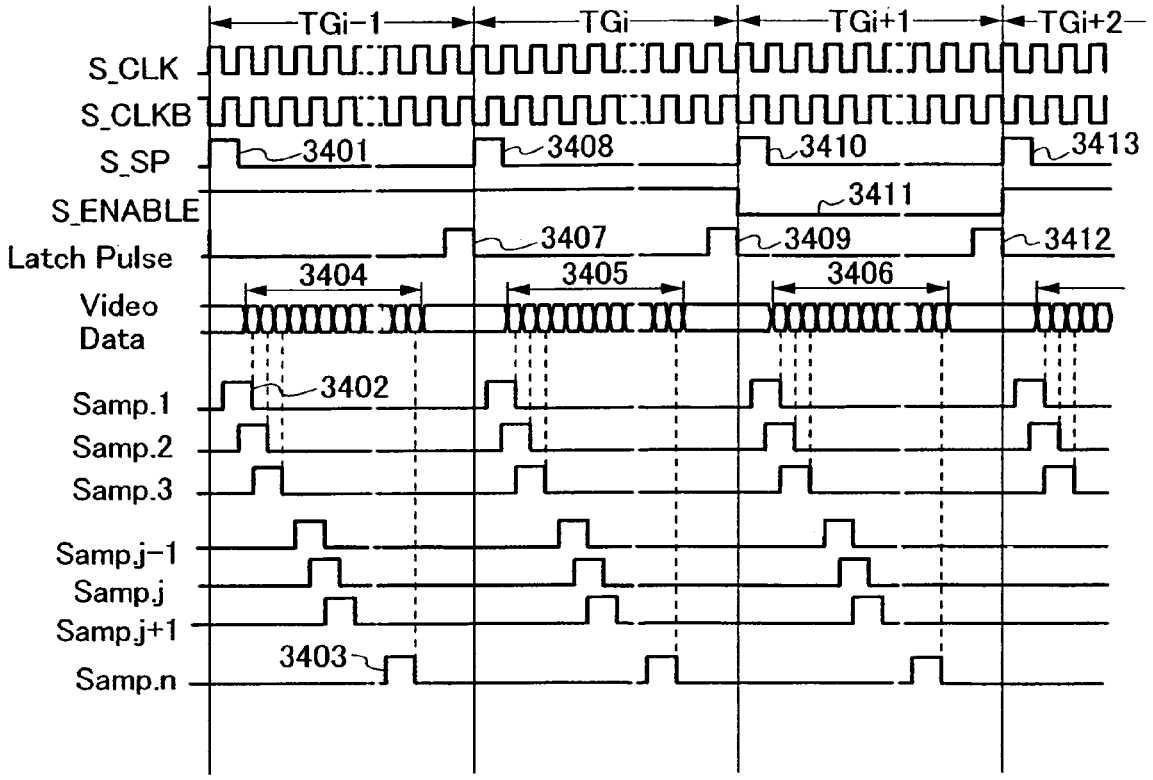
FIG. 31 explains an operation of a signal line driving circuit of a display device of the present invention.

Note that $T_{Gi-1}$, $T_{Gi}$, $T_{Gi+1}$, and $T_{Gi+2}$ in FIG. 31 denote periods for which video signals inputted to pixels in the (j−1)-th row, the j-th row, the (j+1)-th row, and the (j+2)-th row are latched in the first latch circuit portion 812 of the signal line driving circuit in a certain subframe period, respectively. In other words, each of these periods corresponds to one gate selection period. Then, video signal data 3404, video signal data 3405, and video signal data 3406 are inputted to the first latch circuit portion 812 in $T_{Gi-1}$, $T_{Gi}$, and $T_{Gi+1}$, respectively.

First, an operation during $T_{Gi-1}$ is explained. A clock signal (S_CLK) and an inverted clock signal (S_CLKB) are inputted to each of the flip-flop circuits 815, and a start pulse signal (S_SP) is inputted to the flip-flop circuit 815 in the first stage. In FIG. 31, a pulse 3401 corresponds to the start pulse signal of $T_{Gi-1}$.

The pulse 3401 is delayed by a pulse of the clock signal when inputted to the flip-flop circuit 815 in the next stage. This pulse 3402 is inputted as a sampling pulse Samp. 1 to a LAT1 corresponding to a pixel of the first column in the first latch circuit portion 812. Similarly, the output from the flip-flop circuit 815 in the n-th stage is inputted to a LAT1 corresponding to a pixel of the n-th column in the first latch circuit portion 812 as a sampling pulse Samp. n as shown by a pulse 3403.

In $T_{Gi-1}$, the video signal data 3404 is inputted to the first latch circuit portion 812, and the video signal is held in each stage of the latch circuit portion that corresponds to a pixel of each column in accordance with the timing of the input of the sampling pulse. Note that the timing of the input of the sampling pulse means the timing at which the sampling pulse falls from an H level to an L level. At this time, the video signal inputted to the first latch circuit portion 812 is held in each stage of the first latch circuit portion 812.

When the video signal holding is completed to the last stage in the first latch circuit portion 812, a latch pulse (Latch Pulse) 3407 is inputted to the second latch circuit portion 813 in a horizontal flyback period, and the video signals held in the first latch circuit portion 812 are simultaneously transferred to the second latch circuit portion 813. Thereafter, the video signals held in the second latch circuit portion 813 for one pixel row are simultaneously inputted to the output controlling circuit 814.

Note that an output controlling signal (S_ENABLEs) is inputted to the output controlling circuit 814, and whether or not the video signals are outputted to the signal lines S1 to Sn is controlled based on the level of the output controlling signal. Note that the output controlling signal (S_ENABLE) is at an L level when video signals for one pixel row in which signal writing is conducted to pixels in a subframe period in one frame period are identical with video signals for one row in the preceding subframe period, and the output controlling signal is at an H level when even one of the video signals for one pixel row is different.

In other words, the video signal is not outputted from the output controlling circuit 814 when the output controlling signal (S_ENABLEs) is at an L level since an analog switch provided in each stage of the output controlling circuit 814 is turned off, and the video signal is outputted from the output controlling circuit 814 when the output controlling signal (S_ENABLEs) is at an H level since the analog switch provided in each stage is turned on.

Subsequently, the operation proceeds to $T_{Gi}$. Since the output controlling signal (S_ENABLEs) is at an H level, the video signal data 3404 held in the second latch circuit portion 813 is outputted to the signal lines S1 to Sn through the output controlling circuit 814. Then, the start pulse signal (S_SP) is inputted again to the flip-flop circuit 815 in the first stage. A pulse 3408 is the start pulse signal of $T_{Gi}$. Then, the sampling pulse is outputted again. In accordance with the timing of the sampling pulse, the video signal data 3405 is held in each stage of the first latch circuit portion 812. When a latch pulse 3409 is inputted, the video signal data 3405 is simultaneously transferred to the second latch circuit portion 813. The video signal data 3405 for one pixel row is simultaneously inputted to the output controlling circuit 814.

Subsequently, the operation proceeds to $T_{Gi+1}$. Since the output controlling signal (S_ENABLEs) is at an L level, the video signal data 3405 held in the second latch circuit portion 813 is not outputted from the output controlling circuit 814. In other words, the signal lines S1 to Sn are put in a floating state. Then, the start pulse signal (S_SP) is inputted again to the flip-flop circuit 815 in the first stage. A pulse 3410 is the start pulse signal of $T_{Gi+1}$. Then, the sampling pulse is outputted again. In accordance with the timing of the sampling pulse, the video signal data 3406 is held in each stage of the first latch circuit portion 812. When a latch pulse 3412 is inputted, the video signal data 3406 is simultaneously transferred to the second latch circuit portion 813. The video signal data 3406 for one pixel row is simultaneously inputted to the output controlling circuit 814.

Subsequently, the operation proceeds to $T_{Gi+2}$. Since the output controlling signal (S_ENABLEs) is at an H level, the video signal data 3406 held in the second latch circuit portion 813 is outputted to the signal lines S1 to Sn through the output controlling circuit 814. Then, the start pulse signal (S_SP) is inputted again to the flip-flop circuit 815 in the first stage. A pulse 3413 is the start pulse signal of $T_{Gi+2}$.

In a writing period, the above-described operation is repeated to process video signals for a subframe. Furthermore, an image of one frame can be displayed by repeating the processing for the subframe.

Note that the signal lines S1 to Sn are put in a floating state during a period of writing signals in the pixels in the i-th row, in other words, during $T_{Gi+1}$ since the video signal data to be written in the pixels in the i-th row are identical with the signal data already written in the pixels in the i-th row. Accordingly, charging and discharging of the signal lines can be omitted, so that the power consumption can be reduced.

Figure 32A:
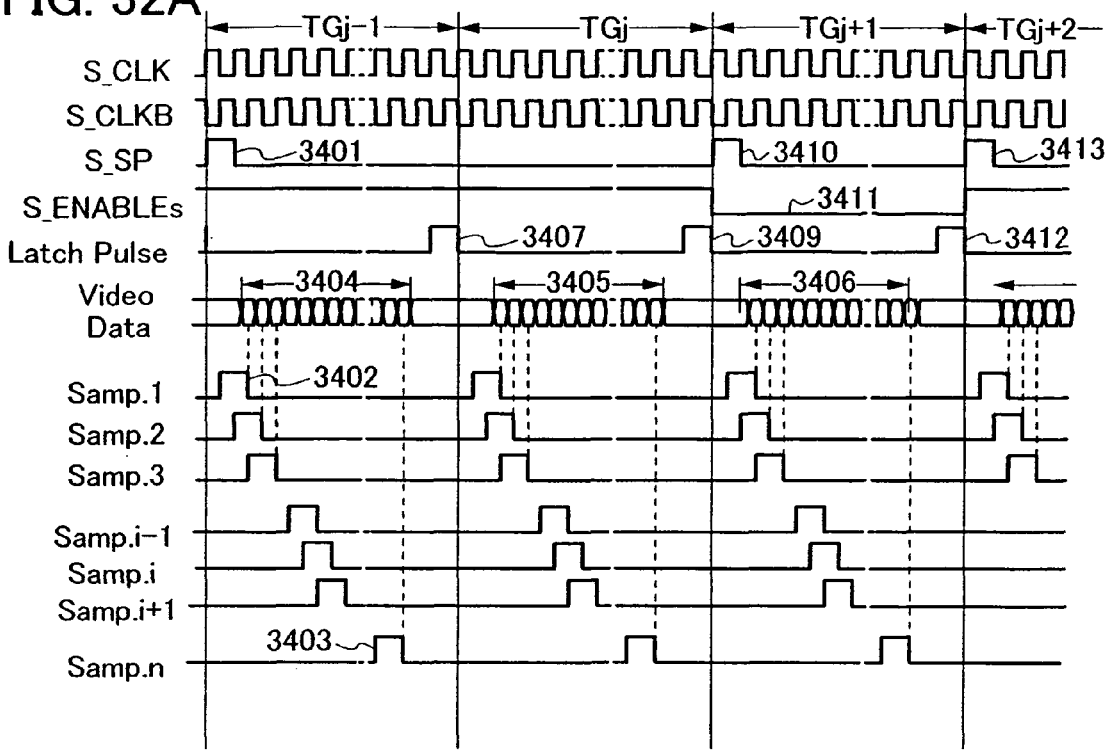
FIGS. 32A and 32B each explain an operation of a signal line driving circuit of a display device of the present invention.

In a period for which the video signals for a pixel row in which signal writing is not conducted are converted from serial into parallel, a pulse of a start pulse signal (S_SP) which triggers a start of holding signal data may be prevented from being inputted. In other words, the pulse of the start pulse signal (S_SP) is not inputted during $T_{Gi}$ as shown in FIG. 32A. Since the sampling pulse is not outputted from the pulse output circuit 811 accordingly, the video signal data 3405 is not held in the first latch circuit portion 812. Thus, charging and discharging of the first latch circuit portion 812 can be omitted. Therefore, the power consumption can further be reduced.

Figure 32B:
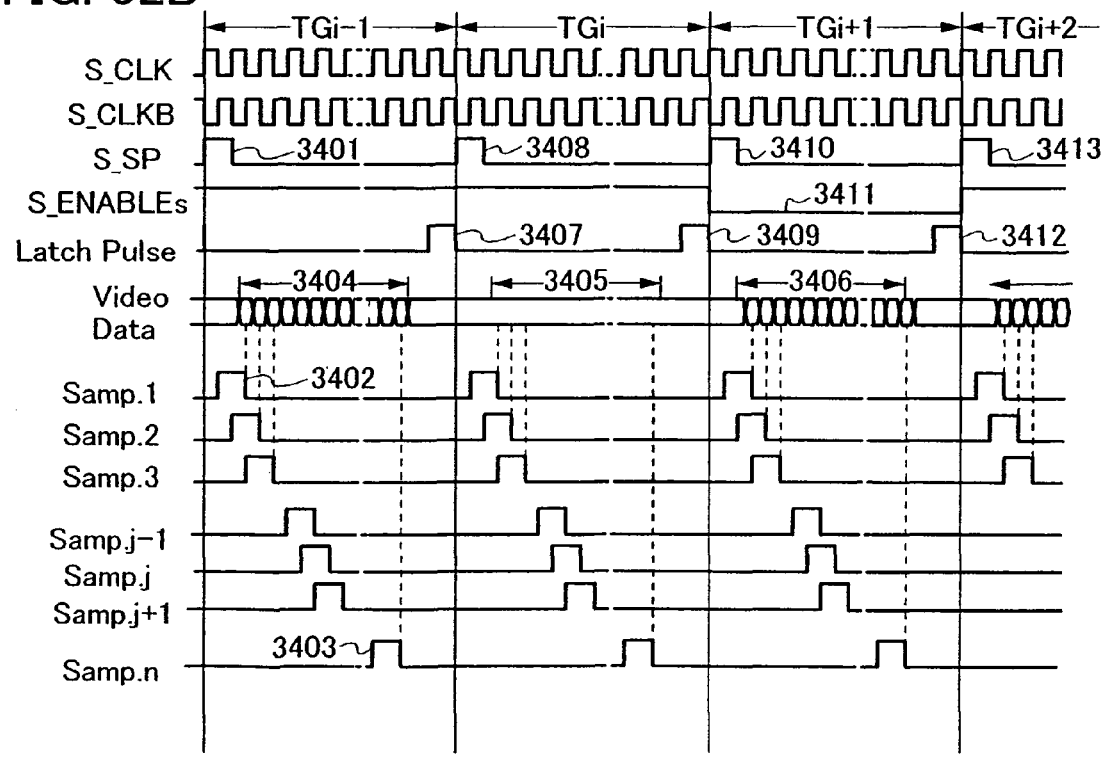

In a period for which the video signals for a pixel row in which signal writing is not conducted are converted from serial into parallel, the video signals are not necessarily inputted to the signal line driving circuit. In other words, the video signal (Video Data) may be prevented from being inputted to the signal line driving circuit during $T_{Gi}$ as shown in FIG. 32B. This is because the video signals held during $T_{Gi}$ are not outputted to the signal lines S1 to Sn, so the video signals do not need to be inputted originally. Since charging and discharging of a video line can be omitted by not inputting the video signal, the power consumption can be reduced. During $T_{Gi}$, such a potential as to reduce the power consumption may be inputted to the video line. Alternatively, the video signal may be put in a floating state. At this time, as shown in FIG. 32A, the structure may be that a pulse of a start pulse signal (S_SP) is not inputted during $T_{Gi}$.

Figure 33A:
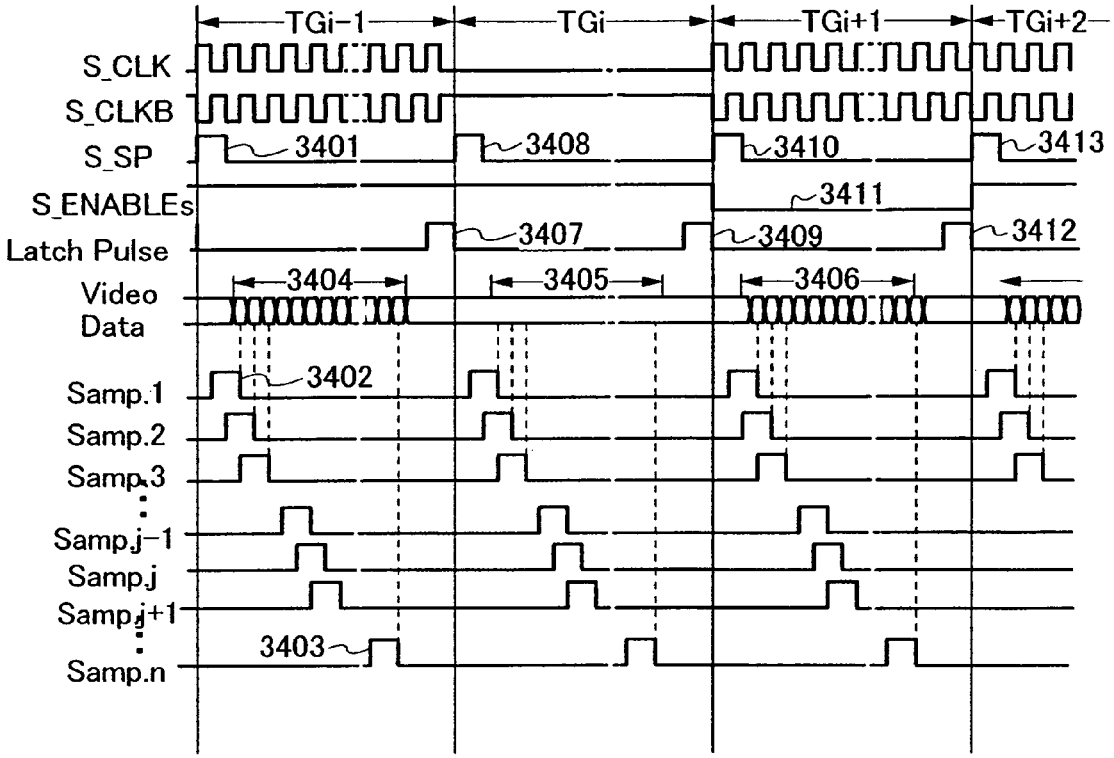
FIGS. 33A and 33B each explain an operation of a signal line driving circuit of a display device of the present invention.

In a period for which the video signals for a pixel row in which signal writing is not conducted are converted from serial into parallel, the clock signal (S_CLK), the inverted clock signal (S_CLKB), and the like are not necessarily inputted. In other words, the clock signal (S_CLK) and the inverted clock signal (S_CLKB) may be prevented from being inputted to the signal line driving circuit during $T_{Gi}$ as shown in FIG. 33A. For example, a fixed potential that is inverted between the clock signal (S_CLK) and the inverted clock signal (S_CLKB) (one is at an H level and the other is at an L level) may be inputted. This is because charging and discharging are not performed in the case of inputting a fixed potential, so the power consumption can be reduced. At this time, the structure may be that a pulse of a start pulse signal is not inputted during $T_{Gi}$ as shown in FIG. 32A, that a video signal is not inputted during $T_{Gi}$ as shown in FIG. 32B, or that a pulse of a start pulse signal and a video signal are not inputted.

Figure 33B:
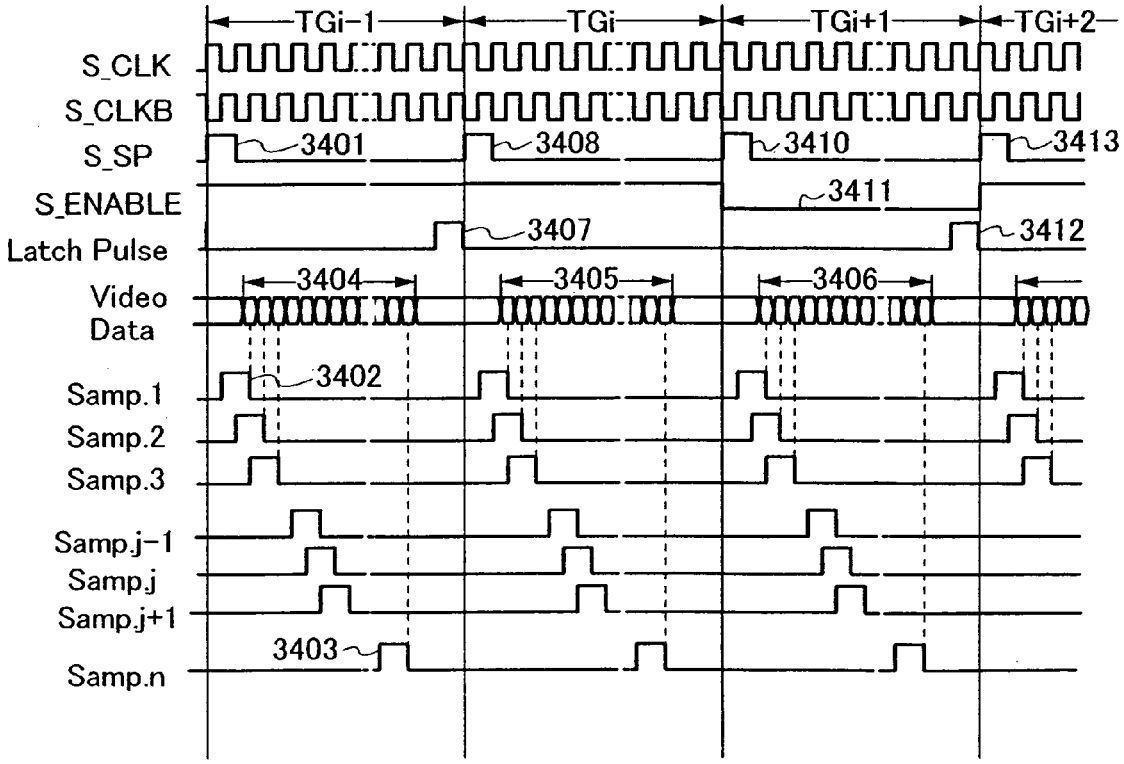

In other words, in a period for which the video signals for a pixel row in which signal writing is not conducted are converted from serial into parallel, the latch pulse is not necessarily inputted. In other words, the latch pulse (Latch Pulse) may be prevented from being inputted to the signal line driving circuit during $T_{Gi}$ as shown in FIG. 33B. Then, signal transfer is not conducted from the first latch circuit portion 812 to the second latch circuit portion 813; thus, charging and discharging can be omitted. Therefore, the power consumption can be reduced. At this time, the structure may be that a pulse of a start pulse signal is not inputted during $T_{Gi}$ as shown in FIG. 32A, that a video signal is not inputted during $T_{Gi}$ as shown in FIG. 32B, that a clock signal or an inverted clock signal is not inputted during $T_{Gi}$ as shown in FIG. 33A, or that a pulse of a start pulse signal, a video signal, a clock signal, and an inverted clock signal are not inputted.

In this manner, if video signals already written in a pixel row are identical with video signals to be newly written in the pixel row, a scan line is not selected; therefore, the signal lines of the pixel row are put in a floating state by using the output controlling circuit when writing a signal in that row, thereby achieving lower power consumption.

This embodiment mode can be freely combined with the above embodiment mode. That is to say, the present invention can employ all the structures formed by combining the structure shown in this embodiment mode and the structure shown in any of the above embodiment modes.

Embodiment Mode 8

In this embodiment mode, description is made of structure examples of a scan line driving circuit and a signal line driving circuit, which are different from those shown in the above embodiment mode, in a case where a video signal to be newly written in a pixel is identical with a video signal already written in the pixel (i.e., a video signal stored in the pixel), with reference to drawings.

Figure 34A:
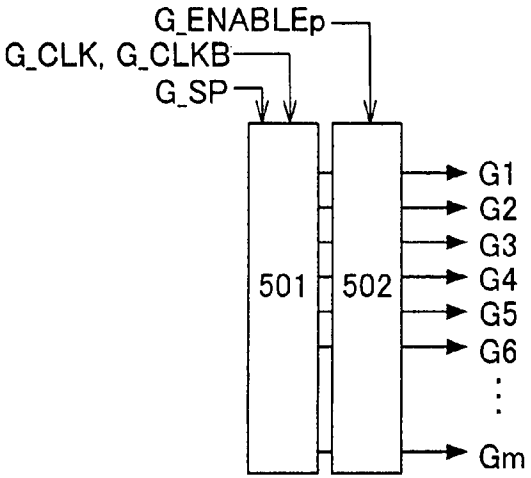
FIGS. 34A to 34C each explain a structure example of a scan line driving circuit of a display device of the present invention.
Figure 34B:
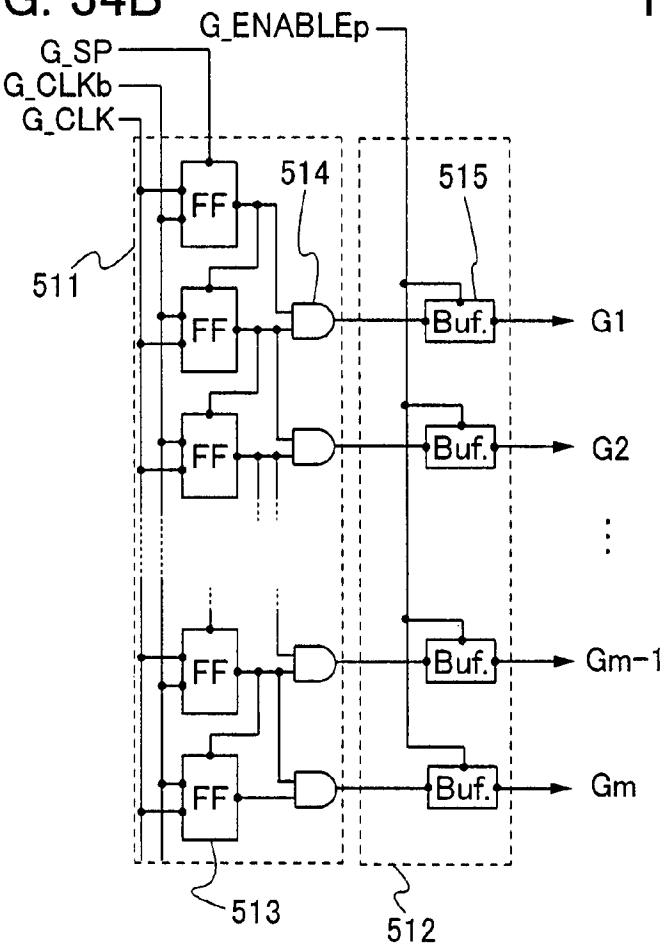
Figure 34C:
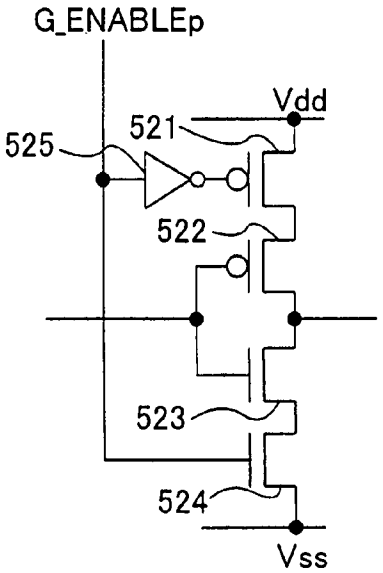

A structure example of a scan line driving circuit applicable to the display device of the present invention is shown in FIGS. 34A to 34C.

First, the scan line driving circuit shown in FIG. 34A includes a pulse output circuit 501 and a buffer 502. A clock signal (G_CLK), an inverted clock signal (G_CLKB), a start pulse signal (G_SP), and the like are inputted to the pulse output circuit 501. Then, scan signals (SC.1 to SC.m) are inputted to the buffer 502 in accordance with the timing of these signals. The scan signals are converted by the buffer 502 into pixel selection signals (G.1 to G.m) having high current supply capability and are then inputted to scan lines G1 to Gm. Here, a sampling controlling signal (G_ENABLEp) is inputted to the buffer 502. Then, the output controlling signal performs control so as not to input a signal among the pixel selection signals G.1 to G.m to the scan line of a pixel row in which signal writing is not conducted.

A more detailed structure example is shown in FIG. 34B.

A pulse output circuit 511 includes plural stages of flip-flop circuits (FF) 513 and AND gates 514, and two input terminals of the AND gate 514 are connected to output terminals of adjacent flip-flop circuits (FF) 513. In other words, one redundant flip-flop circuit 513 with respect to the AND gates 514 is provided in each stage, and the outputs from the adjacent flip-flop circuits (FF) 513 are inputted to the AND gates 514 of the respective stages provided in accordance with the scan lines G1 to Gm.

A clock signal (G_CLK) and an inverted clock signal (G_CLKB) are inputted to each flip-flop circuit 513, and a start pulse signal (G_SP) is inputted to the flip-flop circuit 513 in the first stage. The start pulse signal is delayed by one pulse of the clock signal when inputted to the flip-flop circuit 513 in the next stage. Therefore, a pulse outputted from the AND gate 514 in the first row to which the outputs from the redundant flip-flop circuit 513 in the first stage and the flip-flop circuit 513 in the next stage are inputted corresponds to one pulse of the clock signal. The pulse is inputted as the scan signal SC.1 to an input terminal of a buffer (Buf.) 515 corresponding to a first stage of an output controlling circuit 512. Similarly, the output from the AND gate 514 in the i-th row and the output from the AND gate 514 in the m-th row are inputted as scan signals to an input terminal of the buffer 515 of each stage of the output controlling circuit 512.

In addition, the buffer 515 of each stage of the output controlling circuit 512 includes an output controlling terminal, to which a sampling controlling signal (G_ENABLEp) is inputted. The sampling controlling signals are converted by the buffers 515 into pixel selection signals (G.1 to G.m) having high current supply capability, which are then inputted to the scan lines G1 to Gm. Here, the sampling controlling signal is inputted to each stage of the buffer 512. Then, it is determined in accordance with the sampling controlling signal whether or not the pixel selection signals (G.1 to G.m) that are generated by improving current supply capability of the scan signals (SC.1 to SC.m) are outputted to every stage of the buffer 512.

Note that an example of a buffer provided with an output controlling circuit is shown in FIG. 34C. A p-channel transistor 521 and a p-channel transistor 522, and an n-channel transistor 523 and an n-channel transistor 524 are serially connected. A high power source potential Vdd is set to a source terminal of the p-channel transistor 521, and a low power source potential Vss is set to a source terminal of the n-channel transistor 524. A sampling controlling signal (G_ENABLEp) is inputted to a gate terminal of the n-channel transistor 524, and an inverted signal of the sampling controlling signal by an inverter 525 is inputted to a gate terminal of the p-channel transistor 521. In addition, gate terminals of the p-channel transistor 522 and the n-channel transistor 523 are connected to each other, to which a scan signal (any one of SC.1 to SC.m) is inputted. Here, since the n-channel transistor 524 and the p-channel transistor 521 are turned on when the sampling controlling signal is at an H level, an inverted signal of the scan signal (any one of SC.1 to SC.m) is outputted from either the p-channel transistor 522 or the n-channel transistor 523. On the other hand, since the n-channel transistor 524 and the p-channel transistor 521 are turned off when the sampling controlling signal is at an L level, the signal is not outputted from the buffer and the scan line connected to the buffer is put in a floating state. Note that the levels of the scan signals (SC.1 to SC.m) and the pixel selection signals (G.1 to G.m) are inverted in the case of FIG. 34C. Therefore, an odd number of inverters, for example one inverter, may be additionally provided in each stage. In this case, the additionally provided inverter may be located on an input side of the buffer shown in FIG. 34C. This is because, when the additionally provided inverter is located on an output side of the buffer shown in FIG. 34C, the output to the scan line becomes unstable in the case where the input of the additionally provided inverter is put in a floating state.

Figure 35B:
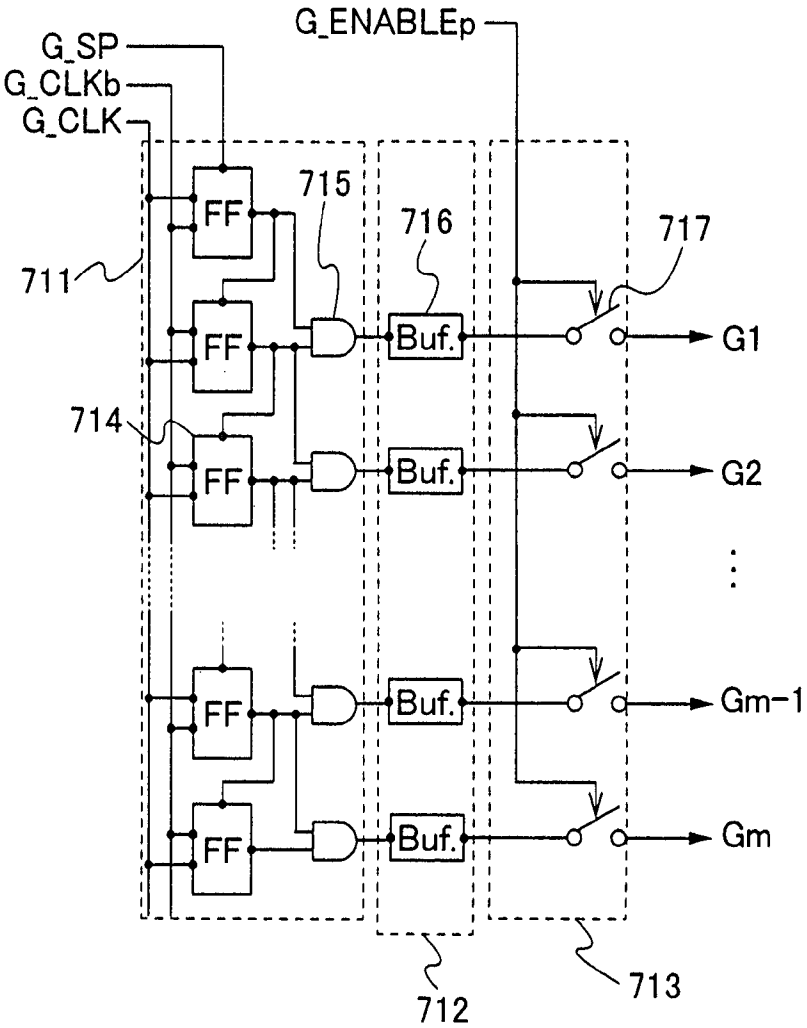
FIGS. 35A and 35B each explain a structure example of a scan line driving circuit of a display device of the present invention.
Figure 35A:
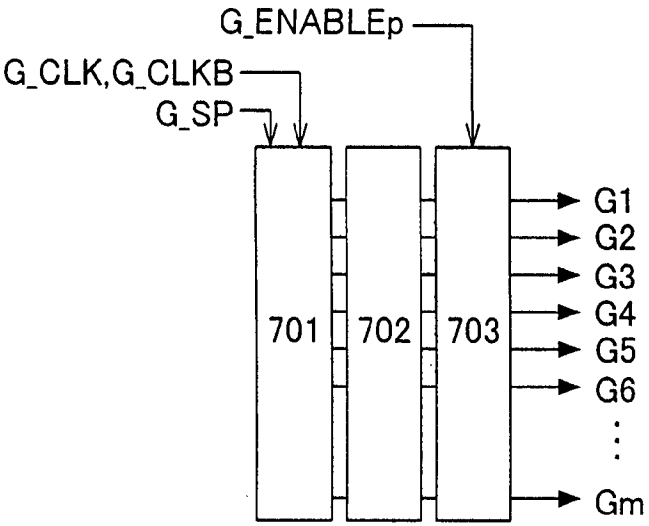

In addition, referring to FIGS. 35A and 35B, explanation is made of a structure example of another scan line driving circuit which is different from that in FIGS. 34A to 34C.

First, the scan line driving circuit shown in FIG. 35A includes a pulse output circuit 701, a buffer 702, and an output controlling circuit 703. A clock signal (G_CLK), an inverted clock signal (G_CLKB), a start pulse signal (G_SP), and the like are inputted to the pulse output circuit 701. Then, scan signals (SC.1 to SC.m) are inputted to the buffer 702 in accordance with the timing of these signals. The scan signals (SC.1 to SC.m) are converted by the buffer 702 into pixel selection signals (G.1 to G.m) having high current supply capability, which are then inputted to the output controlling circuit 703. Here, an output controlling signal (G_ENABLE) is inputted to the output controlling circuit 703. Then, the sampling controlling signal (G_ENABLEp) performs control so as not to output a signal among the pixel selection signals G.1 to G.m to the scan line of a pixel row in which signal writing is not conducted.

A more detailed structure example is shown in FIG. 35B.

A pulse output circuit 711 includes plural stages of flip-flop circuits 714 and AND gates 715, and two input terminals of the AND gate 715 are connected to output terminals of adjacent flip-flop circuits 714. In other words, one redundant flip-flop circuit 714 with respect to the AND gates 715 is provided in each stage, and the outputs from the adjacent flip-flop circuits 714 are inputted to the AND gate 715 of each stage provided in accordance with each of the scan lines G1 to Gm.

A clock signal (G_CLK) and an inverted clock signal (G_CLKB) are inputted to each flip-flop circuit 714, and a start pulse signal (G_SP) is inputted to the flip-flop circuit 714 in the first stage. The start pulse signal is delayed by one pulse of the clock signal when inputted to the flip-flop circuit 714 in the next stage. Therefore, a pulse outputted from the AND gate 715 in the first row to which the outputs from the redundant flip-flop circuit 714 in the first stage and the flip-flop circuit 714 in the next stage are inputted corresponds to one pulse of the clock signal. The pulse is inputted as the scan signal SC.1 to an input terminal of a buffer (Buf.) 716 corresponding to the first stage of the buffer 712. Similarly, the output from the AND gate 715 in the i-th row and the output from the AND gate 715 in the m-th row are inputted as scan signals to respective input terminals of a buffer 716 of each stage of the buffer 712.

The buffer 716 in each stage of the buffer 712 and each of the scan lines G1 to Gm corresponding thereto are connected to one another through a switch 717 in each stage of the output controlling circuit 713. Each switch 717 includes a control terminal, and a sampling controlling signal (G_ENABLEp) is inputted to the output control terminal. Then, it is determined in accordance with the sampling controlling signal whether or not the pixel selection signals (G.1 to G.m) that are generated by improving current supply capability of the scan signals (SC.1 to SC.m) are outputted to every stage of the buffer 712. Here, for example, in the case where the sampling controlling signal is at an L level when a pulse of the pixel selection signal G.1 is outputted from the buffer 716 of the first stage, the switch 717 of the first stage is turned off. Therefore, the scan line G1 connected to the switch 717 of the first stage is put in a floating state. On the other hand, in the case where the sampling controlling signal is at an H level when pulses of the pixel selection signals (G.1 to G.m) are outputted from the buffers 716 of all the stages, the switches 717 of all the stages are turned on during one vertical period. Therefore, the pixel selection signals (G.1 to G.m) are sequentially inputted to the scan lines G1 to Gm.

Figure 36B:
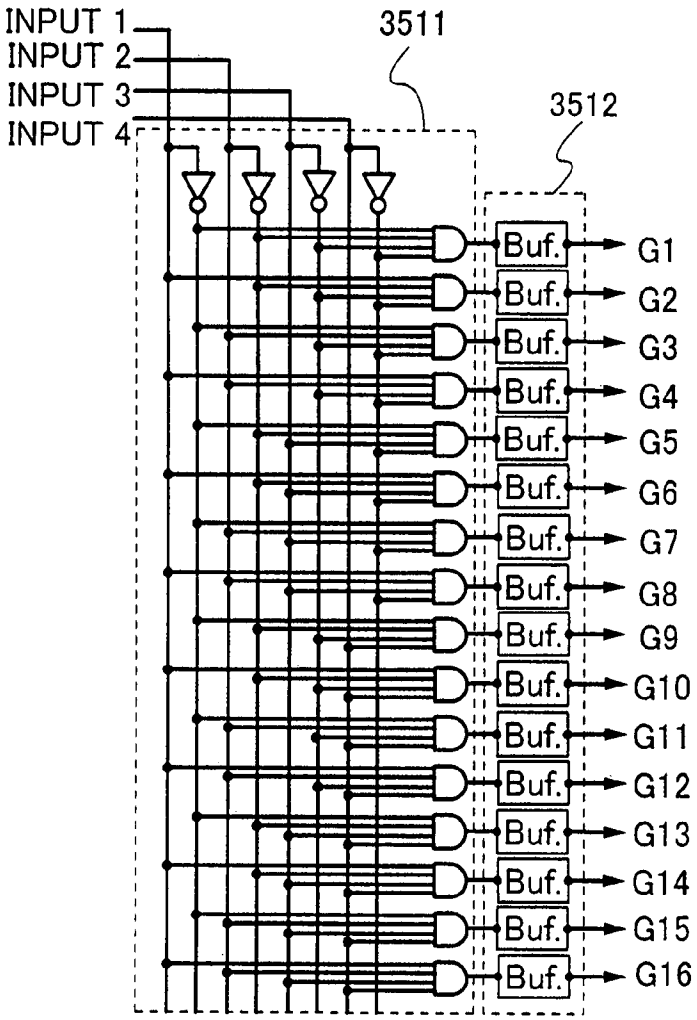
FIGS. 36A and 36B each explain a structure example of a scan line driving circuit of a display device of the present invention.
Figure 36A:
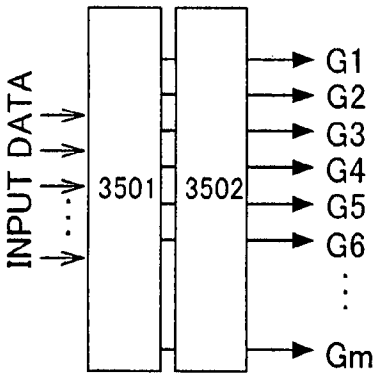

Alternatively, a structure shown in FIG. 36A may be used as the scan line driving circuit.

Scan line selection data is inputted to a decoder circuit 3501, and a pulse signal corresponding to a pixel row selected by the data is outputted. Then, a signal whose current supply capability is improved by a buffer 3502 is outputted to any of G1 to Gm as a pixel selection signal.

A more detailed structure is shown in FIG. 36B. Here, description is made of an example of the case of selecting sixteen scan lines in accordance with four pieces of scan line selection data.

A decoder circuit 3511 includes AND gates 3513 provided corresponding to scan lines G1 to G16 which select pixel rows. In addition, four pieces of scan line selection data, Inputs 1 to 4, are inputted to the decoder circuit 3511. Each AND gate 3513 selects a different combination of the Input 1 or inverted data thereof, the Input 2 or inverted data thereof, the Input 3 or inverted data thereof, and the Input 4 or inverted data thereof. In this manner, the sixteen scan lines G1 to G16 can be arbitrarily selected in accordance with the four inputs.

Note that the scan line driving circuit of the display device of the present invention is not limited to the above-described structure. For example, it may include a level shifter. Note that the level shifter is to shift the level of a signal.

Figure 37B:
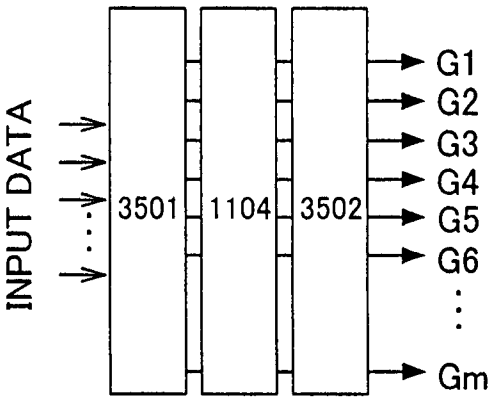
FIGS. 37A and 37B each explain a structure example of a scan line driving circuit of a display device of the present invention.
Figure 37A:
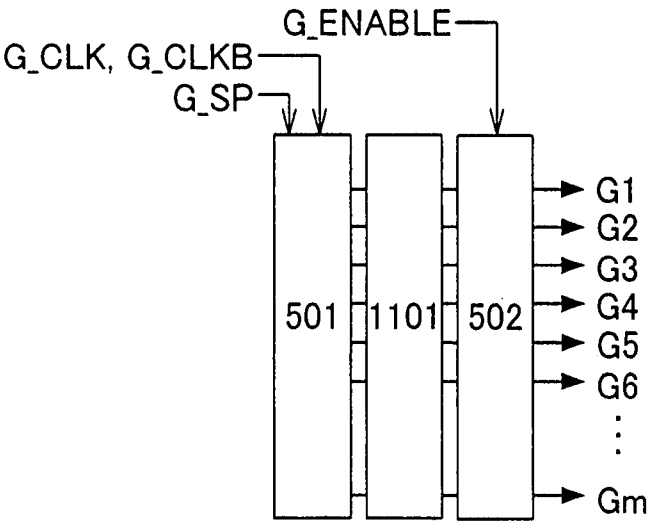

For example, in a structure of FIG. 37A, the output from the pulse output circuit 501 is inputted to a level shifter 1101, the output from the level shifter 1101 is inputted to the buffer 502, and signals selecting pixels are sequentially inputted from the buffer 502 to scan lines G1 to Gm.

In addition, the structure may be that the output from the decoder circuit 3501 is inputted to a level shifter 1104, and signals selecting pixels are sequentially inputted from the buffer 3502 to scan lines G1 to Gm (FIG. 37B).

In this manner, the scan line driving circuit with various structures can be applied to the display device of the present invention. That is to say, the structure may be that if the signals to be inputted to the pixel row connected to one scan line are identical with the signals already inputted to the pixel row, the pixel row is not selected. In other words, the signal to be inputted to the scan line connected to the pixel row is made an L-level signal for not selecting a pixel, or the scan line is put in a floating state.

This embodiment mode can be freely combined with the above embodiment mode. That is to say, the present invention can employ all the structures formed by combining the structure shown in this embodiment mode and the structure shown in any of the above embodiment modes.

Embodiment Mode 9

In this embodiment mode, explanation is made of a pixel and its driving method applicable to a display device of the present invention with reference to drawings. Specifically, explanation is made of a pixel and its driving method of a display device using a time gray scale method.

Note that a self-light-emitting display element such as an EL element is suitable as a display element for the pixels shown in FIGS. 38A to 39D and FIGS. 41 to 42B. Note that each of them shows only one pixel, but a plurality of pixels are arranged in matrix in a row direction and a column direction in a pixel portion of the display device.

Figure 38A:
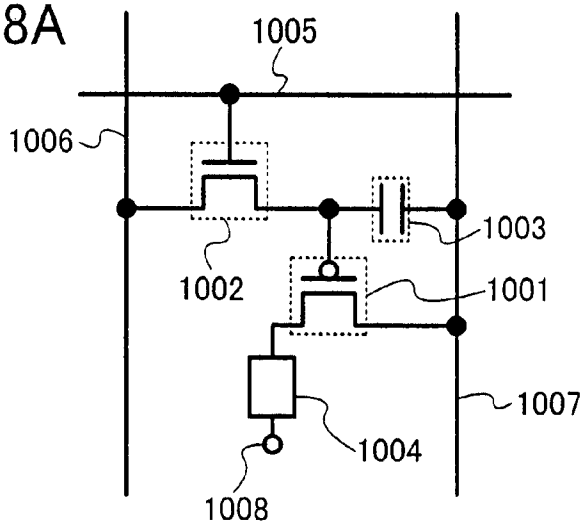
FIGS. 38A to 38D each explain an example of a pixel structure which can be applied to a display device of the present invention.

The pixel shown in FIG. 38A includes a driving transistor 1001, a switching transistor 1002, a capacitor element 1003, a display element 1004, a scan line 1005, a signal line 1006, and a power source line 1007.

A gate terminal of the switching transistor 1002 is connected to the scan line 1005, a first terminal (one of a source terminal and a drain terminal) thereof is connected to the signal line 1006, and a second terminal (the other of the source terminal and the drain terminal) thereof is connected to a gate terminal of the driving transistor 1001. Further, the second terminal of the switching transistor 1002 is connected to the power source line 1007 through the capacitor element 1003. Furthermore, a first terminal (one of a source terminal and a drain terminal) of the driving transistor 1001 is connected to the power source line 1007 and a second terminal (the other of the source terminal and the drain terminal) thereof is connected to a first electrode of the display element 1004. A low power source potential is set to a second electrode 1008 of the display element 1004.

Note that a low power source potential is, based on a high power source potential set to the power source line 1007, a potential satisfying the relation of the low power source potential<the high power source potential, and for example, GND, 0 V, or the like may be set as the low power source potential. Since the display element 1004 is made to emit light by applying a potential difference between the high power source potential and the low power source potential to the display element 1004 and making a current flow to the display element 1004, each potential is set so that the potential difference between the high power source potential and the low power potential is equal to or more than a forward threshold voltage of the display element 1004.

Note that the capacitor element 1003 can be omitted by being substituted by gate capacitance of the driving transistor 1001. The gate capacitance of the driving transistor 1001 may be formed in a region where a source region, a drain region, an LDD region, and the like are overlapped with a gate electrode or may be formed between a channel region and a gate electrode.

When the pixel is selected by the scan line 1005, that is, when the switching transistor 1002 is in an on state, a video signal is inputted from the signal line 1006 to the pixel. Then, charges for a voltage corresponding to the video signal are accumulated in the capacitor element 1003, and the capacitor element 1003 holds the voltage. This voltage is a voltage between the gate terminal and the first terminal of the driving transistor 1001, which corresponds to a gate-source voltage Vgs of the driving transistor 1001.

In general, operating regions of a transistor can be divided into a linear region and a saturation region. These regions are divided when (Vgs−Vth)=Vds is satisfied where Vds is a drain-source voltage, Vgs is a gate-source voltage, and Vth is a threshold voltage. In the case of (Vgs−Vth)>Vds, the transistor operates in a linear region and a current value thereof depends on the levels of Vds and Vgs. On the other hand, in the case of (Vgs−Vth)<Vds, the transistor operates in a saturation region, and ideally, a current value thereof hardly varies even if Vds varies. In other words, the current value depends only on the level of Vgs.

Here, in the case of the voltage input voltage drive method, a video signal is inputted to the gate terminal of the driving transistor 1001 such that the driving transistor 1001 is put in either of two states of being sufficiently turned on and turned off. In other words, the driving transistor 1001 is operated in a linear region. Thus, when the video signal is such a signal as to turn on the driving transistor 1001, the power source potential Vdd set to the power source line 1007 is ideally set to the first electrode of the display element 1004 without any change.

In other words, ideally, a voltage applied to the display element 1004 is made constant, so that the luminance obtained from the display element 1004 is made constant. Then, a plurality of subframe periods are provided in one frame period, the video signal is written in a pixel in each subframe period to control lighting and non-lighting of the pixel in each subframe period, so that a gray scale is expressed depending on the total of subframe periods in which the pixel is in a lighting state.

Figure 38B:
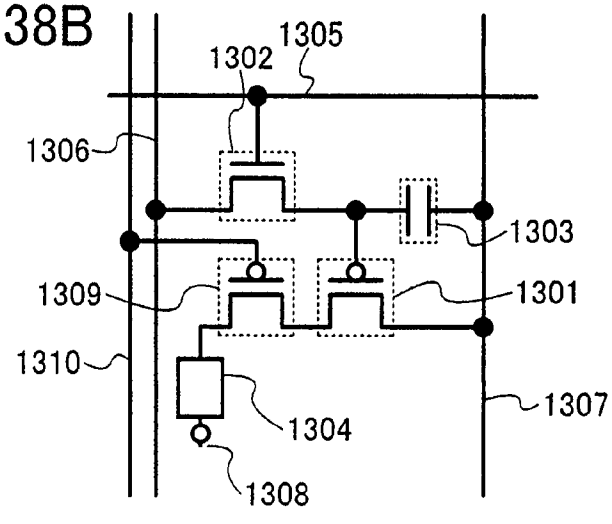

Subsequently, a pixel structure of FIG. 38B is explained. The pixel shown in FIG. 38B includes a driving transistor 1301, a switching transistor 1302, a current controlling transistor 1309, a capacitor element 1303, a display element 1304, a scan line 1305, a signal line 1306, and a power source line 1307, and a wire 1310.

A gate terminal of the switching transistor 1302 is connected to the scan line 1305, a first terminal (one of a source terminal and a drain terminal) thereof is connected to the signal line 1306, and a second terminal (the other of the source terminal and the drain terminal) thereof is connected to a gate terminal of the driving transistor 1301. Further, the second terminal of the switching transistor 1302 is connected to the power source line 1307 through the capacitor element 1303. Furthermore, a first terminal (one of a source terminal and a drain terminal) of the driving transistor 1301 is also connected to the power source line 1307 and a second terminal (the other of the source terminal and the drain terminal) thereof is connected to a first terminal (one of a source terminal and a drain terminal) of the current controlling transistor 1309.

A second terminal (the other of the source terminal and the drain terminal) of the current controlling transistor 1309 is connected to a first electrode of the display element 1304, and a gate terminal thereof is connected to the wire 1310. In other words, the driving transistor 1301 and the current controlling transistor 1309 are serially connected. Note that a low power source potential is set to a second electrode 1308 of the display element 1304. Note that the low power source potential is, based on a high power source potential set to the power source line 1307, a potential satisfying the relation of the low power source potential<the high power source potential, and for example, GND, 0 V, or the like may be set as the low power source potential.

In this pixel structure, the current controlling transistor 1309 is operated in a saturation region to supply a constant current to the display element 1304 when the pixel is in a lighting state. In other words, potentials of the wire 1310, the power source line 1307, and the second electrode 1308 are set so that a gate-source voltage Vgs and a drain-source voltage Vds of the current controlling transistor 1309 satisfy (Vgs−Vth)<Vds. Note that Vth denotes a threshold voltage of the current controlling transistor 1309.

Therefore, ideally, a current value thereof hardly varies even when Vds varies. In other words, the current value depends only on the level of Vgs; accordingly, the current value is determined by the potentials set to the power source line 1307 and the wire 1310. Note that the capacitor element 1303 can be deleted by being substituted by gate capacitance of the driving transistor 1301.

While the pixel is selected by the scan line 1305, that is, while the switching transistor 1302 is in an on state, a video signal is inputted from the signal line 1306 to the pixel. Then, charges for a voltage corresponding to the video signal are accumulated in the capacitor element 1303, and the capacitor element 1303 holds the voltage. This voltage is a voltage between the gate terminal and the first terminal of the driving transistor 1301, which corresponds to a gate-source voltage Vgs of the driving transistor 1301.

Then, a video signal is inputted such that Vgs of the driving transistor 1301 is put in either of two states of being sufficiently turned on and turned off. In other words, the driving transistor 1301 is operated in a linear region.

Thus, when the video signal is such a signal as to turn on the driving transistor 1301, the power source potential Vdd set to the power source line 1307 is ideally set to the first terminal of the current controlling transistor 1309 without any change. At this time, the first terminal of the current controlling transistor 1309 is a source terminal, and a current supplied to the display element 1304 is determined by the gate-source voltage of the current controlling transistor 1309 set by the wire 1310 and the power source line 1307.

In other words, ideally, a current applied to the display element 1304 is made constant, so that the luminance obtained from the display element 1304 is made constant. Then, a plurality of subframe periods are provided in one frame period, the video signal is written in a pixel in each subframe period to control lighting and non-lighting of the pixel in each subframe period, so that a gray scale is expressed depending on the total of subframe periods in which the pixel is in a lighting state.

Figure 38C:
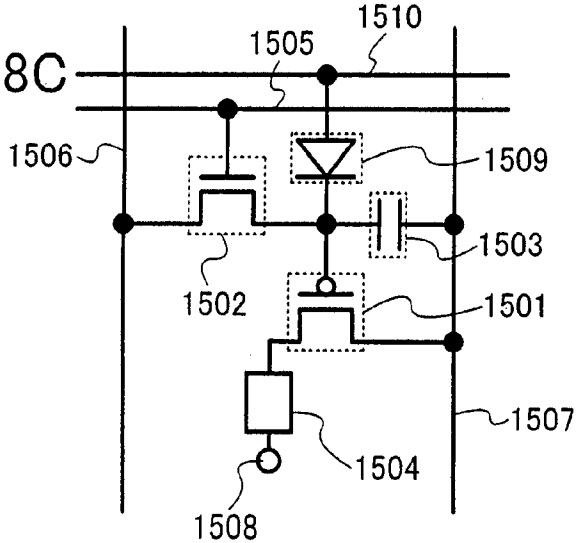

Subsequently, a pixel structure of FIG. 38C is explained. The pixel shown in FIG. 38C includes a driving transistor 1501, a switching transistor 1502, a capacitor element 1503, a display element 1504, a first scan line 1505, a signal line 1506, a power source line 1507, an erasing diode 1509, and a second scan line 1510. A gate terminal of the switching transistor 1502 is connected to the first scan line 1505, a first terminal (one of a source terminal and a drain terminal) thereof is connected to the signal line 1506, and a second terminal (the other of the source terminal and the drain terminal) thereof is connected to a gate terminal of the driving transistor 1501. Furthermore, the gate terminal of the driving transistor 1501 is connected to the second scan line 1510 through the rectifying element (diode 1509). In addition, the second terminal of the switching transistor 1502 is connected to the power source line 1507 through the capacitor element 1503.

In addition, a first terminal (one of a source terminal and a drain terminal) of the driving transistor 1501 is connected to the power source line 1507, and a second terminal (the other of the source terminal and the drain terminal) thereof is connected to a first electrode of the display element 1504. A low power source potential is set to a second electrode 1508 of the display element 1504. Note that the low power source potential is, based on a high power source potential set to the power source line 1507, a potential satisfying the relation of the low power source potential<the high power source potential, and for example, GND, 0 V, or the like may be set as the low power source potential.

Since the display element 1504 is made to emit light by applying a potential difference between the high power source potential and the low power source potential to the display element 1504 and making a current flow to the display element 1504, each potential is set so that the potential difference between the high power source potential and the low power source potential is equal to or more than a forward threshold voltage of the display element 1504. Note that the capacitor element 1503 can be deleted by being substituted by gate capacitance of the driving transistor 1501.

This pixel structure is a structure in which the erasing diode 1509 and the second scan line 1510 are added to the pixel of FIG. 38A. Therefore, the driving transistor 1501, the switching transistor 1502, the capacitor element 1503, the display element 1504, the first scan line 1505, the signal line 1506, and the power source line 1507 correspond to the driving transistor 1001, the switching transistor 1002, the capacitor element 1003, the display element 1004, the scan line 1005, the signal line 1006, and the power source line 1007 of the pixel in FIG. 38A, respectively. Since the writing operation and the light emission operation are similar, explanation thereof is omitted here.

An erasing operation is explained. At the time of the erasing operation, an H-level signal is inputted to the second scan line 1510. Then, a current flows to the rectifying element 1509, and a gate potential of the driving transistor 1501, which is held by the capacitor element 1503, can be set to a certain potential. In other words, the potential of the gate terminal of the driving transistor 1501 can be set to a certain potential, and the driving transistor 1501 can be forced to be turned off regardless of the video signal written in the pixel.

Figure 38D:
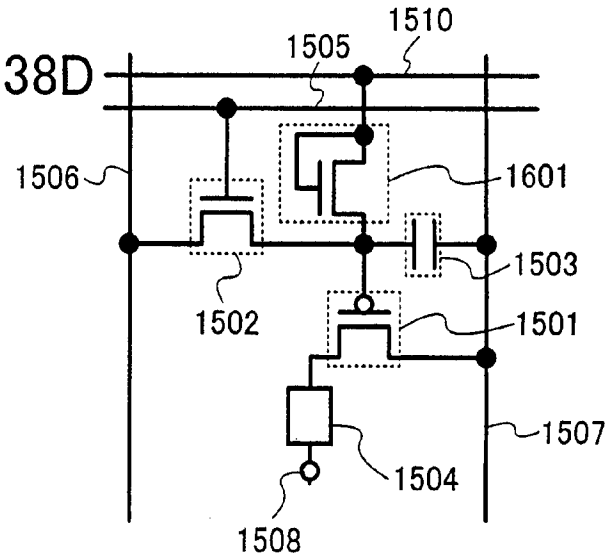

Note that a diode-connected transistor can be used as the rectifying element 1509. Furthermore, a PN-junction or PIN-junction diode, a Schottky diode, a diode formed with a carbon nanotube, or the like may be used in place of the diode-connected transistor. The case of applying a diode-connected n-channel transistor is shown in FIG. 38D.

A first terminal (one of a source terminal and a drain terminal) of a diode-connected transistor 1601 is connected to a gate terminal of the driving transistor 1501, and a second terminal (the other of the source terminal and the drain terminal) of the diode-connected transistor 1601 is connected to the gate terminal and the second scan line 1510. Then, a current does not flow when the second scan line 1510 is at an L level since the gate terminal and the source terminal of the diode-connected transistor 1601 are connected, whereas a current flows to the diode-connected transistor 1601 when an H-level signal is inputted to the second scan line 1510 since the second terminal of the diode-connected transistor 1601 is the drain terminal. Thus, the diode-connected transistor 1601 exerts a rectifying action.

Figure 39A:
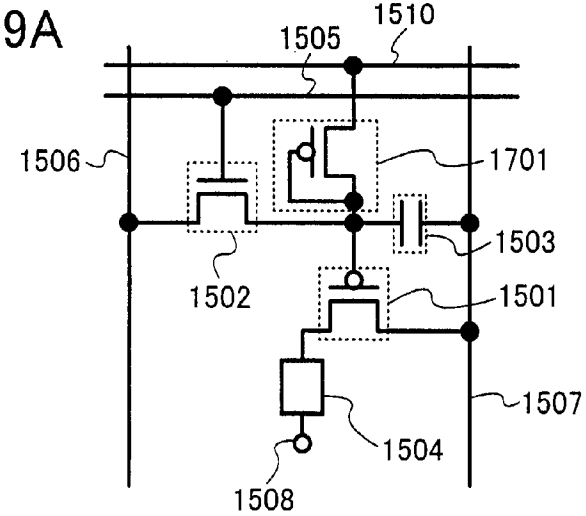
FIGS. 39A to 39D each explain an example of a pixel structure which can be applied to a display device of the present invention.

In addition, the case of applying a diode-connected p-channel transistor is shown in FIG. 39A.

A first terminal (one of a source terminal and a drain terminal) of a diode-connected transistor 1701 is connected to the second scan line 1510. In addition, a second terminal (the other of the source terminal and the drain terminal) of the diode-connected transistor 1701 is connected to a gate terminal thereof and the gate terminal of the driving transistor 1501. Then, a current does not flow when the second scan line 1510 is at an L level since the gate terminal and the source terminal of the diode-connected transistor 1701 are connected, whereas a current flows when an H-level signal is inputted to the second scan line 1510 since the second terminal of the diode-connected transistor 1701 is the drain terminal. Thus, the diode-connected transistor 1701 exerts a rectifying action.

Note that an L-level signal to be inputted to the second scan line 1510 is set to have such a potential not allowing a current to flow to the rectifying element 1509, the diode-connected transistor 1601, and the diode-connected transistor 1701 when a video signal for non-lighting is written in the pixel. Note that, in the gate terminal, an H-level signal to be inputted to the second scan line 1510 is set to have such a potential as to turn off the driving transistor 1501 regardless of the video signal written in the pixel.

In addition, an erasing transistor may be provided to erase the signal written in the pixel. The pixel shown in FIG. 39B has a structure in which an erasing transistor 1809 and a second scan line 1810 are added to the pixel of FIG. 38A. Therefore, a driving transistor 1801, a switching transistor 1802, a capacitor element 1803, a display element 1804, a first scan line 1805, a signal line 1806, and a power source line 1807 correspond to the driving transistor 1001, the switching transistor 1002, the capacitor element 1003, the display element 1004, the scan line 1005, the signal line 1006, and the power source line 1007 of the pixel in FIG. 38A, respectively. Since the writing operation and the light emission operation are similar, explanation thereof is omitted here.

An erasing operation is explained. At the time of the erasing operation, an H-level signal is inputted to the second scan line 1810. Then, the erasing transistor 1809 is turned on, and the potentials of a gate terminal and a first terminal of the driving transistor 1801 can be made equivalent. In other words, a gate-source voltage of the driving transistor 1801 can be 0 V. Note that the potential at an H level of the second scan line 1810 is desirably higher than the potential of the power source line 1807 by the threshold voltage Vth of the erasing transistor 1809 or more. In this manner, the driving transistor can be forced to be turned off.

In addition, the rectifying element and the erasing transistor can be applied to the pixel structure as shown in FIG. 38B. As an example, a structure in which a rectifying element is added to the pixel of FIG. 38B is shown in FIG. 39C. In the structure of FIG. 38B, the gate terminal of the driving transistor 1301 is connected to a second scan line 1902 through a rectifying element 1901. It is to be noted that the writing operation and the light emission operation can be carried out in a similar manner to those of FIG. 38B.

An erasing operation is explained. At the time of the erasing operation, an H-level signal is inputted to the second scan line 1902. Then, a current flows to the rectifying element 1901, and a gate potential of the driving transistor 1301, which is held by the capacitor element 1303, can be set to a certain potential. In other words, the potential of the gate terminal of the driving transistor 1301 can be set to a certain potential, and the driving transistor 1301 can be forced to be turned off regardless of the video signal written in the pixel. In this manner, the pixel can be forced to be in a non-lighting state. Note that a diode-connected n-channel transistor or a diode-connected p-channel transistor can be used as the rectifying element 1901.

Figure 39B:
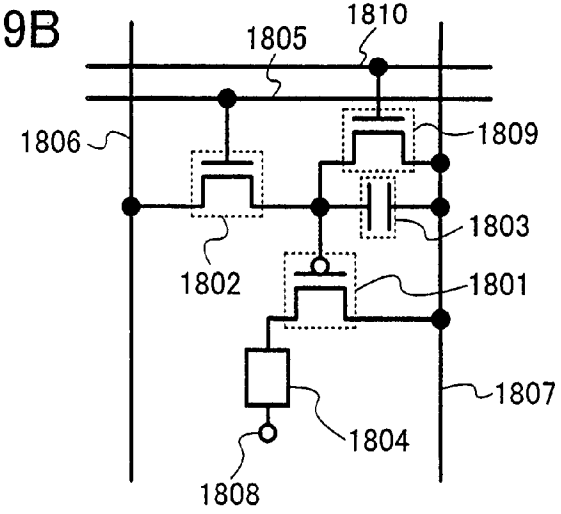
Figure 39C:
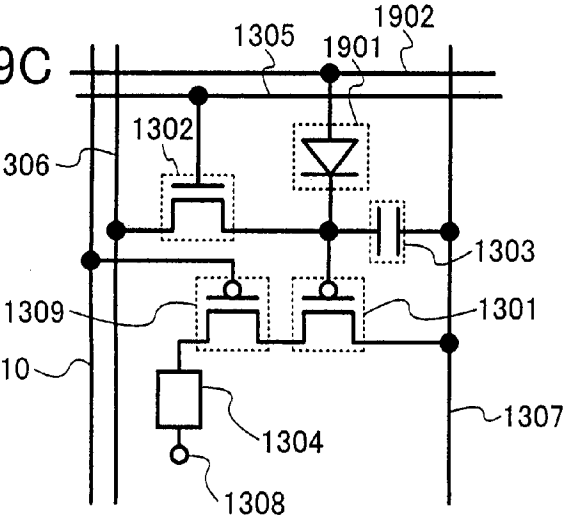
Figure 40:
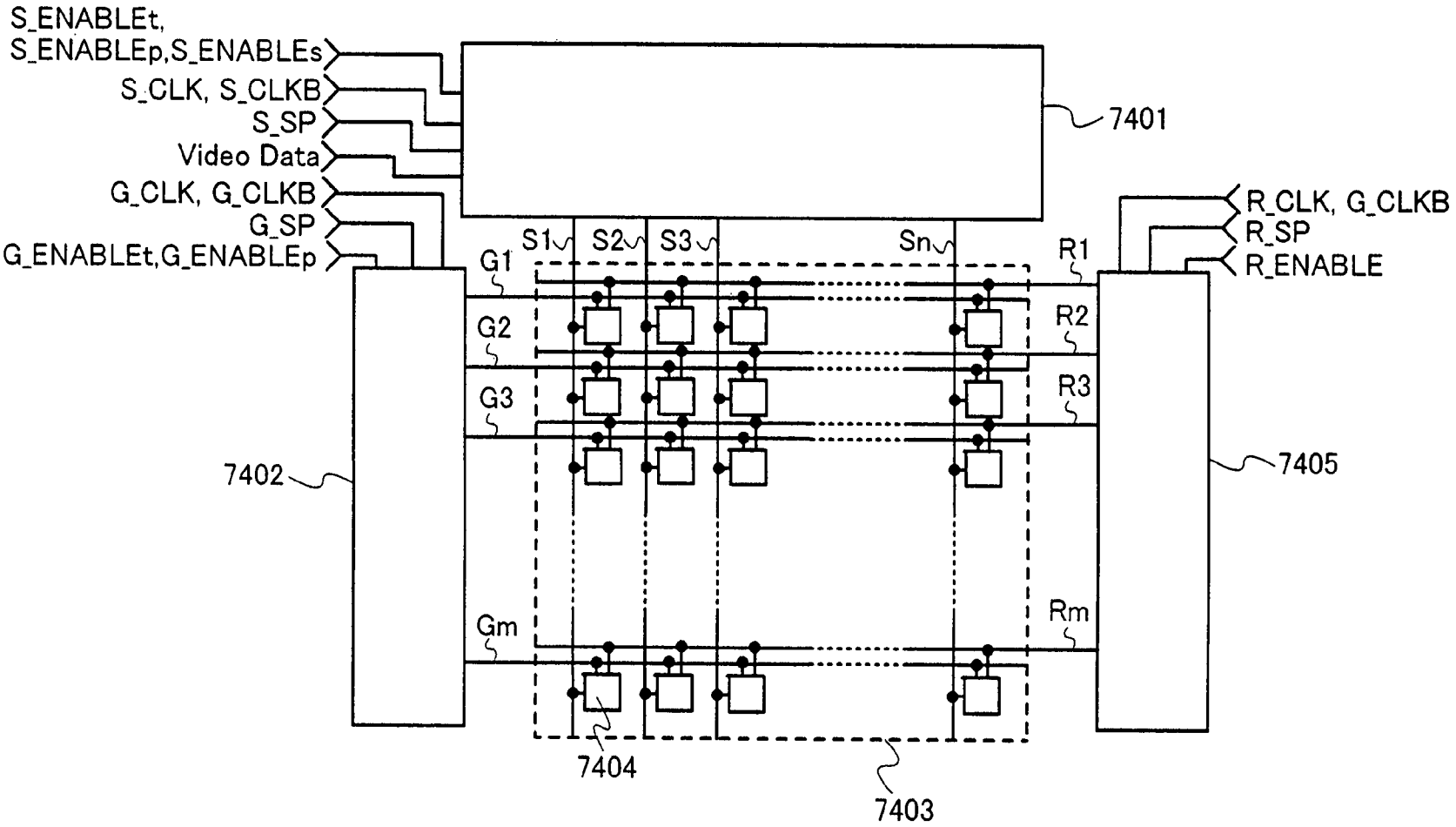
FIG. 40 explains a structure example of a display device of the present invention.

In the case of inputting a signal for putting the pixel in a non-lighting state to the gate terminal of the driving transistor by providing the second scan line and selecting the second scan line as shown in FIGS. 38C, 38D, 39A, 39B, and 39C, a structure of a display device, for example, as shown in FIG. 40 can be used.

The display device includes a signal line driving circuit 7401, a first scan line driving circuit 7402, a second scan line driving circuit 7405, and a pixel portion 7403. In addition, a plurality of pixels 7404 are provided in matrix in the pixel portion 7403 in accordance with signal lines S1 to Sn extended in a column direction from the signal line driving circuit 7401, and first scan lines G1 to Gm and second scan lines R1 to Rm extended in a row direction from the first scan line driving circuit 7402 and the second scan line driving circuit 7405, respectively.

Signals such as a clock signal (G_CLK), an inverted clock signal (G_CLKB), and a start pulse signal (G_SP) are inputted to the first scan line driving circuit 7402. A signal is outputted to a first scan line Gi (any one of the first scan lines G1 to Gm) in a selected pixel row in accordance with these signals. Then, a pixel row in which signal writing is to be performed is selected.

In addition, signals such as a clock signal (R_CLK), an inverted clock signal (R_CLKB), and a start pulse signal (R_SP) are inputted to the second scan line driving circuit 7405. A signal is outputted to a second scan line Ri (any one of the second scan lines R1 to Rm) in a selected pixel row in accordance with these signals. Then, a pixel row in which signal erasing is to be performed is selected.

In addition, signals such as a clock signal (S_CLK), an inverted clock signal (S_CLKB), a start pulse signal (S_SP), and a video signal (Digital Video Data) are inputted to the signal line driving circuit 7401. In accordance with these signals, a video signal corresponding to a pixel in each column is outputted to each of the signal lines S1 to Sn.

Thus, the video signals inputted to the signal lines S1 to Sn are written in the pixels 7404 of every column in a pixel row selected by the signal inputted to the first scan line Gi (any one of the scan lines G1 to Gm). Each pixel row is selected by each of the first scan lines G1 to Gm, and the video signal corresponding to each pixel 7404 is written in all of the pixels 7404. Each pixel 7404 holds the written video signal data for a certain period. Then, each pixel 7404 can maintain a lighting or non-lighting state by holding the video signal data for a certain period.

Here, the display device of this embodiment mode is a display device using a time gray scale method in which the lighting and non-lighting of each pixel 7404 are controlled by signal data written in each pixel 7404 and a gray scale is expressed by the length of light emitting time. Note that a period for displaying an image of one display region completely is referred to as one frame period, and the display device of this embodiment mode includes a plurality of subframes in one frame period. The length of each subframe period in this one frame period may be approximately equal or different. In other words, the lighting and non-lighting of each pixel 7404 are controlled in each subframe period in one frame period, and a gray scale is expressed depending on a difference in total time of lighting time of each pixel 7404.

Moreover, in the display device of this embodiment mode, signals which control the output of the sampling pulse and the output of the gate selection pulse are inputted to the signal line driving circuit 7401 and the scan line driving circuit 7402. For example, in a certain subframe in one frame period, video signal data for one row in a pixel row to which signal writing is newly conducted are identical with video signal data for one row already written in the pixel row, a gate selection pulse for selecting that pixel row is not outputted by inputting a transfer controlling signal or a sampling controlling signal to the scan line driving circuit 7402 as shown in the above embodiment mode. Specifically, an L-level signal for not selecting a pixel row is inputted to a scan line of the pixel row, or the scan line of the pixel row is put in a floating state. In addition, the output controlling circuit of the signal line driving circuit 7401 also does not output the video signal. The output from the signal line driving circuit 7401 may be a signal for putting a pixel in a lighting state or may be a signal for putting a pixel in a non-lighting state. Such a signal as to consume as little power as possible may be inputted. Alternatively, the signal lines S1 to Sn may be put in a floating state. Note that the signal which was inputted to the signal line just before may be outputted without any change instead of putting the signal lines in a floating state. This is because charging and discharging of the wire cross capacitance are already completed and the power consumption is therefore not so high. For example, the driving method in the case where the video signals are identical in a row and in a next row in all the columns as aforementioned in the above embodiment mode (for example, FIGS. 14, 15A and 15B, and 17A and 17B) can be applied.

Another structure of the display device of this embodiment mode, signal transfer is not carried out in a shift register of the signal line driving circuit 7401 by inputting a transfer controlling signal, a sampling controlling signal, and the like to the signal line driving circuit 7401 as shown in the above embodiment mode if, in a certain subframe period in one frame period, video signal data to be newly written in a pixel row is identical with that already written in one row before (if writing is not conducted in a pixel of one row before, the video signal is compared with a video signal written in a pixel in the closest row before the certain row).

Therefore, in the display device of this embodiment mode, attention is paid to a certain pixel row. If the signals already inputted to the pixel row are identical with the signals to be newly inputted to the pixel row, the signal is not inputted to that pixel row; thus, the number of times to charge and discharge the scan line or the signal line can be reduced. Accordingly, the power consumption can be reduced. Moreover, attention is paid to a certain pixel row. If a signal to be newly inputted to the pixel row is identical with a signal already written in one row before (if writing is not conducted in a pixel of one row before, the video signal is compared with a video signal written in a pixel in the closest row before the certain row), the signal which was inputted just before to the signal line can be outputted without any change; therefore, the power consumption can be reduced.

Figure 39D:
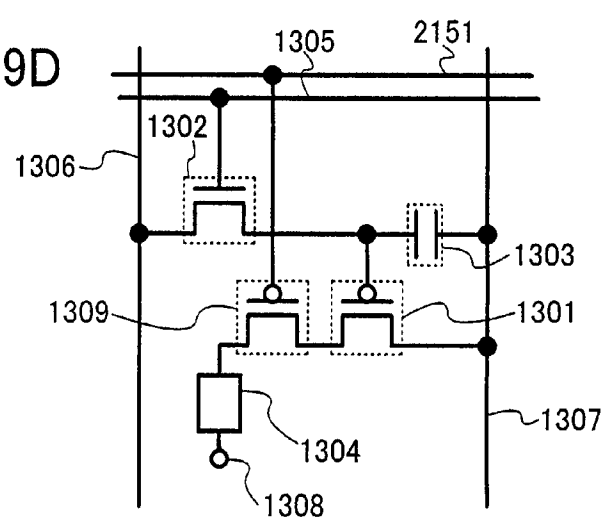

In the case of the pixel structure in FIG. 39D, the pixel can be forced to be in a non-lighting state without providing a rectifying element. For example, in the pixel structure of FIG. 38B, a second scan line 2151 is provided in place of the wire 1310, and the gate terminal of the current controlling transistor 1309 is connected to the second scan line 2151. In order to force the pixel to be in a non-lighting state regardless of the video signal written in the pixel, an H-level signal is inputted to the second scan line 2151. Then, the current controlling transistor 1309 is turned off; therefore, the pixel can be put in a non-lighting state regardless of the video signal written in the pixel. Note that a constant potential is set to the second scan line 2151 and a current flowing to the current controlling transistor 1309 is made constant, except when the pixel is forced to be in a non-lighting state.

Figure 41:
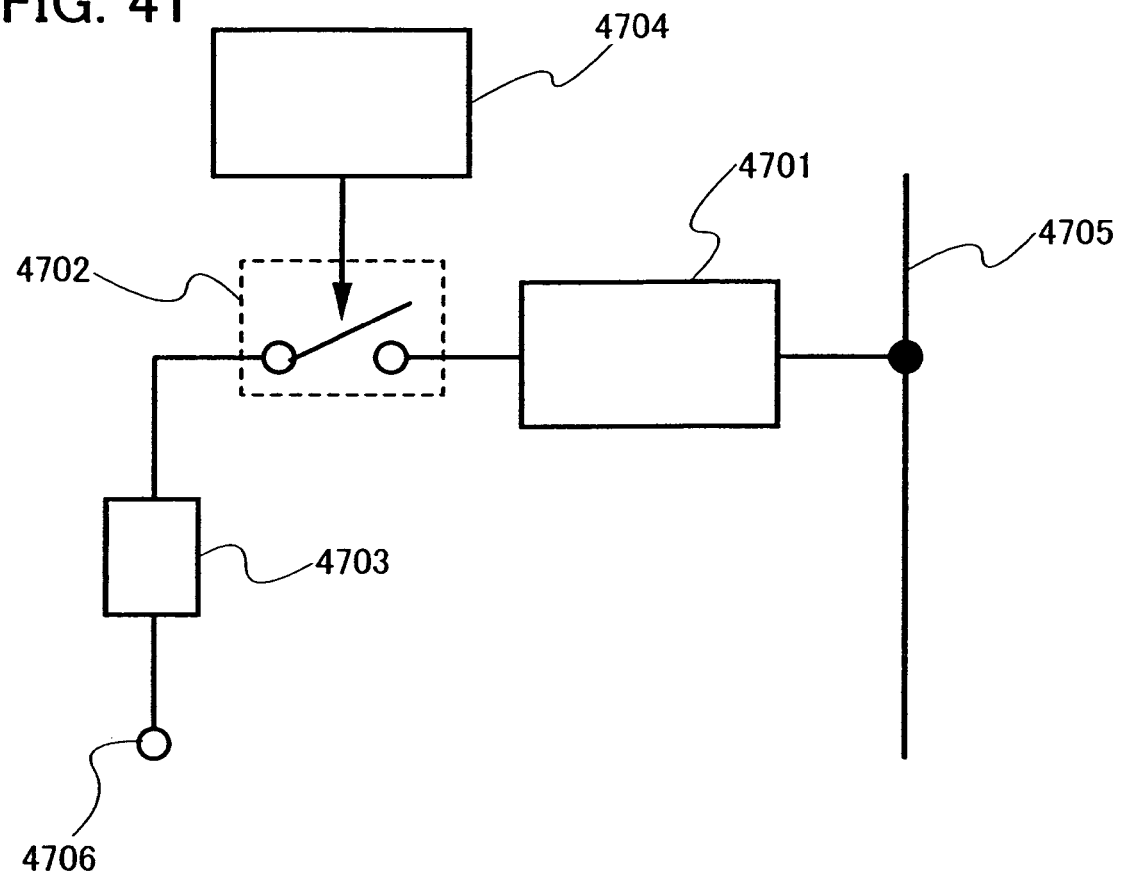
FIG. 41 explains an example of a pixel structure which can be applied to a display device of the present invention.

Subsequently, a pixel of FIG. 41 is explained. The pixel of FIG. 41 includes a current source circuit 4701, a switch 4702, a display element 4703, a signal holding means 4704, and a power source line 4705.

A pixel electrode of the display element 4703 is connected to the power source line 4705 through the switch 4702 and the current source circuit 4701. Note that a signal which controls lighting and non-lighting of the pixel is inputted to the signal holding means 4704, which holds the signal. Then, the switch 4702 is controlled to be turned on or off by this signal.

In addition, potentials set to an opposite electrode 4706 of the display element 4703 and the power source line 4705 are set so as to be able to normally supply a current having a current value programmed in the current source circuit 4701.

According to this pixel structure, a constant current can be continuously supplied to the display element 4703 by programming a constant current value in the current source circuit 4701. Thus, variation in light emission between the pixels can be suppressed. In addition, a constant current can be supplied even if a current-voltage characteristic of the display element 4703 changes due to temperature change. Therefore, a change in luminance of the display element 4703 associated with temperature change can be suppressed.

In addition, the display element 4703 deteriorates over time, and the current-voltage characteristic changes. However, since a constant current can be supplied in this pixel structure, change in luminance of the display element 4703 associated with the deterioration over time can be suppressed. In addition, if the deterioration over time proceeds, a current-luminance characteristic changes. In other words, even when a current having the same current value is made to flow, the luminance of the deteriorated display element 4703 is lower than that of the display element 4703 that is not deteriorated. Thus, in this pixel, the decrease in luminance associated with change over time can be suppressed by programming a current value in the current source circuit 4701 in accordance with the change over time.

Figure 42B:
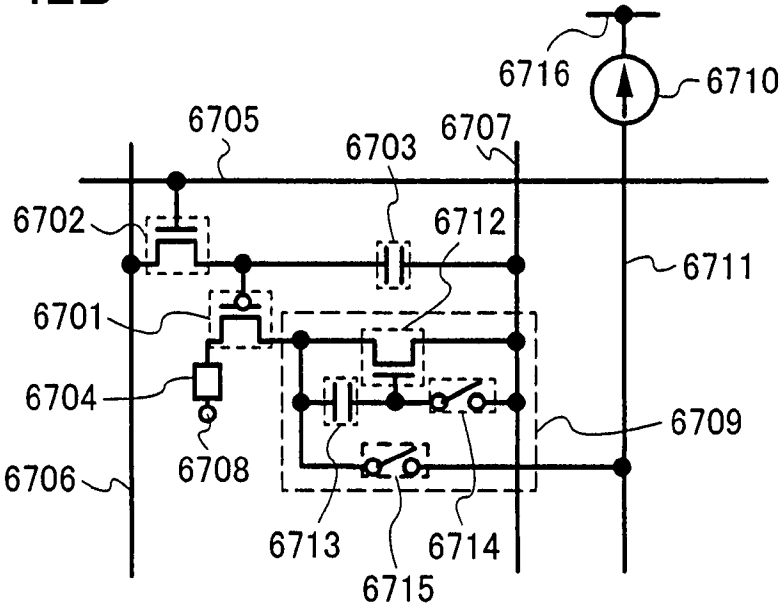
FIGS. 42A and 42B each explain an example of a pixel structure which can be applied to a display device of the present invention.
Figure 42A:
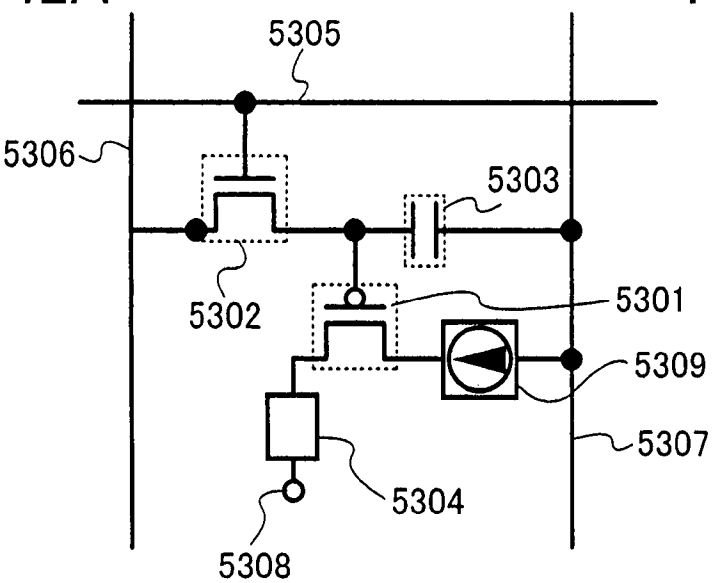

An example of a basic structure of the pixel in FIG. 41 is shown in FIG. 42A. The pixel includes a driving transistor 5301, a switching transistor 5302, a capacitor element 5303, a display element 5304, a scan line 5305, a signal line 5306, a power source line 5307, and a current source circuit 5309.

A gate terminal of the switching transistor 5302 is connected to the scan line 5305, a first terminal (one of a source terminal and a drain terminal) thereof is connected to the signal line 5306, and a second terminal (the other of the source terminal and the drain terminal) thereof is connected to a gate terminal of the driving transistor 5301. In addition, the second terminal (the other of the source terminal and the drain terminal) of the switching transistor 5302 is connected to the power source line 5307 through the capacitor element 5303. Furthermore, a first terminal (one of a source terminal and a drain terminal) of the driving transistor 5301 is connected to the power source line 5307 through the current source circuit 5309, and a second terminal (the other of the source terminal and the drain terminal) thereof is connected to a first electrode of the display element 5304. A low power source potential is set to a second electrode 5308 of the display element 5304. Note that the low power source potential is, based on a high power source potential set to the power source line 5307, a potential satisfying the relation of the low power source potential<the high power source potential, and for example, GND, 0 V, or the like may be set as the low power source potential. Such potentials being able to make a current, which has a current value programmed in the current source circuit 5309, normally flow are set as the high power source potential and the low power source potential. Note that the capacitor element 5303 can be omitted by being substituted by gate capacitance of the driving transistor 5301. The gate capacitance of the driving transistor 5301 may be formed in a region where a source region, a drain region, an LDD region, and the like are overlapped with a gate electrode or may be formed between a channel region and a gate electrode.

The operation of this pixel structure is explained. When the pixel is selected by the scan line 5305, that is, when the switching transistor 5302 is in an on state, a video signal is inputted from the signal line 5306 to the pixel. Then, charges are accumulated in the capacitor element 5303, and the capacitor element 5303 holds the gate potential of the driving transistor 5301.

In general, operating regions of a transistor can be divided into a linear region and a saturation region. These regions are divided when (Vgs−Vth)=Vds is satisfied where Vds is a drain-source voltage, Vgs is a gate-source voltage, and Vth is a threshold voltage. In the case of (Vgs−Vth)>Vds, the transistor operates in a linear region and a current value thereof depends on the levels of Vds and Vgs. On the other hand, in the case of (Vgs−Vth)<Vds, the transistor operates in a saturation region, and ideally, a current value thereof hardly varies even if Vds varies. In other words, the current value depends only on the level of Vgs.

Here, in the case of this structure, the driving transistor 5301 is operated in a linear region. A video signal is inputted to the gate terminal of the driving transistor 5301 such that the driving transistor 5301 is put in either of two states of being sufficiently turned on and turned off. Thus, when the video signal is such a signal as to turn on the driving transistor 5301, a current having a current value programmed in the current source circuit 5309 is set to the first electrode of the display element 5304 without any change.

In other words, a current applied to the display element 5304 is made constant, so that the luminance obtained from the display element 5304 is made constant. Then, a plurality of subframe periods are provided in one frame period, the video signal is written in a pixel in each subframe period to control lighting and non-lighting of the pixel in each subframe period, so that a gray scale is expressed depending on the total of subframe periods in which the pixel is in a lighting state.

Furthermore, a detailed structure example is shown in FIG. 42B. The pixel includes a driving transistor 6701, a switching transistor 6702, a first capacitor element 6703, a display element 6704, a scan line 6705, a signal line 6706, a power source line 6707, a current source transistor 6712, a second capacitor element 6713, a first switch 6714, and a second switch 6715.

A gate terminal of the switching transistor 6702 is connected to the scan line 6705, a first terminal (one of a source terminal and a drain terminal) thereof is connected to the signal line 6706, and a second terminal (the other of the source terminal and the drain terminal) thereof is connected to a gate terminal of the driving transistor 6701. In addition, the second terminal (the other of the source terminal and the drain terminal) of the switching transistor 6702 is connected to the power source line 6707 through the first capacitor element 6703. Furthermore, a first terminal (one of a source terminal and a drain terminal) of the driving transistor 6701 is connected to a first terminal (one of a source terminal and a drain terminal) of the current source transistor 6712. Then, a second terminal (the other of the source terminal and the drain terminal) of the current source transistor 6712 is connected to the power source line 6707. In addition, the first terminal of the current source transistor 6712 is connected to a current supply line 6711 through the second switch 6715. The second terminal of the current source transistor 6712 is connected to a gate terminal thereof through the first switch 6714. The second capacitor element 6713 is connected between the gate terminal and the first terminal of the current source transistor 6712. In addition, the current supply line 6711 is connected to a wire 6716 through a current source 6710.

In this structure, the current source circuit 6709 including the current source transistor 6712, the second capacitor element 6713, the first switch 6714, and the second switch 6715 corresponds to the current source circuit 5309 of the pixel in FIG. 42A. Since the signal writing operation to the pixel and the light emission operation are common, explanation thereof is omitted. Accordingly, programming into the current source circuit 6709 is explained here.

When a current is programmed into the current source circuit 6709, the first switch 6714 and the second switch 6715 are turned on. Then, a current flowing to the current source 6710 is transiently diffused to flow to the second capacitor element 6713 and the current source transistor 6712. Then, in a stationary state, a current flowing to the current source 6710 comes to flow to the current source transistor 6712. Then, charges for a voltage between the gate terminal and the first terminal, in other words, a voltage Vgs between the gate terminal and the source terminal of the current source transistor 6712 for making the current flow are accumulated in the second capacitor element 6713.

In this state, the first switch 6714 and the second switch 6715 are turned off. In this manner, the voltage Vgs between the gate terminal and the source terminal of the current source transistor 6712 is held by the capacitor element 6713. Then, the programming into the current source circuit 6709 is completed. In other words, a current roughly equal to the current flowing to the current source 6710 can be made to flow to the display element 6704 when the driving transistor 6701 is turned on. Note that various pixels can be applied to the display device of this embodiment mode, and the invention is not limited to the above-described pixel.

Subsequently, explanation is made of a driving method applicable to a display device of the present invention.

Figure 43:
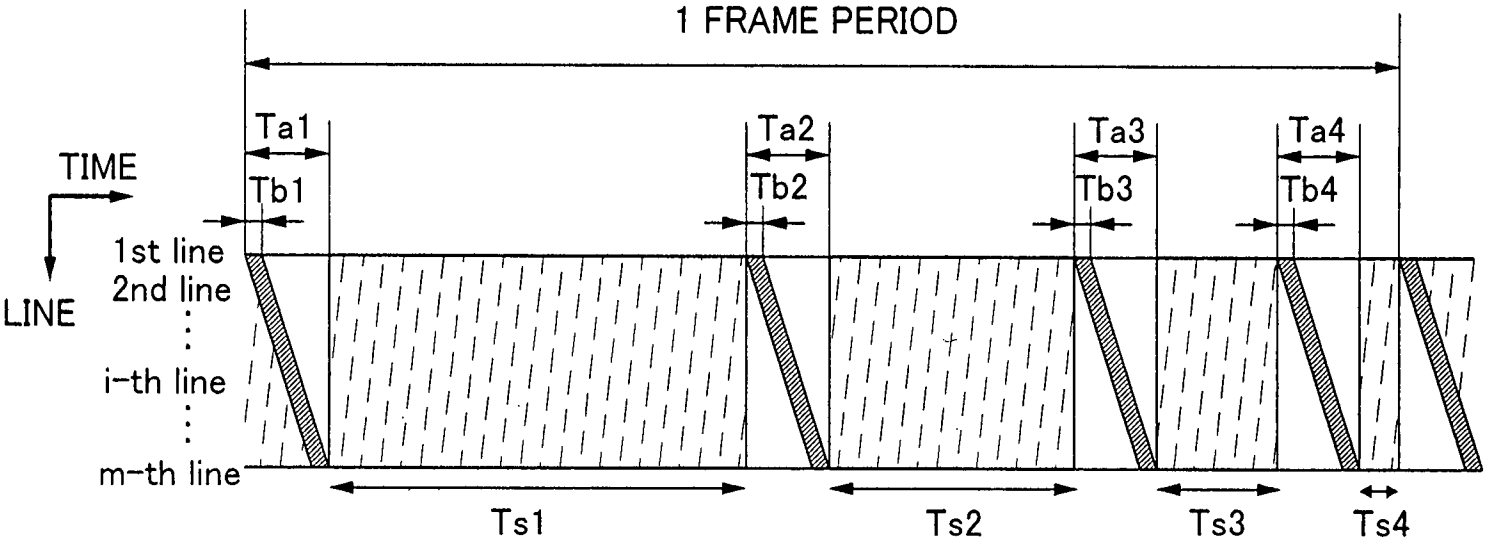
FIG. 43 explains an example of a driving method of a display device of the present invention.

First, a driving method in the case where a signal writing period (address period) to the pixel and a light emission period (sustain period) are separated is explained with reference to FIG. 43. Here, a case of a 4-bit digital time gray scale is explained as an example.

Note that a period for completely displaying an image of one display region is referred to as one frame period. The one frame period includes a plurality of subframe periods, and one subframe period includes an address period and a sustain period. Address periods Ta1 to Ta4 denote time necessary for signal writing to pixels in all rows, and periods Tb1 to Tb4 denote time necessary for signal writing to pixels of one row (or one pixel). In addition, sustain periods Ts1 to Ts4 denote time for maintaining a lighting or non-lighting state in accordance with a video signal written in a pixel, and a ratio of lengths thereof is set to satisfy Ts1:Ts2:Ts3:Ts4$=2^3:2^2:2^1:2^0=8:4:2:1$. A gray scale is expressed depending on which sustain period light emission is performed in.

An operation is explained. First, in the address period Ta1, pixel selection signals are inputted to scan lines sequentially from the first row to select a pixel. Then, a video signal is inputted to the pixel from a signal line when the pixel is selected. When the video signal is written in the pixel, the pixel holds the signal until a signal is inputted again. In accordance with the written video signal, lighting and non-lighting of each pixel in the sustain period Ts1 are controlled. In a similar manner, the video signal is inputted to the pixel in the address periods Ta2, Ta3, and Ta4, and lighting and non-lighting of each pixel in the sustain periods Ts2, Ts3, and Ts4 are controlled in accordance with the video signal. In each subframe period, a pixel is in a non-lighting state during an address period, a sustain period begins after the address period ends, and the pixel to which a signal for lighting is written is put in a lighting state.

Here, in the display device of the present invention, in the case where video signals inputted in an address period in the preceding subframe period are identical in pixels for one row with video signals inputted in a subsequent subframe period, signal writing to the pixels for one row is not conducted in the subsequent subframe period.

Note that signal data in the first subframe period in one frame period is compared with that for pixels in the same row in the last subframe period in one frame period before. When signal data for pixels in the row is identical, the signals are not written to the pixels in the row in the first subframe period in one frame period.

Accordingly, charging and discharging can be reduced, so that the power consumption can be reduced.

For example, charging and discharging of wire cross capacitance of a scan line connected to the pixels in the row and gate capacitance of a transistor connected to the scan line can be omitted by preventing a signal selecting a pixel from being inputted to the scan line in the subsequent subframe period. Therefore, a signal not selecting a pixel may be kept being inputted to the scan line, or the scan line may be put in a floating state.

In addition, in the subsequent subframe period, the power consumption can be reduced by putting a signal line in a floating state or inputting such a potential as to reduce charging and discharging into the signal line in a signal writing period to the pixels in the row. As such a potential as to reduce charging and discharging, signals written just before to pixels for one row may be inputted to the signal line without any change.

Note that the case of expressing a 4-bit gray scale is explained here, but the number of bits and gray scale levels are not limited thereto. In addition, the order of lighting does not always need to be Ts1, Ts2, Ts3, and Ts4, and the order may be random or light emission may be performed with the sustain period divided into a plurality of periods.

Note that such a driving method can be used for a display device including, for example, the pixel shown in FIG. 38A or the pixel shown in FIG. 38B. In the address periods Ta1 to Ta4, potentials of the second electrode 1008 of the display element 1004 or the second electrode 1308 of the display element 1304 may be set higher than that in the sustain period, and may be set to be equal to or lower than a forward threshold voltage of the display element 1004 or the display element 1304. Alternatively, the second electrode 1308 of the display element 1304 may be put in a floating state.

Subsequently, a driving method in the case where the signal writing period (address period) to the pixel and the light emission period (sustain period) are not separated is explained. In other words, a pixel in a row in which a writing operation of a video signal is completed holds the signal until next signal writing (or erasure) to the pixel is performed. A period from the writing operation to the next signal writing operation to the pixel is referred to as data holding time. Then, during the data holding time, the pixel is put in a lighting or non-lighting state in accordance with a video signal written in the pixel. The same operation is performed to the last row, and then, the address period ends. Then, the operation proceeds to the signal writing operation in a next subframe period sequentially from a row in which the data holding time ends.

In the case of a driving method in which the pixel is put in a lighting or non-lighting state in accordance with a video signal written in the pixel immediately after the signal writing operation is completed and the data holding time starts, signals cannot be inputted to two rows at the same time and address periods need to be prevented from overlapping. Therefore, even if the data holding time is attempted to be made shorter than the address period, the data holding time cannot be made short. As a result, it becomes difficult to perform high-level gray scale display.

Thus, the data holding time is set to be shorter than the address period by providing an erasing period. A driving method in the case of setting the data holding time shorter than the address period by providing an erasing period is explained using FIG. 44A.

In the address period Ta1, a scan signal is inputted to a scan line sequentially from the first row to select a pixel. Then, when the pixel is selected, a video signal is inputted to the pixel from a signal line. When the video signal is inputted to the pixel, the pixel holds the signal until a signal is inputted again. In accordance with the written video signal, lighting and non-lighting of each pixel in the sustain period Ts1 are controlled. In other words, in a row in which the writing operation of the video signal is completed, the pixel is immediately put in a lighting or non-lighting state in accordance with the written video signal. The same operation is performed to the last row, and the address period Ta1 ends. Then, the operation proceeds to the signal writing operation in a next subframe period sequentially from a row in which the data holding time ends. In a similar manner, video signals are inputted to pixels in the address periods Ta2, Ta3, and Ta4, and lighting and non-lighting of each pixel in the sustain periods Ts2, Ts3, and Ts4 are controlled in accordance with the video signal. Then, the end of the sustain period Ts4 is set by the start of an erasing operation. This is because, when the signal written in the pixel is erased in erasing time Te of each row, the pixel is forced to be in a non-lighting state regardless of the video signal written in the pixel in the address period until signal writing is performed to a next pixel. In other words, the data holding time ends from a pixel in a row where the erasing time Te starts.

Thus, a display device having data holding time shorter than an address period, a high-level gray scale, and a high duty ratio (ratio of a lighting period to one frame period) can be provided without separating the address period and the sustain period. In addition, the reliability of the display element can be improved since instantaneous luminance can be lowered.

Here, in the display device of the present invention, if video signal data for one row in a pixel row to which signals are newly written is identical with video signal data already written in the pixel row in a certain subframe period in one frame period, signal writing to the pixel row is not conducted. Moreover, if the video signal data to be newly written in the pixels is identical with the video signal data already written in the pixels in one row before (if writing is not conducted in a pixel of one row before, the video signal is compared with a video signal written in a pixel in the closest row before the certain row), signal transfer in a shift register in the signal line driving circuit is not conducted. That is to say, such a driving method is suitable for high-level gray scale display. When high-level gray scale display is performed, the number of times to write a signal to the pixel is increased. Thus, the power consumption can be reduced by reducing the number of times to charge and discharge as in the case of the display device of the present invention.

Note that the case of expressing a 4-bit gray scale is explained here, but the number of bits and gray scale levels are not limited thereto. In addition, the order of lighting does not always need to be Ts1, Ts2, Ts3, and Ts4, and the order may be random or light emission may be performed with the sustain period divided into a plurality of periods.

An erasing operation for starting the above-described erasing time can be performed by selecting a pixel by inputting a signal to the second scan line 1510 in the structures of FIGS. 38C, 38D, and 39A, the second scan line 1810 in the structure of FIG. 39B, or the second scan line 1902 in the structure of FIG. 39C.

An example of the display device having such a pixel is shown in FIG. 40. The display device includes the signal line driving circuit 7401, the first scan line driving circuit 7402, the second scan line driving circuit 7405, and the pixel portion 7403. In the pixel portion 7403, the pixels 7404 are arranged in a matrix form in accordance with the first scan lines G1 to Gm, the second scan lines R1 to Rm, and the signal lines S1 to Sn.

Note that the first scan line Gi (any one of the first scan lines G1 to Gm) corresponds to the first scan line 1505 of FIG. 38C, 38D, or 39A, the first scan line 1805 of FIG. 39B, or the first scan line 1305 of FIG. 39C. The second scan line Ri (any one of the second scan lines R1 to Rm) corresponds to the second scan line 1510 of FIG. 38C, 38D, or 39A, the second scan line 1810 in FIG. 39B, or the second scan line 1902 of FIG. 39C. The signal line Sj (any one of the signal lines S1 to Sn) corresponds to the signal line 1506 of FIG. 38C, 38D, or 39A, the signal line 1806 of FIG. 39B, or the signal line 1306 of FIG. 39C.

Signals such as a clock signal (G_CLK), an inverted clock signal (G_CLKB), a start pulse signal (G_SP), and an output controlling signal (G_ENABLE) are inputted to the first scan line driving circuit 7402. In accordance with these signals, a signal is outputted to the first scan line Gi (any one of the first scan lines G1 to Gm) of a pixel row to be selected.

Signals such as a clock signal (R_CLK), an inverted clock signal (R_CLKB), a start pulse signal (R_SP), and an output controlling signal (R_ENABLE) are inputted to the second scan line driving circuit 7405. In accordance with these signals, a signal is outputted to the second scan line R1 (any one of the second scan lines R1 to Rm) of a pixel row to be selected.

In addition, signals such as a clock signal (S_CLK), an inverted clock signal (S_CLKB), a start pulse signal (S_SP), a video signal (Digital Video Data), and an output controlling signal (S_ENABLE) are inputted to the signal line driving circuit 7401. Then, in accordance with these signals, a video signal corresponding to a pixel of each column is outputted to each of the signal lines S1 to Sn.

Thus, each of the video signals inputted to the signal lines S1 to Sn is written in the pixel 7404 in each column of a pixel row selected by the signal inputted to the first scan line Gi (any one of the first scan lines G1 to Gm). Then, each pixel row is selected by each of the first scan lines G1 to Gm, and video signals corresponding to respective pixels 7404 are written in all of the pixels 7404. Each pixel 7404 holds the video signal data written therein for a certain period. Each pixel 7404 can maintain a lighting or non-lighting state by holding the video signal data for a certain period.

In addition, a signal for putting the pixel in a non-lighting state (also referred to as an erasing signal) is written in the pixel 7404 of each column in a pixel row selected by the signal inputted to the second scan line Ri (any one of the second scan lines R1 to Rm). Then, a non-lighting period can be set by selecting each pixel row by each of the second scan lines R1 to Rm. For example, in FIGS. 44A and 44B, the erasing time Te is one gate selection period (one horizontal period) in the second scan line Ri.

In addition, the display device of the present invention includes output controlling circuits in the signal line driving circuit 7401, the first scan line driving circuit 7402, and the second scan line driving circuit 7405.

In other words, information showing whether or not the video signal data for one pixel row in which video signal writing to a pixel is newly conducted in a certain subframe period in one frame period is identical with data of signals (video signals or erasing signals) for the pixel row already written therein is transmitted to the first scan line driving circuit 7402 by a sampling controlling signal (G_ENABLEp) and to the signal line driving circuit 7401 by an output controlling signal (S_ENABLEs). This erasing signal puts pixels for one row, which are selected by the second scan line driving circuit in the preceding subframe period, in a non-lighting state. When the data is identical, the output controlling circuit of the first scan line driving circuit 7402 does not output a signal selecting the pixel row. In other words, an L-level signal for not selecting the pixel row is inputted to a first scan line of the pixel row, or the first scan line of the pixel row is put in a floating state.

In addition, the output controlling circuit of the signal line driving circuit 7401 also does not output the video signal. The output from the signal line driving circuit 7401 may be a signal for putting a pixel in a lighting state or may be a signal for putting a pixel in a non-lighting state. Such a signal as to consume as little power as possible may be inputted. Further, the signal lines S1 to Sn may be put in a floating state. Alternatively, the signal which was inputted just before to the signal line may be outputted without any change instead of putting the signal line in a floating state. This is because charging and discharging of the wire cross capacitance are already completed to the signal line and the power consumption is therefore not so high. For example, the driving method in the case where the video signal is identical in a row and in a next row in all the columns as aforementioned (for example, FIGS. 14, 15A and 15B, and 17A and 17B) can be applied.

In a certain subframe period in one frame period, if the signal data of pixels for one row already written to a pixel row to which signal erasing is carried out are all not-light-emitting, the information is transferred to the second scan line driving circuit 7405 by a sampling controlling signal (R_ENABLEp). Then, the output controlling circuit of the second scan line driving circuit 7405 is made not to output the signal which selects the pixel row. In other words, an L-level signal for not selecting the pixel row is inputted to a second scan line of the pixel row, or the second scan line of the pixel row is put in a floating state. In addition, the output controlling circuit of the signal line driving circuit 7401 also does not output the video signal.

Therefore, in the display device of the present invention, attention is paid to a certain pixel row. If the signals already inputted to the pixel row are identical with the signals to be newly inputted to the pixel row, the signal is not inputted to that pixel row; thus, the number of times to charge and discharge the scan line or the signal line can be reduced. Accordingly, the power consumption can be reduced.

Figure 44A:
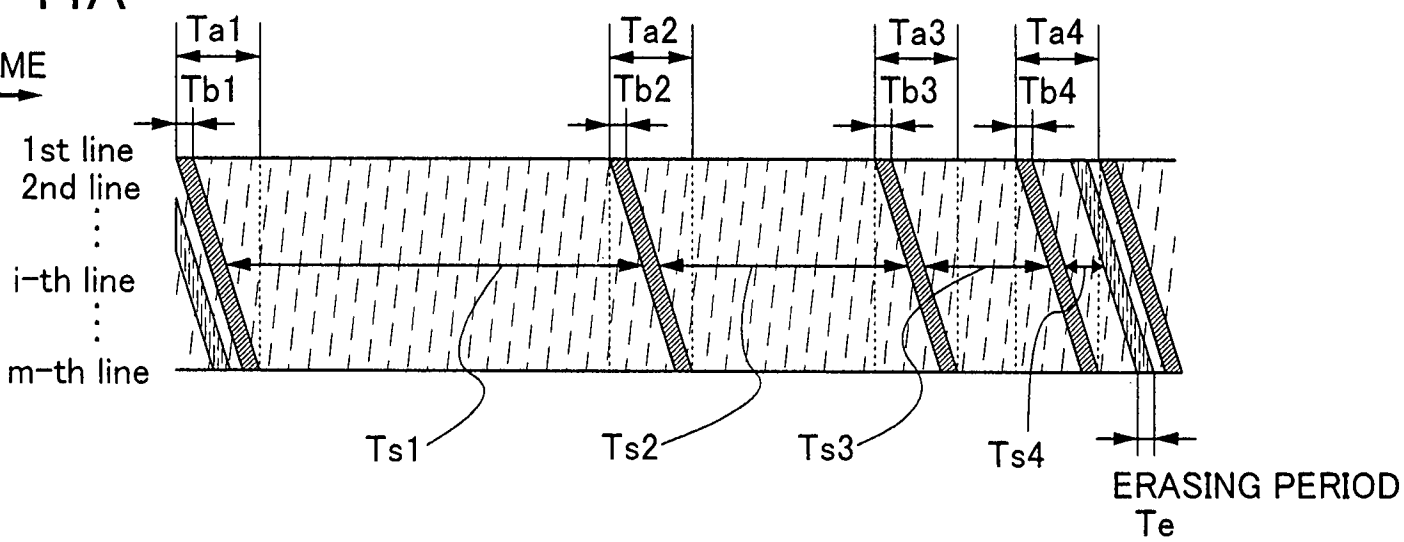
FIGS. 44A and 44B explain an example of a driving method of a display device of the present invention.
Figure 44B:
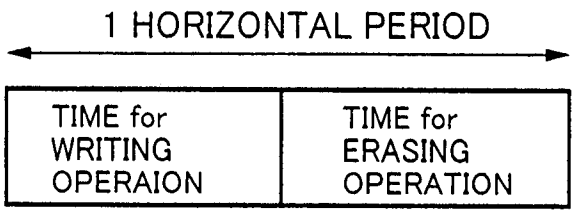
Figure 45:
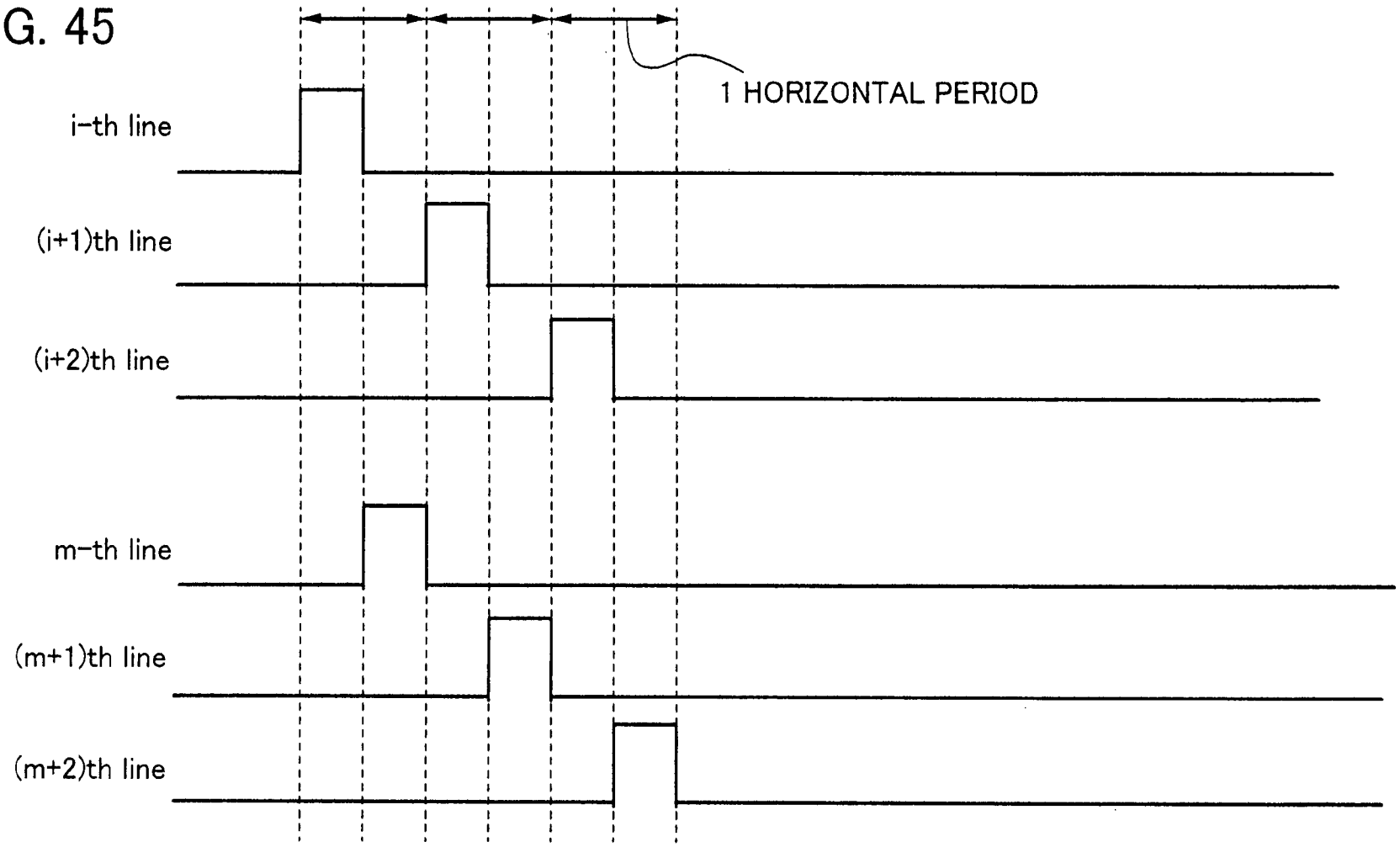
FIG. 45 explains an example of a driving method of a display device of the present invention.

In addition, a gray scale in the case where the data holding time is shorter than the address period as in FIG. 44A can be expressed with the pixel structure in FIG. 38A by providing the writing time for the writing operation and the erasing time for the erasing operation in one horizontal period as shown in FIG. 44B. For example, one horizontal period is divided into two periods as shown in FIG. 45. Here, explanation is made assuming that the former half is the writing time and the latter half is the erasing time. In the divided horizontal period, each scan line 1005 is selected, and at that time, a corresponding signal is inputted to the signal line 1006. For example, the i-th row is selected in the former half of a certain horizontal period and the m-th row is selected in the latter half. Then, the operation can be performed as if two rows are selected at the same time in one horizontal period. In other words, the video signals are written in pixels from the signal line 1006 in the writing time Tb1 to Tb4 using the writing time that is the former half of each one horizontal period. Then, a pixel is not selected in the erasing time that is the latter half of the one horizontal period at this time. In addition, an erasing signal is inputted to a pixel from the signal line 1006 in erasing time Te using the erasing time that is the latter half of another horizontal period. In the writing time that is the former half of one horizontal period at this time, a pixel is not selected. In accordance with that, a display device having a high aperture ratio can be provided and a yield can be improved.

Here, in the display device of the present invention, video signal writing to pixels for one row is not conducted when video signal data for one pixel row in which the signal is to be written to a pixel in a certain subframe period in one frame period is identical with data of signals (video signals or erasing signals) for the pixel row already inputted thereto. When data of signals (video signals or erasing signals) for one pixel row in which the erasing signal is to be inputted to a pixel is signals for putting the pixels in a non-lighting state, the erasing signal is not inputted to the pixels for one row. When high-level gray scale display is performed, the number of times to write or erase signals in the pixel is increased. However, the display device of the present invention can reduce power consumption by reducing the number of times to charge and discharge. In other words, such a driving method is suitable for performing high-level gray scale display.

Figure 46:
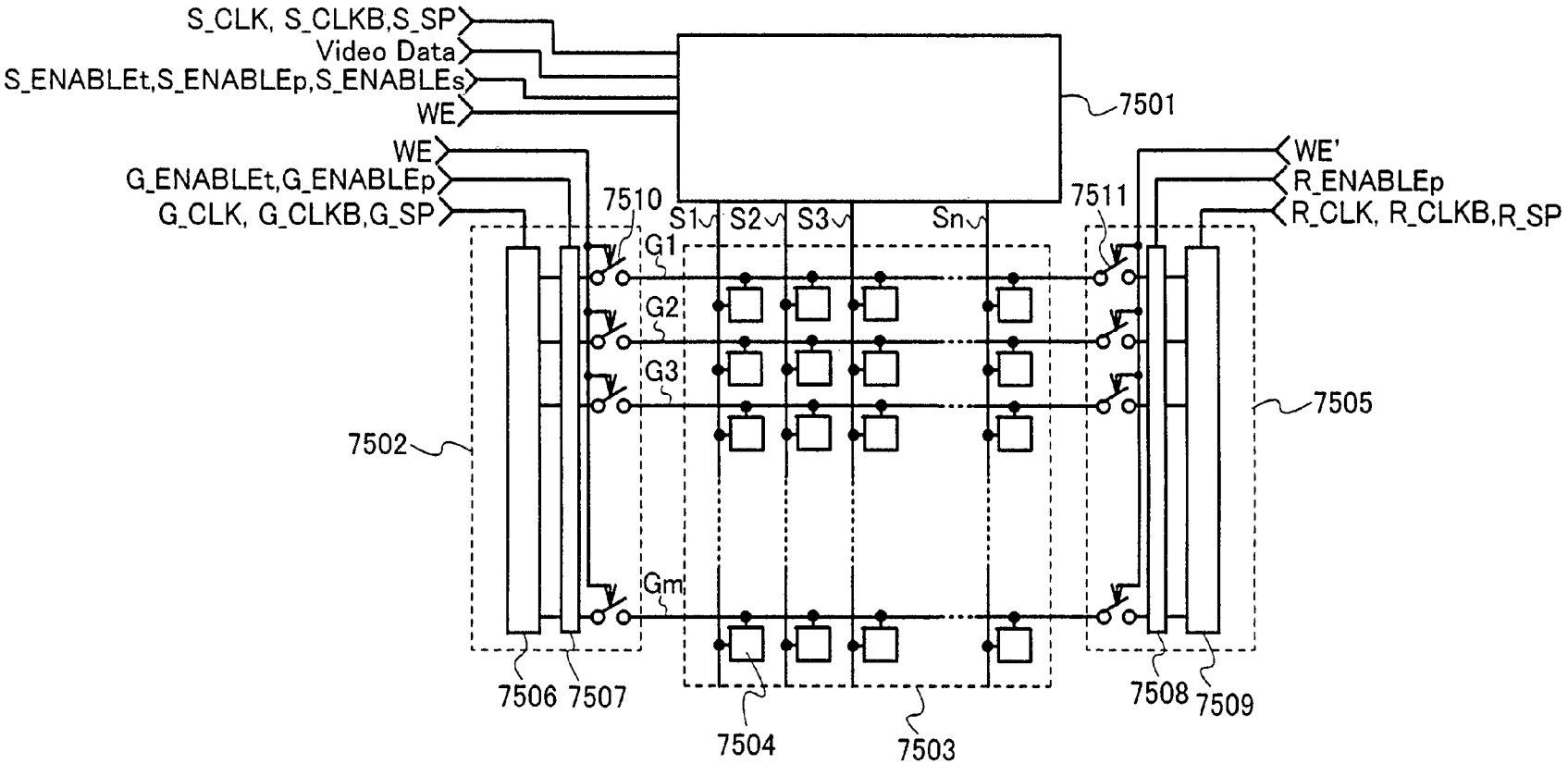
FIG. 46 explains a structure of a display device of the present invention.

An example of a display device including such a pixel is shown in FIG. 46. The display device includes a signal line driving circuit 7501, a first scan line driving circuit 7502, a second scan line driving circuit 7505, and a pixel portion 7503. In the pixel portion 7503, pixels 7504 are arranged in a matrix form in accordance with the scan lines G1 to Gm and the signal lines S1 to Sn.

Note that a scan line Gi (any one of the scan lines G1 to Gm) corresponds to the scan line 1005 of FIG. 38A, and a signal line Sj (any one of the signal lines S1 to Sn) corresponds to the signal line 1006 of FIG. 38A.

Signals such as a clock signal (G_CLK), an inverted clock signal (G_CLKB), a start pulse signal (G_SP), and an output controlling signal (G_ENABLE) are inputted to the first scan line driving circuit 7502. In accordance with these signals, a signal selecting a pixel is outputted to a first scan line Gi (any one of the first scan lines G1 to Gm) of a pixel row to be selected. Note that the signal at this time is a pulse outputted in the former half of one horizontal period as shown in the timing chart of FIG. 45.

Signals such as a clock signal (R_CLK), an inverted clock signal (R_CLKB), a start pulse signal (R_SP), and an output controlling signal (R_ENABLE) are inputted to the second scan line driving circuit 7505. In accordance with these signals, a signal is outputted to a second scan line Ri (any one of the second scan lines R1 to Rm) of a pixel row to be selected. Note that the signal at this time is a pulse outputted in the latter half of one horizontal period as shown in the timing chart of FIG. 45.

In addition, signals such as a clock signal (S_CLK), an inverted clock signal (S_CLKB), a start pulse signal (S_SP), a video signal (Digital Video Data), and an output controlling signal (S_ENABLE) are inputted to the signal line driving circuit 7501. In accordance with these signals, a video signal corresponding to a pixel of each column is outputted to each of the signal lines S1 to Sn.

Thus, the video signal inputted to each of the signal lines S1 to Sn is written in the pixel 7504 in each column of a pixel row selected by the signal inputted to the scan line Gi (any one of the scan lines G1 to Gm) from the first scan line driving circuit 7502. Then, each pixel row is selected by each of the scan lines G1 to Gm, and video signals corresponding to respective pixels 7504 are written in all the pixels 7504. Each pixel 7504 holds video signal data written therein for a certain period. Each pixel 7504 can maintain a lighting or non-lighting state by holding the video signal data for a certain period.

In addition, a signal for putting the pixel in a non-lighting state (also referred to as an erasing signal) is written from each of the signal lines S1 to Sn to the pixel 7504 of each column in a pixel row selected by the signal inputted to the scan line Gi (one of the scan lines G1 to Gm) from the second scan line driving circuit 7505. Then, a non-lighting period can be set by selecting each pixel row by each of the scan lines G1 to Gm. For example, time for which the pixels in the i-th row are selected by the signal inputted to the scan line Gi from the second scan line driving circuit 7505 corresponds to erasing time Te in FIGS. 44A and 44B.

In addition, the display device of the present invention includes output controlling circuits in the signal line driving circuit 7501, the first scan line driving circuit 7502, and the second scan line driving circuit 7505. In other words, a signal showing whether or not data of signals (video signals or erasing signals) for one pixel row in which the signal is to be written to a pixel in a certain subframe period in one frame period is identical with data of signals (video signals or erasing signals) for the pixel row already written therein is inputted to the first scan line driving circuit 7502 by a sampling controlling signal (G_ENABLEp), to the second scan line driving circuit 7505 by a sampling controlling signal (R_ENABLEs), and to the signal line driving circuit 7501 by a sampling controlling signal (S_ENABLEp) or an output controlling signal (S_ENABLEs). When the data is identical, the output controlling circuits of the first scan line driving circuit 7502 and the second scan line driving circuit 7505 are prevented from outputting a signal selecting the pixel row. In other words, an L-level signal for not selecting a pixel row is inputted to a scan line of the pixel row, or the scan line of the pixel row is put in a floating state. In addition, the output controlling circuit of the signal line driving circuit 7501 is also prevented from outputting the video signal. The output from the signal line driving circuit 7501 may be a signal for putting a pixel in a lighting state or may be a signal for putting a pixel in a non-lighting state. Such a signal as to consume as little power as possible may be inputted. Further, the signal lines S1 to Sn may be put in a floating state.

Thus, according to the display device of the present invention, attention is paid to a certain pixel row, and a signal can be prevented from being inputted to the pixel row when a signal already inputted to the pixel row is identical with a signal to be newly inputted therein. Therefore, the number of times to charge and discharge the scan line and the signal line can be reduced, so that the power consumption can be reduced.

Note that the pixel structure of the display device of the present invention is not limited to the structures described above, and various pixel structures can be applied. In addition, the driving method of the present invention is also not limited to the driving methods described above, and various driving methods can be applied.

Note that according to the display device of the present invention, in a subframe period in one frame period, if signal data for one row in a pixel row to which signal writing to a pixel is conducted is identical with signal data for one row already written in that pixel row, signal writing is not conducted to the pixels in the row. Therefore, the number of times to charge and discharge can be reduced, so that the power consumption can be reduced.

In particular, the power consumption can further be reduced when the number of subframes is increased to perform high-level gray scale display.

It is to be noted that this embodiment mode can be combined with the above embodiment mode. That is to say, the present invention can employ all the structures formed by combining the structure shown in this embodiment mode and the structure shown in any of the above embodiment modes.

Embodiment Mode 10

Embodiment Mode 10 will explain a main structure of a display device of the present invention.

Figure 47:
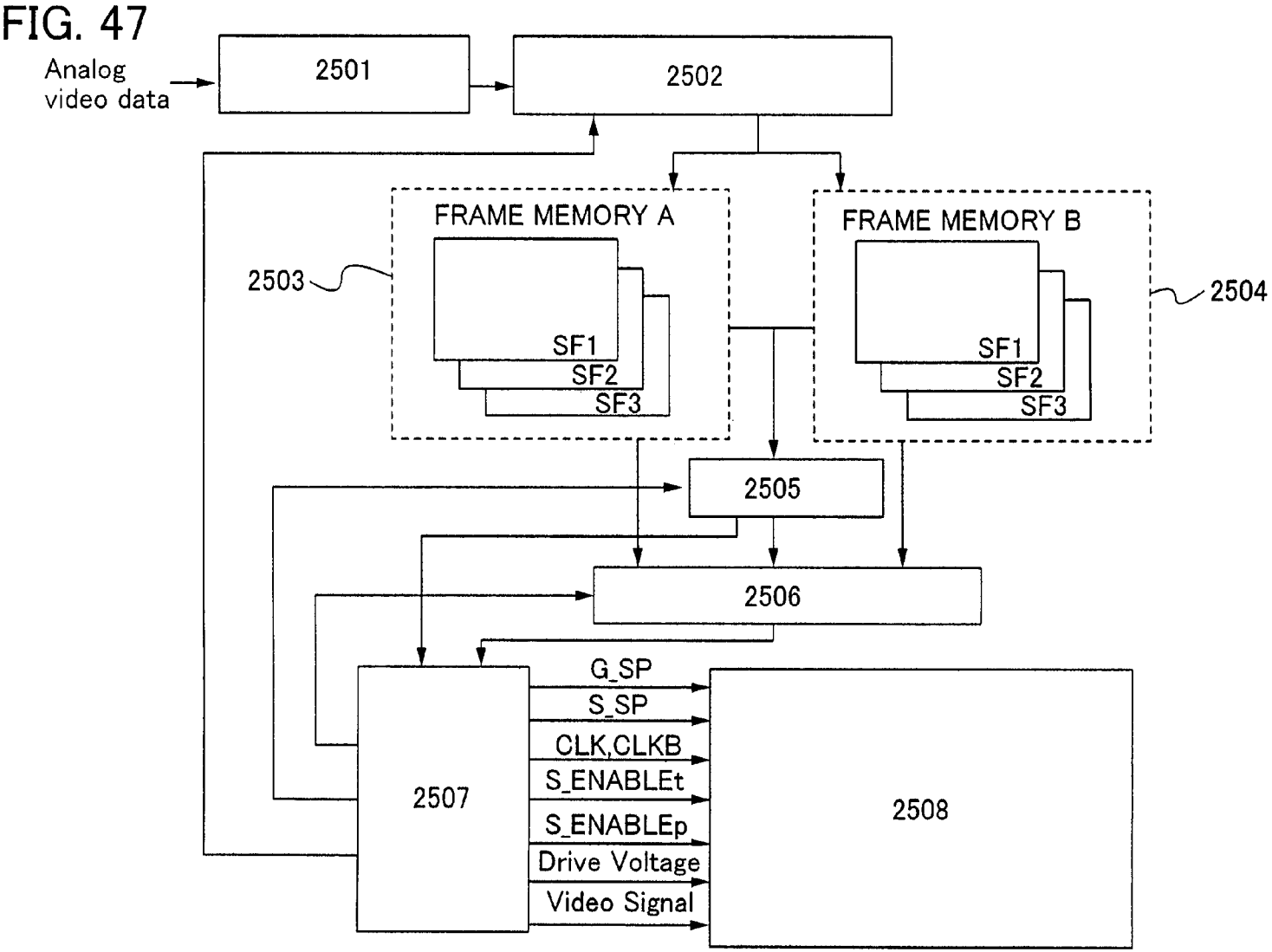
FIG. 47 explains a structure of a display device of the present invention.

First of all, description is made of a display device of the present invention having a first structure with reference to FIG. 47. In this structure, a sampling pulse is not outputted when, in a case of writing in a pixel in a certain row, a video signal to be newly written in the certain row is identical with a video signal already written in one row before (if writing is not conducted in a pixel of one row before, the video signal is compared with a video signal written in a pixel in the closest row before the certain row).

When an analog video signal (Analog Video Data) is inputted to an analog digital conversion circuit 2501, the analog video signal is converted into a digital video signal (Digital Video Data), which is then inputted to a memory writing selection circuit 2502 from the analog digital conversion circuit 2501.

In the memory writing selection circuit 2502, the digital video signal is divided into data for each subframe and the digital video signal for one frame is written in a frame memory A2503 or a frame memory B2504 based on an inputted signal from a display controller 2507. Although FIG. 47 shows SF1, SF2, and SF3 as subframes in each of the frame memory A2503 and the frame memory B2504, the number of subframes is not limited to this.

In addition, in a determination circuit 2505, video signals to be written in a certain subframe are compared in a certain row and in one row before or after the certain row in the frame memory A2503 or the frame memory B2504 based on the signal inputted from the display controller 2507. Specifically, in a certain subframe, video signals to be written in the rows are compared for each column in a row and in one row before or after the row. Then, a writing controlling signal showing whether there is a column where the video signal inputted to a pixel in a certain row is identical with the video signal inputted in one row before is inputted to a memory reading selection circuit 2506 and the display controller 2507.

Then, the digital video signals for one frame written in the frame memory A2503 or the frame memory B2504 in accordance with the signal from the display controller 2507 are read out by the memory reading selection circuit 2506 and inputted to the display controller 2507. Here, the video signals written in a certain subframe are compared for each column in a row and in a row before or after the row by the determination circuit 2505. If the signal showing that the video signals written in a row and the video signals written in a next row are identical in all the columns is inputted to the memory reading selection circuit 2506, the video signals in the pixels in the next row among the video signals for one row in one frame written in the frame memory A2503 or the frame memory B2504 are read out by the memory reading selection circuit 226 regardless of the signal from the display controller 2507.

Moreover, the display controller 2507 inputs a start pulse signal (G_SP, S_SP), a clock signal (G_CLK, S_CLK), a transfer controlling signal (S_ENABLEt), a sampling controlling signal (S_ENABLEp), a drive voltage, a video signal (Digital Video Data), and the like into a display 2508.

In other words, the display controller 2507 compares for each column, in a certain subframe period in one frame period, video signals to be newly written in a certain row and video signals already written in one row before. If there is a column where the video signal to be newly written in the row and the video signal already written in one row before are identical, a transfer controlling signal or a sampling controlling signal is inputted to the display 2508.

The display 2508 in FIG. 47 corresponds to a display panel in which a pixel portion having pixels arranged in a matrix form and a peripheral driving circuit (such as a scan line driving circuit or a signal line driving circuit) around the pixel portion are formed over a substrate. The display panel may be formed over a substrate in such a way that a peripheral driving circuit is formed over an IC chip and the IC chip is mounted over the substrate by COG (Chip On Glass) or the like or the peripheral driving circuit may be formed over the same substrate as the pixel portion. It is to be noted that the IC chip refers to a chip-like form in which an electronic circuit is constituted by an element including a semiconductor element over a semiconductor substrate or an insulating substrate or inside a semiconductor substrate. Among the IC chips, an IC chip manufactured by baking a circuit pattern on a silicon wafer is called a semiconductor chip.

Figure 48:
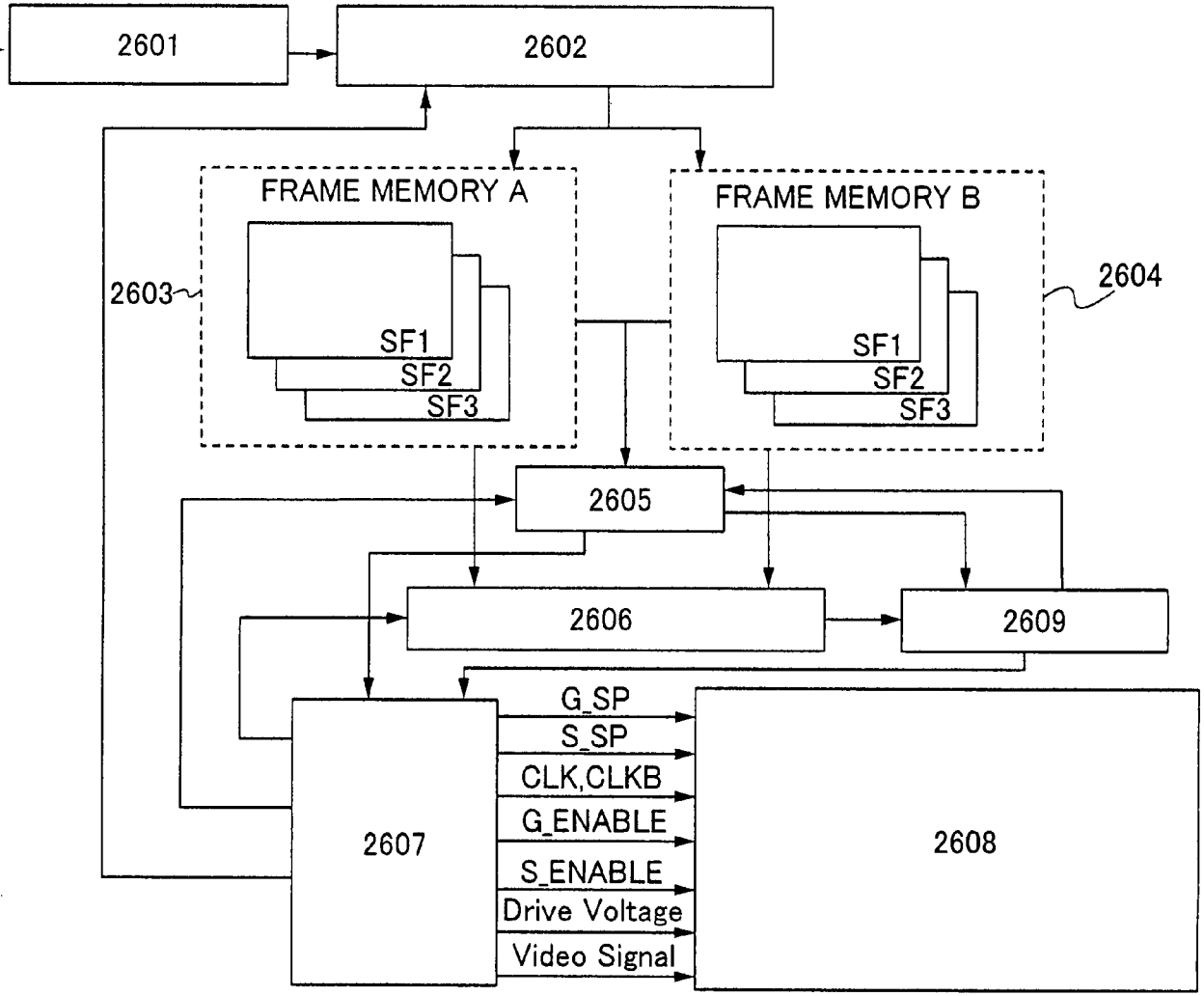
FIG. 48 explains a structure of a display device of the present invention.

Next, description is made of the second structure of the present invention with reference to FIG. 48. Specifically, a display device is described in which, if video signal data for one row in a pixel row to which signal writing is conducted to a pixel in a certain subframe period in one frame period is identical with video signal data in one row before in the preceding subframe period, signal writing is not carried out in the pixel row.

When an analog video signal (Analog video data) is inputted to an analog digital conversion circuit 2601, the analog video signal is converted into a digital video signal (Digital video data), which is then inputted from the analog digital conversion circuit 2601 to a memory writing selection circuit 2602.

In the memory writing selection circuit 2602, the digital video signal is divided into data for each subframe and the digital video signal for one frame is written in a frame memory A2603 or a frame memory B2604 based on the signal inputted from the display controller 2607. It is to be noted that each of the frame memories A2603 and B2604 includes SF1, SF2, and SF3 as subframes in FIG. 48; however, the number of subframes is not limited to this.

Moreover, the memory reading selection circuit 2606 reads out the digital video signal for one frame already written in either the frame memory A2603 or the frame memory B2604 based on the signal from the display controller 2607, and inputs the video signal to a line memory 2610.

A signal showing data of which pixel row and subframe in the frame memory A2603 and the frame memory B2604 is inputted to a line memory 2609 is inputted to the determination circuit 2605 from the display controller 2607. Based on the signal, data for one pixel row is compared with data for one pixel row in the same pixel row in the preceding subframe. Then, a writing controlling signal showing whether the data to be inputted to the pixels for one row are matched with each other is inputted to the line memory 2309 and the display controller 2607.

The data of the video signal to be inputted to the pixels for one row is inputted from the line memory 2609 to the display controller 2607. Here, if the signal indicating the data of the pixel row inputted in the line memory 2609 is identical with the data written in the pixel row in the preceding subframe is inputted to the line memory 2609, the line memory 2609 does not input the video signal of the pixels for one row to the display controller 2607.

Moreover, the display controller 2607 inputs a start pulse signal (G_SP or S_SP), a clock signal (G_CLK or S_CLK), a transfer controlling signal (G_ENABLEt), a sampling controlling signal (G_ENABLEp), an output controlling signal (S_ENABLE), drive voltage, a video signal (Digital Video Data), or the like to the display 2608.

In other words, in order not to output a sampling pulse which converts a video signal in the pixel row from serial data to parallel data if the video signal data for one row in the pixel row to which signal writing is conducted in the pixel in a certain subframe period of one frame period is identical with that for one row in the preceding subframe period, a start pulse signal (S_SP) corresponding to the pixel row is not outputted. Moreover, the display controller 2607 inputs to a display 2608 an output controlling signal (G_ENABLE or S_ENABLE) for controlling whether to output a scan signal from a scan line driving circuit or a video signal from a signal line driving circuit. In addition, if the video signal data for one row is identical with that in the preceding subframe period, the video signal data is not inputted to the display 2608.

It is to be noted that the block diagram showing the main structure of the display device of the present invention is not limited to those shown in FIG. 47 and FIG. 48. The display device having the first structure may be provided with the line memory shown in FIG. 48, and the display device having the second structure is not required to be provided with the line memory shown in FIG. 47. Moreover, the signal inputted to the pixel is not limited to the video signal but may be a signal (erasing signal) that forcibly makes the pixel emit no light.

This embodiment mode can be combined with the aforementioned embodiment mode. In other words, the present invention can employ all the structures formed by combining the structure shown in this embodiment mode and the structure shown in any of the above embodiment modes.

Embodiment Mode 11

Embodiment Mode 11 will describe a circuit structure which can be applied to the determination circuit 2505 shown in FIG. 47 and the determination circuit 2605 shown in FIG. 48 in Embodiment Mode 10.

Figure 52:
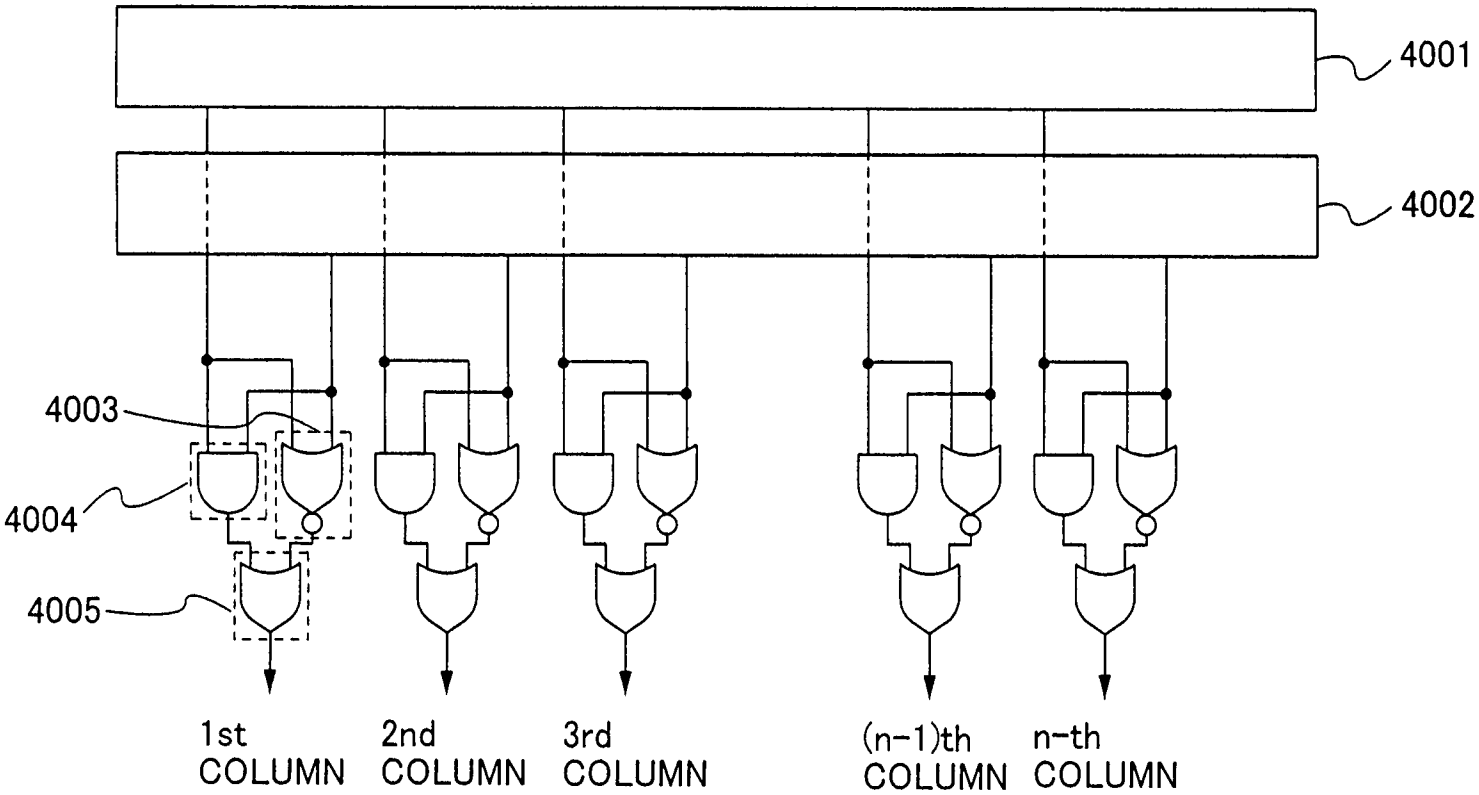
FIG. 52 explains a structure of a determination circuit of a display device of the present invention.

First, FIG. 52 shows an example of a determination circuit where, in a case of writing in pixels of a certain row, video signals to be newly written in the certain row are compared with video signals already written in one row before.

In a certain subframe SFx (x is an integer) of a NOR gate 4003, video signal data of the same pixel column in consecutive rows is inputted. Moreover, video signal data of the same pixel column in consecutive rows are also inputted to an AND gate 4004. Then, the outputs of the NOR gate 4003 and the AND gate 4004 are inputted to an OR gate 4005. The output of the OR gate 4005 controls the turning on/off of a switch 4006.

In other words, among pixel data 4001 in the (i−1)-th row and pixel data 4002 in the i-th row during SFx, the comparison result of the pixel data in the same j-th column is determined by comparing the pixels in the j-th column. An H-level signal is outputted from the OR gate 4005 corresponding to the pixel in the j-th column when the pixel data 4001 in the (i−1)-th row and the pixel data 4002 in the i-th row in the same column are identical. By comparing the pixel columns in the consecutive rows in this way, the outputs of a transfer controlling signal (S_ENABLEt) and a sampling controlling signal (S_ENBALEp) are controlled based on the comparison result.

Figure 49:
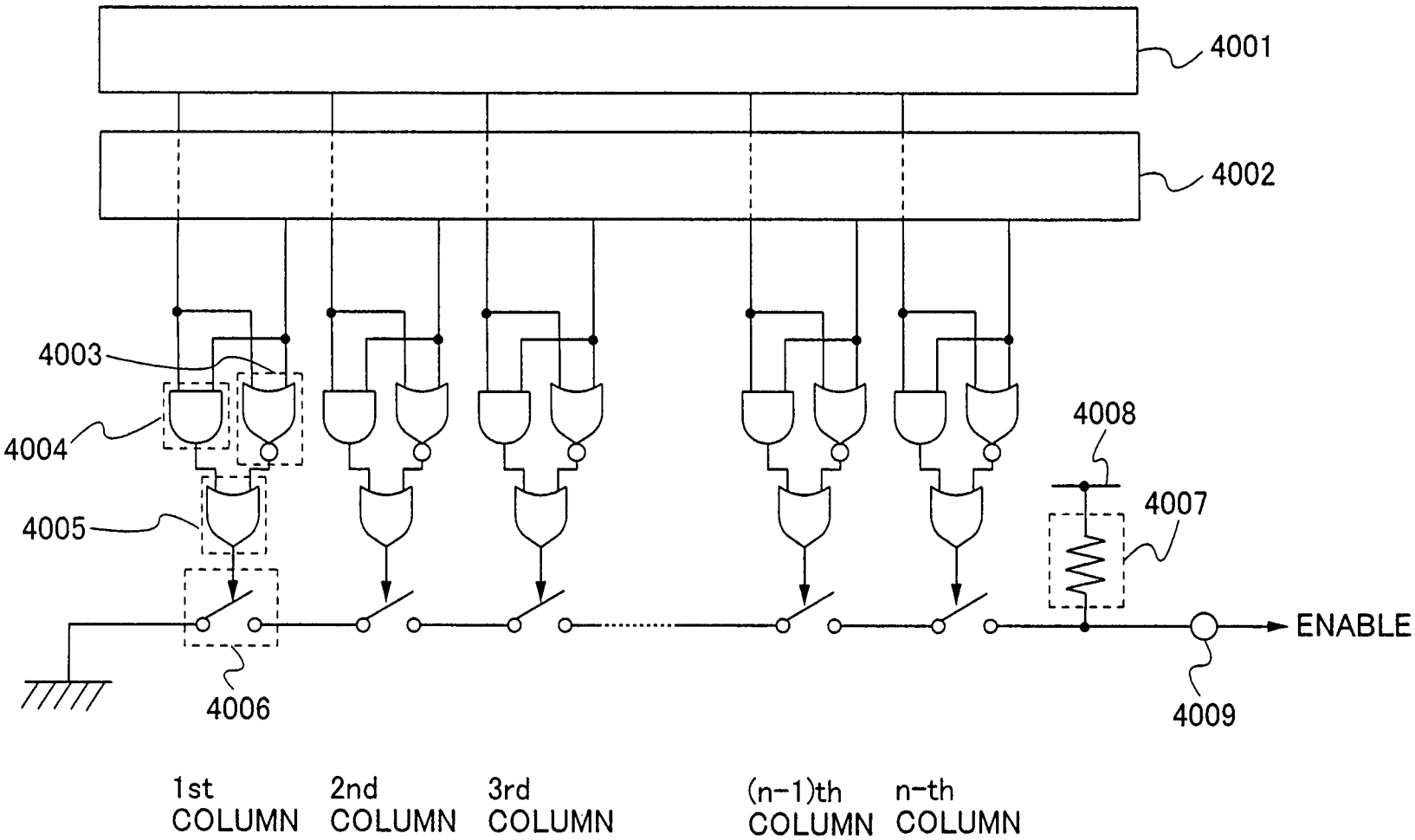
FIG. 49 explains a structure of a determination circuit of a display device of the present invention.

Next, FIG. 49 shows an example of the determination circuit in a case where video signal data for one row in a pixel row to which signals are written in pixels in a certain subframe period in one frame period is compared with video signal data for one row in the preceding subframe period.

The switches 4006 with the same number as the pixel rows are connected serially. An end of the serially-connected switches 4006 is set at an L-level potential (here GND) and the other end is connected to an output terminal 4009. Moreover, a wire 4008 which is set at an H-level potential (for example a power source potential Vdd) is connected between the other end of the serially-connected switches 4006 and the output terminal 4009 with a pull-up resistor 4007 interposed therebetween. Therefore, when all the serially-connected switches 4006 are turned on, an output controlling signal (ENABLE) outputted from the output terminal 4009 is an L-level signal. On the other hand, when even one of the serially-connected switches 4006 is turned off, the output controlling signal (ENABLE) outputted from the output terminal 4009 is an H-level signal.

In the NOR gate 4003, video signal data of the same pixel column in the same pixel row in consecutive subframes is inputted. Moreover, in the AND gate 4004, video signal data of the same pixel column in the same pixel row in consecutive subframes are inputted. Then, the outputs of the NOR gate 4003 and the AND gate 4004 are inputted to the OR gate 4005. Based on the output of the OR gate 4005, the turning on/off of the switch 4006 is controlled.

In other words, the comparison result of the pixel data in the same j-th column among the pixel data 4001 in the i-th row in SFx-1 and the pixel data 4002 in the i-th row in SFx is determined by the turning on/off of the switch 4006 corresponding to the pixel in the j-th column. That is to say, if the pixel data in the same j-th column among the pixel data 4001 in the i-th row in SFx-1 and the pixel data 4002 in the i-th row in SFx are identical, the switch 4006 corresponding to the pixel in the j-th column is turned on. If the pixel data in the same j-th column are not identical, the switch 4006 corresponding to the pixel in the j-th column is turned off. In other words, the output controlling signal (ENABLE) is at an L level only if the pixel data 4001 in the i-th row in SFx-1 and the pixel data 4002 in the i-th row in SFx are identical in all the pixel columns. If the data is not identical even in one pixel column, the output controlling signal (ENABLE) is at an H level.

Figure 50:
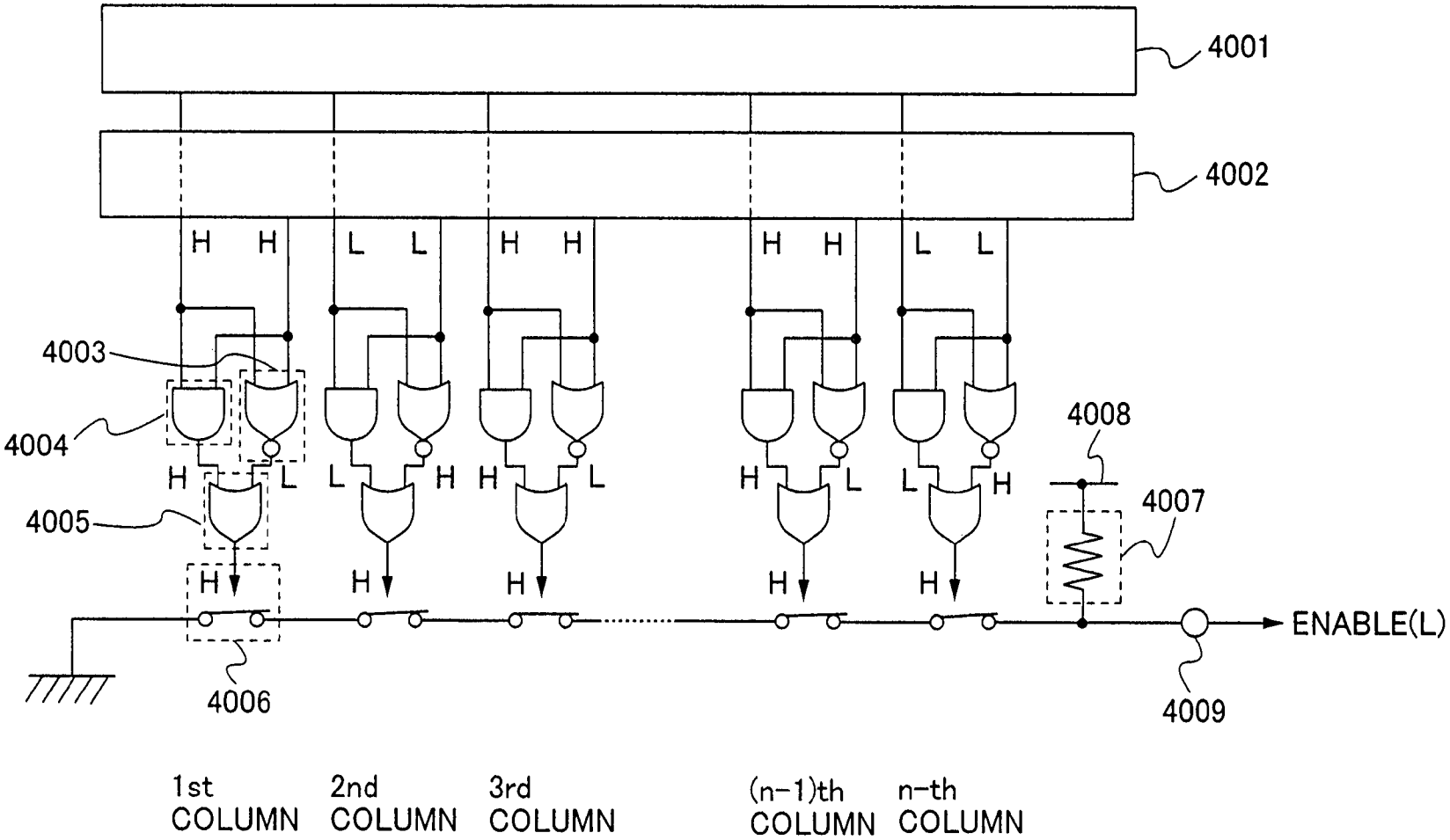
FIG. 50 explains a structure of a determination circuit of a display device of the present invention.

An operation of the determination circuit is explained in more detail. First, description is made of a case where the pixel data 4001 in the i-th row in SFx-1 and the pixel data 4002 in the i-th row in SFx are identical in all the columns. In FIG. 50, the pixel data 4001 in the i-th row in SFx-1 and the pixel data 4002 in the i-th row in SFx are at an H level in the first column, they are at an L level in the second column, they are at an H level in the third column, . . . they are at an H level in the (n−1)-th column, and they are at an L level in the n-th column. In other words, the pixel data 4001 in the i-th row in SFx-1 and the pixel data 4002 in the i-th row in SFx are identical in all the columns.

Then, since the pixel data are both at an H level in the first column, H-level signals are inputted to the input terminals of the NOR gate 4003 and the AND gate 4004. Then, the output of the NOR gate 4003 is at an L level and that of the AND gate 4004 is at an H level. Thus, since the H-level signal and the L-level signal are inputted to the input terminal of the OR gate 4005, the output of the OR gate is at an H level. The switch 4006 in the first column is turned on by the H-level signal outputted from this OR gate. In addition, since the pixel data are both at an L level in the second column, L-level signals are inputted to the input terminals of the NOR gate 4003 and the AND gate 4004. Then, the output of the NOR gate 4003 is at an H level and that of the AND gate 4004 is at an L level. Thus, since the H-level signal and the L-level signal are inputted to the input terminal of the OR gate 4005, the output of the OR gate is at an H level. The switch 4006 in the second column is turned on by the H-level signal outputted from this OR gate. In a similar manner, the switches 4006 in all the columns are turned on so that the output controlling signal (ENABLE) from the output terminal 4009 is at an L level.

Figure 51:
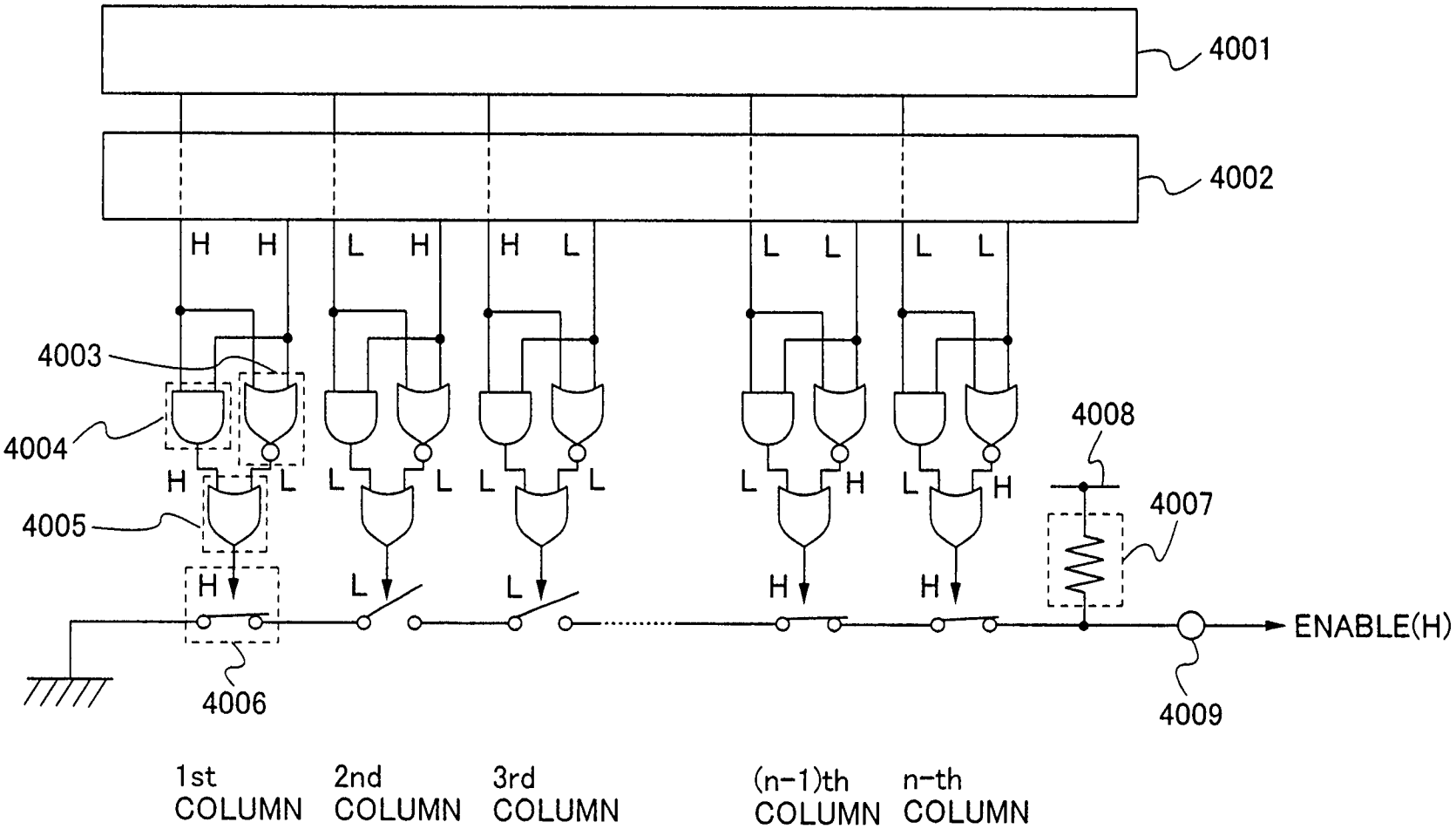
FIG. 51 explains a structure of a determination circuit of a display device of the present invention.

Next, description is made of a case where the pixel data 4001 in the i-th row in SFx-1 and the pixel data 4002 in the i-th row in SFx are different in at least in one column. In FIG. 51, the pixel data 4001 in the i-th row in SFx-1 and the pixel data 4002 in the i-th row in SFx are both at an H level in the first column, they are at an L level and an H level, respectively in the second column, they are at an H level and an L level, respectively in the third column, . . . they are both at an L level in the (n−1)-th column, and they are both at an L level in the n-th column. In other words, among the pixel data 4001 in the i-th row in SFx-1 and the pixel data 4002 in the i-th row in SFx, at least the pixel data in the second and third columns are different.

Then, since the pixel data are both at an H level in the first column, H-level signals are inputted to the input terminals of the NOR gate 4003 and the AND gate 4004. Then, the output of the NOR gate 4003 is at an L level and that of the AND gate 4004 is at an H level. Thus, since the H-level signal and the L-level signal are inputted to the input terminal of the OR gate 4005, the output of the OR gate is at an H level. The switch 4006 in the first column is turned on by the H-level signal outputted from this OR gate. Meanwhile in the second column, since the pixel data in the i-th row in SFx-1 is at an L level and the pixel data in the i-th row in SFx is at an H level, an L-level signal and an H-level signal are inputted to the input terminals of the NOR gate 4003 and the AND gate 4004. Then, the output of the NOR gate 4003 is at an L level while that of the AND gate 4004 is at an L level. Thus, since the L-level signals are inputted to both of the input terminals of the OR gate 4005, the output of the OR gate 4005 is at an L level. Then, the switch 4006 in the second column is turned off by the L-level signal outputted from the OR gate. In the third column, since the pixel data in the i-th row in SFx-1 is at an H level and the pixel data in the i-th row in SFx are at an L level, the output of the OR gate 4005 is at an L level. Then, the switch 4006 in the third column is turned off by the L-level signal outputted from the OR gate 4005. Therefore, the switches 4006 in at least the second and third columns are turned off, so that the output controlling signal (ENABLE) of the output terminal 4009 is at an H level.

This embodiment mode can be combined with the above embodiment mode. In other words, the present invention can employ all the structures formed by combining the structure shown in this embodiment mode and the structure shown in any of the above embodiment modes.

Embodiment Mode 12

Embodiment Mode 12 will explain a structure of a pixel in a case of using a display element in which luminance of the pixel changes depending on an applied voltage. This embodiment mode will also explain a structure of a display device including the pixel and a suitable driving method thereof. A liquid crystal element is particularly suitable for the display element described in this embodiment mode.

Figure 65:
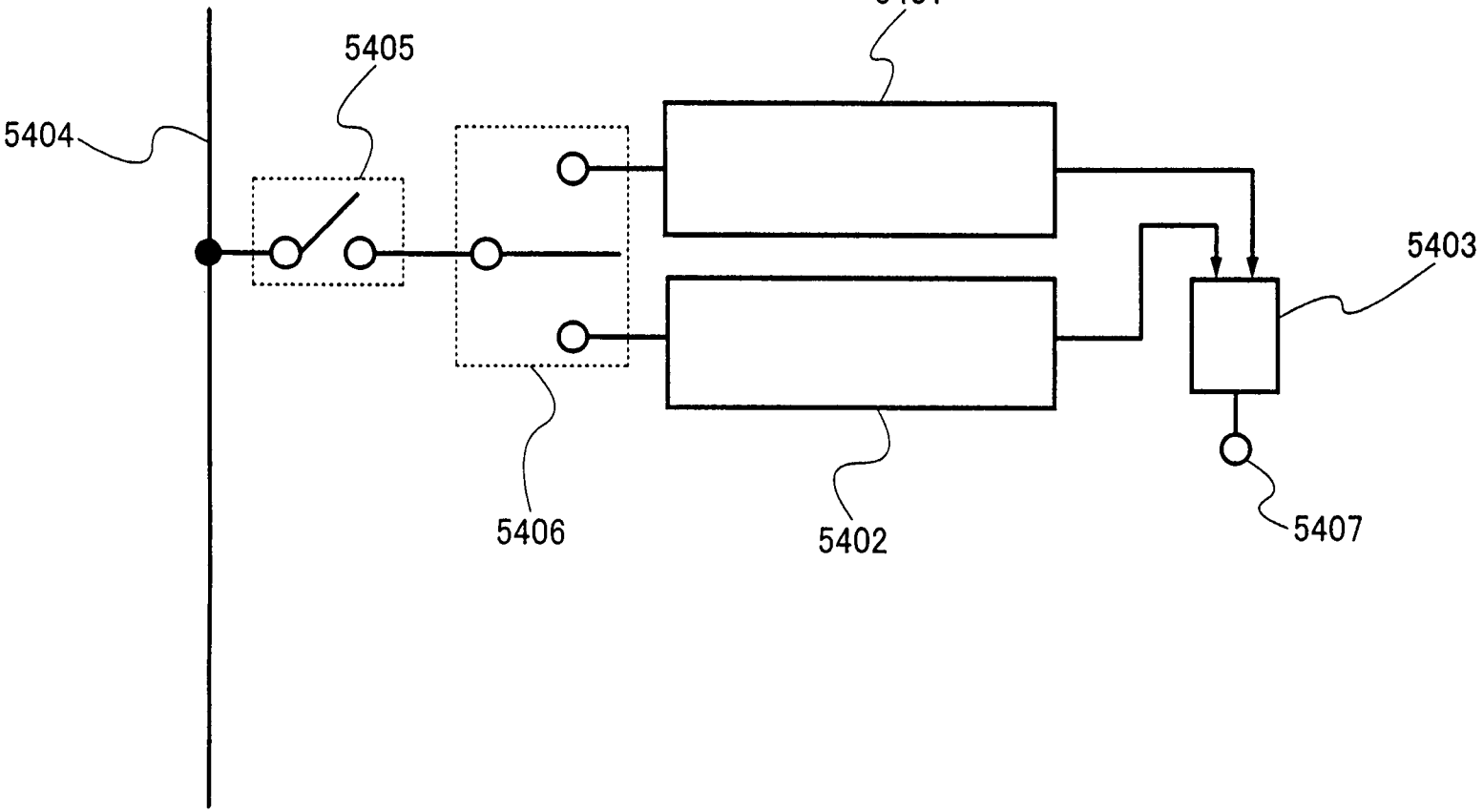
FIG. 65 explains an example of a pixel structure which can be applied to a display device of the present invention.

First, FIG. 65 shows a basic structure of a pixel. The pixel includes an analog voltage holding circuit 5401, a digital signal memory circuit 5402, a display element 5403, a signal line 5404, a first switch 5405, and a second switch 5406.

In the case of this structure, the first switch 5405 is turned on when the pixel is selected.

In a case of displaying a moving image, the analog voltage holding circuit 5401 is selected by the second switch 5406. Then, an analog voltage corresponding to a video signal is inputted to the analog voltage holding circuit 5401 from the signal line 5404.

The analog voltage holding circuit 5401 holds this analog voltage and applies the voltage to the display element 5403.

In this manner, a gray scale of the pixel is expressed in accordance with the analog voltage. Then, an analog voltage is inputted to the analog voltage holding circuit 5401 from the signal line 5404 in each frame period.

In a case of displaying a still image, the digital signal memory circuit 5402 is selected by the second switch 5406. Then, a digital signal corresponding to a video signal is inputted to the digital signal memory circuit 5402 from the signal line 5404.

The digital signal memory circuit 5402 stores this digital signal and sets a potential of a pixel electrode of the display element 5403. In this manner, lighting and non-lighting of the display element 5403 are controlled in accordance with a potential difference between a potential inputted from the digital signal memory circuit 5402 and a potential of an opposite electrode 5407 of the display element 5403.

Note that in the case of displaying a still image, a gray scale can be expressed using an area gray scale method or the like.

The case of using an area gray scale method is explained with reference to FIGS. 66A and 66B.

Figure 66A:
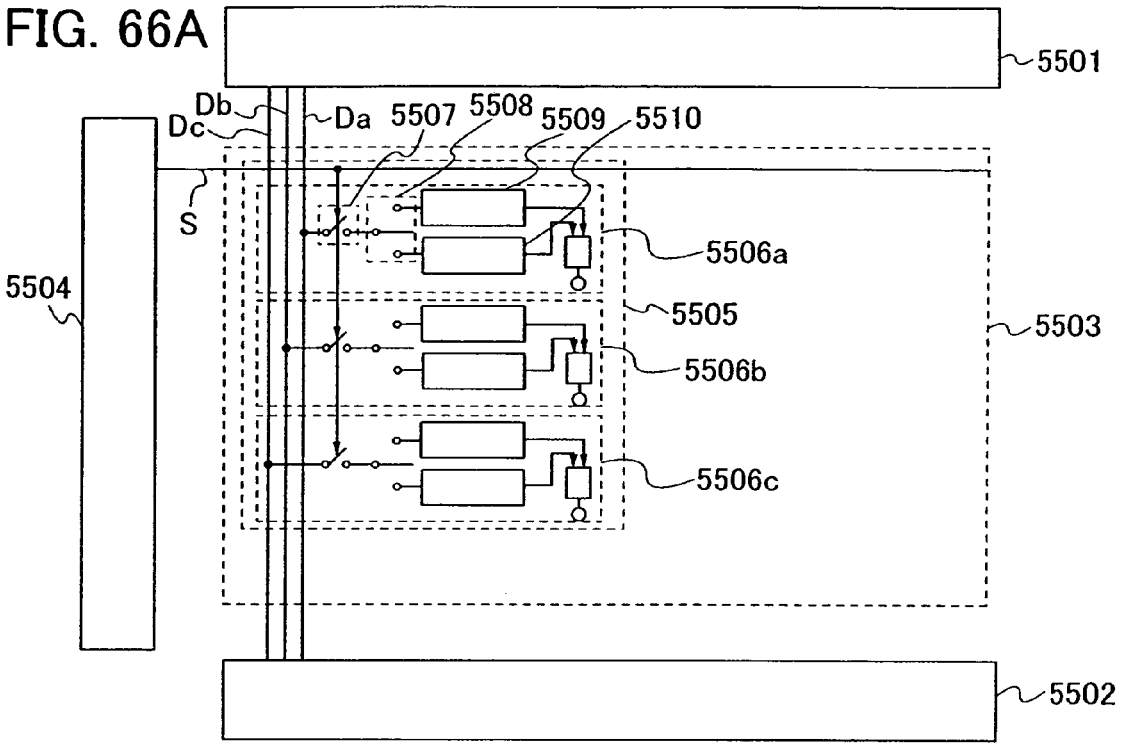
FIGS. 66A and 66B each explain an example of a pixel structure which can be applied to a display device of the present invention.

A display device in FIG. 66A includes a first signal line driving circuit 5501, a second signal line driving circuit 5502, a pixel portion 5503, and a scan line driving circuit 5504. In the pixel portion 5503, pixels 5505 are arranged in a matrix form in accordance with scan lines and signal lines.

Each of the pixels 5505 includes a sub-pixel 5506*a*, a sub-pixel 5506*b*, and a sub-pixel 5506*c*. Lighting regions of the sub-pixels are weighted. For example, the sizes of the lighting regions are set to satisfy $2^2:2^1:2^0$. This makes it possible to perform 3-bit display, that is, display with eight gray scale levels.

Note that a first switch 5507 of the sub-pixel 5506*a* is connected to a signal line Da, a first switch 5507 of the sub-pixel 5506*b* is connected to a signal line Db, and a first switch 5507 of the sub-pixel 5506*c* is connected to a signal line Dc. By a signal inputted to a scan line S from the scan line driving circuit 5504, the first switches 5507 of the sub-pixel 5506*a*, the sub-pixel 5506*b*, and the sub-pixel 5506*c* are controlled to be turned on/off. In other words, the first switch 5507 is in an on state in a selected pixel. Then, an analog voltage and a digital signal are written in an analog voltage holding circuit 5509 and a digital signal memory circuit 5510 from the signal lines, respectively.

In other words, in the case of displaying a moving image, a signal is inputted to the scan line S to turn on the first switch 5507, and the analog voltage holding circuit 5509 is selected by a second switch 5508. Analog voltages corresponding to video signals are inputted from the first signal line driving circuit 5501 to the signal line Da, the signal line Db, and the signal line Dc. Then, the analog voltage is held in the analog voltage holding circuit 5509 of each sub-pixel. Note that the analog voltages inputted to the signal line Da, the signal line Db, and the signal line Dc at this time are approximately equal to one another. Therefore, a gray scale can be expressed depending on the level of the analog voltage.

On the other hand, in the case of displaying a still image, a signal is inputted to the scan line S to turn on the first switch 5507, and the digital signal memory circuit 5510 is selected by the second switch 5508. A digital signal corresponding to a video signal is inputted from the second signal line driving circuit 5502 to the signal line Da, the signal line Db, and the signal line Dc. Then, the digital signal is stored in the digital signal memory circuit 5510 of each sub-pixel. It is to be noted that a signal of each bit corresponding to the size of the lighting region of each sub-pixel is inputted as the digital signal inputted to each of the signal line Da, the signal line Db, and the signal line Dc at this time. Therefore, a gray scale can be expressed by selecting lighting and non-lighting of each sub-pixel by the digital signal.

Figure 66B:
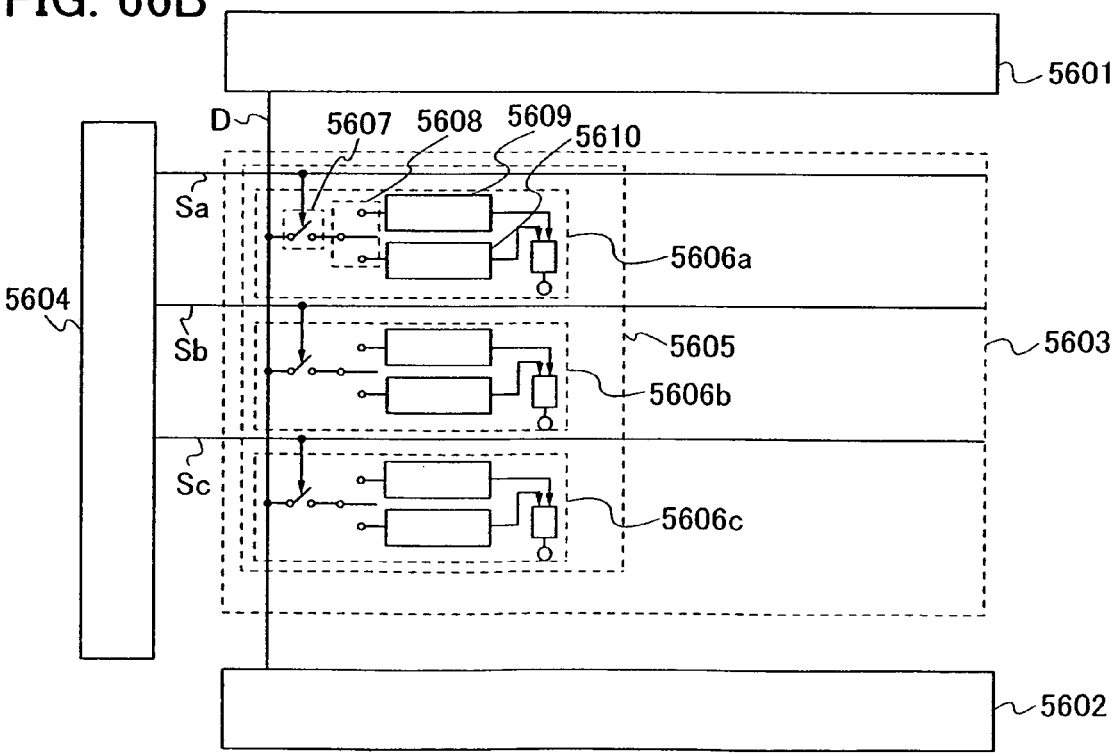

Next, a structure in FIG. 66B is explained. A display device in FIG. 66B includes a first signal line driving circuit 5601, a second signal line driving circuit 5602, a pixel portion 5603, and a scan line driving circuit 5604. In the pixel portion 5603, pixels 5605 are arranged in a matrix form in accordance with scan lines and signal lines.

Each of the pixels 5605 includes a sub-pixel 5606*a*, a sub-pixel 5606*b*, and a sub-pixel 5606*c*. Lighting regions of the sub-pixels are weighted. For example, the sizes of the lighting regions are set to satisfy $2^2:2^1:2^0$. This makes it possible to perform 3-bit display, that is, display with eight gray scale levels.

It is to be noted that first switches 5607 of the sub-pixel 5606*a*, the sub-pixel 5606*b*, and the sub-pixel 5606*c* are connected to a signal line D. Then, the first switch 5607 of the sub-pixel 5606*a* is controlled to be turned on/off by a signal inputted to a scan line Sa from the scan line driving circuit 5604; that of the sub-pixel 5606*b* is controlled to be turned on/off by a signal inputted to a scan line Sb from the scan line driving circuit 5604; and that of the sub-pixel 5606*c* is controlled to be turned on/off by a signal inputted to a scan line Sc from the scan line driving circuit 5604. In other words, the first switch 5607 is in an on state in a selected pixel. Then, an analog voltage or a digital signal is written in an analog voltage holding circuit 5609 or a digital signal memory circuit 5610 from the signal lines, respectively.

In other words, in the case of displaying a moving image, signals are sequentially inputted to the scan line Sa, the scan line Sb, and the scan line Sc to turn on the first switch 5607 of each sub-pixel, and the analog voltage holding circuit 5609 is selected by the second switch 5608. An analog voltage corresponding to a video signal is inputted from the first signal line driving circuit 5601 to the signal line D. Then, the analog voltages are sequentially held in the analog voltage holding circuit 5609 of each sub-pixel. It is to be noted that the analog voltages inputted to the signal line D while each sub-pixel is selected are approximately equal to each other. Therefore, a gray scale can be expressed depending on the level of the analog voltage.

On the other hand, in the case of displaying a still image, signals are sequentially inputted to the scan line Sa, the scan line Sb, and the scan line Sc to turn on the first switch 5607 of each sub-pixel, and the digital signal memory circuit 5610 is selected by the second switch 5608. A digital signal corresponding to a video signal is inputted from the second signal line driving circuit 5602 to the signal line D. Then, the digital signals are sequentially stored in the digital signal memory circuit 5610 of each sub-pixel. It is to be noted that a digital signal of each bit corresponding to the size of the lighting region of each sub-pixel is inputted while each sub-pixel is selected. Therefore, a gray scale can be expressed by selecting lighting or non-lighting of each sub-pixel by the digital signal.

When an image is partially rewritten in the case of displaying a still image, the display device of the present invention does not carry out signal writing to a pixel row in which the rewriting is not performed.

In other words, the scan line driving circuit includes an output controlling means which, in the case where video signal data for a pixel row in one frame before is identical with data for the pixel row in which writing is to be performed, prevents the pixel row from being selected.

Figure 67:
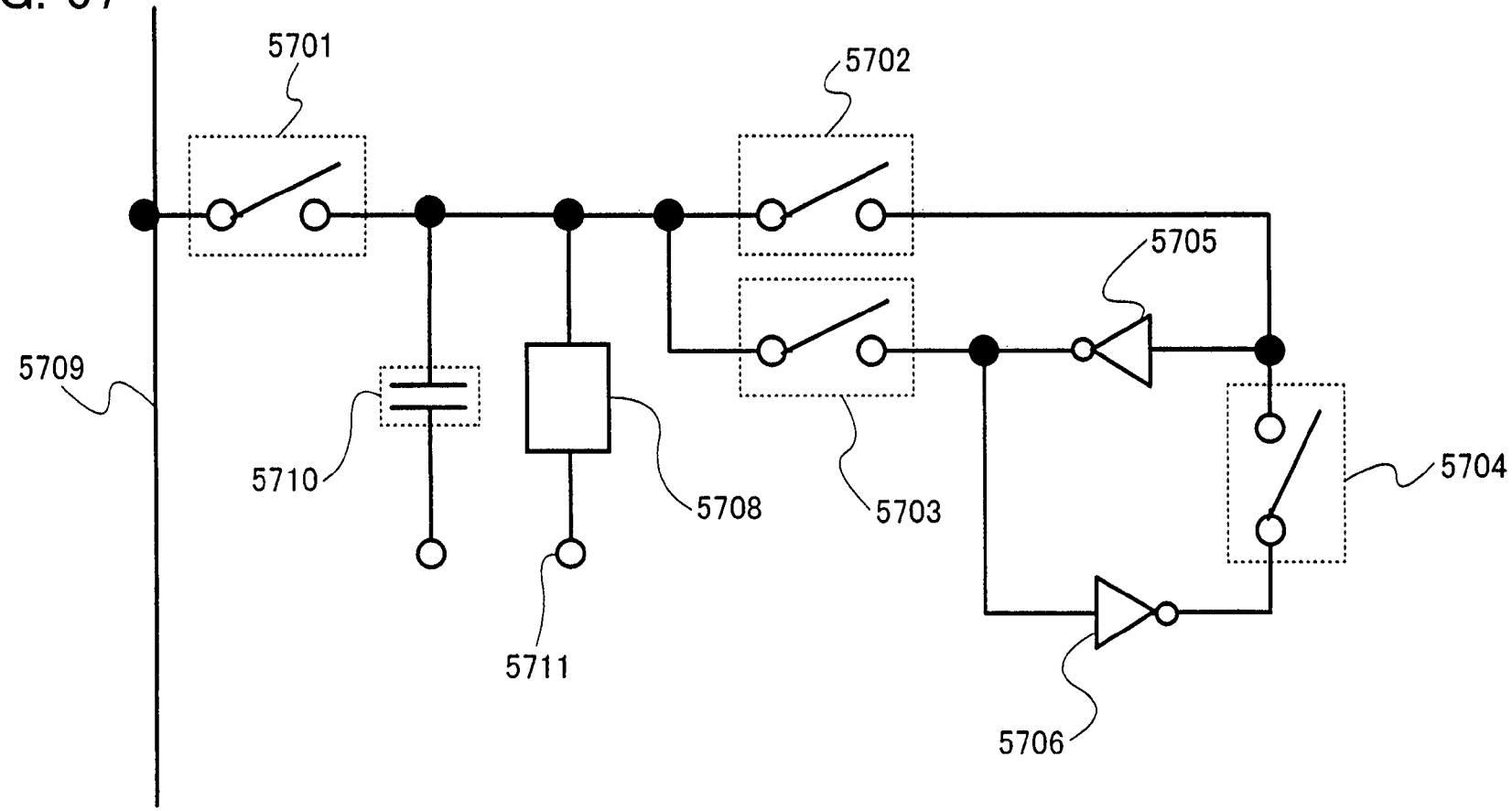
FIG. 67 shows an example of a pixel structure which can be applied to a display device of the present invention.

In addition, FIG. 67 shows a structure example of a pixel including an analog voltage holding circuit and a digital signal memory circuit. The pixel includes a pixel selection switch 5701, a first switch 5702, a second switch 5703, a third switch 5704, a first inverter 5705, a second inverter 5706, a display element 5708, a signal line 5709, and a capacitor element 5710.

The pixel selection switch 5701 is turned on when writing a signal in the pixel.

Here, in the case of display a moving image, the first switch 5702 and the second switch 5703 are turned off. Note that the third switch 5704 may be in either an on state or an off state. Then, an analog voltage corresponding to a video signal is inputted from the signal line 5709, and charges for the analog voltage are accumulated in the capacitor element 5710. By turning off the pixel selection switch 5701, the analog voltage is held in the capacitor element 5710.

In this manner, a gray scale is expressed in accordance with the analog voltage.

On the other hand, in the case of displaying a still image, the first switch 5702 is turned on first, and then, the second switch 5703 is turned off. The third switch 5704 is turned on from an off state. A digital signal corresponding to a video signal is inputted to the first inverter 5705 from the signal line 5709, and the output from the first inverter 5705 is inputted to the second inverter 5706. Then, the output from the second inverter 5706 is inputted to the capacitor element 5710 and the display element 5708. Even if the pixel selection switch 5701 is turned off, the output from the second inverter 5706 can be kept being inputted to a pixel electrode of the display element 5708. It is to be noted that the first switch 5702 and the third switch 5704 may be simultaneously turned on in the case where the digital signal has high drive capability.

Figure 68:
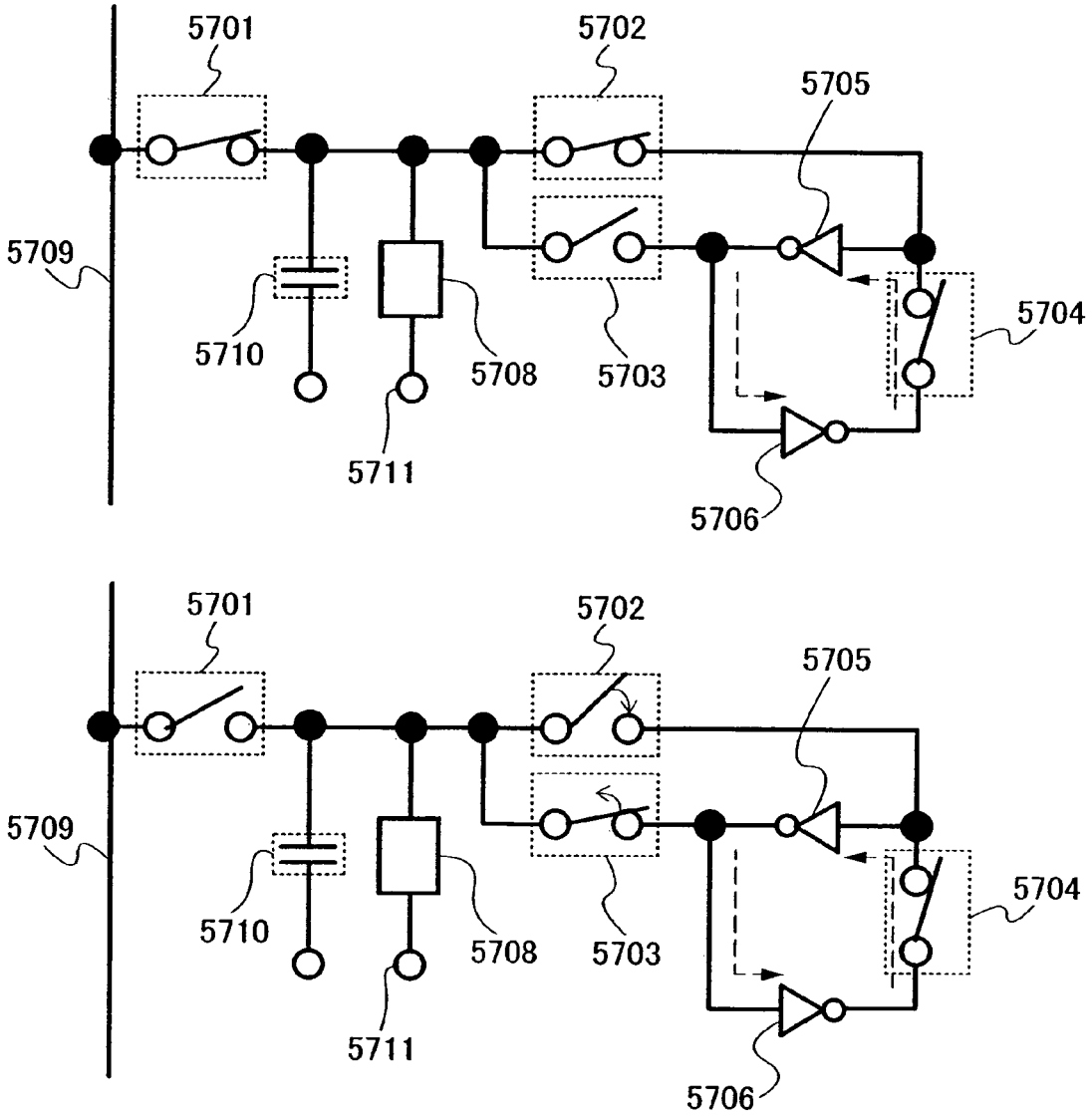
FIG. 68 explains an example of a pixel structure which can be applied to a display device of the present invention.

When the digital signal is written in the pixel, the digital signal is stored as shown in FIG. 68. In other words, as indicated by an arrow, the output from the first inverter 5705 sets the input of the second inverter 5706 and the output from the second inverter 5706 sets the input of the first inverter 5705. Therefore, the digital signal when written in the pixel can be kept being stored.

In the case of applying a liquid crystal element as the display element 5708, burnin or the like is caused in the liquid crystal element when a DC voltage is applied to the liquid crystal element for a long time. Therefore, a voltage applied to the liquid crystal element is preferably inverted regularly. Thus, the first switch 5702 and the second switch 5703 are alternately turned on and off as shown in FIG. 68 with the pixel selection switch 5701 turned off and the third switch 5704 turned on. In addition, a potential set to an opposite electrode 5711 is also changed according to the regularized on/off timing of the first switch 5702 and the second switch 5703. In a white display pixel, an AC voltage is applied to the display element 5708. On the other hand, in a black display pixel, a voltage applied to the display element 5708 is set to be equal to or lower than a threshold voltage of the liquid crystal element.

Figure 69:
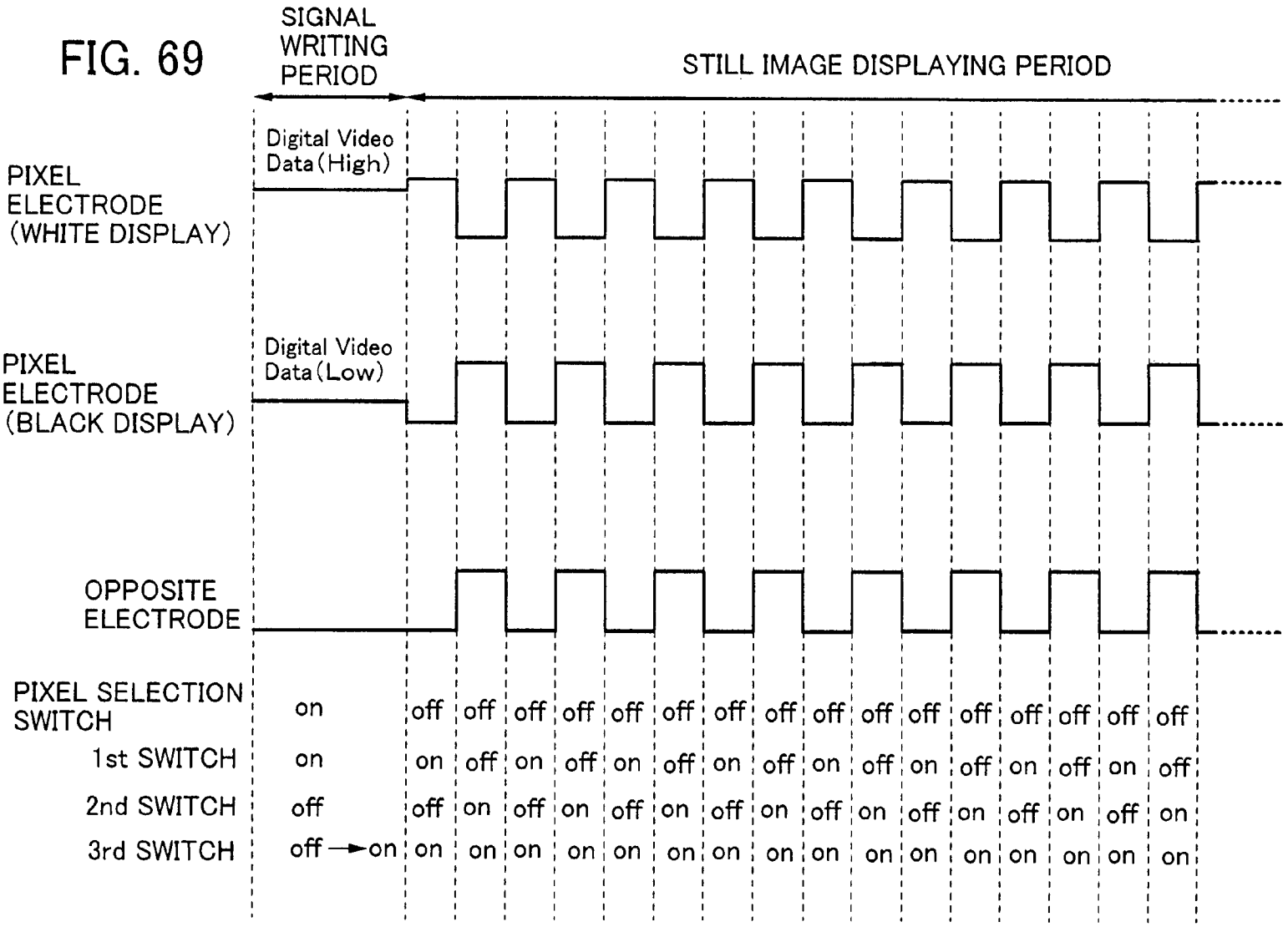
FIG. 69 explains an example of a driving method of a display device of the present invention.

For example, explanation is made with reference to FIG. 69 in the case where the pixel is put in a lighting state (white display) when a digital signal (Digital Video Data) inputted from the signal line 5709 is High (also referred to as an H level) and the pixel is put in a non-lighting state (black display) when the digital signal (Digital Video Data) is Low (also referred to as an L level). At this time, a potential set to the opposite electrode 5711 is set at an L level in a signal writing period to the pixel. In a writing period (referring to time for writing a signal to a selected pixel in the signal writing period to the pixel), the third switch 5704 is turned on from an off state with the pixel selection switch 5701 turned on, the first switch 5702 turned on, and the second switch 5703 turned off. Then, in a still image displaying period, the pixel selection switch 5701 is set in an off state and the third switch is in an on state.

As shown in FIG. 69, in a pixel to which a High digital signal (Digital Video Data) is inputted from the signal line 5709 in the writing period (referring to time for writing a signal to a selected pixel in the signal writing period to the pixels), the first switch 5702 is turned on and the second switch 5703 is turned off in the still image displaying period. When the output at an H level from the second inverter 5706 is inputted to a pixel electrode of the display element 5708, a potential at an L level is set to the opposite electrode 5711 of the display element 5708. In addition, a potential at an H level is set to the opposite electrode 5711 of the display element 5708 when the first switch 5702 is turned off, the second switch 5703 is turned on, and the output at an L level from the first inverter 5705 is inputted to the pixel electrode of the display element 5708. Thus, an AC voltage can be kept being applied to the display element 5708.

On the other hand, in a pixel to which a Low digital signal (Digital Video Data) is inputted from the signal line 5709 in the writing period (referring to time for writing a signal to a selected pixel in the signal writing period to the pixels), the first switch 5702 is turned on and the second switch 5703 is turned off in the still image displaying period. When the output at an L level from the second inverter 5706 is inputted to the pixel electrode of the display element 5708, a potential at an L level is set to the opposite electrode 5711 of the display element 5708. In addition, a potential at an H level is set to the opposite electrode 5711 of the display element 5708 when the first switch 5702 is turned off, the second switch 5703 is turned on to input the output at an H level from the first inverter 5705 to the pixel electrode of the display element 5708. Thus, a voltage applied to the display element 5708 can be set to be equal to or lower than a threshold voltage of the liquid crystal element.

In the case of displaying a still image, a gray scale can be expressed using an area gray scale method or the like.

The case of applying an area gray scale method is briefly explained with reference to FIG. 70. A pixel includes a sub-pixel 6000*a*, a sub-pixel 6000*b*, and a sub-pixel 6000*c*. Lighting regions of the sub-pixels are weighted. For example, the sizes of the lighting regions are set to satisfy $2^0:2^1:2^2$. This makes it possible to perform 3-bit display, that is, display with eight gray scale levels.

Figure 70:
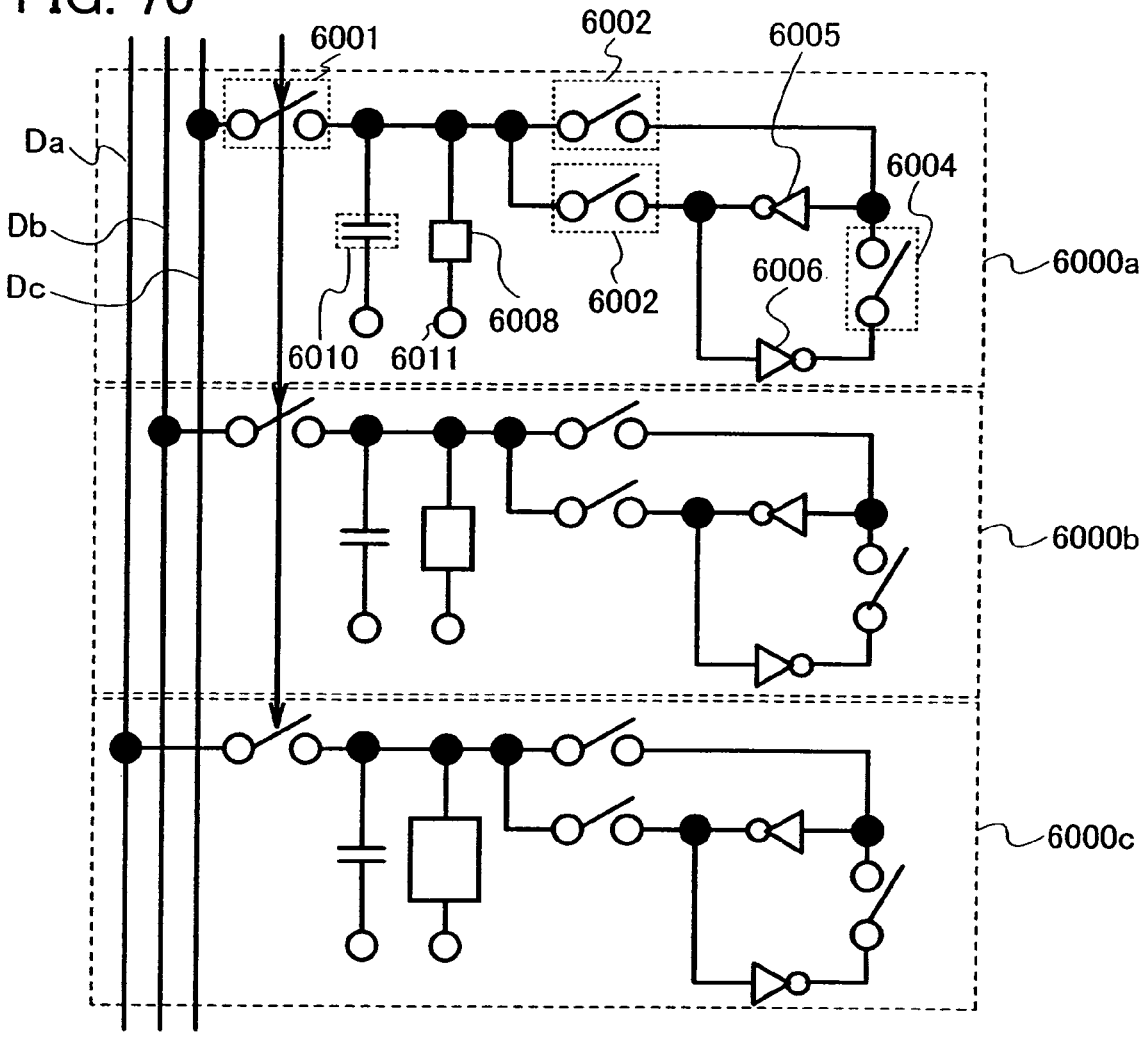
FIG. 70 explains an example of a pixel structure which can be applied to a display device of the present invention.

Note that a pixel selection switch 6001, a first switch 6002, a second switch 6003, a third switch 6004, a first inverter 6005, a second inverter 6006, a display element 6008, a capacitor element 6010, and an opposite electrode 6010 in FIG. 70 correspond to the pixel selection switch 5701, the first switch 5702, the second switch 5703, the third switch 5704, the first inverter 5705, the second inverter 5706, the display element 5708, the capacitor element 5710, and the opposite electrode 5711 of the pixel in FIG. 67, respectively. In FIG. 70, a signal line is provided for each sub-pixel as the signal line 5709 shown in FIG. 67. In other words, a pixel selection switch 6001 of the sub-pixel 6000*a* is connected to the signal line Da, a pixel selection switch 6001 of the sub-pixel 6000*b* is connected to the signal line Db, and a pixel selection switch 6001 of the sub-pixel 6000*c* is connected to the signal line Dc. Then, a digital signal of each bit corresponding to the size of the lighting region of each sub-pixel is inputted from each signal line. Therefore, a gray scale can be expressed by selecting lighting or non-lighting of each sub-pixel by the digital signal.

Figure 71B:
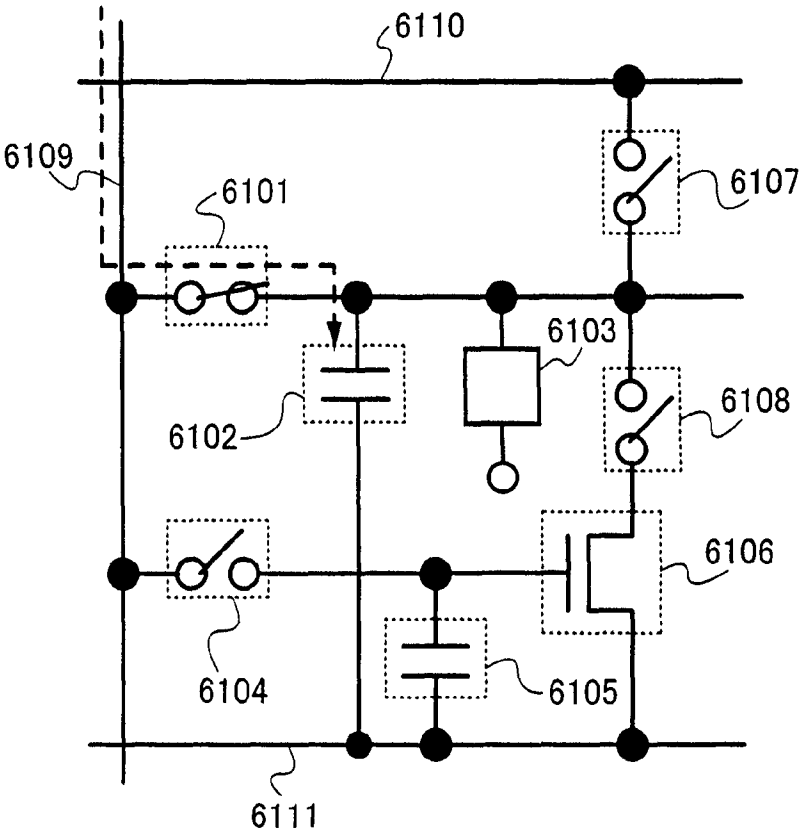
FIGS. 71A and 71B each explain an example of a pixel structure which can be applied to a display device of the present invention.
Figure 71A:
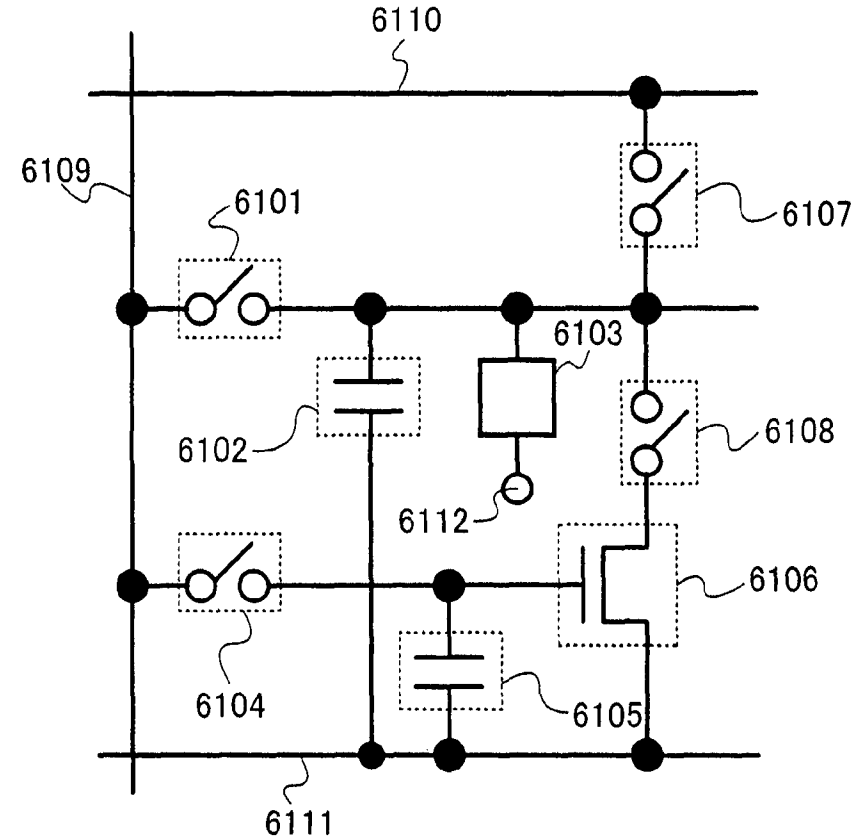

Subsequently, FIG. 71A shows another structure example of a pixel including an analog voltage holding circuit and a digital signal memory circuit. The pixel includes a first pixel selection switch 6101, a second pixel selection switch 6104, a first capacitor element 6102, a second capacitor element 6105, a display element 6103, a transistor 6106, a first switch 6107, a second switch 6108, a signal line 6109, a first power source line 6110, and a second power source line 6111. Vrefh and Vrefl are alternately set to the first power source line 6110, and Vcom is set to the second power source line 6111. Here, Vrefh is a potential satisfying (Vrefh>Vcom) and (Vrefh−Vcom)>$V_{LCD}$, and Vrefl is a potential satisfying (Vrefl<Vcom) and (Vcom−Vrefl)>$V_{LCD}$. When Vrefh or Vrefl is set to one electrode of the display element 6103 and Vcom is set to the other electrode, a voltage equal to or higher than a threshold voltage $V_{LCD}$ is applied to the display element 6103. In addition, a potential approximately equal to that of the second power source line 6111 is set to an opposite electrode 6112 of the display element 6103. In other words, when Vcom is set to a pixel electrode of the display element 6103, a potential difference between a potential of the pixel electrode and a potential of the opposite electrode is set to be equal to or lower than a threshold voltage $V_{LCD}$ of the display element 6103.

An operation of the pixel is explained. In the case of displaying a moving image, the first pixel selection switch 6101 is set in an on state, and the second pixel selection switch 6104, the first switch 6107, and the second switch 6108 are set in an off state as shown in FIG. 71B. Then, an analog potential in accordance with a gray scale level of the pixel is inputted to the signal line 6109. This analog potential corresponds to a video signal.

Figure 72B:
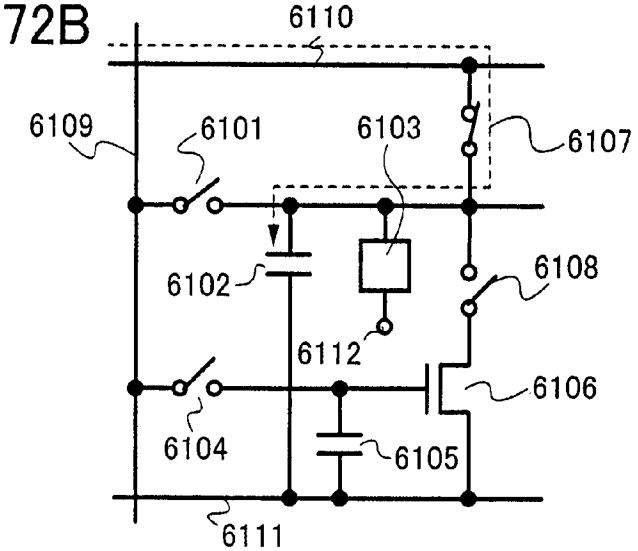
FIGS. 72A to 72D each explain an example of a pixel structure which can be applied to a display device of the present invention.
Figure 72A:
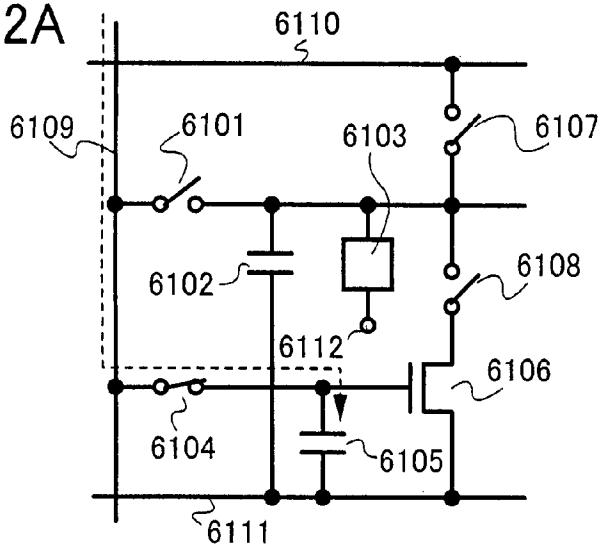

Subsequently, the case of displaying a still image is explained. In the case of displaying a still image, the second pixel selection switch 6104 is set in an on state first, and the first pixel selection switch 6101, the first switch 6107, and the second switch 6108 are set in an off state. Then, a digital signal is inputted to the signal line 6109. This digital signal corresponds to a video signal. Then, the signal is written in the second capacitor element 6105 as shown in FIG. 72A.

Next, the second pixel selection switch 6104 is turned off, and the first switch 6107 is turned on while the first pixel selection switch 6101 and the second switch 6108 are kept in an off state. Then, a potential Vrefh of the first power source line 6110 is set to one electrode of the first capacitor element 6102 as shown in FIG. 72B. In addition, a potential Vcom of the second power source line 6111 is set to the other electrode of the first capacitor element 6102; therefore, charges for a potential difference (Vrefh−Vcom) are accumulated in the capacitor element 6102. It is to be noted that a power source potential Vrefh is set to the pixel electrode of the display element 6103 at this time.

Subsequently, the first switch 6107 is turned off and the second switch 6108 is turned on while the first pixel selection switch 6101 and the second pixel selection switch 6104 are kept in an off state. Then, the transistor 6106 is controlled to be turned on/off in accordance with a digital signal written in the second capacitor element 6105.

Figure 72D:
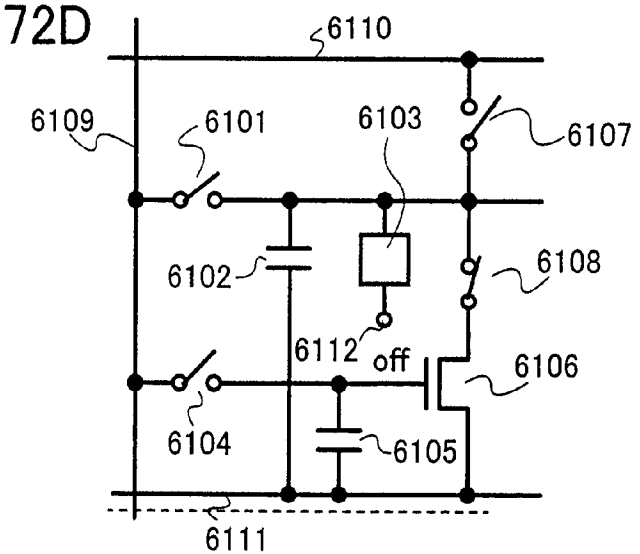
Figure 72C:
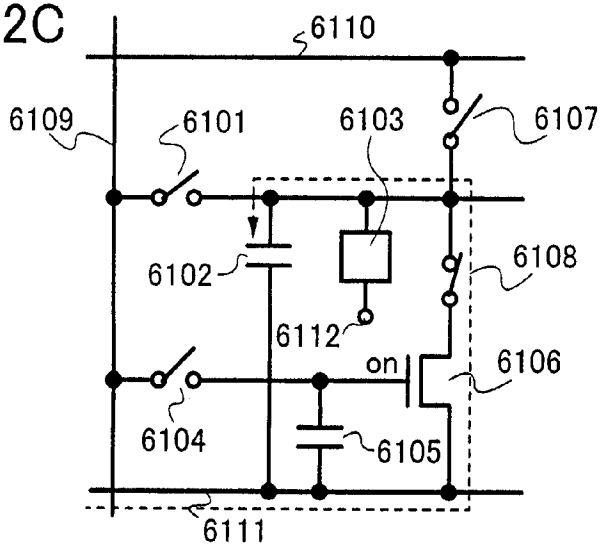

In other words, the transistor 6106 is turned on when the digital signal written in the second capacitor element 6105 is at an H level. Therefore, the potential Vcom of the second power source line 6111 is set to both electrodes of the first capacitor element 6102 as shown in FIG. 72C. Then, a potential of Vcom is set to the pixel electrode of the display element 6103. Note that a voltage is hardly applied to the display element 6103 at this time since a potential approximately equal to Vcom is set to the opposite electrode 6112 of the display element 6103. Accordingly, the pixel is put in a non-lighting state. On the other hand, the transistor 6106 is turned off when the digital signal written in the second capacitor element 6105 is at an L level. Therefore, the first capacitor element 6102 holds the voltage as shown in FIG. 72D. Accordingly, since a potential set to the pixel electrode of the display element 6103 is kept at Vrefh, the pixel is put in a lighting state.

Subsequently, a similar operation is performed in a next frame period with a potential of Vrefl set to the first power source line 6110. Then, a reverse bias voltage of that applied to the display element 6103 in the preceding frame period is applied to the display element 6103 of a lighting pixel. Thus, the direction of bias applied to the display element 6103 can be changed by changing the potential set to the first power source line 6110 in each frame period. Therefore, burn-in of the display element 6103 can be prevented.

Note that it is acceptable as long as the digital signal held in the second capacitor element 6105 can control the transistor 6106 to be turned on/off. Therefore, a normal operation can be performed even if the charges accumulated in the second capacitor element 6105 are slightly released. Accordingly, periodic rewriting of a digital signal to the pixel may be performed every several frame periods, ten-odd frame periods, or several tens frame periods. Thus, the power consumption can be reduced.

Note that signal rewriting to the pixel is performed separately from the periodic rewriting of a digital signal to the pixel when an image is partially changed in the case of displaying a still image. In this case, the display device of the present invention performs the signal rewriting to the pixel separately from the periodic rewriting only in a pixel row including a pixel in which a lighting or non-lighting state changes. In other words, when digital signal data for a pixel row in which the signal is to be written to the pixel is identical with data of a digital signal already written in the pixel, a scan line driving circuit does not select the pixel row.

Therefore, the power consumption can further be reduced.

Note that the pixel structure applicable to the display device of the present invention is not limited to those described above. Further, for the digital signal memory circuit, a static random access memory (SRAM) may be used as shown in FIG. 67 or a dynamic random access memory (DRAM) may be used as shown in FIGS. 71A and 71B. Alternatively, a combination thereof may be used.

This embodiment mode can be combined with any of the above embodiment modes. In other words, the present invention can employ all the structures formed by combining the structure shown in this embodiment mode and the structure shown in any of the above embodiment modes.

Embodiment Mode 13

In this embodiment mode, a structure of a display panel used for a display device is described with reference to FIGS. 53A and 53B.

In this embodiment mode, a display panel which can be applied to a display device of the present invention is described with reference to FIGS. 53A and 53B. FIG. 53A is a top view of the display panel, and FIG. 53B is a sectional view taken along a line A-A' of FIG. 53A. A signal line driving circuit 3601, a pixel portion 3602, a first scan line driving circuit 3606, and a second scan line driving circuit 3603 which are shown by dotted lines are provided. In addition, a sealing substrate 3604 and a sealant 3605 are provided. There is space 3607 surrounded by the sealant 3605.

A wire 3608 is a wire for transmitting signals inputted to the first scan line driving circuit 3606, the second scan line driving circuit 3603, and the signal line driving circuit 3601. Through the wire 3608, a video signal, a clock signal, a start signal, and the like are received from an FPC (Flexible Printed Circuit) 3609 which is an external input terminal. Over a connecting portion between the FPC 3609 and the display panel, an IC chip (a semiconductor chip provided with a memory circuit, a buffer circuit, or the like) 3619 is mounted by COG (Chip On Glass) or the like. It is to be noted that although only the FPC is shown here, a printed wiring board (PWB) may be attached to the FPC. The display device in this specification includes not only a main body of the display panel, but also the main body of the display panel provided with an FPC or a PWB, and besides, the main body of the display panel with an IC chip or the like mounted.

Across-sectional structure thereof is described with reference to FIG. 53B. The pixel portion 3602 and peripheral driving circuits (the second scan line driving circuit 3603, the first scan line driving circuit 3606, and the signal line driving circuit 3601) are formed over the substrate 3610. The signal line driving circuit 3601 and the pixel portion 3602 are illustrated here.

It is to be noted here that the signal line driving circuit 3601 is constituted by a CMOS circuit using an n-channel TFT 3620 and a p-channel TFT 3621. Although the peripheral driving circuits are formed over one substrate in the display panel in this embodiment mode, the invention is not limited to this and the whole or a part of the peripheral driving circuits may be formed on an IC chip or the like and then mounted by COG or the like.

Moreover, the pixel portion 3602 has a plurality of circuits each forming a pixel including a switching TFT 3611 and a driving TFT 3612. A source electrode of the driving TFT 3612 is connected to a first electrode 3613. In addition, an insulator 3614 is formed so as to cover end portions of the first electrode 3613; it is formed using a positive photosensitive acrylic resin film here.

In order to improve the coverage, the upper edge portion or the bottom edge portion of the insulator 3614 is formed to have a curved surface having curvature. For example, in the case where a positive photosensitive acrylic is used as a material for the insulator 3614, it is preferable that only the upper edge portion of the insulator 3614 be formed to have a curved surface having a radius of curvature (from 0.2 to 3 μm). Either a negative type resin that is insoluble in etchant due to light or a positive type resin that is soluble in etchant due to light can be used as the insulator 3614.

Over the first electrode 3613, a layer 3616 containing an organic compound and a second electrode 3617 are formed. The first electrode 3613 which functions as an anode is preferably formed using a material having a high work function. For example, a single-layer film of an ITO (indium tin oxide) film, an indium zinc oxide (IZO) film, a titanium nitride film, a chromium film, a tungsten film, a Zn film, or a Pt film; a laminated-layer film of a titanium nitride film and a film containing aluminum as a main component; or a three-layer structure of a titanium nitride film, a film containing aluminum as a main component, and a titanium nitride film can be used. It is to be noted that a laminated structure makes it possible to reduce the resistance as a wire, realize a good ohmic contact, and provide a function as an anode.

The layer 3616 containing an organic compound is formed by an evaporation method using an evaporation mask or an ink jetting method. As the layer 3616 containing an organic compound, a metal complex of the fourth group of the periodic system is partially used, and either a low molecular weight material or a high molecular weight material may be used in combination with such a metal complex. Generally, an organic compound is used in a single layer or laminated layers in many cases as a material for the layer containing an organic compound; however, the structure in which an inorganic compound is used partially in a film formed of an organic compound is included in this embodiment mode. Moreover, a known triplet material can be used as well.

As a material for the second electrode (cathode) 3617 formed over the layer 3616 containing an organic compound, a material having a low work function (Al, Ag, Li, Ca, or an alloy of these elements such as MgAg, MgIn, AlLi, $CaF_2$, or calcium nitride) can be used. In the case where light generated in the layer 3616 containing an organic compound is emitted through the second electrode 3617, laminated layers of a thin metal film and a transparent conductive film (e.g., ITO (an alloy of indium oxide and tin oxide), an alloy of indium oxide and zinc oxide ($In_2O_3$—ZnO), zinc oxide (ZnO) or the like) is preferably used as the second electrode (cathode) 3617.

Subsequently, the sealing substrate 3604 is attached to the substrate 3610 with the sealant 3605, so that a display element 3618 is provided in the space 3607 surrounded by the substrate 3610, the sealing substrate 3604, and the sealant 3605. It is to be noted that the space 3607 may be filled with an inert gas (such as nitrogen or argon) or the sealant 3605.

It is to be noted that an epoxy-based resin is preferably used for the sealant 3605. In addition, it is preferable that the materials of these do not transmit moisture and oxygen as much as possible. As the sealing substrate 3604, a glass substrate, a quartz substrate, or a plastic substrate formed of FRP (Fiberglass-Reinforced Plastics), PVF (polyvinyl fluoride), mylar, polyester, acrylic, or the like can be used.

In this manner, the display panel can be obtained.

Figure 53A:
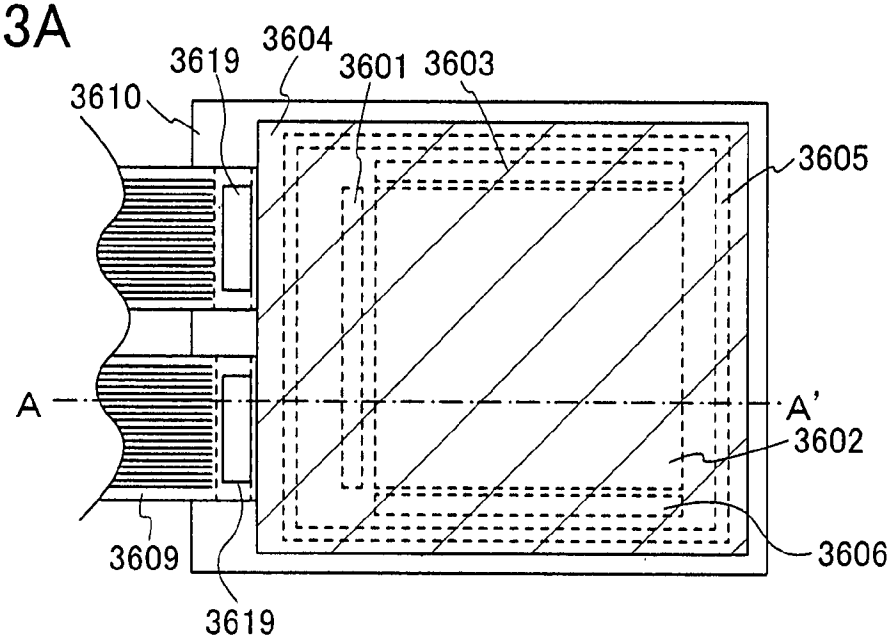
FIGS. 53A and 53B explain a structure of a display device of the present invention.
Figure 53B:
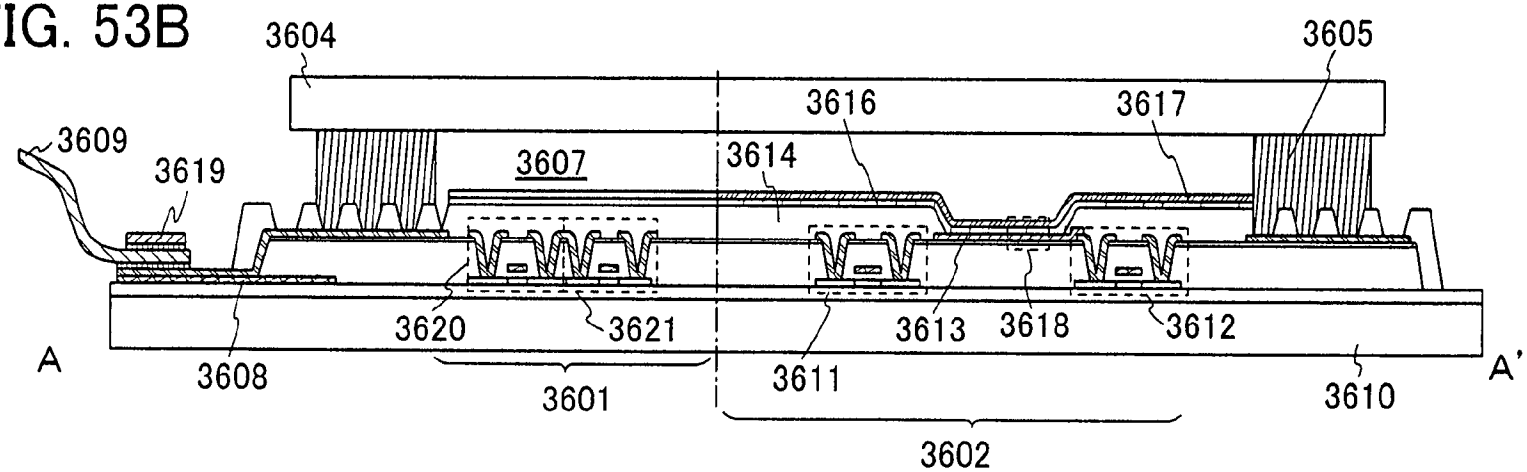

By forming the signal line driving circuit 3601, the pixel portion 3602, the second scan line driving circuit 3603, and the first scan line driving circuit 3606 over one substrate as shown in FIGS. 53A and 53B, cost reduction of a display device can be realized.

Figure 54B:
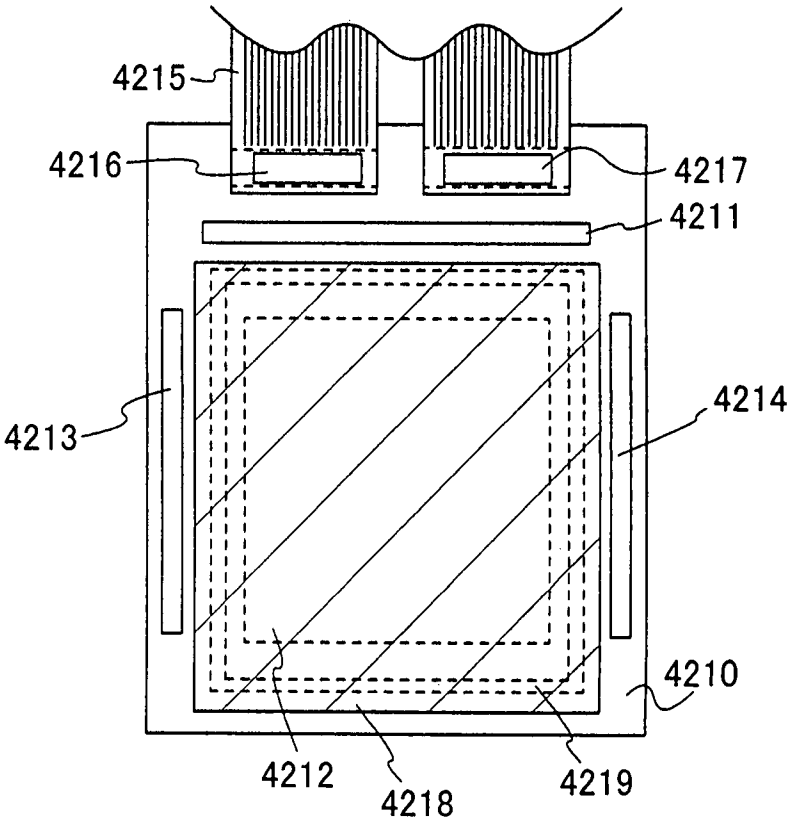
FIGS. 54A and 54B each explain a structure of a display device of the present invention.
Figure 54A:
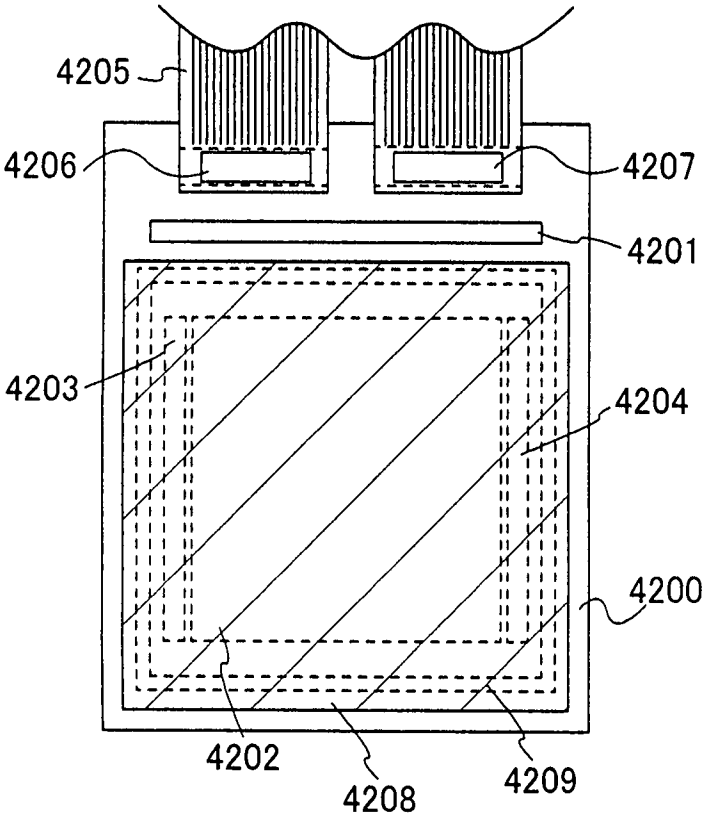

It is to be noted that the structure of the display panel is not limited to that shown in FIG. 53A where the signal line driving circuit 3601, the pixel portion 3602, the second scan line driving circuit 3603, and the first scan line driving circuit 3606 are formed over one substrate, and the structure where a signal line driving circuit 4201 shown in FIG. 54A corresponding to the signal line driving circuit 3601 is formed on an IC chip and mounted onto the display panel by COG or the like may be employed. It is to be noted that a substrate 4200, a pixel portion 4202, a second scan line driving circuit 4203, a first scan line driving circuit 4204, an FPC 4205, an IC chip 4206, an IC chip 4207, a sealing substrate 4208, and a sealant 4209 in FIG. 54A correspond to the substrate 3610, the pixel portion 3602, the second scan line driving circuit 3603, the first scan line driving circuit 3606, the FPC 3609, the IC chip 3618, the IC chip 3619, the sealing substrate 3604, and the sealant 3605 in FIG. 53A, respectively.

That is, only the signal line driving circuit of which driving circuit is required to operate at high speed may be formed using a CMOS or the like on an IC chip in order to reduce the power consumption. Moreover, when the IC chip is a semiconductor chip formed by using a silicon wafer or the like, higher-speed operation and lower power consumption can be achieved.

In addition, by integrating the second scan line driving circuit 4203 and the first scan line driving circuit 4204 with the pixel portion 4202, cost reduction can be achieved.

Thus, cost reduction of a high definition display device can be realized. In addition, by mounting an IC chip provided with a functional circuit (a memory or a buffer) onto a connecting portion between the FPC 5305 and the substrate 5300, substrate area can be utilized efficiently.

In addition, a signal line driving circuit 4211, a second scan line driving circuit 4214, and a first scan line driving circuit 4213 in FIG. 54B corresponding to the signal line driving circuit 3601, the second scan line driving circuit 3603, and the first scan line driving circuit 3606 in FIG. 53A respectively may be formed on an IC chip, and then mounted onto a display panel by COG or the like as well. In that case, the power consumption of a high definition display device can be further reduced. Therefore, in order to further reduce the power consumption of the display device, it is desirable to use polysilicon for a semiconductor layer of a transistor used in a pixel portion. It is to be noted that a substrate 4210, a pixel portion 4212, an FPC 4215, an IC chip 4216, an IC chip 4217, a sealing substrate 4218, and a sealant 4219 in FIG. 54B correspond to the substrate 3610, the pixel portion 3602, the FPC 3609, the IC chip 3618, the IC chip 3619, the sealing substrate 3604, and the sealant 3605 in FIG. 53A, respectively.

Alternatively, by using amorphous silicon for the semiconductor layer of the transistor used in the pixel portion 4212, cost reduction can be achieved. Further, a large display panel can be manufactured.

Figure 55B:
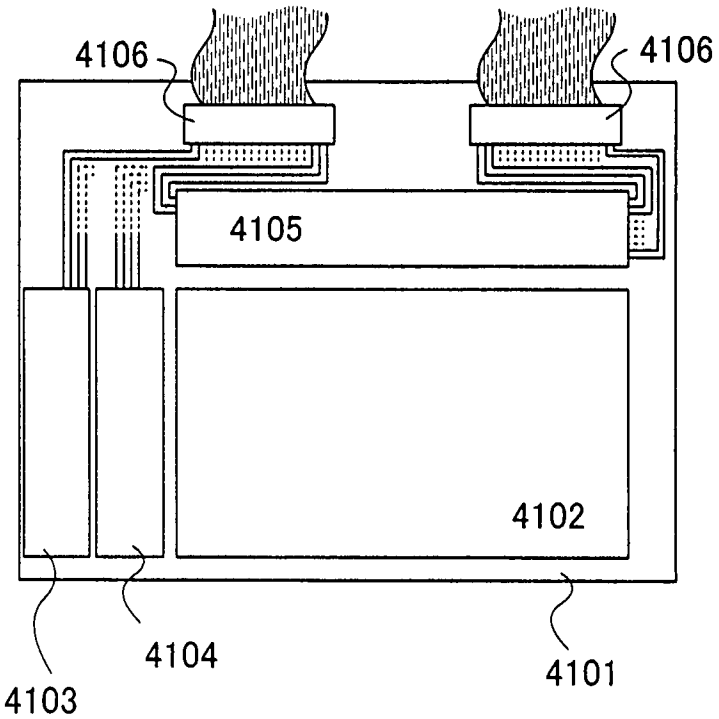
FIGS. 55A and 55B each explain a structure of a display device of the present invention.
Figure 55A:
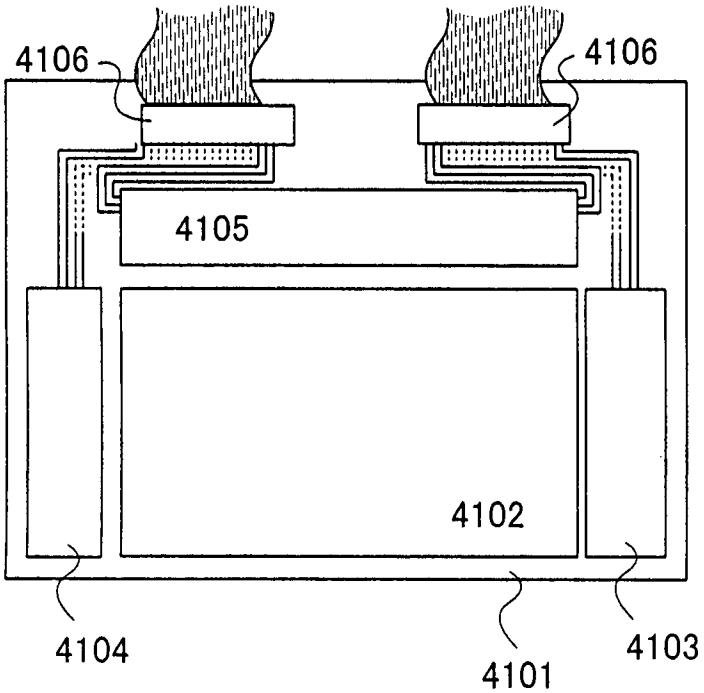

A structure of the aforementioned display panel is shown by a schematic view of FIG. 55A. A pixel portion 4102 provided with a plurality of pixels is formed over a substrate 4101, and a first scan line driving circuit 4104, a second scan line driving circuit 4103, and a signal line driving circuit 4105 are formed in the periphery of the pixel portion 4102.

Signals are supplied to the first scan line driving circuit 4104, the second scan line driving circuit 4103, and the signal line driving circuit 4105 from the outside through FPCs (Flexible Print Circuits) 4106.

It is to be noted that an IC chip may be mounted onto the FPCs 4106 by COG (Chip On Glass), TAB (Tape Automated Bonding), or the like. That is, a part of memories, buffers, or the like of the first scan line driving circuit 4104, the second scan line driving circuit 4103, and the signal line driving circuit 4105 which are difficult to be formed over the same substrate as the pixel portion 4102 may be formed on an IC chip to be mounted on a display device.

In addition, as shown in FIG. 55B, the first scan line driving circuit 4104 and the second scan line driving circuit 4103 may be provided on one side of the pixel portion 4102 in the display device of the present invention. It is to be noted that the display device shown in FIG. 55B is different from the display device shown in FIG. 55A only in the arrangement of the second scan line driving circuit 4103, and therefore, the same reference numerals are used. In addition, a structure in which one scan line driving circuit performs a function of the first scan line driving circuit 4104 and the second scan line driving circuit 4103 may be adopted. Alternatively, either one of the scan line driving circuits 4104 and 4103 may be used. That is to say, the structure may be appropriately changed in accordance with the pixel structure and the driving method.

Figure 56B:
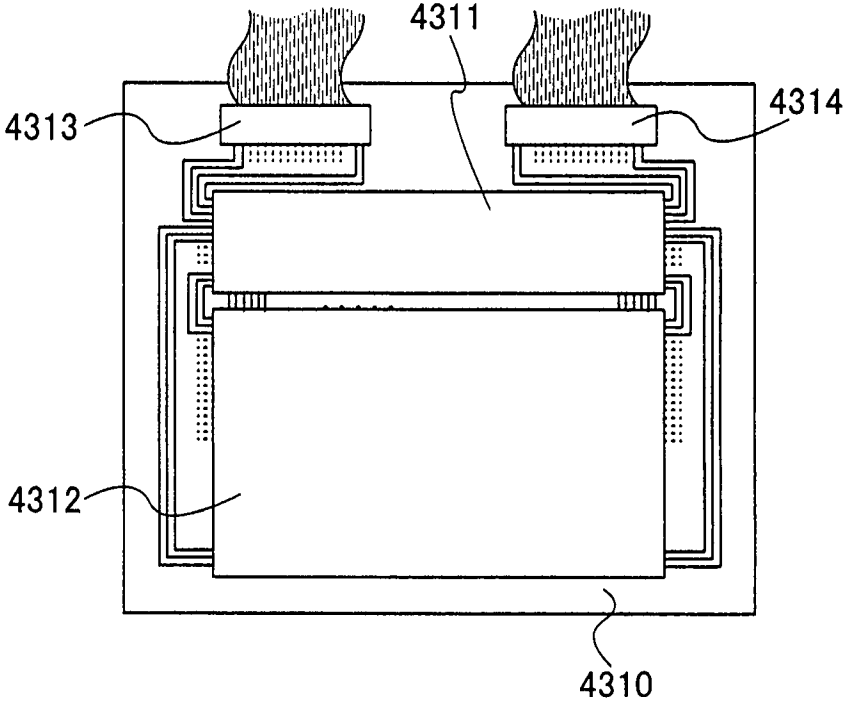
FIGS. 56A and 56B each explain a structure of a display device of the present invention.
Figure 56A:
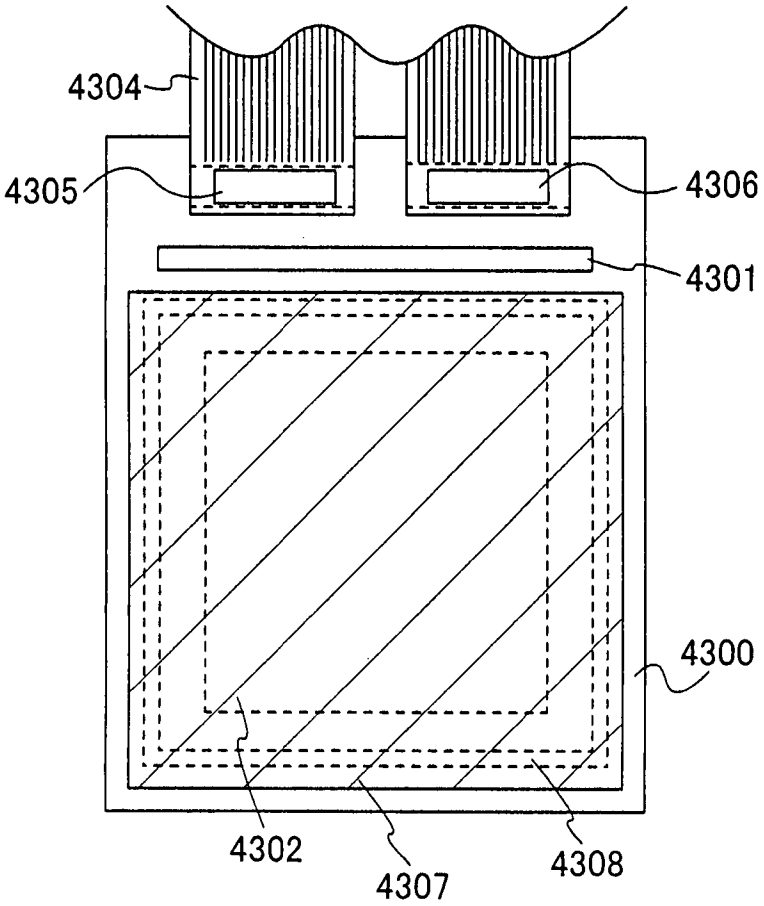

Moreover, the first scan line driving circuit, the second scan line driving circuit, and the signal line driving circuit are not necessarily provided in the row direction and the column direction of the pixels. For example, as shown in FIG. 56A, a peripheral driving circuit 4301 formed on an IC chip may have a function of the first scan line driving circuit 4213, the second scan line driving circuit 4214, and the signal line driving circuit 4211 shown in FIG. 54B. It is to be noted that a substrate 4300, a pixel portion 4302, an FPC 4304, an IC chip 4305, an IC chip 4306, a sealing substrate 4307, and a sealant 4308 in FIG. 56A correspond to the substrate 3610, the pixel portion 3602, the FPC 3609, the IC chip 3618, the IC chip 3619, the sealing substrate 3604, and the sealant 3605 in FIG. 53A, respectively.

Connection of signal lines of the display device shown in FIG. 56A is described with reference to a pattern diagram shown in FIG. 56B. A substrate 4310, a peripheral driving circuit 4311, a pixel portion 4312, an FPC 4313, and an FPC 4314 are included. An external signal and a power source potential are inputted to the peripheral driving circuit 4311 through the FPC 4313. The outputs from the peripheral driving circuit 4311 are inputted to signal lines in a column direction and scan lines in a row direction connected to pixels in the pixel portion 4312.

Figure 57A:
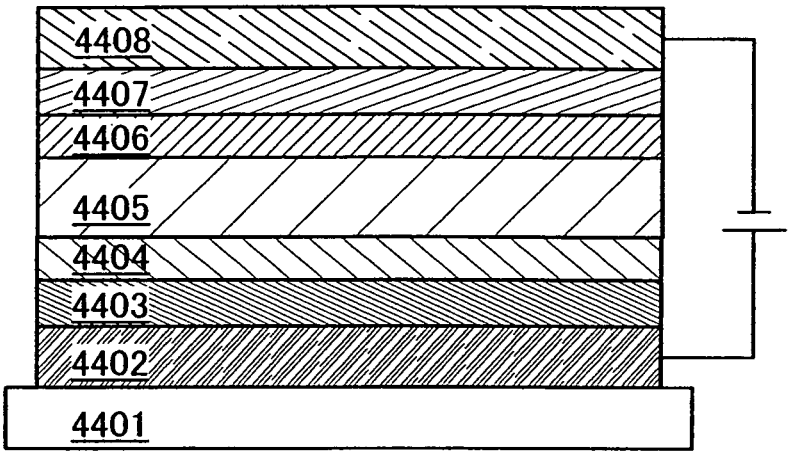
FIGS. 57A and 57B explain light-emitting elements which can be applied to a display device of the present invention.
Figure 57B:
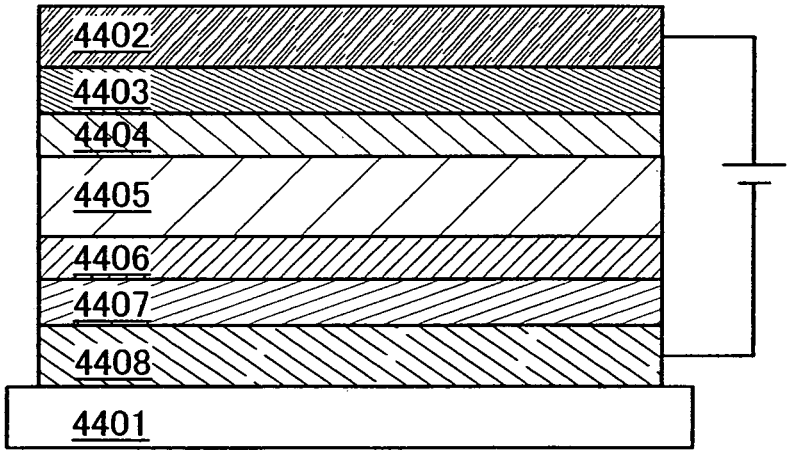

An example of a display element applicable to the display element 3618 is shown in FIGS. 57A and 57B. In other words, a structure of the display element applicable to the pixel shown in the above embodiment mode is explained with reference to FIGS. 57A and 57B.

In an element structure shown in FIG. 57A, an anode 4402, a hole injecting layer 4403 formed of a hole injecting material, a hole transporting layer 4404 formed of a hole transporting material, a light emitting layer 4405, an electron transporting layer 4406 formed of an electron transporting material, an electron injecting layer 4407 formed of an electron injecting material, and a cathode 4408 are stacked over a substrate 4401 in this order. Here, the light emitting layer 4405 is sometimes formed of only one kind of a light emitting material, but may be formed of two or more materials. In addition, an element structure of the invention is not limited to this structure.

In addition to the laminated structure in which the functional layers are stacked as shown in FIG. 57A, various elements can be applied, such as an element using a high molecular compound or a high-efficiency element in which a light emitting layer is formed using a triplet light emitting material which emits light from a triplet excited state. In addition, a white display element realized by dividing a light emitting region into two regions by controlling a carrier recombination region by a hole blocking layer, or the like can be applied as well.

In a manufacturing method of the element of the invention shown in FIG. 57A, first, the hole injecting material, the hole transporting material, and the light emitting material are evaporated in this order over the substrate 4401 provided with the anode 4402 (ITO). Then, the electron transporting material and the electron injecting material are evaporated, and the cathode 4408 is lastly formed by evaporation.

Described below are materials suitable for the hole injecting material, the hole transporting material, the electron transporting material, the electron injecting material, and the light emitting material.

As the hole injecting material, a porphyrin-based compound, phthalocyanine (hereinafter referred to as "$H_2Pc$"), copper phthalocyanine (hereinafter referred to as "CuPc"), or the like is efficient among organic compounds. In addition, a material that has a smaller value of an ionization potential than the hole transporting material to be used and that has a hole transporting function can also be used as the hole injecting material. There is also a material of a conductive high molecular compound that is chemically doped, which includes polyethylene dioxythiophene (hereinafter referred to as "PEDOT") doped with polystyrene sulfonate (hereinafter referred to as "PSS"), polyaniline, and the like. In addition, an insulating high molecular compound is also efficient in terms of planarization of an anode, and polyimide (hereinafter referred to as "PI") is often used. Further, an inorganic compound is also used, which includes an ultrathin film of aluminum oxide (hereinafter referred to as "alumina") as well as a thin film of a metal such as gold or platinum.

As the hole transporting material, it is an aromatic amine-based compound (i.e., a compound having a bond of benzene ring-nitrogen) that is most widely used. The materials that are widely used include 4,4'-bis(diphenylamino)-biphenyl (hereinafter referred to as "TAD"), derivatives thereof such as 4,4'-bis[N-(3-methylphenyl)-N-phenyl-amino]-biphenyl (hereinafter referred to as "TPD") or 4,4'-bis[N-(1-naphthyl)-N-phenyl-amino]-biphenyl (hereinafter referred to as "α-NPD"), and besides, star burst aromatic amine compounds such as 4,4',4"-tris(N,N-diphenyl-amino)-triphenylamine (hereinafter referred to as "TDATA") and 4,4',4"-tris[N-(3-methylphenyl)-N-phenyl-amino]-triphenylamine (hereinafter referred to as "MTDATA").

As the electron transporting material, a metal complex is often used. The following metal complex having a quinoline skeleton or a benzoquinoline skeleton, or the like can be used: Alq, BAlq, tris(4-methyl-8-quinolinolato)aluminum (abbreviation: Almq), bis(10-hydroxybenzo[h]-quinolinato) beryllium (abbreviation: Bebq), and the like. Besides those, the following metal complex having an oxazole-based ligand or a thiazole-based ligand, or the like can be used: bis[2-(2-hydroxyphenyl)benzoxazolato]zinc (abbreviation: $Zn(BOX)_2$); bis[2-(2-hydroxyphenyl)benzothiazolato]zinc (abbreviation: $Zn(BTZ)_2$); and the like. Further, other than the metal complexes, oxadiazole derivatives such as 2-(4-biphenylyl)-5-(4-tert-butylphenyl)-1,3,4-oxadiazole (hereinafter referred to as "PBD") and OXD-7, triazole derivatives such as TAZ and 3-(4-tert-butylphenyl)-4-(4-ethylphenyl)-5-(4-biphenylyl)-1,2,4-triazole (hereinafter referred to as "p-EtTAZ"), and phenanthroline derivatives such as bathophenanthroline (hereinafter referred to as "BPhen") and BCP have an electron transporting property.

As the electron injecting material, the above-described electron transporting materials can be used. In addition, an ultrathin film of an insulator, such as metal halide like calcium fluoride, lithium fluoride, or cesium fluoride, or alkali-metal oxide like lithium oxide, is often used. Further, an alkali-metal complex such as lithium acetyl acetonate (hereinafter referred to as "Li(acac)") or 8-quinolinolato-lithium (hereinafter referred to as "Liq") is also efficient.

As the light emitting material, other than the above-described metal complexes such as Alq, Almq, BeBq, BAlq, $Zn(BOX)_2$, and $Zn(BTZ)_2$, various fluorescent pigments are efficient. The fluorescent pigments include 4,4'-bis(2,2-diphenyl-vinyl)-biphenyl which is blue, 4-(dicyanomethylene)-2-methyl-6-(p-dimethylaminostyryl)-4H-pyran which is red-orange, and the like. Also, a triplet light emitting material can be used, which is mainly a complex with platinum or iridium as a central metal. As the triplet light emitting material, tris(2-phenylpyridine)iridium, bis(2-(4'-tolyl)pyridinato-N,$C^{2'}$)acetylacetonatoiridium (hereinafter referred to as "acacIr(tpy)2"), 2,3,7,8,12,13,17,18-octaethyl-21H,23Hporphyrin-platinum, and the like are known.

By combining the above-described materials that have respective functions, a display element with high reliability can be manufactured.

In addition, a display element having layers laminated in reverse order of that in FIG. 57A can also be used by changing the polarity of a driving transistor having the pixel structure described in the above embodiment mode so as to be an n-channel transistor, and reversing the level of a potential of an opposite electrode of a display element and a potential set to a power source line. In other words, in an element structure as shown in FIG. 57B, the cathode 4408, the electron injecting layer 4407 formed of an electron injecting material, the electron transporting layer 4406 formed of an electron transporting material, the light emitting layer 4405, the hole transporting layer 4404 formed of a hole transporting material, the hole injecting layer 4403 formed of a hole injecting material, and the anode 4402 are sequentially stacked over the substrate 4401.

In addition, in order to extract light emission of the display element, at least one of the anode and the cathode may be transparent. Then, a TFT and a display element are formed over the substrate. There are display elements having a top emission structure in which light emission is extracted through the surface opposite to the substrate, having a bottom emission structure in which light emission is extracted through the surface on the substrate side, and having a dual emission structure in which light emission is extracted through the surface opposite to the substrate and the surface on the substrate side. The pixel structure of the invention can be applied to a display element having any of the emission structures.

A display element having the top emission structure is described with reference to FIG. 58A.

Over a substrate 4500, a driving TFT 4501 is formed with a base film 4505 interposed therebetween, and a first electrode 4502 is formed in contact with a source electrode of the driving TFT 4501. A layer 4503 containing an organic compound and a second electrode 4504 are formed thereover.

Note that the first electrode 4502 is an anode of the display element, and the second electrode 4504 is a cathode of the display element. In other words, the display element is formed in a region where the layer 4503 containing an organic compound is sandwiched between the first electrode 4502 and the second electrode 4504.

Here, the first electrode 4502 which functions as an anode is preferably formed using a material having a high work function. For example, a single-layer film of a titanium nitride film, a chromium film, a tungsten film, a Zn film, or a Pt film; a laminated-layer film of a titanium nitride film and a film containing aluminum as its main component; or a three-layer structure of a titanium nitride film, a film containing aluminum as its main component, and a titanium nitride film; or the like can be used. Note that when the first electrode 4502 has a laminated-layer structure, it can have low resistance as a wire, form a good ohmic contact, and provide a function as an anode. By using a light-reflective metal film, an anode which does not transmit light can be formed.

The second electrode 4504 which functions as a cathode is preferably formed using laminated layers of a thin metal film formed of a material having a low work function (Al, Ag, Li, Ca, or an alloy thereof such as MgAg, MgIn, AlLi, $CaF_2$, or calcium nitride) and a film of a transparent conductive film (indium tin oxide (ITO), indium zinc oxide (IZO), zinc oxide (ZnO), or the like). By using the thin metal film and the transparent conductive film as described above, a cathode which can transmit light can be formed.

Figure 58A:
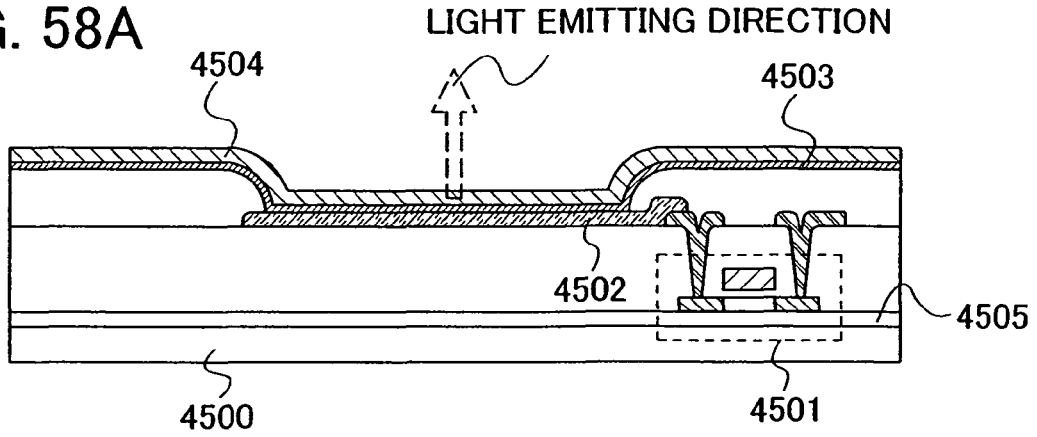
FIGS. 58A to 58C each explain a structure of a display device of the present invention.

Thus, light of the display element can be extracted from a top surface as indicated by an arrow in FIG. 58A. In other words, in the case of applying the display element to the display panel shown in FIGS. 53A and 53B, light is emitted toward the substrate 3610 side. Therefore, when a display element having a top emission structure is used for the display device, a substrate which transmits light is used as the sealing substrate 3604.

In addition, in the case of providing an optical film, the optical film may be provided on the sealing substrate 3604.

A display element having the bottom emission structure is described with reference to FIG. 58B. Description is made using the same reference numerals as those in FIG. 58A since the structure except for its emission structure is identical.

Here, the first electrode 4502 which functions as an anode is preferably formed using a material having a high work function. For example, a transparent conductive film such as an indium tin oxide (ITO) film or an indium zinc oxide (IZO) film can be used. By using a transparent conductive film, an anode which can transmit light can be formed.

The second electrode 4504 which functions as a cathode can be formed using a metal film formed of a material having a low work function (Al, Ag, Li, Ca, or an alloy thereof such as MgAg, Mgln, AlLi, $CaF_2$, or calcium nitride). By using a light-reflective metal film as described above, a cathode which does not transmit light can be formed.

Figure 58B:
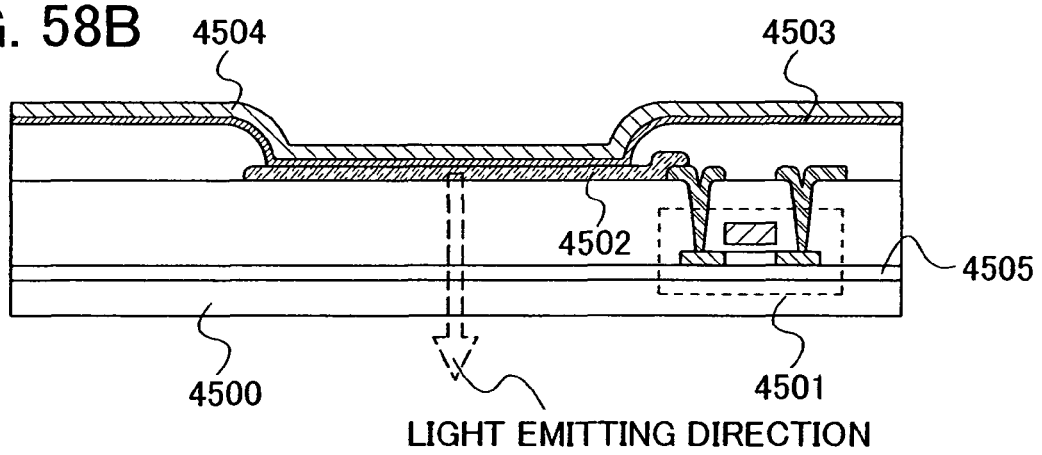

Thus, light of the display element can be extracted from a bottom surface as indicated by an arrow in FIG. 58B. In other words, in the case of applying the display element to the display panel shown in FIGS. 53A and 53B, light is emitted toward the substrate 3610 side. Therefore, when the display element having a bottom emission structure is used for the display device, a substrate which transmits light is used as the substrate 3610.

In addition, in the case of providing an optical film, the optical film may be provided on the substrate 3610.

A display element having the dual emission structure is explained with reference to FIG. 58C. Description is made using the same reference numerals as those in FIG. 58A since the structure except for its emission structure is identical.

Here, the first electrode 4502 which functions as an anode is preferably formed using a material having a high work function. For example, a transparent conductive film such as an indium tin oxide (ITO) film or an indium zinc oxide (IZO) film can be used. By using a transparent conductive film, an anode which can transmit light can be formed.

The second electrode 4504 which functions as a cathode is preferably formed using laminated layers of a thin metal film formed of a material having a low work function (Al, Ag, Li, Ca, or an alloy thereof such as MgAg, MgIn, AlLi, $CaF_2$, or calcium nitride) and a transparent conductive film (indium tin oxide (ITO), an alloy of indium oxide and zinc oxide ($In_2O_3$—ZnO), zinc oxide (ZnO), or the like). By using the thin metal film and the transparent conductive film as described above, a cathode which can transmit light can be formed.

Figure 58C:
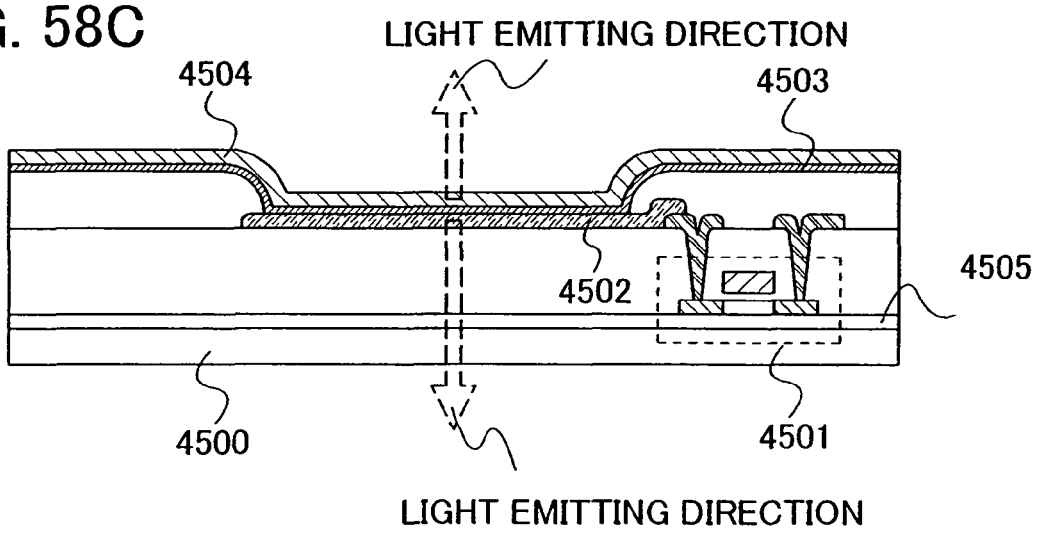

Thus, light of the display element can be extracted from both surfaces as indicated by arrows in FIG. 58C. In other words, in the case of applying the display element to the display panel shown in FIGS. 53A and 53B, light is emitted toward the substrate 3610 side and the sealing substrate 3604 side. Therefore, when the display element having a dual emission structure is used for the display device, substrates which transmit light are used as both the substrate 3610 and the sealing substrate 3604.

In addition, in the case of providing an optical film, the optical film may be provided on both the substrate 3610 and the sealing substrate 3604.

In addition, the invention can be applied to a display device which achieves full-color display by using a white display element and a color filter.

Figure 59:
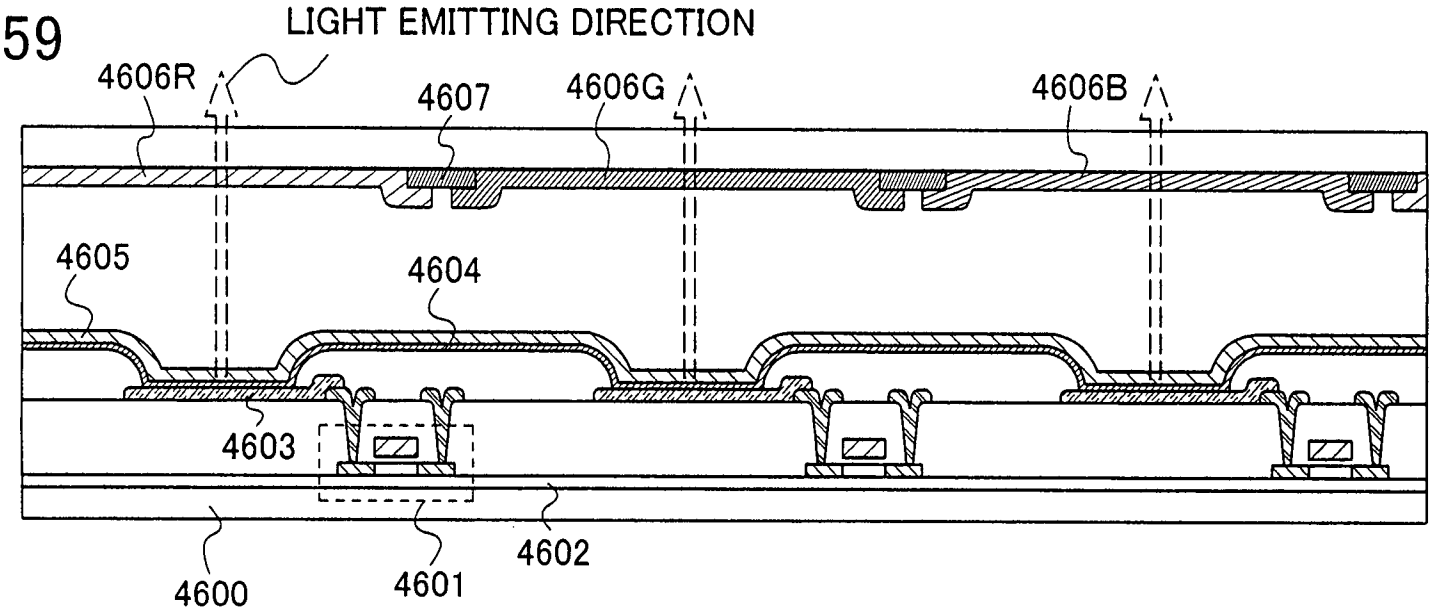
FIG. 59 explains a structure of a display device of the present invention.

As shown in FIG. 59, for example, the structure may be that a base film 4602 is formed over a substrate 4600, a driving TFT 4601 is formed thereover, a first electrode 4603 is formed in contact with a source electrode of the driving TFT 4601, and a layer 4604 containing an organic compound and a second electrode 4605 are formed thereover.

Note that the first electrode 4603 is an anode of the display element, and the second electrode 4605 is a cathode of the display element. In other words, the display element is formed in a region where the layer 4604 containing an organic compound is sandwiched between the first electrode 4603 and the second electrode 4605. White light is emitted with the structure shown in FIG. 59. A red color filter 4606R, a green color filter 4606G, and a blue color filter 4606B are provided above the display elements respectively to achieve full-color display. In addition, a black matrix (also referred to as a "BM") 4607 which separates these color filters is provided.

The above-described structures of the display element can be used in combination and can be appropriately applied to the display device of the invention. In addition, the structure of the display panels described above and the display element are merely examples, and another structure can be naturally applied to the display device of the invention.

Embodiment Mode 14

The present invention can be applied to various electronic appliances. Specifically, the present invention can be applied to a display portion of an electronic appliance. As the electronic appliance, a camera such as a video camera or a digital camera, a goggle type display, a navigation system, a sound reproducing device (such as a car audio or audio component), a computer, a game machine, a mobile information terminal (such as a mobile computer, a mobile phone, a mobile game machine, or an electronic book), an image reproducing device provided with a record medium (specifically, a device which reproduces a record medium such as a digital versatile disk (DVD) and is provided with a light emitting device for displaying the image), or the like is given.

Figure 60A:
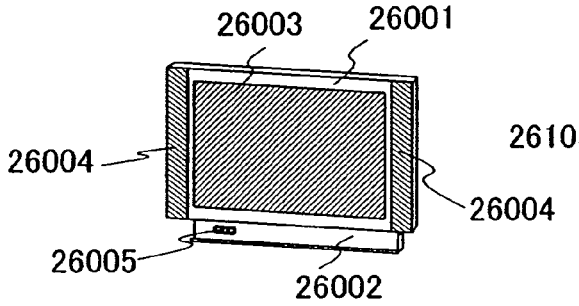
FIGS. 60A to 60H each show an example of usage of a display device of the present invention.

FIG. 60A shows a light emitting device including a housing 26001, a support 26002, a display portion 26003, speaker portions 26004, a video input portion 26005, and the like. A display device of the present invention can be used in the display portion 26003. It is to be noted that the light emitting device includes all the light emitting devices for displaying information, which are used for a personal computer, a television broadcasting reception, advertisement display, and the like. The light emitting device using the display device of the present invention for the display portion 26003 can achieve low power consumption.

Figure 60B:
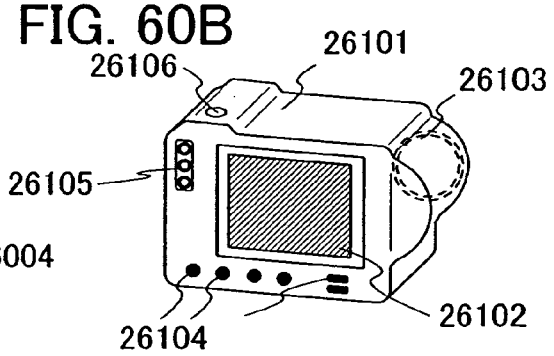

FIG. 60B shows a camera including a main body 26101, a display portion 26102, an image receiving portion 26103, operation keys 26104, an external connection port 26105, a shutter 26106, and the like.

A digital camera using the present invention for the display portion 26102 can achieve low power consumption.

Figure 60C:
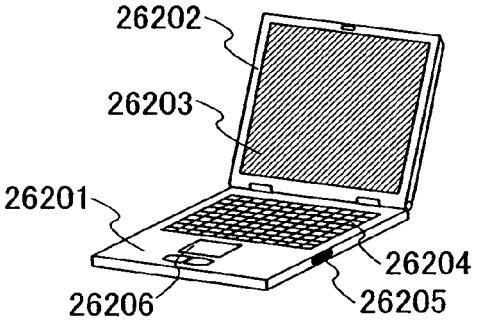

FIG. 60C shows a computer including a main body 26201, a housing 26202, a display portion 26203, a keyboard 26204, an external connection port 26205, a pointing mouse 26206, and the like. The computer using the present invention for the display portion 26203 can achieve low power consumption.

Figure 60D:
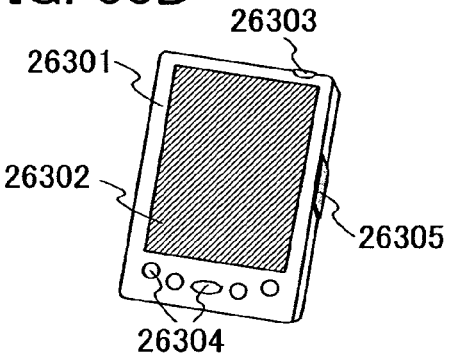

FIG. 60D shows a mobile computer including a main body 26301, a display portion 26302, a switch 26303, operation keys 26304, an infrared port 26305, and the like. The mobile computer using the present invention for the display portion 26302 can achieve low power consumption.

Figure 60E:
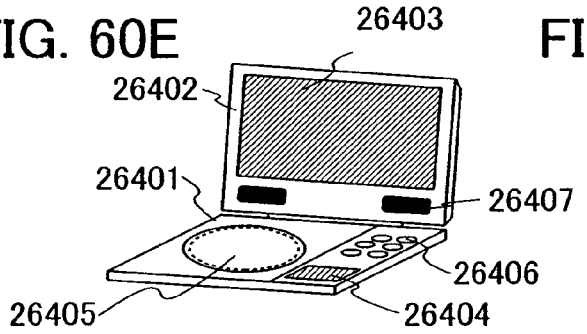

FIG. 60E shows a mobile image reproducing device provided with a record medium (specifically, a DVD reproducing device) including a main body 26401, a housing 26402, display portions A26403 and B26404, a record medium (such as a DVD) reading portion 26405, an operation key 26406, a speaker portion 26407, and the like. The display portion A26403 can mainly display image information while the display portion B26404 can mainly display letter information. The image reproducing device using the present invention for the display portions A26403 and B26404 can achieve low power consumption.

Figure 60F:
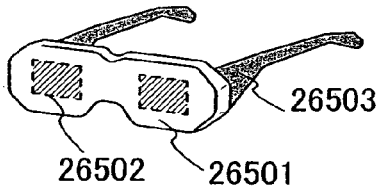

FIG. 60F shows a goggle type display including a main body 26501, a display portion 26502, an arm portion 26503, and the like. The goggle type display using the present invention for the display portion 26502 can achieve low power consumption.

Figure 60G:
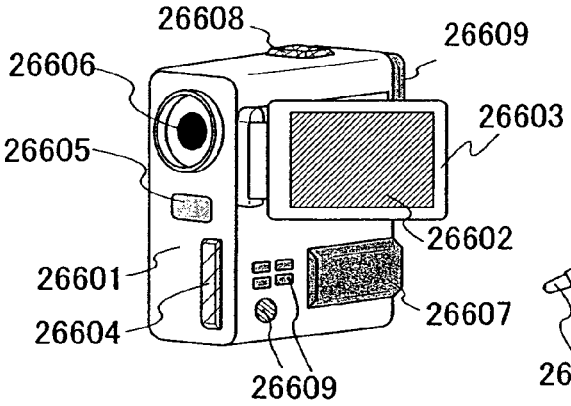

FIG. 60G shows a video camera including a main body 262001, a display portion 262002, a housing 262003, an external connection port 262004, a remote control receiving portion 262005, a battery 262007, a sound input portion 262008, operation keys 262009, and the like. The video camera using the present invention for the display portion 262002 can achieve low power consumption.

Figure 60H:
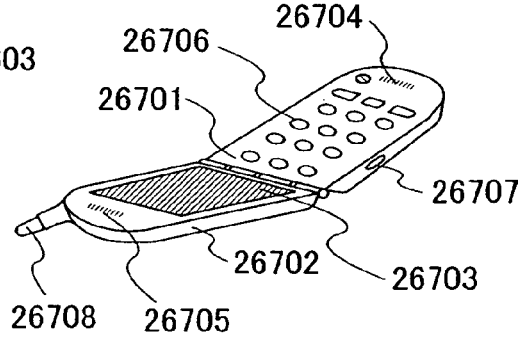
Figure 61:
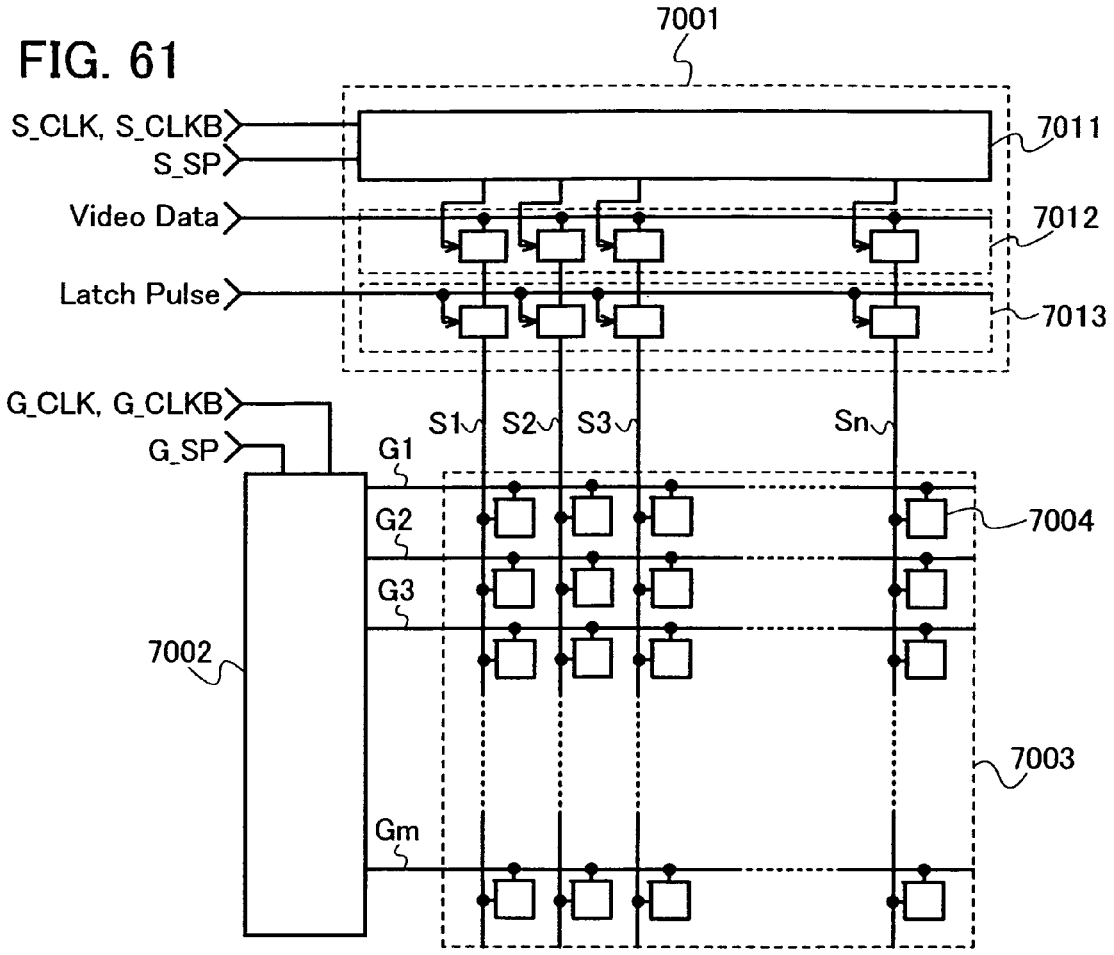
FIG. 61 explains a structure of a conventional display device.

FIG. 60H shows a mobile phone including a main body 26701, a housing 26702, a display portion 26703, a sound input portion 26704, a sound output portion 26705, an operation key 26706, an external connection port 26707, an antenna 26708, and the like.

In recent years, a mobile phone is provided with a game function, a camera function, an electronic money function, or the like, and the need of a high-value added mobile phone has been increased. While a mobile phone has been multifunctional and frequency of use thereof has been increased, the life per charge has been required to be long. The mobile phone using the present invention for the display portion 26703 can achieve lower power consumption. Therefore, long-term use becomes possible.

Figure 62:
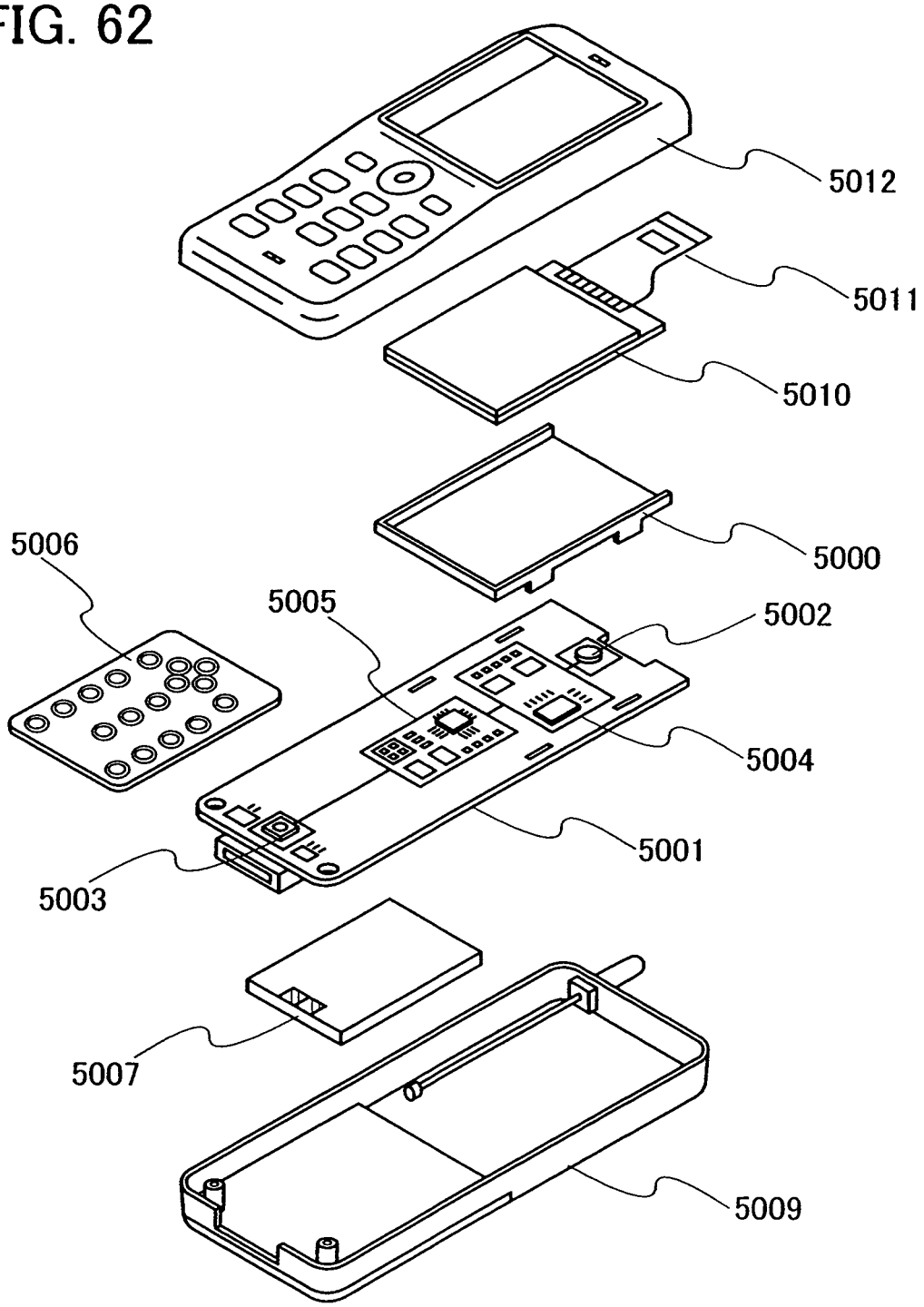
FIG. 62 shows an example of usage of a display device of the present invention.

A more specific structure example of a mobile phone having the display device of the present invention in a display portion is explained with reference to FIG. 62.

A display panel 5010 which is detachable is incorporated into a housing 5000. The shape or the size of the housing 5000 can be appropriately changed depending on the size of the display panel 5010. The housing 5000 which fixes the display panel 5010 is fitted into a printed board 5001 so as to be incorporated as a module.

The display panel 5010 is connected to the printed board 5001 via an FPC 5011. The printed board 5001 is provided with a speaker 5002, a microphone 5003, a sending and receiving circuit 5004, and a signal processing circuit 5005 including a CPU, a controller, and the like. Such a module, an input means 5006, and a battery 5007 are combined with each other to be stored in a housing 5009. A pixel portion of the display panel 5010 is arranged so as to be visible from an opening window which is provided to the housing 5009.

The display panel 5010 may be integrated in such a way that a pixel portion and a part of peripheral driving circuit (a driving circuit having low operating frequency among plural driving circuits) are formed over a substrate using TFTs and a part of the peripheral driving circuit (a driving circuit having high operating frequency among plural driving circuits) may be formed over an IC chip which is mounted on the display panel 5010 by COG (Chip On Glass). Alternatively, the IC chip may be connected to the glass substrate by using TAB (Tape Automated Bonding) or a printed board. FIG. 54A shows an example of a structure of a display panel in which a part of a peripheral driving circuit and a pixel portion are formed integrally over a substrate and an IC chip where the other peripheral driving circuit is formed is mounted by COG or the like. Such a structure allows reduction of power consumption of a display device and the mobile phone can be used for a longer period per charge. Moreover, cost reduction of the mobile phone is possible.

In order to further reduce the power consumption, as shown in FIG. 54B, a pixel portion may be formed over a substrate using TFTs and all the peripheral driving circuits are formed over an IC chip, and then the IC chip may be mounted on a display panel by COG (Chip On Glass) or the like.

Figure 63:
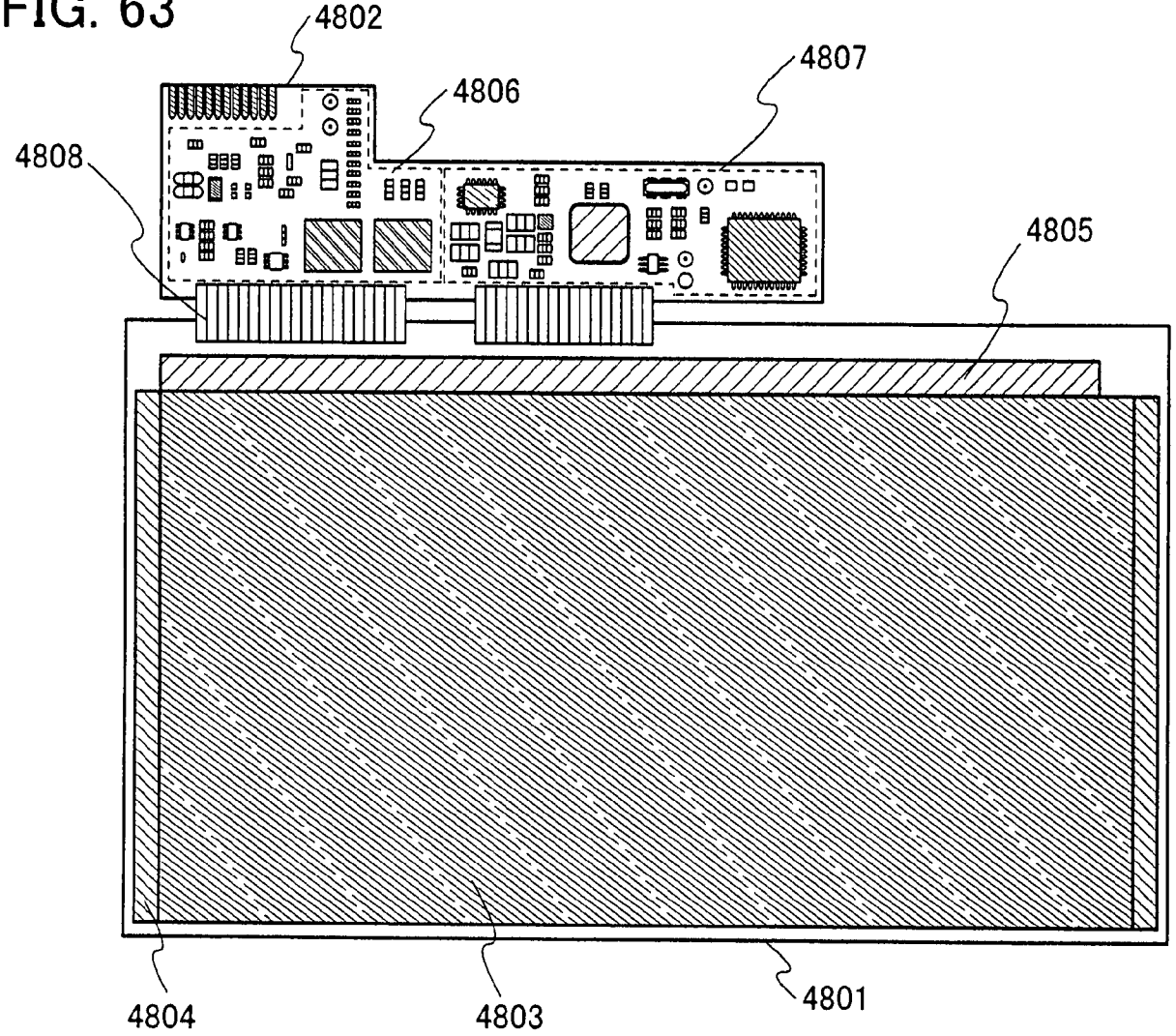
FIG. 63 shows an example of usage of a display device of the present invention.

FIG. 63 shows an EL module in which a display panel 4801 is combined with a circuit substrate 4802. The display panel 4801 has a pixel portion 4803, a scan line driving circuit 4804, and a signal line driving circuit 4805. Over the circuit substrate 4802, for example, a control circuit 4806, a signal dividing circuit 4807, and the like are formed. The display panel 4801 and the circuit substrate 4802 are connected to each other by a connection wire 4808. An FPC or the like can be used as the connection wire.

As for the display panel 4801, a pixel portion and a part of peripheral driving circuit (a driving circuit having low operating frequency among plural driving circuits) are formed over a substrate using TFTs and a part of the peripheral driving circuit (a driving circuit having high operating frequency among plural driving circuits) may be formed over an IC chip which is then mounted on the display panel 4801 by COG (Chip On Glass) or the like. Alternatively, the IC chip may be mounted on the display panel 4801 using a TAB (Tape Automated Bonding) or a printed board. FIG. 54A shows an example of a structure of a display panel in which a part of a peripheral driving circuit and a pixel portion are formed integrally over a substrate and an IC chip where the other peripheral driving circuit is formed is mounted by COG or the like.

In order to further reduce the power consumption, as shown in FIG. 54B, a pixel portion may be formed over a substrate using TFTs and all the peripheral driving circuits are formed over an IC chip, and then the IC chip may be mounted on a display panel by COG (Chip On Glass) or the like. FIG. 54B shows an example of a structure in which a pixel portion is formed over a substrate and an IC chip where a peripheral driving circuit is formed is mounted over the substrate by COG or the like.

Figure 64:
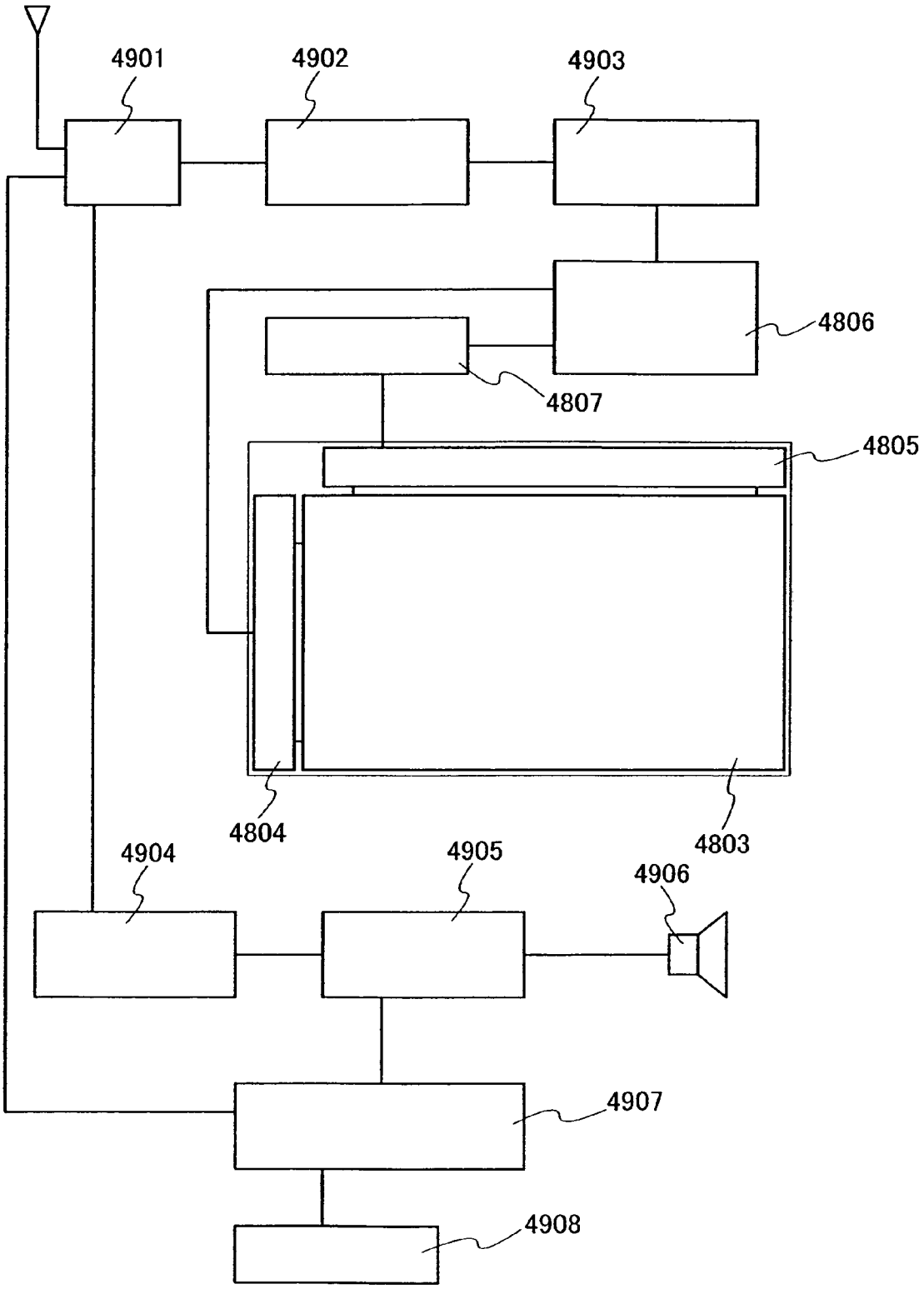
FIG. 64 shows an example of usage of a display device of the present invention.

With this EL module, an EL television receiver can be completed. FIG. 64 is a block diagram showing a main structure of an EL television receiver. A tuner 4901 receives an image signal and an audio signal. An image signal is processed by an image signal amplifier circuit 4902, an image signal processing circuit 4903 that converts signal outputted therefrom into a color signal corresponding to each color of red, green, and blue, and a control circuit 4806 for converting the image signal into an input specification of a driving circuit. The control circuit 4806 outputs signals to a scan line side and a signal line side. In a case of digital driving, the signal line side is provided with a signal line dividing circuit 4807 to divide an inputted digital signal into m units to be supplied.

Among signals received by the tuner 4901, an audio signal is transmitted to an audio signal amplifier circuit 4904, and the output thereof is provided to a speaker 4906 through an audio signal processing circuit 4905. A control circuit 4907 receives control information of a receiving station (a receiving frequency) or sound volume from an input portion 4908 and transmits a signal to the tuner 4901 or the audio signal processing circuit 4905.

As shown in FIG. 60A, the television receiver can be completed by incorporating the EL module in FIG. 64 into the housing 26001. With the EL module, the display portion 26003 is formed. Moreover, the television receiver is arbitrarily provided with the speaker 26004 the video input terminal 26005, and the like.

The present invention is not limited to the television receiver and is applicable to a display medium with a large-sized area such as an information display board at a railway station, an airport, or the like, or an advertisement display board on the street as well as a monitor of a personal computer.

In this way, the present invention can be applied to every electronic appliance.

This application is based on Japanese Patent Application serial no. 2005-348835 filed in Japan Patent Office on Dec. 2, in 2005, the entire contents of which are hereby incorporated by reference.

What is claimed is:

1. A display device comprising:

a pixel portion comprising (n×m) pixels provided in a matrix form;

a scan line driving circuit configured to select (i−1)-th row of the (n×m) pixels, and i-th row of the (n×m) pixels;

a signal line driving circuit configured to input first video signal to the (i−1)-th row when the (i−1)-th row is selected, and second video signal to the i-th row when the i-th row is selected, the signal line driving circuit comprising:

a shift register comprising flip-flop circuits; and a determination circuit configured to compare data to be displayed of the first video signal and data to be displayed of the second video signal, wherein the determination circuit comprises a plurality of logical gates, a plurality of switches, a resistor and an output terminal, wherein the plurality of switches is electrically connected in series, wherein the plurality of switches is electrically connected to the output terminal, wherein each of the plurality of switches is controlled by an output from one of the plurality of logical gates, wherein the resistor is electrically connected to the output terminal, wherein the first video signal and the second video signal are to display two consecutive rows of a same image;

wherein n is a natural number, wherein m is a natural number, and wherein i is a natural number no less than 2 and no more than n.

2. A display device comprising:

a pixel portion comprising (n×m) pixels provided in a matrix form;

a scan line driving circuit configured to select (i−1)-th row of the (n×m) pixels, and i-th row of the (n×m) pixels;

a signal line driving circuit configured to input first video signal to j-th to k-th columns of the (i−1)-th row when the (i−1)-th row is selected, and second video signal to j-th to k-th columns of the i-th row when the i-th row is selected, the signal line driving circuit comprising:

a shift register comprising flip-flop circuits; and a determination circuit configured to compare data to be displayed of the first video signal and data to be displayed of the second video signal, wherein the determination circuit comprises a plurality of logical gates, a plurality of switches, a resistor and an output terminal, wherein the plurality of switches is electrically connected in series, wherein the plurality of switches is electrically connected to the output terminal, wherein each of the plurality of switches is controlled by an output from one of the plurality of logical gates, wherein the resistor is electrically connected to the output terminal, wherein the first video signal and the second video signal are to display two consecutive rows of a same image;

wherein n is a natural number, wherein m is a natural number, wherein i is a natural number no less than 2, and no more than n, wherein j is a natural number smaller than m, and wherein k is a natural number larger than j, and no more than m.

3. A display device comprising:

a pixel portion comprising (n×m) pixels provided in a matrix form;

a scan line driving circuit configured to select (i−1)-th row of the (n×m) pixels, and i-th row of the (n×m) pixels;

a signal line driving circuit configured to input first video signal to the (i−1)-th row when the (i−1)-th row is selected, and second video signal to the i-th row when the i-th row is selected, the signal line driving circuit comprising:

a latch circuit configured to receive sampling pulses and to hold the first video signal; and a shift register configured to supply the sampling pulses to the latch circuit, the shift register comprising flip-flop circuits; and a determination circuit configured to interrupt transmission of sampling pulses between the shift register and the latch circuit when a comparison between data to be displayed of the first video signal and data to be displayed of the second video signal shows that data to be displayed of the first video signal held in the latch circuit are identical with data to be displayed of the second video signal, wherein the determination circuit comprises a plurality of logical gates, a plurality of switches, a resistor and an output terminal, wherein the plurality of switches is electrically connected in series, wherein the plurality of switches is electrically connected to the output terminal, wherein each of the plurality of switches is controlled by an output from one of the plurality of logical gates, wherein the resistor is electrically connected to the output terminal, wherein the first video signal and the second video signal are to display two consecutive rows of a same image;

wherein n is a natural number, wherein m is a natural number, and wherein i is a natural number no less than 2 and no more than n.

4. A display device comprising:

a pixel portion comprising (n×m) pixels provided in a matrix form;

a scan line driving circuit configured to select (i−1)-th row of the (n×m) pixels, and i-th row of the (n×m) pixels;

a signal line driving circuit configured to input first video signal to j-th to k-th columns of the (i−1)-th row when the (i−1)-th row is selected, and second video signal to j-th to k-th columns of the i-th row when the i-th row is selected, the signal line driving circuit comprising:

a latch circuit configured to receive sampling pulses and to hold the first video signal; and a shift register configured to supply the sampling pulses to the latch circuit, the shift register comprising flip-flop circuits; and a determination circuit configured to interrupt transmission of sampling pulses between the shift register and the latch circuit when a comparison between data to be displayed of the first video signal and data to be displayed of the second video signal shows that data to be displayed of the first video signal held in the latch circuit are identical with data to be displayed of the second video signal, wherein the determination circuit comprises a plurality of logical gates, a plurality of switches, a resistor and an output terminal, wherein the plurality of switches is electrically connected in series, wherein the plurality of switches is electrically connected to the output terminal, wherein each of the plurality of switches is controlled by an output from one of the plurality of logical gates, wherein the resistor is electrically connected to the output terminal, wherein the first video signal and the second video signal are to display two consecutive rows of a same image;

wherein n is a natural number, wherein m is a natural number, wherein i is a natural number no less than 2, and no more than n, wherein j is a natural number smaller than m, and wherein k is a natural number larger than j, and no more than m.

5. A display device comprising:

a pixel portion comprising (n×m) pixels provided in a matrix form;

a scan line driving circuit configured to select (i−1)-th row of the (n×m) pixels, and i-th row of the (n×m) pixels;

a signal line driving circuit configured to input first video signal to j-th to k-th columns of the (i−1)-th row when the (i−1)-th row is selected, and second video signal to j-th to k-th columns of the i-th row when the i-th row is selected, the signal line driving circuit comprising:

a shift register comprising flip-flop circuits; and a latch circuit configured to hold the first video signal according to sampling pulses for the first video signal; and a determination circuit configured to compare data to be displayed of the first video signal and data to be displayed of the second video signal, wherein the determination circuit comprises a plurality of logical gates, a plurality of switches, a resistor and an output terminal, wherein the plurality of switches is electrically connected in series, wherein the plurality of switches is electrically connected to the output terminal, wherein each of the plurality of switches is controlled by an output from one of the plurality of logical gates, wherein the resistor is electrically connected to the output terminal, wherein the first video signal and the second video signal are to display two consecutive rows of a same image;

wherein n is a natural number, wherein m is a natural number, wherein i is a natural number no less than 2 and no more than n wherein j is a natural number smaller than m, and wherein k is a natural number larger than j, and no more than m.

6. A display device comprising:

a pixel portion comprising (n×m) pixels provided in a matrix form;

a scan line driving circuit configured to select (i−1)-th row of the (n×m) pixels, and i-th row of the (n×m) pixels;

a signal line driving circuit configured to input first video signal to the (i−1)-th row when the (i−1)-th row is selected, and second video signal to the i-th row when the i-th row is selected, the signal line driving circuit comprising:

a first latch circuit configured to receive sampling pulses and to hold the first video signal;

a second latch circuit configured to hold the first video signal supplied from the first latch circuit; and a shift register configured to supply the sampling pulses to the first latch circuit, the shift register comprising flip-flop circuits; and a determination circuit configured to interrupt transmission of sampling pulses between the shift register and the first latch circuit when a comparison between data to be displayed of the first video signal and data to be displayed of the second video signal shows that data to be displayed of the first video signal held in the second latch circuit are identical with data to be displayed of the second video signal, wherein the determination circuit comprises a plurality of logical gates, a plurality of switches, a resistor and an output terminal, wherein the plurality of switches is electrically connected in series, wherein the plurality of switches is electrically connected to the output terminal, wherein each of the plurality of switches is controlled by an output from one of the plurality of logical gates, wherein the resistor is electrically connected to the output terminal, wherein the first video signal and the second video signal are to display two consecutive rows of a same image;

wherein n is a natural number, wherein m is a natural number, and wherein i is a natural number no less than 2 and no more than n.

7. A display device comprising:

a pixel portion comprising (n×m) pixels provided in a matrix form;

a scan line driving circuit configured to select (i−1)-th row of the (n×m) pixels, and i-th row of the (n×m) pixels;

a signal line driving circuit configured to input first video signal to j-th to k-th columns of the (i−1)-th row when the (i−1)-th row is selected, and second video signal to j-th to k-th columns of the i-th row when the i-th row is selected, the signal line driving circuit comprising:

a first latch circuit configured to receive sampling pulses and to hold the first video signal;

a second latch circuit configured to hold the first video signal supplied from the first latch circuit; and a shift register configured to supply the sampling pulses to the first latch circuit, the shift register comprising flip-flop circuits; and a determination circuit which configured to interrupt transmission of sampling pulses between the shift register and the first latch circuit when a comparison between data to be displayed of the first video signal and data to be displayed of the second video signal shows that data to be displayed of the first video signal are identical with data to be displayed of the second video signal, wherein the determination circuit comprises a plurality of logical gates, a plurality of switches, a resistor and an output terminal, wherein the plurality of switches is electrically connected in series, wherein the plurality of switches is electrically connected to the output terminal, wherein each of the plurality of switches is controlled by an output from one of the plurality of logical gates, wherein the resistor is electrically connected to the output terminal, wherein the first video signal and the second video signal are to display two consecutive rows of a same image;

wherein n is a natural number, wherein m is a natural number, wherein i is a natural number no less than 2, and no more than n, wherein j is a natural number smaller than m, and wherein k is a natural number larger than j, and no more than m.

8. A display device comprising:

a pixel portion comprising (n×m) pixels provided in a matrix form;

a scan line driving circuit configured to select (i−1)-th row of the (n×m) pixels, and i-th row of the (n×m) pixels;

a signal line driving circuit configured to input first video signal to the (i−1)-th row when the (i−1)-th row is selected, and second video signal to the i-th row when the i-th row is selected, the signal line driving circuit comprising:

a shift register comprising flip-flop circuits;

a first latch circuit configured to hold the first video signal according to sampling pulses for the first video signal; and a second latch circuit configured to hold the first video signal supplied from the first latch circuit; and a determination circuit configured to stop signal transfer for the second video signal in the shift register by turning on the switches when a comparison between data to be displayed of the first video signal and data to be displayed of the second video signal shows that data to be displayed of the first video signal are identical with data to be displayed of the second video signal, wherein the determination circuit comprises a plurality of logical gates, a plurality of switches, a resistor and an output terminal, wherein the plurality of switches is electrically connected in series, wherein the plurality of switches is electrically connected to the output terminal, wherein each of the plurality of switches is controlled by an output from one of the plurality of logical gates, wherein the resistor is electrically connected to the output terminal, wherein the first video signal and the second video signal are to display two consecutive rows of a same image;

wherein n is a natural number, wherein m is a natural number, and wherein i is a natural number no less than 2 and no more than n.

9. A display device comprising:

a pixel portion comprising (n×m) pixels provided in a matrix form;

a scan line driving circuit configured to select (i−1)-th row of the (n×m) pixels, and i-th row of the (n×m) pixels;

a signal line driving circuit configured to input first video signal to the (i−1)-th row when the (i−1)-th row is selected, and second video signal to the i-th row when the i-th row is selected, the signal line driving circuit comprising:

a shift register comprising flip-flop circuits; and a determination circuit configured to stop signal transfer for the second video signal in the shift register by turning on the switches when data to be displayed of the first video signal are identical with data to be displayed of the second video signal, wherein the determination circuit comprises a plurality of logical gates, a plurality of switches, a resistor and an output terminal, wherein the plurality of switches is electrically connected in series, wherein the plurality of switches is electrically connected to the output terminal, wherein each of the plurality of switches is controlled by an output from one of the plurality of logical gates, wherein the resistor is electrically connected to the output terminal, wherein the scan line driving circuit comprises a switch which stops to select the i-th row when a comparison between data to be displayed of the first video signal and data to be displayed of the second video signal shows that data to be displayed of the first video signal are identical with data to be displayed of the second video signal, wherein the first video signal and the second video signal are to display two consecutive rows of a same image;

wherein n is a natural number, wherein m is a natural number, and wherein i is a natural number no less than 2 and no more than n.

10. The display device according to claim 1, wherein the shift register includes a plurality of regions, and wherein a different start pulse signal is inputted to each of the plurality of regions so as to control signal transfer.

11. The display device according to claim 2, wherein the shift register includes a plurality of regions, and wherein a different start pulse signal is inputted to each of the plurality of regions so as to control signal transfer.

12. The display device according to claim 3, wherein the shift register includes a plurality of regions, and wherein a different start pulse signal is inputted to each of the plurality of regions so as to control signal transfer.

13. The display device according to claim 4, wherein the shift register includes a plurality of regions, and wherein a different start pulse signal is inputted to each of the plurality of regions so as to control signal transfer.

14. The display device according to claim 5, wherein the shift register includes a plurality of regions, and wherein a different start pulse signal is inputted to each of the plurality of regions so as to control signal transfer.

15. The display device according to claim 6, wherein the shift register includes a plurality of regions, and wherein a different start pulse signal is inputted to each of the plurality of regions so as to control signal transfer.

16. The display device according to claim 7, wherein the shift register includes a plurality of regions, and wherein a different start pulse signal is inputted to each of the plurality of regions so as to control signal transfer.

17. The display device according to claim 8, wherein the shift register includes a plurality of regions, and wherein a different start pulse signal is inputted to each of the plurality of regions so as to control signal transfer.

18. The display device according to claim 9, wherein the shift register includes a plurality of regions, and wherein a different start pulse signal is inputted to each of the plurality of regions so as to control signal transfer.

* * * * *